US012496500B2

(12) United States Patent
Demkowski et al.

(10) Patent No.: US 12,496,500 B2
(45) Date of Patent: Dec. 16, 2025

(54) GOLF CLUB HEAD

(71) Applicant: Taylor Made Golf Company, Inc., Carlsbad, CA (US)

(72) Inventors: Paul M. Demkowski, Cardiff, CA (US); Jonathan Dreitlein, Carlsbad, CA (US); Bill Price, Santa Ana, CA (US); Gustavo Eduardo Alisio, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 178 days.

(21) Appl. No.: 18/414,128

(22) Filed: Jan. 16, 2024

(65) Prior Publication Data

US 2025/0229145 A1 Jul. 17, 2025

(51) Int. Cl.
*A63B 53/06* (2015.01)
*A63B 53/08* (2015.01)

(52) U.S. Cl.
CPC ..... *A63B 53/065* (2013.01); *A63B 53/08* (2013.01)

(58) Field of Classification Search
CPC ..... A63B 53/065; A63B 53/0487
See application file for complete search history.

(56) References Cited

U.S. PATENT DOCUMENTS

| | | | |
|---|---|---|---|
| 1,116,417 | A | 11/1914 | Hackbarth |
| 1,454,267 | A | 5/1923 | Challis et al. |
| 1,517,476 | A | 12/1924 | Tyler |
| 1,703,199 | A | 2/1929 | Mcclure |
| D91,336 | S | 1/1934 | Thompson |
| D188,857 | S | 9/1960 | Mospan |
| 2,991,082 | A | 7/1961 | Handzlik, Jr. |
| 3,199,872 | A | 8/1965 | Taylor |
| 3,206,206 | A | 9/1965 | Santosuosso |
| 3,333,854 | A | 8/1967 | White |
| D209,301 | S | 11/1967 | Comitz |
| 3,423,089 | A | 1/1969 | Andis |
| D217,873 | S | 6/1970 | Steele |
| 3,567,227 | A | 3/1971 | Panks |
| 3,578,332 | A | 5/1971 | Caldwell |
| D220,844 | S | 6/1971 | Letters |
| 3,625,517 | A | 12/1971 | Durnack |
| D223,031 | S | 2/1972 | Ernst |
| 3,675,923 | A | 7/1972 | Allen |
| 3,843,122 | A | 10/1974 | Florian |
| D234,960 | S | 4/1975 | Swash |
| D235,668 | S | 7/1975 | Swash |
| 3,966,210 | A | 6/1976 | Rozmus |
| D240,749 | S | 7/1976 | Benson |
| 3,992,015 | A | 11/1976 | Benson |
| D248,050 | S | 5/1978 | Muehl |
| 4,136,877 | A | 1/1979 | Antonious |
| D251,077 | S | 2/1979 | Strop |
| 4,147,357 | A | 4/1979 | Strop |
| 4,240,636 | A | 12/1980 | Swenson |

(Continued)

FOREIGN PATENT DOCUMENTS

| | | |
|---|---|---|
| GB | 2230461 | 10/1990 |
| WO | WO1984003447 | 9/1984 |

*Primary Examiner* — Raeann Gorden
(74) *Attorney, Agent, or Firm* — Dawsey Co., LPA; David J. Dawsey

(57) ABSTRACT

A putter golf club head having one or more repositionable weight assemblies, such as a heel weight assembly and a toc weight assembly.

20 Claims, 69 Drawing Sheets

(56) References Cited

U.S. PATENT DOCUMENTS

| | | | |
|---|---|---|---|
| 4,289,311 | A | 9/1981 | Smith |
| D282,556 | S | 2/1986 | Slagle |
| D290,984 | S | 7/1987 | Antonious |
| D291,106 | S | 7/1987 | Antonious |
| D293,355 | S | 12/1987 | Wampler |
| D293,809 | S | 1/1988 | Antonious |
| D293,926 | S | 1/1988 | Antonious |
| D294,059 | S | 2/1988 | Antonious |
| D294,158 | S | 2/1988 | Risk |
| D294,377 | S | 2/1988 | Antonious |
| D294,512 | S | 3/1988 | Antonious |
| D294,514 | S | 3/1988 | Antonious |
| D299,043 | S | 12/1988 | Antonious |
| D305,055 | S | 12/1989 | Antonious |
| 4,895,371 | A | 1/1990 | Bushner |
| 4,948,140 | A | 8/1990 | Antonious |
| 4,951,949 | A | 8/1990 | Kastenhuber |
| 4,984,794 | A | 1/1991 | Pernelle |
| D316,129 | S | 4/1991 | Bryson |
| D317,961 | S | 7/1991 | Antonious |
| D317,963 | S | 7/1991 | Antonious |
| D318,088 | S | 7/1991 | Antonious |
| D318,089 | S | 7/1991 | Antonious |
| D318,702 | S | 7/1991 | Igarashi |
| D322,108 | S | 12/1991 | Antonious |
| D322,112 | S | 12/1991 | Kastenhuber |
| D322,646 | S | 12/1991 | Antonious |
| D322,647 | S | 12/1991 | Antonious |
| D322,828 | S | 12/1991 | Antonious |
| 5,090,703 | A | 2/1992 | Koumarianos |
| D324,712 | S | 3/1992 | Shearer |
| D327,929 | S | 7/1992 | Nebbia |
| 5,167,414 | A | 12/1992 | Montgomery, III |
| 5,197,737 | A | 3/1993 | Desbiolles |
| 5,209,475 | A | 5/1993 | Loman |
| D336,321 | S | 6/1993 | Gerritzen |
| D341,404 | S | 11/1993 | Kruh |
| 5,362,048 | A | 11/1994 | Haste |
| D354,785 | S | 1/1995 | Luks |
| 5,460,375 | A | 10/1995 | Hardee |
| D368,751 | S | 4/1996 | Rife |
| D369,393 | S | 4/1996 | Takahashi et al. |
| 5,505,447 | A | 4/1996 | Mockovak |
| 5,556,345 | A | 9/1996 | Whitesell |
| 5,577,968 | A | 11/1996 | Pritchett |
| 5,599,241 | A | 2/1997 | Pritchett |
| D379,484 | S | 5/1997 | Solheim |
| 5,647,806 | A | 7/1997 | McDevitt |
| D388,143 | S | 12/1997 | Huan-Chiang |
| D389,539 | S | 1/1998 | Moore |
| D395,692 | S | 6/1998 | Butler |
| D396,896 | S | 8/1998 | Casteel |
| D397,751 | S | 9/1998 | Karagozian |
| D399,900 | S | 10/1998 | Hogan |
| D400,610 | S | 11/1998 | Cameron |
| D400,629 | S | 11/1998 | Markwardt |
| D410,054 | S | 5/1999 | Yu |
| 5,910,055 | A | 6/1999 | Bennett |
| D413,951 | S | 9/1999 | Storer |
| 6,068,560 | A | 5/2000 | DeLuca |
| D426,863 | S | 6/2000 | Ozment |
| 6,110,057 | A | 8/2000 | McKinnon |
| D434,094 | S | 11/2000 | Miyashita |
| D437,017 | S | 1/2001 | Ford |
| 6,217,459 | B1 | 4/2001 | Purcell |
| 6,379,264 | B1 | 4/2002 | Forzano |
| D457,586 | S | 5/2002 | Tang |
| D458,656 | S | 6/2002 | Tang |
| D461,514 | S | 8/2002 | Tang |
| D461,515 | S | 8/2002 | Tang |
| D461,860 | S | 8/2002 | Tang |
| D461,861 | S | 8/2002 | Tang |
| 6,428,424 | B2 | 8/2002 | Franco |
| D463,002 | S | 9/2002 | Tang |
| D467,985 | S | 12/2002 | Tang |
| D470,904 | S | 2/2003 | Tang |
| D471,245 | S | 3/2003 | Tang |
| D471,940 | S | 3/2003 | Tang |
| 6,530,848 | B2 | 3/2003 | Gillig |
| D477,041 | S | 7/2003 | Cameron |
| D479,291 | S | 9/2003 | Murray |
| D481,089 | S | 10/2003 | Breier |
| 6,663,499 | B2 | 12/2003 | Riseley |
| D484,935 | S | 1/2004 | Tang |
| D485,321 | S | 1/2004 | Breier |
| D485,323 | S | 1/2004 | Wagner |
| D486,872 | S | 2/2004 | Schweigert |
| D488,200 | S | 4/2004 | Olsavsky |
| D488,526 | S | 4/2004 | Souza |
| 6,749,523 | B1 | 6/2004 | Forzano |
| D493,857 | S | 8/2004 | Cameron |
| D494,237 | S | 8/2004 | Ware |
| D496,417 | S | 9/2004 | Tang |
| D496,418 | S | 9/2004 | Tang |
| D499,782 | S | 12/2004 | Stites |
| D500,109 | S | 12/2004 | Solheim |
| D500,110 | S | 12/2004 | Solheim |
| D501,233 | S | 1/2005 | Thomas |
| D502,233 | S | 2/2005 | Grace |
| D502,234 | S | 2/2005 | Grace |
| D502,235 | S | 2/2005 | Burrows |
| D502,748 | S | 3/2005 | Burrows |
| D506,796 | S | 6/2005 | Li |
| D507,316 | S | 7/2005 | Li |
| D507,317 | S | 7/2005 | Garner |
| D507,319 | S | 7/2005 | Kramski |
| D507,612 | S | 7/2005 | Souza |
| D508,273 | S | 8/2005 | Garner |
| D508,546 | S | 8/2005 | Oldknow |
| D509,273 | S | 9/2005 | Morris |
| D509,867 | S | 9/2005 | Perry |
| D510,394 | S | 10/2005 | Tang |
| D511,802 | S | 11/2005 | Cameron |
| D513,048 | S | 12/2005 | Garner |
| D513,776 | S | 1/2006 | Grace |
| D514,182 | S | 1/2006 | Olsavsky |
| 6,988,956 | B2 | 1/2006 | Cover |
| D515,646 | S | 2/2006 | Perry |
| D515,647 | S | 2/2006 | Morgulis |
| D517,623 | S | 3/2006 | Johnson |
| D518,127 | S | 3/2006 | Tang |
| D520,582 | S | 5/2006 | Zelnicek |
| D520,583 | S | 5/2006 | Rollinson |
| D520,584 | S | 5/2006 | Karlsen |
| D521,088 | S | 5/2006 | Mercier |
| D521,582 | S | 5/2006 | Souza |
| D522,598 | S | 6/2006 | Solheim |
| D523,102 | S | 6/2006 | Stites |
| D523,499 | S | 6/2006 | Fussell |
| 7,070,515 | B1 | 7/2006 | Liu |
| D527,433 | S | 8/2006 | Hueber |
| D528,177 | S | 9/2006 | Grace |
| D528,616 | S | 9/2006 | Grace |
| D529,108 | S | 9/2006 | Stites |
| D529,109 | S | 9/2006 | Jones |
| D529,564 | S | 10/2006 | Grace |
| D531,242 | S | 10/2006 | Adams |
| 7,128,660 | B2 | 10/2006 | Gillig |
| D532,065 | S | 11/2006 | Johnson |
| D532,067 | S | 11/2006 | Soracco |
| D532,842 | S | 11/2006 | Jones |
| D532,843 | S | 11/2006 | Jones |
| D532,845 | S | 11/2006 | Rollinson |
| D532,846 | S | 11/2006 | Lee |
| D532,847 | S | 11/2006 | Rollinson |
| D533,243 | S | 12/2006 | Fife, Jr. |
| D533,609 | S | 12/2006 | Moore |
| D534,974 | S | 1/2007 | Haack |
| D534,978 | S | 1/2007 | Rollinson |
| D537,134 | S | 2/2007 | Imamoto |
| D537,135 | S | 2/2007 | Rollinson |
| D538,364 | S | 3/2007 | Frame |
| D539,370 | S | 3/2007 | Imamoto |
| D540,410 | S | 4/2007 | Sizemore, Jr. |

(56) References Cited

U.S. PATENT DOCUMENTS

| | | | |
|---|---|---|---|
| D540,897 | S | 4/2007 | Oldknow |
| D541,361 | S | 4/2007 | Oldknow |
| D541,362 | S | 4/2007 | Oldknow |
| 7,201,669 | B2 | 4/2007 | Stites |
| 7,204,765 | B2 | 4/2007 | Cover |
| D541,894 | S | 5/2007 | Imamoto |
| D542,869 | S | 5/2007 | Adams |
| D542,871 | S | 5/2007 | Oldknow |
| D542,872 | S | 5/2007 | Oldknow |
| D542,873 | S | 5/2007 | Oldknow |
| D543,598 | S | 5/2007 | Kuan |
| D545,385 | S | 6/2007 | Tang |
| D546,407 | S | 7/2007 | Oldknow |
| D548,295 | S | 8/2007 | Jertson |
| D548,296 | S | 8/2007 | Rollinson |
| D549,292 | S | 8/2007 | Meier |
| D552,197 | S | 10/2007 | Wells |
| D552,697 | S | 10/2007 | Johnson |
| D553,207 | S | 10/2007 | Johnson |
| D557,361 | S | 12/2007 | Rollinson |
| D560,263 | S | 1/2008 | Rubino |
| D561,854 | S | 2/2008 | Morris |
| D564,606 | S | 3/2008 | Oldknow |
| D564,607 | S | 3/2008 | Oldknow |
| D564,608 | S | 3/2008 | Oldknow |
| D564,609 | S | 3/2008 | Oldknow |
| D564,612 | S | 3/2008 | Oldknow |
| D565,137 | S | 3/2008 | Oldknow |
| D565,139 | S | 3/2008 | Wilson |
| D565,141 | S | 3/2008 | Oldknow |
| D565,142 | S | 3/2008 | Oldknow |
| D565,681 | S | 4/2008 | Tanaka |
| D568,954 | S | 5/2008 | Oldknow |
| D569,460 | S | 5/2008 | Walker |
| D569,461 | S | 5/2008 | Morris |
| D569,462 | S | 5/2008 | Rollinson |
| D570,944 | S | 6/2008 | Oldknow |
| D571,420 | S | 6/2008 | Stites |
| D571,879 | S | 6/2008 | Jones |
| D571,880 | S | 6/2008 | Ban |
| D571,886 | S | 6/2008 | Stites |
| D572,331 | S | 7/2008 | Oldknow |
| D572,780 | S | 7/2008 | Rollinson |
| D572,789 | S | 7/2008 | Stites |
| 7,396,289 | B2 | 7/2008 | Soracco |
| D574,457 | S | 8/2008 | Stites |
| D574,907 | S | 8/2008 | Jones |
| D574,908 | S | 8/2008 | Hettinger |
| D575,366 | S | 8/2008 | Rollinson |
| D577,398 | S | 9/2008 | Hilton |
| D578,593 | S | 10/2008 | Oldknow |
| D578,594 | S | 10/2008 | Oldknow |
| D579,070 | S | 10/2008 | Oldknow |
| D579,071 | S | 10/2008 | Oldknow |
| D579,508 | S | 10/2008 | Oldknow |
| D579,998 | S | 11/2008 | Oldknow |
| D581,003 | S | 11/2008 | Oldknow |
| D582,497 | S | 12/2008 | Rollinson |
| D583,003 | S | 12/2008 | Solheim |
| D583,431 | S | 12/2008 | Madore |
| D584,780 | S | 1/2009 | Ines |
| D587,325 | S | 2/2009 | Solheim |
| D587,326 | S | 2/2009 | Ines |
| D587,771 | S | 3/2009 | Kuan |
| D589,575 | S | 3/2009 | Kim |
| D590,035 | S | 4/2009 | Hilton |
| D590,461 | S | 4/2009 | Kim |
| D591,371 | S | 4/2009 | Hilton |
| 7,520,820 | B2 | 4/2009 | DiMarco |
| D591,806 | S | 5/2009 | Cameron |
| D591,807 | S | 5/2009 | Rollinson |
| D592,717 | S | 5/2009 | Rollinson |
| D594,073 | S | 6/2009 | Kadoya |
| D594,517 | S | 6/2009 | Tang |
| D595,370 | S | 6/2009 | Ines |
| D595,372 | S | 6/2009 | Rollinson |
| D595,373 | S | 6/2009 | Kim |
| D595,793 | S | 7/2009 | Rollinson |
| D599,425 | S | 9/2009 | Laub |
| D599,870 | S | 9/2009 | Serrano |
| D600,295 | S | 9/2009 | Meeks |
| D600,298 | S | 9/2009 | Serrano |
| D600,759 | S | 9/2009 | Cokewell |
| D600,760 | S | 9/2009 | Serrano |
| D600,761 | S | 9/2009 | Solheim |
| D600,762 | S | 9/2009 | Serrano |
| D603,008 | S | 10/2009 | Donahue |
| D604,782 | S | 11/2009 | Franklin |
| D606,139 | S | 12/2009 | Ines |
| D606,140 | S | 12/2009 | Ramsauer |
| D606,141 | S | 12/2009 | Ramsauer |
| D606,142 | S | 12/2009 | Ramsauer |
| D606,143 | S | 12/2009 | Ramsauer |
| D607,952 | S | 1/2010 | Demkowski |
| D616,053 | S | 5/2010 | Chien |
| 7,717,803 | B2 | 5/2010 | DiMarco |
| D619,665 | S | 7/2010 | Rollinson |
| D621,458 | S | 8/2010 | Serrano |
| D621,459 | S | 8/2010 | Serrano |
| D621,460 | S | 8/2010 | Serrano |
| D621,461 | S | 8/2010 | Serrano |
| D621,462 | S | 8/2010 | Serrano |
| D621,891 | S | 8/2010 | Serrano |
| D622,343 | S | 8/2010 | Khan |
| D623,710 | S | 9/2010 | Hilton |
| D624,616 | S | 9/2010 | Rife |
| D625,764 | S | 10/2010 | Hilton |
| D626,191 | S | 10/2010 | Hilton |
| 7,806,782 | B2 | 10/2010 | Stites |
| D627,840 | S | 11/2010 | Cameron |
| D629,476 | S | 12/2010 | Serrano |
| 7,854,667 | B2 | 12/2010 | Gillig |
| D630,690 | S | 1/2011 | Rollinson |
| D633,968 | S | 3/2011 | Tryner |
| D633,969 | S | 3/2011 | Tryner |
| D633,970 | S | 3/2011 | Cardani |
| D636,828 | S | 4/2011 | Ross |
| D636,829 | S | 4/2011 | Cardani |
| D636,830 | S | 4/2011 | Cardani |
| 7,918,745 | B2 | 4/2011 | Morris |
| 7,922,603 | B2 | 4/2011 | Boyd |
| D637,674 | S | 5/2011 | Tryner |
| D638,891 | S | 5/2011 | Nicolette |
| D639,361 | S | 6/2011 | Reinberg |
| D639,366 | S | 6/2011 | Reinberg |
| D639,367 | S | 6/2011 | Reinberg |
| D640,341 | S | 6/2011 | Foster |
| D641,439 | S | 7/2011 | Rollinson |
| D641,816 | S | 7/2011 | Rollinson |
| D643,080 | S | 8/2011 | Serrano |
| D643,485 | S | 8/2011 | Nicolette |
| D643,486 | S | 8/2011 | Serrano |
| D643,487 | S | 8/2011 | Serrano |
| 7,988,568 | B2 | 8/2011 | Stites |
| D644,703 | S | 9/2011 | Serrano |
| D645,104 | S | 9/2011 | Nicolette |
| D650,459 | S | 12/2011 | Rollinson |
| 8,096,039 | B2 | 1/2012 | Soracco |
| D653,718 | S | 2/2012 | Stokke |
| 8,142,308 | B2 | 3/2012 | Gillig |
| D657,836 | S | 4/2012 | Oldknow |
| D657,837 | S | 4/2012 | Oldknow |
| D658,245 | S | 4/2012 | Oldknow |
| 8,192,297 | B1 | 6/2012 | Johnston |
| D664,617 | S | 7/2012 | Serrano |
| 8,298,096 | B2 | 10/2012 | Stites |
| D670,774 | S | 11/2012 | Seiff |
| 8,308,583 | B2 | 11/2012 | Morris |
| D688,341 | S | 8/2013 | Rollinson |
| D690,378 | S | 9/2013 | Rollinson |
| 8,523,702 | B2 | 9/2013 | Thomas |
| D691,226 | S | 10/2013 | Hilton |
| D699,308 | S | 2/2014 | Rollinson |
| D701,274 | S | 3/2014 | Rollinson |

(56) References Cited

U.S. PATENT DOCUMENTS

| | | | |
|---|---|---|---|
| D701,928 | S | 4/2014 | Cameron |
| 8,690,706 | B2 | 4/2014 | Stites |
| 8,690,708 | B1 | 4/2014 | Ehlers |
| 8,696,491 | B1 | 4/2014 | Myers |
| D704,782 | S | 5/2014 | Rollinson |
| D705,369 | S | 5/2014 | Mickle |
| D709,971 | S | 7/2014 | Trahan |
| D709,972 | S | 7/2014 | Trahan |
| D709,973 | S | 7/2014 | Trahan |
| 8,790,195 | B1 | 7/2014 | Myers |
| D710,469 | S | 8/2014 | Trahan |
| D710,470 | S | 8/2014 | Trahan |
| D710,958 | S | 8/2014 | Mickle |
| D713,900 | S | 9/2014 | Hilton |
| D715,388 | S | 10/2014 | Serrano |
| 8,870,678 | B2 | 10/2014 | Beach |
| 8,894,506 | B1 | 11/2014 | Myers |
| D719,622 | S | 12/2014 | Rollinson |
| D720,023 | S | 12/2014 | Thompson |
| D720,411 | S | 12/2014 | Rollinson |
| D720,412 | S | 12/2014 | Rollinson |
| D722,350 | S | 2/2015 | Schweigert |
| D722,351 | S | 2/2015 | Parsons |
| D725,208 | S | 3/2015 | Schweigert |
| 8,968,116 | B1 | 3/2015 | Myers |
| 8,992,339 | B2 | 3/2015 | Matsunaga |
| D726,270 | S | 4/2015 | Rollinson |
| D726,846 | S | 4/2015 | Schweigert |
| D728,715 | S | 5/2015 | Cameron |
| D730,462 | S | 5/2015 | Becktor |
| D730,463 | S | 5/2015 | Dolezel |
| D730,464 | S | 5/2015 | Cameron |
| 9,022,881 | B1 | 5/2015 | Ehlers |
| D731,605 | S | 6/2015 | Rollinson |
| D732,120 | S | 6/2015 | Becktor |
| D732,121 | S | 6/2015 | Trahan |
| D732,122 | S | 6/2015 | Becktor |
| D732,618 | S | 6/2015 | Becktor |
| 9,084,921 | B1 | 7/2015 | Liang |
| D736,876 | S | 8/2015 | Rollinson |
| 9,101,811 | B1 | 8/2015 | Goudarzi |
| D738,447 | S | 9/2015 | Schweigert |
| D738,449 | S | 9/2015 | Schweigert |
| D739,487 | S | 9/2015 | Schweigert |
| 9,174,096 | B2 | 11/2015 | Sargent |
| 9,180,349 | B1 | 11/2015 | Seluga |
| D744,607 | S | 12/2015 | Bennis |
| 9,199,145 | B1 | 12/2015 | Myers |
| 9,211,453 | B1 | 12/2015 | Foster |
| 9,216,332 | B1 | 12/2015 | Ehlers |
| 9,220,957 | B1 | 12/2015 | Myers |
| D748,213 | S | 1/2016 | Parsons |
| D748,215 | S | 1/2016 | Parsons |
| 9,238,162 | B2 | 1/2016 | Breier |
| D750,186 | S | 2/2016 | Schweigert |
| 9,259,625 | B2 | 2/2016 | Sargent |
| 9,259,627 | B1 | 2/2016 | Myers |
| 9,289,660 | B1 | 3/2016 | Myers |
| 9,295,885 | B2 | 3/2016 | Matsunaga |
| D753,252 | S | 4/2016 | Schweigert |
| 9,308,423 | B1 | 4/2016 | Tang |
| D758,513 | S | 6/2016 | Cameron |
| 9,364,728 | B1 | 6/2016 | Myers |
| 9,364,729 | B2 | 6/2016 | Myers |
| 9,375,618 | B2 | 6/2016 | Myers |
| D762,274 | S | 7/2016 | Cardani |
| 9,381,410 | B2 | 7/2016 | Golden |
| 9,387,377 | B2 | 7/2016 | Liang |
| D763,374 | S | 8/2016 | Cardani |
| D763,384 | S | 8/2016 | Cardani |
| D763,385 | S | 8/2016 | Cardani |
| D763,982 | S | 8/2016 | Cardani |
| D763,988 | S | 8/2016 | Cardani |
| D763,989 | S | 8/2016 | Cardani |
| D763,990 | S | 8/2016 | Cardani |
| D764,611 | S | 8/2016 | Cardani |
| D765,199 | S | 8/2016 | Cardani |
| 9,409,069 | B2 | 8/2016 | Ehlers |
| 9,421,438 | B2 | 8/2016 | Beno |
| 9,427,638 | B2 | 8/2016 | Sanyal |
| D765,802 | S | 9/2016 | Cameron |
| 9,433,836 | B2 | 9/2016 | Breier |
| D768,248 | S | 10/2016 | Rollinson |
| D769,386 | S | 10/2016 | Schweigert |
| 9,498,686 | B2 | 11/2016 | Breier |
| D773,573 | S | 12/2016 | Abbott |
| D774,607 | S | 12/2016 | Serrano |
| D774,608 | S | 12/2016 | Serrano |
| D774,609 | S | 12/2016 | Serrano |
| D774,610 | S | 12/2016 | Serrano |
| D776,215 | S | 1/2017 | Becktor |
| D776,217 | S | 1/2017 | Seagram |
| D776,771 | S | 1/2017 | Peterson |
| 9,561,413 | B2 | 2/2017 | Reeve |
| 9,597,563 | B2 | 3/2017 | Voshall |
| D783,101 | S | 4/2017 | Schweigert |
| D783,745 | S | 4/2017 | Chen |
| 9,623,294 | B1 | 4/2017 | Kingston |
| 9,623,302 | B1 | 4/2017 | Myers |
| 9,630,069 | B2 | 4/2017 | Foster |
| 9,636,553 | B1 | 5/2017 | Myers |
| 9,636,556 | B2 | 5/2017 | Beck |
| 9,675,856 | B1 | 6/2017 | Gibbs |
| 9,682,296 | B1 | 6/2017 | Myers |
| 9,682,298 | B1 | 6/2017 | Kingston |
| 9,682,299 | B2 | 6/2017 | Tang |
| D791,254 | S | 7/2017 | Ramsauer |
| 9,694,256 | B2 | 7/2017 | Myers |
| 9,694,261 | B2 | 7/2017 | Nunez |
| 9,700,764 | B2 | 7/2017 | Carter |
| 9,700,771 | B2 | 7/2017 | Murphy |
| 9,707,459 | B1 | 7/2017 | Myers |
| 9,713,752 | B2 | 7/2017 | Myers |
| D793,502 | S | 8/2017 | Cardani |
| D793,507 | S | 8/2017 | Cardani |
| D794,732 | S | 8/2017 | Jertson |
| 9,724,577 | B1 | 8/2017 | Kingston |
| 9,731,175 | B1 | 8/2017 | Myers |
| 9,731,178 | B1 | 8/2017 | Myers |
| D796,602 | S | 9/2017 | Serrano |
| D796,604 | S | 9/2017 | Serrano |
| D796,605 | S | 9/2017 | Serrano |
| D797,872 | S | 9/2017 | Jertson |
| 9,757,630 | B2 | 9/2017 | Mata |
| 9,764,210 | B2 | 9/2017 | Curtis |
| 9,770,635 | B2 | 9/2017 | Motokawa |
| D800,855 | S | 10/2017 | Rollinson |
| D801,459 | S | 10/2017 | Rollinson |
| 9,795,846 | B2 | 10/2017 | Sargent |
| D803,334 | S | 11/2017 | Becktor |
| 9,814,953 | B2 | 11/2017 | Sargent |
| 9,839,823 | B2 | 12/2017 | Ehlers |
| 9,849,359 | B2 | 12/2017 | Gibbs |
| D807,453 | S | 1/2018 | Serrano |
| 9,855,474 | B2 | 1/2018 | Beno |
| 9,878,223 | B2 | 1/2018 | Foster |
| D809,616 | S | 2/2018 | Toulon |
| D812,164 | S | 3/2018 | Parsons |
| 9,914,027 | B1 | 3/2018 | Harbert |
| 9,914,028 | B1 | 3/2018 | Cleghorn |
| D815,222 | S | 4/2018 | Serrano |
| D815,703 | S | 4/2018 | Schweigert |
| D816,175 | S | 4/2018 | Solheim |
| 9,937,392 | B2 | 4/2018 | Myers |
| 9,956,462 | B2 | 5/2018 | Nunez |
| 9,962,584 | B2 | 5/2018 | Nielson |
| 9,968,833 | B2 | 5/2018 | Breier |
| 9,968,834 | B1 | 5/2018 | Seluga |
| 9,975,019 | B2 | 5/2018 | Frame |
| D820,366 | S | 6/2018 | Hilton |
| D821,511 | S | 6/2018 | Dolezel |
| 9,987,533 | B2 | 6/2018 | Oldknow |
| 10,004,958 | B2 | 6/2018 | Tang |
| D824,462 | S | 7/2018 | Bruschi |

(56) References Cited

U.S. PATENT DOCUMENTS

| | | | | |
|---|---|---|---|---|
| 10,022,602 | B2 | 7/2018 | Kingston | |
| 10,035,051 | B2 | 7/2018 | Cleghorn | |
| D827,064 | S | 8/2018 | Wypych | |
| 10,046,212 | B2 | 8/2018 | Sargent | |
| D827,742 | S | 9/2018 | Weaver | |
| 10,076,688 | B1 | 9/2018 | Harbert | |
| 10,076,690 | B2 | 9/2018 | Myers | |
| D831,766 | S | 10/2018 | Schweigert | |
| 10,099,094 | B2 | 10/2018 | Myrhum | |
| 10,099,095 | B2 | 10/2018 | Myers | |
| 10,112,085 | B2 | 10/2018 | Beach | |
| D832,949 | S | 11/2018 | Nicolette | |
| D832,950 | S | 11/2018 | Serrano | |
| 10,124,219 | B2 | 11/2018 | Sargent | |
| 10,130,849 | B2 | 11/2018 | Franklin | |
| D835,217 | S | 12/2018 | Nicolette | |
| 10,155,140 | B2 | 12/2018 | Sargent | |
| 10,159,880 | B1 | 12/2018 | Mine | |
| D837,911 | S | 1/2019 | Nicolette | |
| 10,173,110 | B1 | 1/2019 | Foster | |
| 10,173,111 | B2 | 1/2019 | Busch | |
| 10,183,202 | B1 | 1/2019 | Harbert | |
| 10,183,203 | B1 | 1/2019 | Yi | |
| 10,188,916 | B2 | 1/2019 | Harbert | |
| D840,482 | S | 2/2019 | Serrano | |
| 10,207,160 | B2 | 2/2019 | Johnson | |
| 10,213,663 | B2 | 2/2019 | Goudarzi | |
| 10,213,665 | B1 | 2/2019 | Day | |
| D842,952 | S | 3/2019 | Schweigert | |
| D844,085 | S | 3/2019 | Nicolette | |
| D844,723 | S | 4/2019 | Nicolette | |
| D847,923 | S | 5/2019 | Wang | |
| D848,562 | S | 5/2019 | Nicolette | |
| 10,293,225 | B2 | 5/2019 | Sargent | |
| 10,300,356 | B2 | 5/2019 | Mata | |
| D852,300 | S | 6/2019 | Wang | |
| D852,911 | S | 7/2019 | Wang | |
| D855,132 | S | 7/2019 | Schweigert | |
| 10,335,650 | B2 | 7/2019 | Myers | |
| 10,369,437 | B1 | 8/2019 | Cleghorn | |
| 10,376,757 | B2 | 8/2019 | Golden | |
| 10,391,368 | B2 | 8/2019 | Cleghorn | |
| D859,545 | S | 9/2019 | Long | |
| D860,350 | S | 9/2019 | Rollinson | |
| D860,354 | S | 9/2019 | Rollinson | |
| D860,355 | S | 9/2019 | Wang | |
| D860,357 | S | 9/2019 | Rollinson | |
| D861,091 | S | 9/2019 | Glorioso | |
| D861,092 | S | 9/2019 | Glorioso | |
| D864,325 | S | 10/2019 | Rollinson | |
| 10,434,385 | B2 | 10/2019 | Mine | |
| D865,885 | S | 11/2019 | Long | |
| D867,495 | S | 11/2019 | Cameron | |
| D867,496 | S | 11/2019 | Cameron | |
| 10,463,927 | B2 | 11/2019 | Bovee | |
| 2002/0086739 | A1 | 7/2002 | Chiu | |
| 2002/0137576 | A1 | 9/2002 | Dammen | |
| 2003/0162599 | A1* | 8/2003 | Klein | A63B 53/007 473/316 |
| 2005/0153792 | A1 | 7/2005 | Iacullo | |
| 2005/0227777 | A1 | 10/2005 | Cover | |
| 2006/0122004 | A1 | 6/2006 | Chen | |
| 2006/0240908 | A1 | 10/2006 | Adams | |
| 2007/0135231 | A1 | 6/2007 | Lo | |
| 2007/0142123 | A1 | 6/2007 | Franklin | |
| 2007/0178988 | A1 | 8/2007 | Tavares | |
| 2007/0249432 | A1 | 10/2007 | Wu | |
| 2008/0020861 | A1 | 1/2008 | Adams | |
| 2010/0075773 | A1 | 3/2010 | Casati, Jr. | |
| 2010/0184531 | A1 | 7/2010 | Hwang | |
| 2010/0190573 | A1 | 7/2010 | Boyd | |
| 2011/0136583 | A1 | 6/2011 | Hayashi | |
| 2012/0329571 | A1 | 12/2012 | Stites | |
| 2013/0190104 | A1 | 7/2013 | Boyd | |
| 2013/0190105 | A1* | 7/2013 | Boyd | A63B 53/04 473/335 |
| 2017/0028277 | A1 | 2/2017 | Sanyal | |
| 2017/0361185 | A1 | 12/2017 | Henrikson | |
| 2018/0178092 | A1 | 6/2018 | Johnson | |
| 2018/0290030 | A1 | 10/2018 | Nielson | |
| 2018/0345099 | A1 | 12/2018 | Harbert | |
| 2019/0022478 | A1 | 1/2019 | Greaney | |
| 2019/0022480 | A1 | 1/2019 | Harbert | |
| 2019/0038944 | A1 | 2/2019 | Nielson | |
| 2019/0046845 | A1 | 2/2019 | Greensmith | |
| 2019/0046846 | A1 | 2/2019 | Sargent | |
| 2019/0118051 | A1 | 4/2019 | Busch | |
| 2019/0175999 | A1 | 6/2019 | Sargent | |
| 2019/0184246 | A1 | 6/2019 | Harbert | |
| 2019/0232120 | A1 | 8/2019 | Johnson | |
| 2024/0149121 | A1* | 5/2024 | Means | A63B 53/02 |

* cited by examiner

GOLF CLUB HEAD

CROSS-REFERENCE TO RELATED APPLICATION

Not applicable.

BACKGROUND

The disclosure pertains to the field of golf club heads and more particularly, but not exclusively, to putter-type golf club heads.

Golf is a game in which a player, using many types of clubs, hits a ball into each hole or cup on a golf course in the lowest possible number of strokes. When a golf club face contacts a golf ball off-center, the club head can twist about the center of gravity causing the golf ball to travel in an unintended direction. Moreover, the club head twisting can cause the ball to skid across a surface rather than roll forward in a smooth manner.

A putter-type golf club is generally used from a very close distance on a putting green. Putter-type golf clubs are used by a golfer when a great deal of accuracy and precision are required for each shot. Adjustability of a golf club head can improve the performance.

SUMMARY

Described below are embodiments of a putter-type golf club head and associated methods in accordance with the invention that tend to increase the consistency and accuracy of ball motion. The foregoing and other objects, features, and advantages of the disclosed technology will become more apparent from the following detailed description, which proceeds with reference to the accompanying figures. A putter golf club head having one or more repositionable weight assemblies, such as a heel weight assembly and a toe weight assembly.

BRIEF DESCRIPTION OF THE DRAWINGS

The present invention is illustrated by way of example and not limitation in the figures of the accompanying drawings in which like references indicate similar elements.

FIG. 116 is a cross sectional view of the golf putter head embodiment seen in FIG. 106;

FIG. 117 is a bottom plan view of another golf putter head embodiment having a u-shaped weight track;

FIG. 118 is a bottom plan view of another golf putter head embodiment having a rack and pinion system with rotating weights;

FIG. 119 is a top plan view of another golf putter head embodiment;

FIG. 120 is a cross sectional view of the golf putter head embodiment seen in FIG. 1; and FIG. 121 is another cross-sectional view of the golf putter head embodiment seen in FIG. 1.

DETAILED DESCRIPTION

Figure 1:
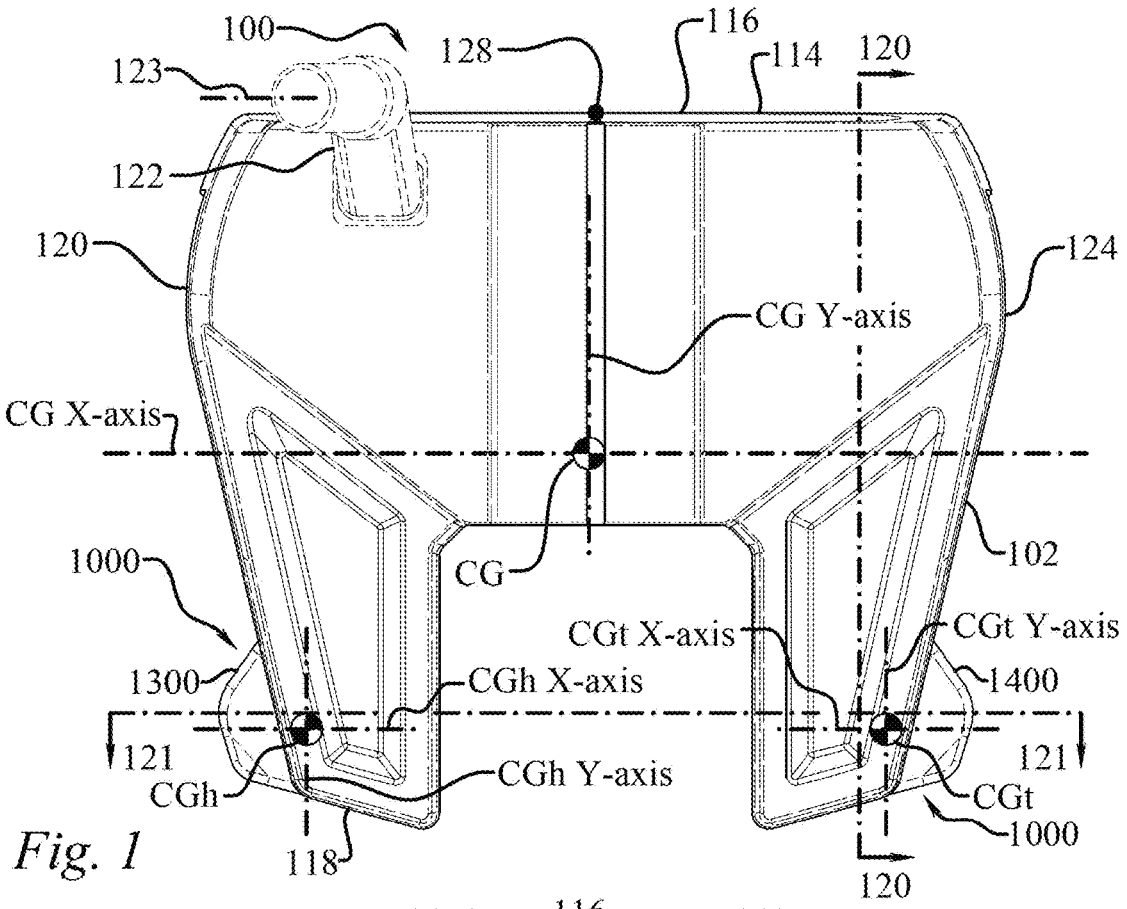
FIG. 1 is a top plan view of a golf putter head embodiment with the toe and heel weights positioned at the rear portion of the putter head.

For purposes of this description, certain aspects, advantages, and novel features of the embodiments of this disclosure are described herein. The described methods, systems, and apparatus should not be construed as limiting in any way. Instead, the present disclosure is directed toward all novel and non-obvious features and aspects of the various disclosed embodiments, alone and in various combinations and sub-combinations with one another. The disclosed methods, systems, and apparatus are not limited to any specific aspect, feature, or combination thereof, nor do the disclosed methods, systems, and apparatus require that any one or more specific advantages be present, or problems be solved.

Features, properties, characteristics, materials, values, ranges, or groups described in conjunction with a particular aspect, embodiment or example of the disclosure are to be understood to be applicable to any other aspect, embodiment or example described herein unless incompatible therewith. All of the features disclosed in this specification (including any accompanying claims, abstract, and drawings), and/or all of the steps of any method or process so disclosed, may be combined in any combination, except combinations where at least some of such features and/or steps are mutually exclusive. The disclosure is not restricted to the details of any foregoing embodiments. The disclosure extends to any novel one, or any novel combination, of the features disclosed in this specification (including any accompanying claims, abstract, and drawings), or to any novel one, or any novel combination, of the steps of any method or process so disclosed.

Although the operations of some of the disclosed methods are described in a particular, sequential order for convenient presentation, this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods, systems, and apparatus can be used in conjunction with other systems, methods, and apparatus.

As used herein, the terms "a," "an," and "at least one" encompass one or more of the specified element. That is, if two of a particular element are present, one of these elements is also present and thus "an" element is present. The terms "a plurality of" and "plural" mean two or more of the specified element. As used herein, the term "and/or" used between the last two of a list of elements means any one or more of the listed elements. For example, the phrase "A, B, and/or C" means "A," "B," "C," "A and B," "A and C," "B and C," or "A, B, and C." As used herein, the term "coupled" generally means physically coupled or linked and does not exclude the presence of intermediate elements between the coupled items absent specific contrary language. The inventive features include all novel and non-obvious features disclosed herein both alone and in novel and non-obvious combinations with other elements. As used herein, the phrase "and/or" means "and", "or" and both "and" and "or". As used herein, the singular forms "a," "an," and "the" refer to one or more than one, unless the context clearly dictates otherwise. As used herein, the term "includes" means "comprises." Any use of terminology such as "at least one of A and B" shall be interpreted to mean "at least one of A or B," and is not meant to exclude having both A and B, unless noted otherwise.

Directions and other relative references (e.g., inner, outer, upper, lower, etc.) may be used to facilitate discussion of the drawings and principles herein, but are not intended to be limiting. For example, certain terms may be used such as "inside," "outside,", "top," "down," "interior," "exterior," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" part can become a "lower" part simply by turning the object over. Nevertheless, it is still the same part and the object remains the same. As used herein, "and/or" means "and" or "or," as well as "and" and "or."

FIGS. 1-4 show an example putter head 100 (or more generally, "club head"), according to one example. Any of the putter heads disclosed herein can be coupled to a putter shaft of any type to form a putter, having a grip. The herein disclosed technology can be implemented in any type of putter, such as blade style putters, mallet style putters, long putters, belly putters, toc balance putters, face balanced putters, peripheral weighted putters, face insert putters, heel-shafted putters, center-shafted putters, hosel-offset putters, etc. Although the descriptions and drawings presented herein are mainly associated with putters, any of the technology disclosed herein can analogously be implemented in any other type of golf club, such as a driver, fairway wood, hybrid, rescue, iron (cavity back, muscle back, hollow iron), wedge, or other golf club type, to provide the adjustability and performance benefits disclosed herein. Thus, references to putter head herein may be interchanged with the term club head, driver club head, fairway wood club head, hybrid or rescue club head, iron club head, cavity back iron club head, muscle back iron club head, hollow iron club head, and/or wedge club head. Thus, any of the disclosed club heads can be couple to a shaft of any type to form a golf club, having a grip.

Figure 121:
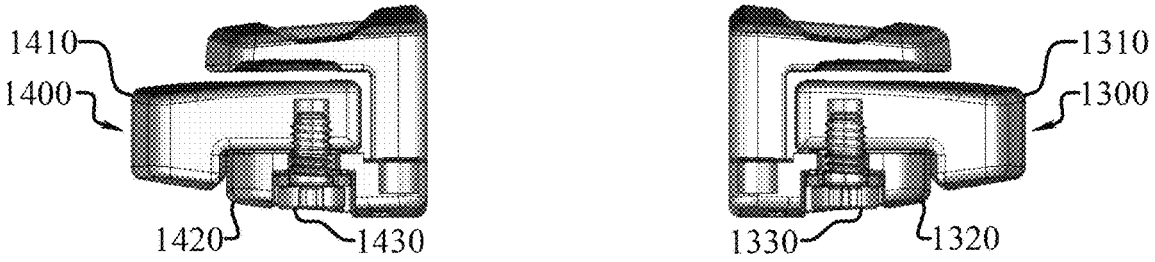

As shown, the putter head 100 includes a body 102. FIGS. 1-121 depict various views and embodiments of the body 102. As depicted in FIGS. 1-4, the body 102 has a sole portion 110 configured to rest on a ground when the putter head 100 is at a normal address position, a top portion 112 opposite to the sole portion 110, a forward or front portion 114 comprising a striking face 116, a rearward portion 118 opposite to the forward portion 114, a heel portion 120 that may include a hosel 122 configured to receive a golf club shaft (not shown), and a toe portion 124 opposite to the heel portion 120. As seen in FIG. 3 the putter head 100 has a maximum length L measured from the forwardmost point of the striking face 116 to a rearwardmost point in a direction parallel to a club head Y-axis, defined below, a maximum height H measured vertically from a ground plane GP to the highest point on the top portion 112, and a maximum width W, seen in FIG. 5, that is the greatest dimension of the putter head 100 measured parallel to the club head X-axis, defined below. Unless otherwise indicated, all parameters are specified with the putter head 100 head in the normal address position, which is the position of the putter head 100 when (1) supported on a ground plane GP; (2) oriented so that a lie angle of an assembled putter is at a lie angle of 70° relative to the ground plane; and (3) a shaft axis, defined by the upper ⅔ of a putter shaft, lies within a vertical plane that is perpendicular to the ground plane GP. In the embodiment illustrated in FIG. 3 the lie angle of the assembled putter corresponds to the illustrated hosel axis 123, however this is dependent on the type of hosel incorporated in the putter head 100 and therefore unless the hosel axis 123 corresponds with the lie angle of the putter, the normal address position is defined with respect to the assembled putter and the associated lie angle defined by the upper ⅔ of the putter shaft, so as not to be impacted by putter shafts having bends near the connection to the putter head 100. However, this does not exclude putter heads 100 designed to be joined to a shaft intended to have a forward, or rearward, lean, and thus a design in which the shaft axis is not intended to be within a vertical plane in the normal address position, and in such situations the normal address position is the position of the putter head when supported on a ground plane GP and oriented at the intended address orientation.

Figure 5:
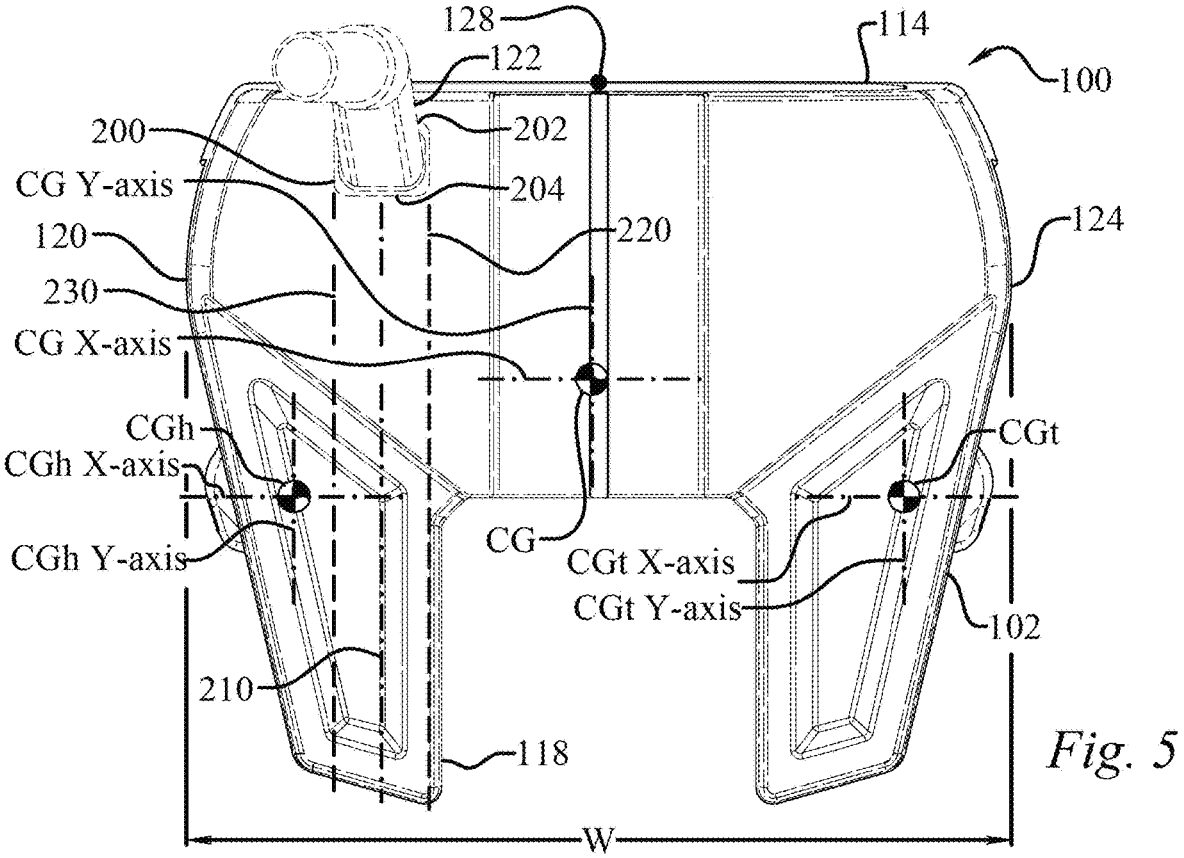
FIG. 5 is a top plan view of golf putter head embodiment with the toe and heel weights positioned in the middle portion of the putter head.

The hosel 122 may join the body 102 at a hosel interface 200, seen in FIG. 5, which defines a hosel interface front-back centerline plane 210, a hosel interface front-back toeward plane 220, and a hosel interface front-back heelward plane 230, with each plane being perpendicular to the ground plane GP. The hosel 122 may be formed with a portion of the putter head 100, or attached to a portion of the putter head 100 with adhesive and/or a mechanical fastener, such as a hosel fastener 113 seen in FIG. 21. In a further embodiment the hosel fastener 113 facilitates the interchangeability of at least two different hosels 122 into a single body 102, selected from the group of a plumber neck hosel, a L-neck hosel, a flow neck hosel, a slant neck hosel, and/or a truss neck hosel.

The striking face 116 can have a geometric center defining an origin 128 of a club head origin coordinate system when the putter head 100 is at a normal address position. For example, the club head coordinate system can include a club head X-axis being tangent to the striking face 116 at the origin 128 and parallel to a ground plane GP. The club head X-axis can extend in a positive direction from the origin 128 to the heel portion 120 of the putter head. The club head coordinate system can include a club head Y-axis intersecting the origin 128, being parallel to the ground plane GP and orthogonal to the club head X-axis. The club head Y-axis can extend in a positive direction from the origin 128 to the rearward portion 118 of the putter head. The club head coordinate system can include a club head Z-axis intersecting the origin 128, and being orthogonal to both the club head X-axis and the Y-axis. The club head Z-axis can extend in a positive direction from the origin 128 vertically toward the top portion 112 of the putter head. The heel portion 120 can extend towards, and may include a portion having the hosel 122. The heel portion 120 can extend from a club head Y-Z plane passing through the origin 128 and including the heel portion 120. The toe half of the club head can be defined as the portion of the club head extending from the club head Y-Z plane in a direction opposite the heel portion 120 and including the toe portion 124; and the heel half of the club head can be defined as the portion of the club head extending from the club head Y-Z plane in a direction opposite the toe half and including the heel 120.

The putter head 100 has a center of gravity CG, also referred to as the putter head CG, club head CG, and/or just CG, which includes the influence and location of all of the individual components of the putter head 100. The club head origin coordinate system can used to define the location of various features of the club head (including a club head center-of-gravity CG. The head origin coordinate system is defined with respect to the origin 128 and includes three axes just described, namely the club head X-axis, club head Y-axis, and club head Z-axis. Any golf club head features disclosed and/or claimed herein are defined with reference to the club head origin coordinate system, unless specifically stated otherwise. The center of gravity (CG) of a golf club head is the average location of the weight of the golf club head or the point at which the entire weight of the golf club head may be considered as concentrated so that if supported at this point the head would remain in equilibrium in any position.

The putter head CG is shown as a point whose location can also be defined with reference to the club head origin coordinate system. For example, and using millimeters as the unit of measure, a CG that is located 3.2 mm from the head origin 128 toward the toe of the club head along the club head X-axis, 36.7 mm from the head origin 128 toward the rear of the club head along the club head Y-axis, and 4.1 mm from the head origin 128 toward the sole of the club head along the club head Z-axis can be defined as having a CGx of −3.2 mm, a CGy of 36.7 mm, and a CGz of −4.1 mm. Additionally, a Zup dimension is the elevation of the putter head CG vertically above the ground plane GP, as seen in FIG. 3. Thus, Zup is 7 mm if the putter head CG is located 7 mm above the ground plane GP.

The club head CG may be used to define a CG coordinate system having a CG X-axis passing through the club head CG and parallel to the club head X-axis, a CG Y-axis passing through the club head CG and parallel to the club head Y-axis, and a CG Z-axis passing through the club head CG and parallel to the club head Z-axis, as seen in FIGS. 1 and 3.

The body 102 can comprise a relatively rigid material, such as stainless steel alloy, carbon steel alloy, aluminum alloy, titanium alloy, other metals/alloys, and/or nonmetallic materials as disclosed herein. The striking face 116 can be a front surface of the body 102 or can be a separate piece that is coupled to the front of the body 102 (e.g., the striking face 116 can be made of a different material than the body 102, such as a polymeric material or any of the materials disclosed herein). The putter head 100 can also include one or more weight members 130 coupled to the body 102, such as those illustrated in FIG. 6. In some cases, the weight members 130 can be detachable and swappable with other weight members of different masses to adjust the mass distribution and inertial properties of the putter head 100. Further, the putter head 100 can also include one or more repositionable weight assemblies 1000, seen in FIGS. 1 and 2, which may include a heel weight assembly 1300 and/or a toe weight assembly 1400, as seen in FIGS. 1-4.

The location of each distinct component or assembly of the club head may be identified in a manner similar to that of the club head CG. For example, the heel weight assembly 1300 has a heel weight assembly CG, labeled CGh in the figures, and the CGh may be used to define a CGh coordinate system having a CGh X-axis passing through the heel weight assembly CG and parallel to the club head X-axis, a CGh Y-axis passing through the heel weight assembly CG and parallel to the club head Y-axis, and a CGh Z-axis passing through the heel weight assembly CG and parallel to the club head Z-axis, as seen best in FIGS. 1-20.

Likewise, the toe weight assembly 1400 has a toe weight assembly CG, labeled CGt in the figures, and the CGt may be used to define a CGt coordinate system having a CGt X-axis passing through the toe weight assembly CG and parallel to the club head X-axis, a CGt Y-axis passing through the toe weight assembly CG and parallel to the club head Y-axis, and a CGt Z-axis passing through the toe weight assembly CG and parallel to the club head Z-axis, as seen best in FIGS. 1-20.

Thus, the heel weight assembly CGh is shown as a point whose location can also be defined with reference to the club head origin coordinate system. The heel weight assembly CGh is the center of gravity associated with all the components that move with the heel weight assembly 1300. For example, and using millimeters as the unit of measure, a CGh that is located 15 mm from the head origin 128 toward the heel of the club head along the club head X-axis, 20 mm from the head origin 128 toward the rear of the club head along the club head Y-axis, and 5 mm from the head origin 128 toward the sole of the club head along the club head Z-axis can be defined as having a CGhx of 15 mm, a CGhy of 20 mm, and a CGhz of −5 mm. Additionally, the heel weight assembly CG is located a Zup-h dimension vertically above the ground plane GP, as seen in FIG. 3. Thus, Zup-h is 5 mm if the heel weight assembly CG is located 5 mm above the ground plane GP.

Figure 4:
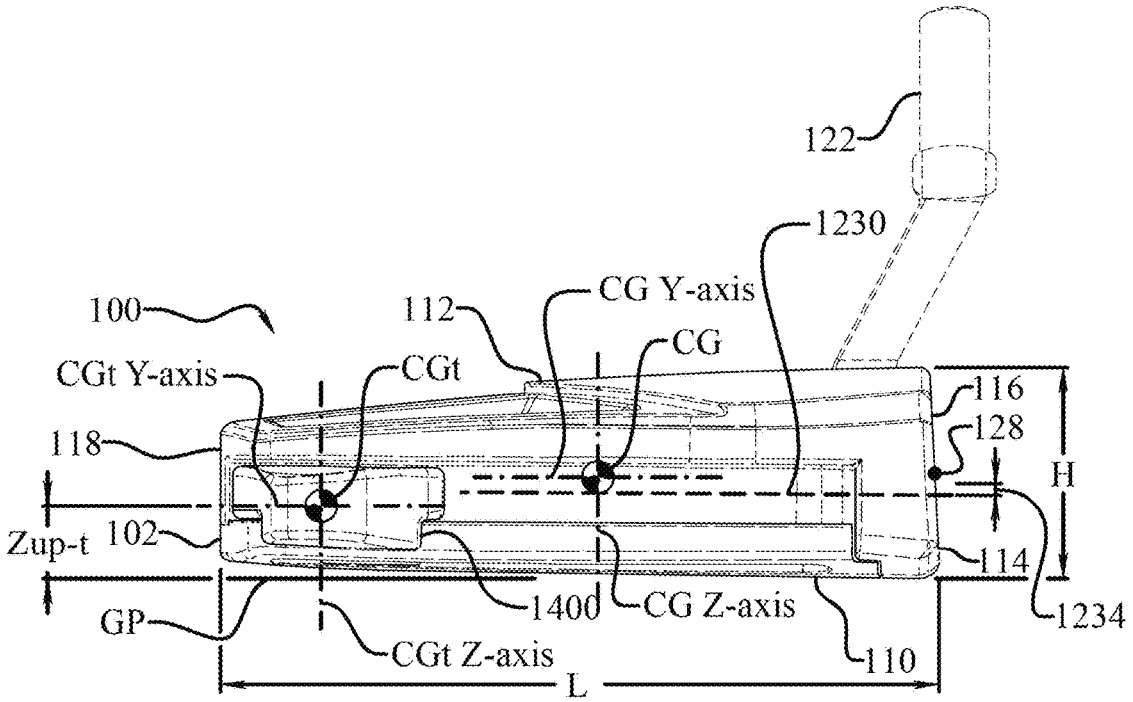
FIG. 4 is a toe side view of the golf putter head embodiment seen in FIG. 1 with the toe weight positioned at the rear portion of the putter head.

Similarly, the toe weight assembly CGt is shown as a point whose location can also be defined with reference to the club head origin coordinate system. The toe weight assembly CGt is the center of gravity associated with all the components that move with the toe weight assembly 1400. For example, and using millimeters as the unit of measure, a CGt that is located 15 mm from the head origin 128 toward the toe of the club head along the club head X-axis, 20 mm from the head origin 128 toward the rear of the club head along the club head Y-axis, and 5 mm from the head origin 128 toward the sole of the club head along the club head Z-axis can be defined as having a CGtx of −15 mm, a CGty of 20 mm, and a CGtz of −5 mm. Additionally, the toe weight assembly CG is located a Zup-t dimension vertically above the ground plane GP, as seen in FIG. 4. Thus, Zup-t is 5 mm if the toe weight assembly CG is located 5 mm above the ground plane GP.

Figure 9:
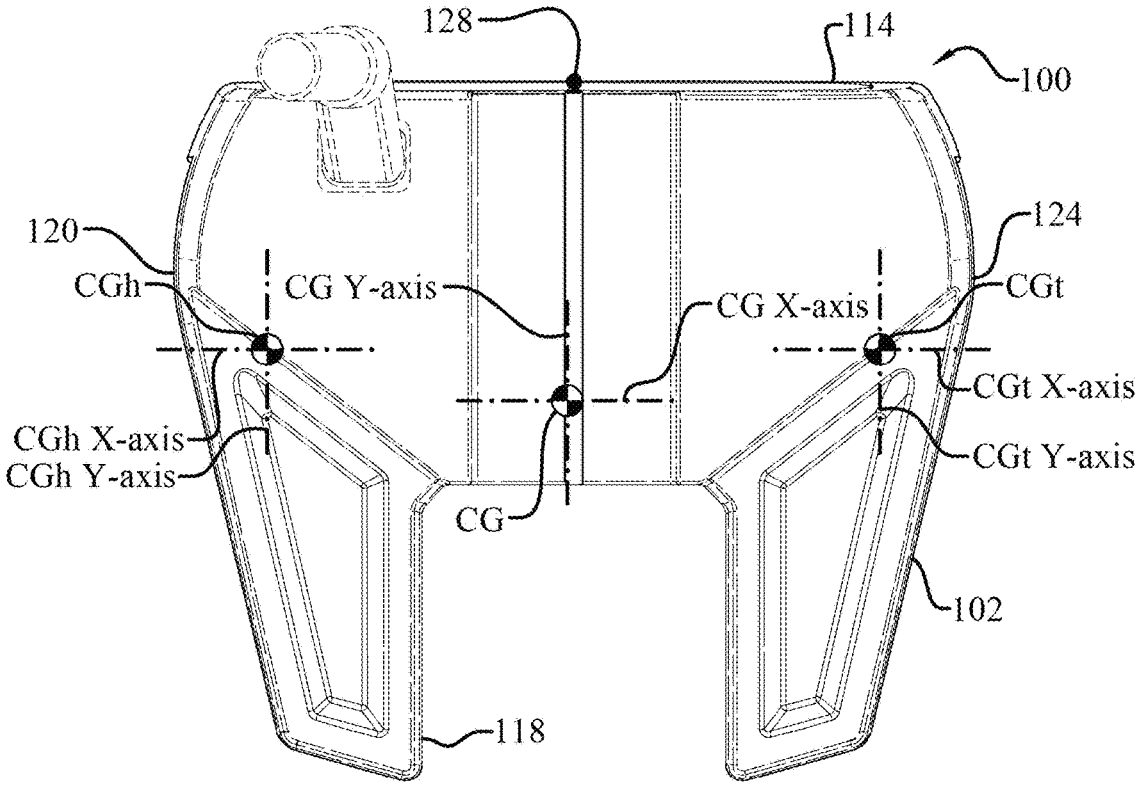
FIG. 9 is a top plan view of golf putter head embodiment with the toe and heel weights positioned in the front portion of the putter head.
Figure 10:
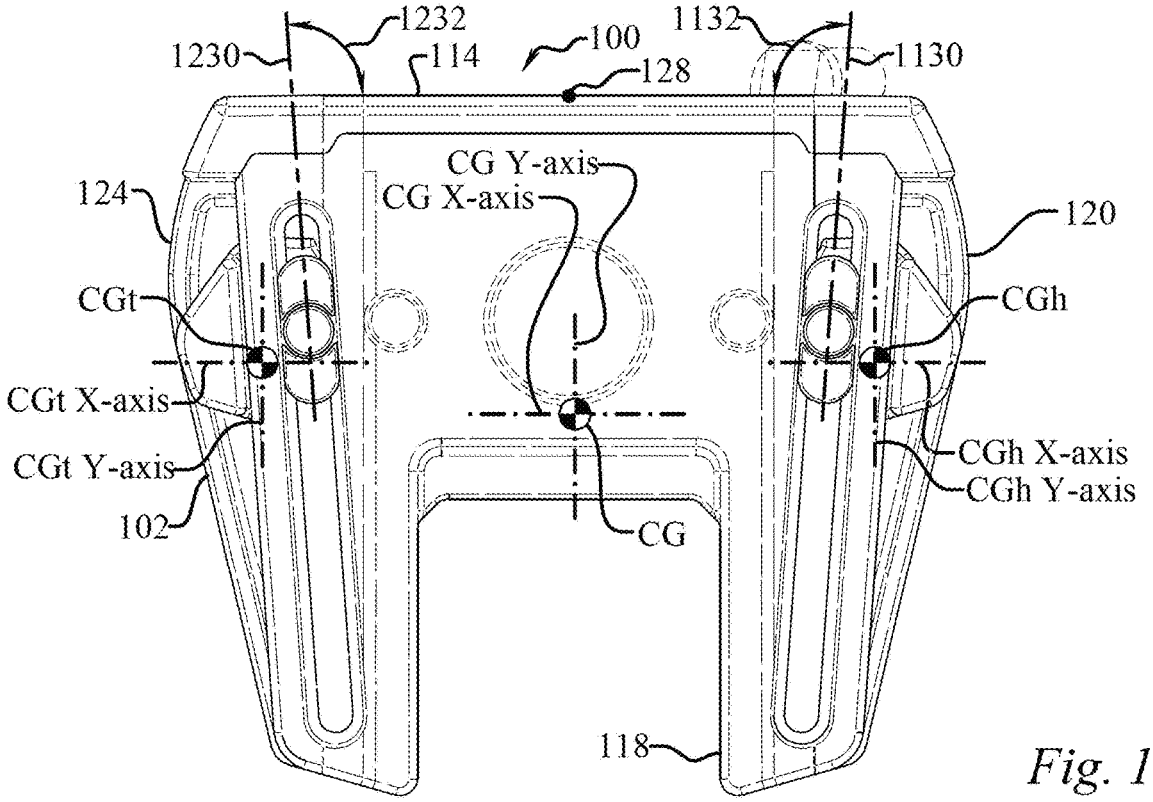
FIG. 10 is a bottom plan view of the golf putter head embodiment seen in FIG. 9 with the toe and heel weights positioned in the front portion of the putter head.
Figure 11:
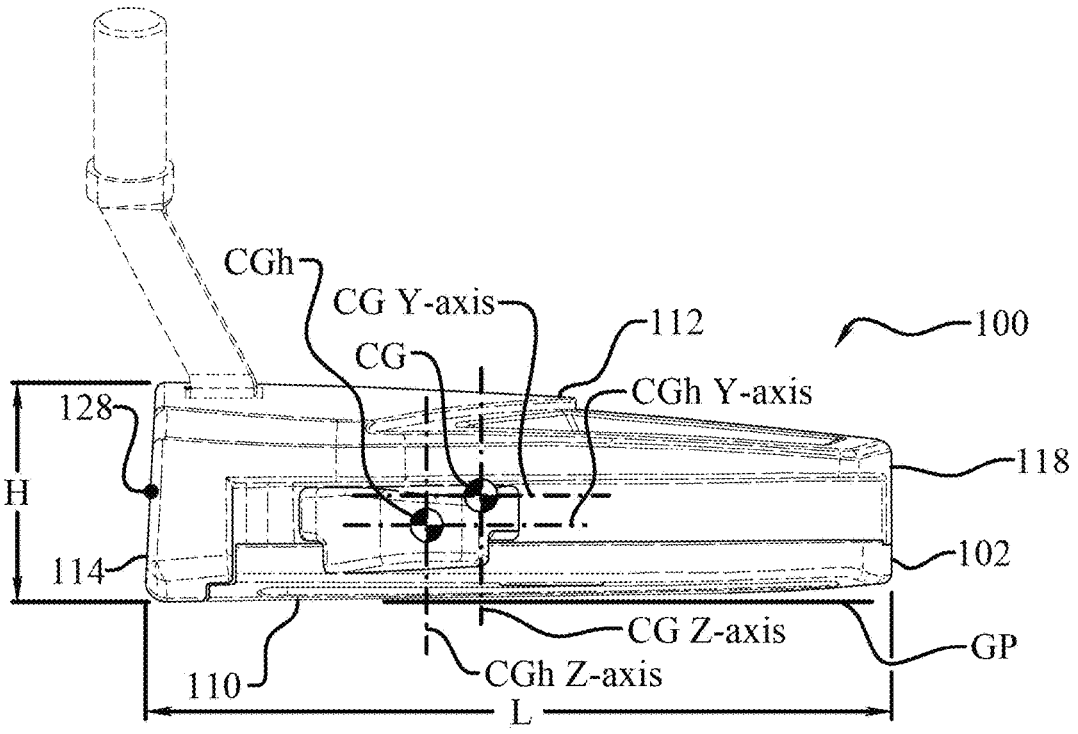
FIG. 11 is a heel side view of the golf putter head embodiment seen in FIG. 9 with the heel weight positioned in the front portion of the putter head.
Figure 12:
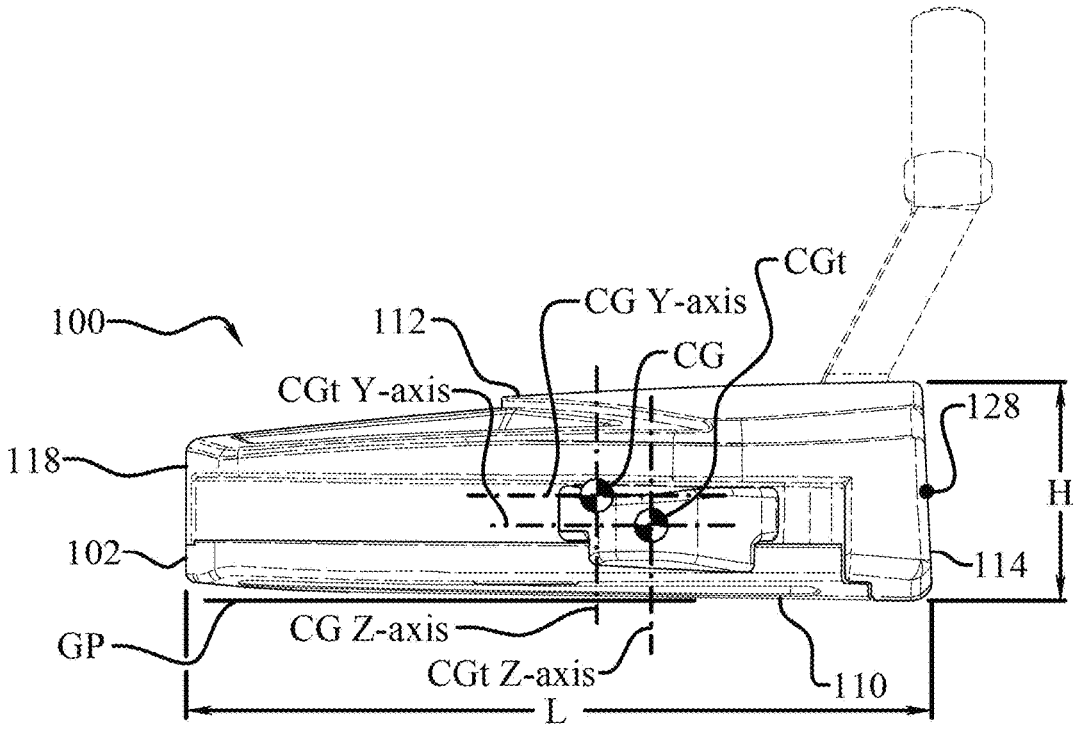
FIG. 12 is a toe side view of the golf putter head embodiment seen in FIG. 9 with the toe weight positioned in the front portion of the putter head.
Figure 24:
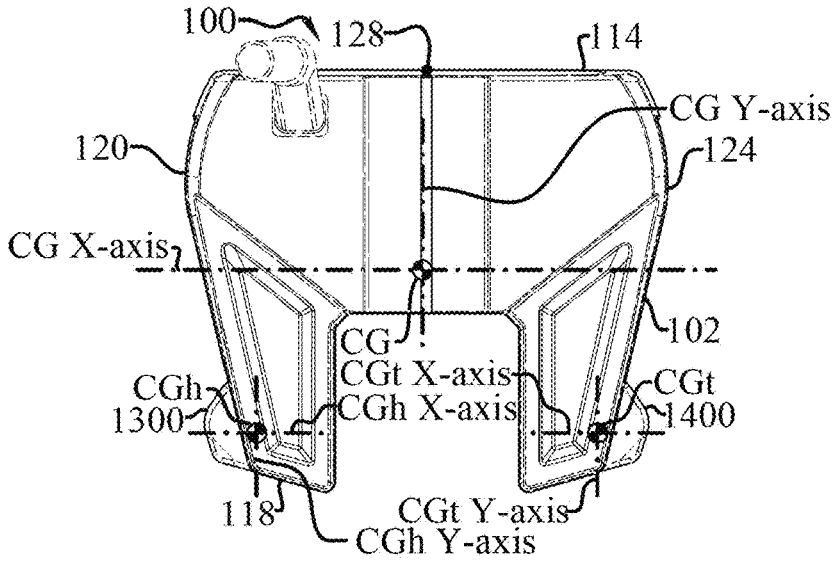
FIG. 24 is a top plan view of a golf putter head embodiment with the toe and heel weights positioned at the rear portion of the putter head.
Figure 25:
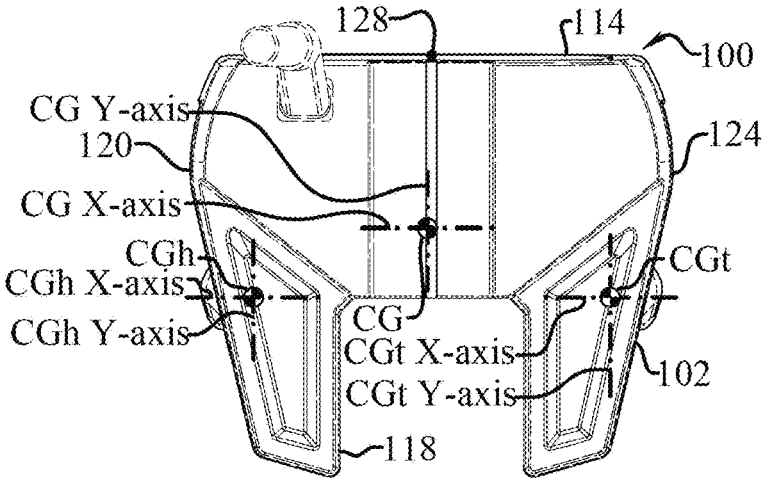
FIG. 25 is a top plan view of a golf putter head embodiment with the toe and heel weights positioned at the middle portion of the putter head.
Figure 26:
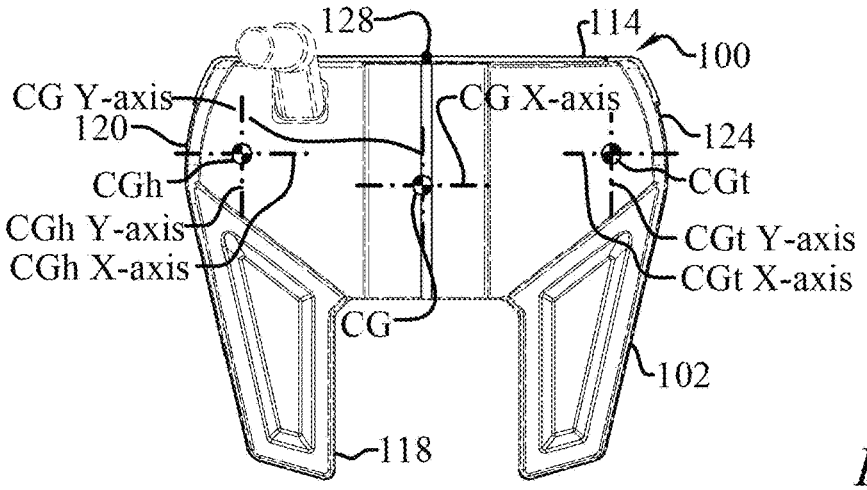
FIG. 26 is a top plan view of a golf putter head embodiment with the toe and heel weights positioned at the front portion of the putter head.
Figure 27:
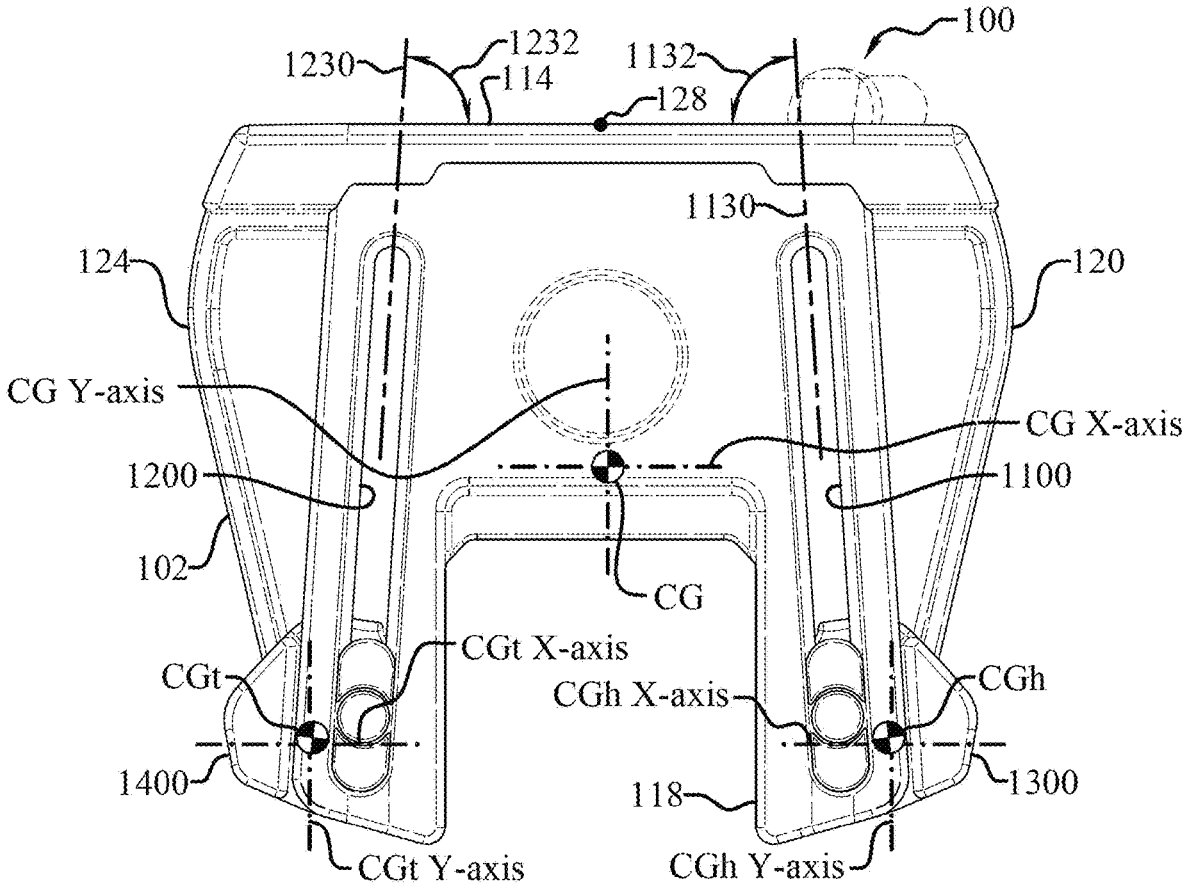
FIG. 27 is a bottom plan view of a golf putter head embodiment with the toe and heel weights positioned at the rear portion of the putter head.

The location and mass of the repositionable weight assembly 1000, in this example the heel weight assembly 1300 and/or the toe weight assembly 1400, impacts the location of the club head CG. For example when the heel weight assembly 1300 and the toe weight assembly 1400 are located in a rear position, such as that illustrated in FIGS. 1-2 and 24, the club head CG will be further back than when they are located in a forward position, such as illustrated in FIGS. 9-10 and 26. While when the heel weight assembly 1300 and the toe weight assembly 1400 are located in a middle position, such as that illustrated in FIGS. 5-6 and 25, the club head CG will be in between that of the rear position and the forward position.

Figure 13:
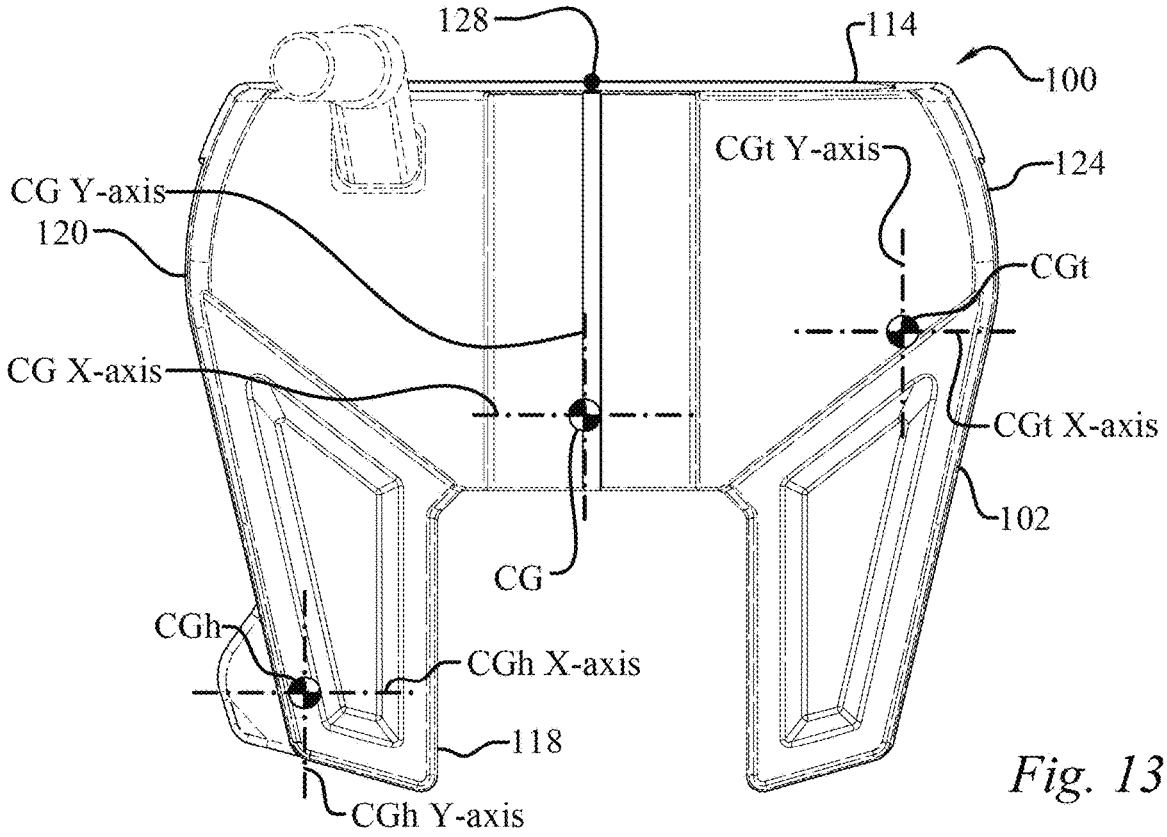
FIG. 13 is a top plan view of golf putter head embodiment with the heel weight positioned in the rear portion of the putter head, and the toe weight positioned in the front portion of the putter head.
Figure 14:
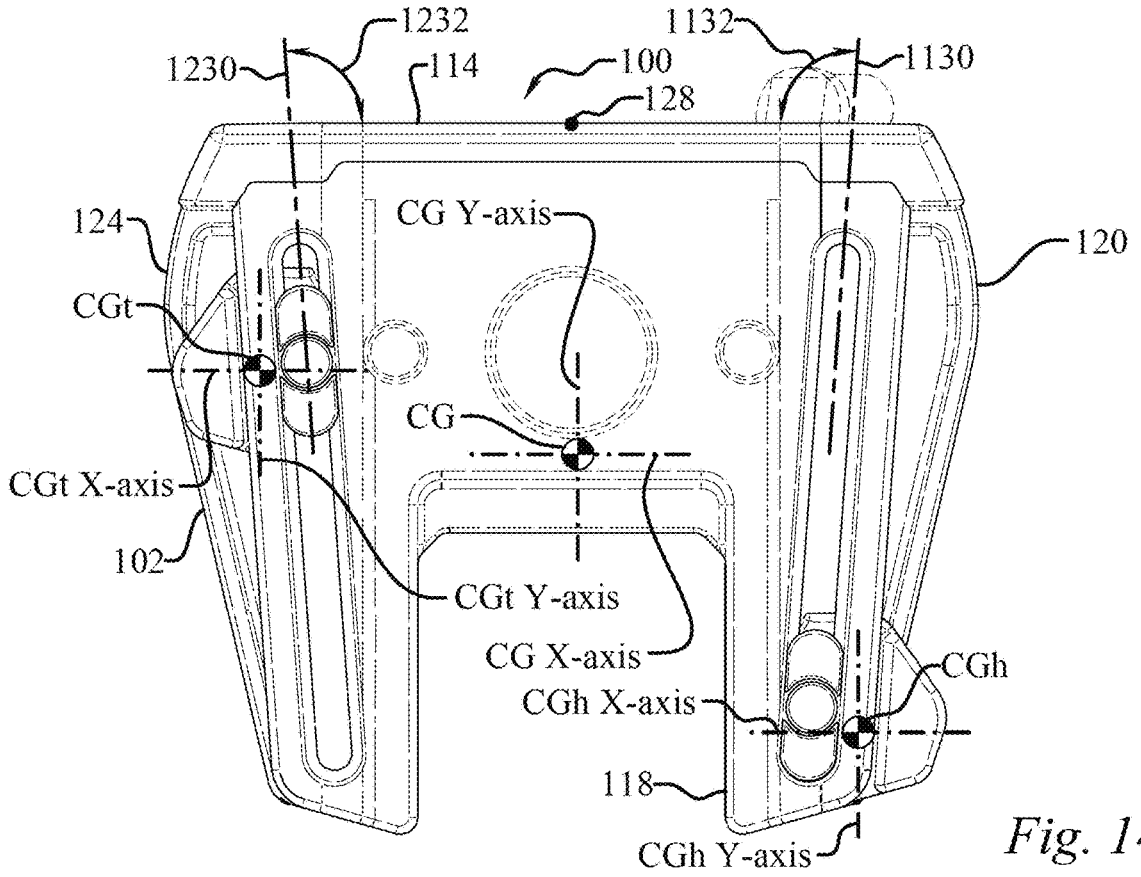
FIG. 14 is a bottom plan view of the golf putter head embodiment seen in FIG. 13 with the heel weight positioned in the rear portion of the putter head and the toe weight positioned in the front portion of the putter head.
Figure 15:
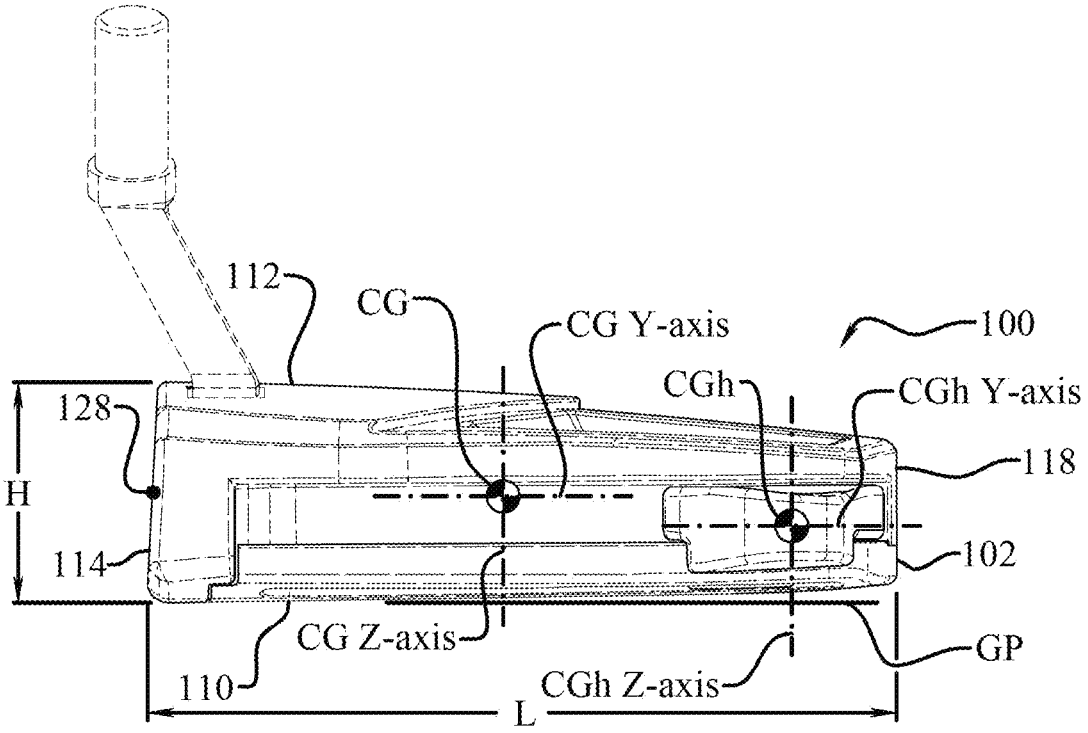
FIG. 15 is a heel side view of the golf putter head embodiment seen in FIG. 13 with the heel weight positioned in the rear portion of the putter head.
Figure 16:
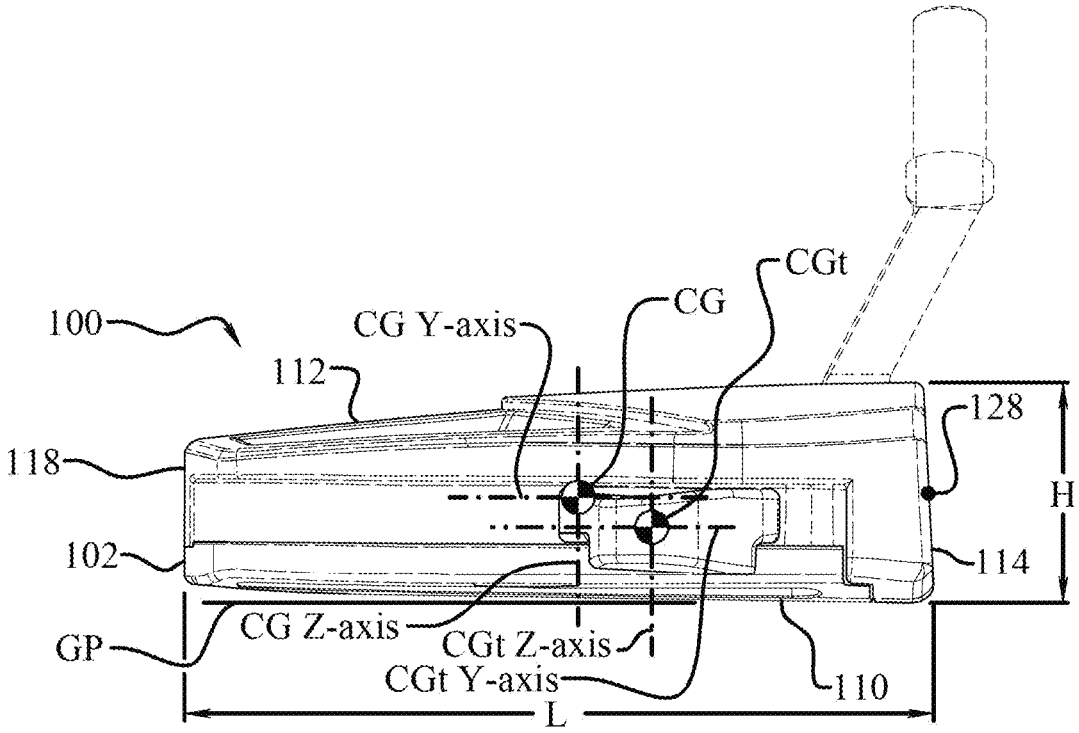
FIG. 16 is a toe side view of the golf putter head embodiment seen in FIG. 13 with the toe weight positioned in the front portion of the putter head.
Figure 17:
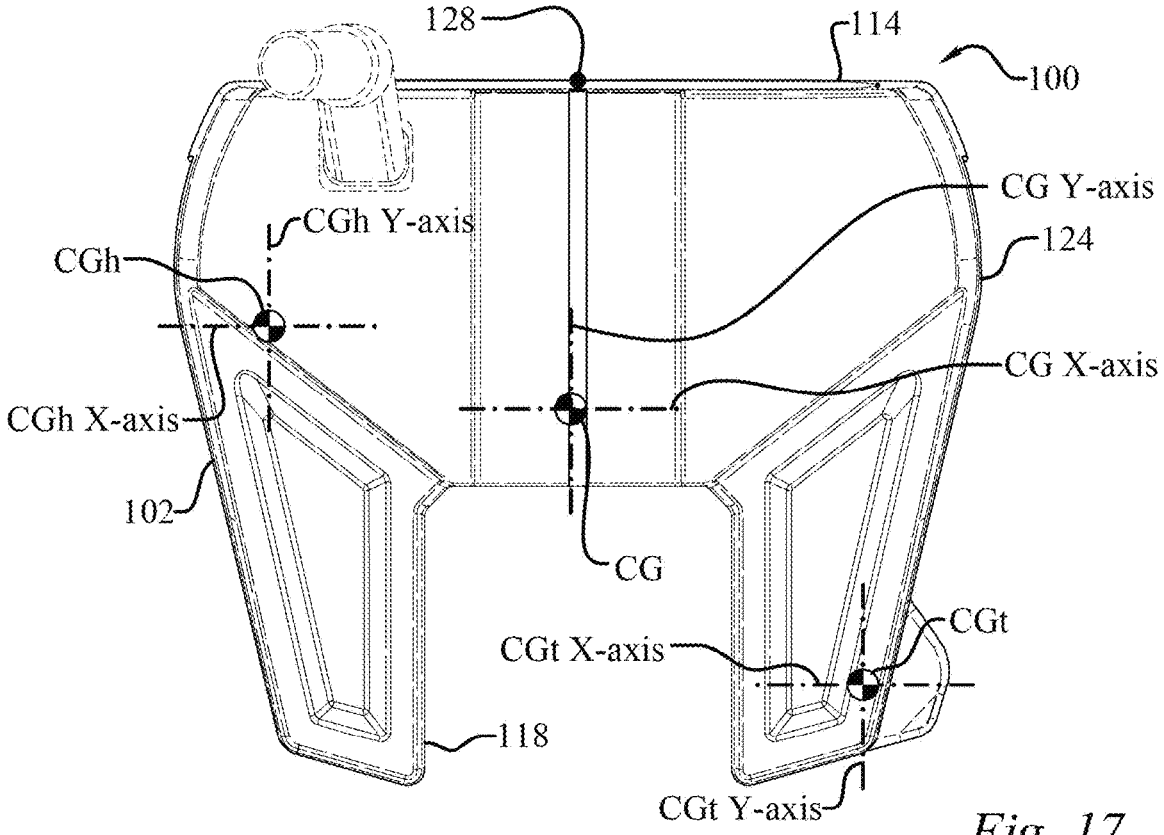
FIG. 17 is a top plan view of golf putter head embodiment with the heel weight positioned in the front portion of the putter head and the toe weight positioned in the rear portion of the putter head.

Similarly, when the heel weight assembly 1300 is located in a rear position and the toe weight assembly 1400 is located in a forward position, such as that illustrated in FIGS. 13-14, the club head CG will be different than in other configurations. Likewise, when the heel weight assembly 1300 is located in a forward position and the toe weight assembly 1400 is located in a rear position, such as that illustrated in FIGS. 17-18, the club head CG will be different than in other configurations. Additionally, in some embodiments the elevation of the heel weight assembly 1300 and/or the toe weight assembly 1400 changes with the forward-to-rear movement and/or the heel-to-toe movement, and therefore impacts the elevation of the putter head CG, and thus CGz and Zup. It is important to note that these examples are for ease of description with relation to the referenced figures and are not meant to limit the disclosure to multiple weight assembly embodiments, nor the location of the weight assemblies.

Further, the location and mass of the repositionable weight assembly 1000, in this example the heel weight assembly 1300 and/or the toe weight assembly 1400, impacts the moment of inertias of the putter head 100. As one skilled in the art will appreciate, a putter head 100 has a moment of inertia about the vertical CG Z-axis ("Izz"), a moment of inertia about the heel/toe CG X-axis ("Ixx"), and a moment of inertia about the front/back CG Y-axis ("Iyy"). A moment of inertia about the golf club head CG X-axis (Ixx) is calculated by the following equation:

$$Ixx = \int (y^2 + z^2)\mathrm{dm}$$

where y is the distance from a golf club head CG xz-plane to an infinitesimal mass dm and z is the distance from a golf club head CG xy-plane to the infinitesimal mass dm. The golf club head CG xz-plane is a plane defined by the golf club head CG x-axis and the golf club head CG z-axis. The CG xy-plane is a plane defined by the golf club head CG X-axis and the golf club head CG Y-axis. Similarly, a moment of inertia about the golf club head CG Z-axis (Izz) is calculated by the following equation:

$$Izz = \int (x^2 + y^2)\mathrm{dm}$$

where x is the distance from a golf club head CG yz-plane to an infinitesimal mass dm and y is the distance from the golf club head CG xz-plane to the infinitesimal mass dm. The golf club head CG yz-plane is a plane defined by the golf club head CG Y-axis and the golf club head CG Z-axis. Similarly, a moment of inertia about the golf club head CG Y-axis (Iyy) is calculated by the following equation:

$$Iyy = \int (x^2 + z^2)\mathrm{dm}$$

where x is the distance from a golf club head CG yz-plane to an infinitesimal mass dm and z is the distance from the golf club head CG xy-plane to the infinitesimal mass dm. The golf club head CG xy-plane is a plane defined by the golf club head CG X-axis and the golf club head CG Y-axis. A further description of the coordinate systems for determining CG positions and MOI can be found in U.S. Pat. No. 9,358,430, the entire contents of which are incorporated by reference herein.

Figure 117:
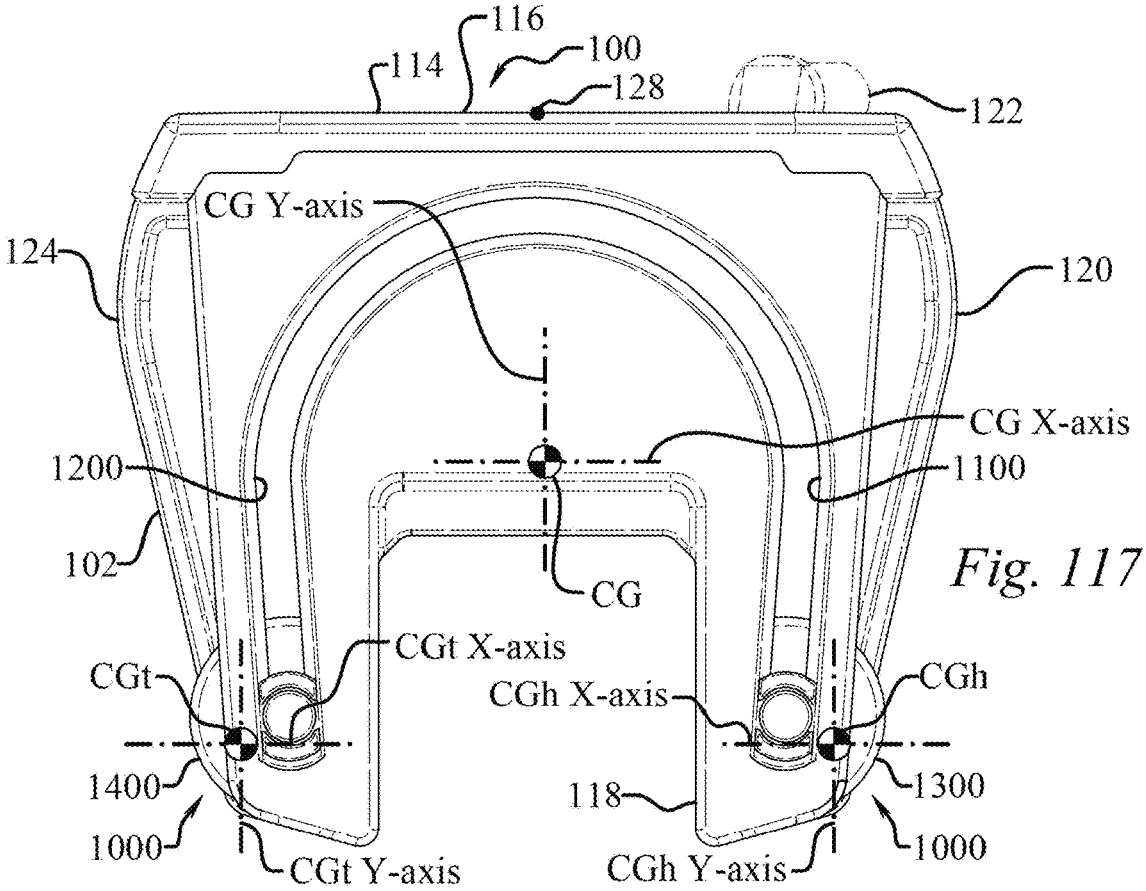

FIGS. 1-12 illustrate an embodiment of the putter head 100 having a repositionable weight assembly 1000 including a heel weight assembly 1300 and a toe weight assembly 1400, however in a further embodiment the repositionable weight assembly 1000 includes at least one of the heel weight assembly 1300 and the toe weight assembly 1400. Further, the repositionable weight assembly 1000 may be located anywhere on the club head including the top, bottom, and/or sides, and it may be centrally located. Thus the reference to heel weight assembly 1300 and the toe weight assembly 1400 are for convenience only in describing the illustrated embodiments, and heel or toe is not meant to limit the movement to only a heel region or toe region of the putter head 100. For instance, as will later be described with respect to FIG. 117, the repositionable weight assembly 1000 may move from the heel half of the club head, across the club head Y-Z plane passing through the origin 128 to the toe half of the club head.

Figure 2:
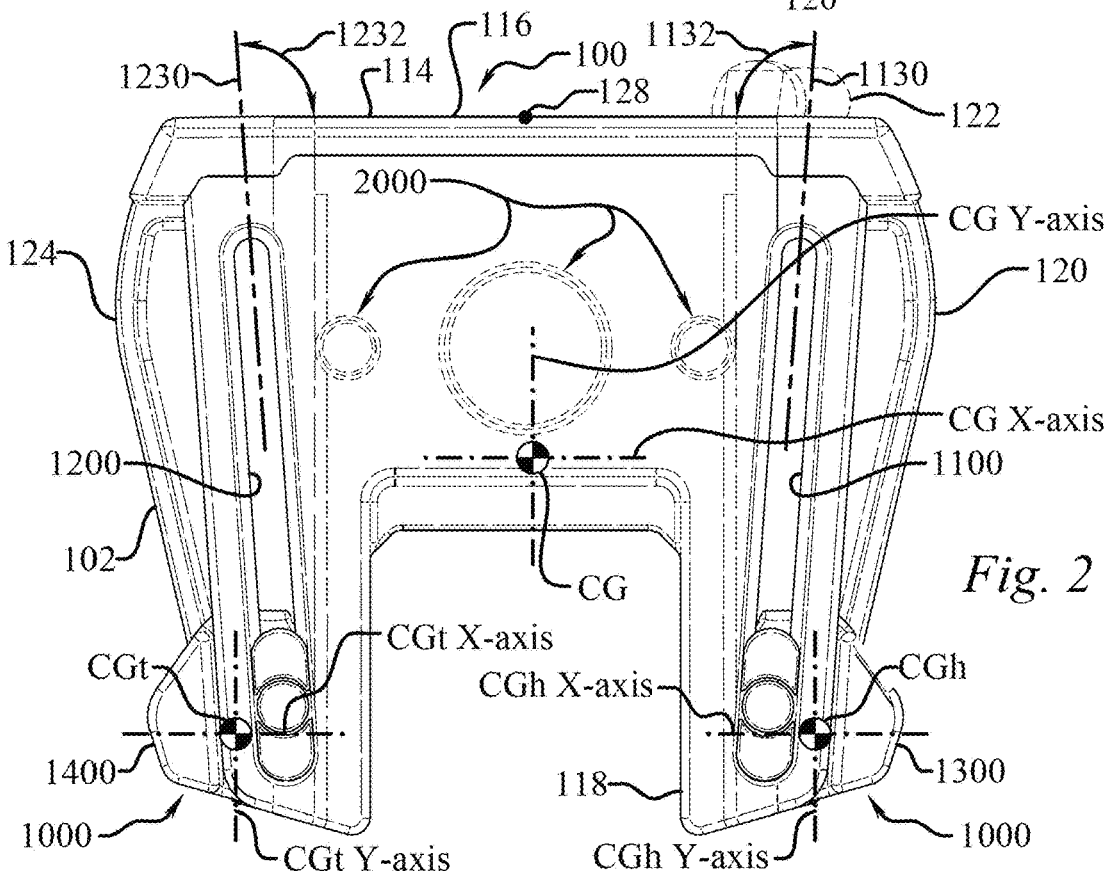
FIG. 2 is a bottom plan view of the golf putter head embodiment seen in FIG. 1 with the toe and heel weights positioned at the rear portion of the putter head.
Figure 3:
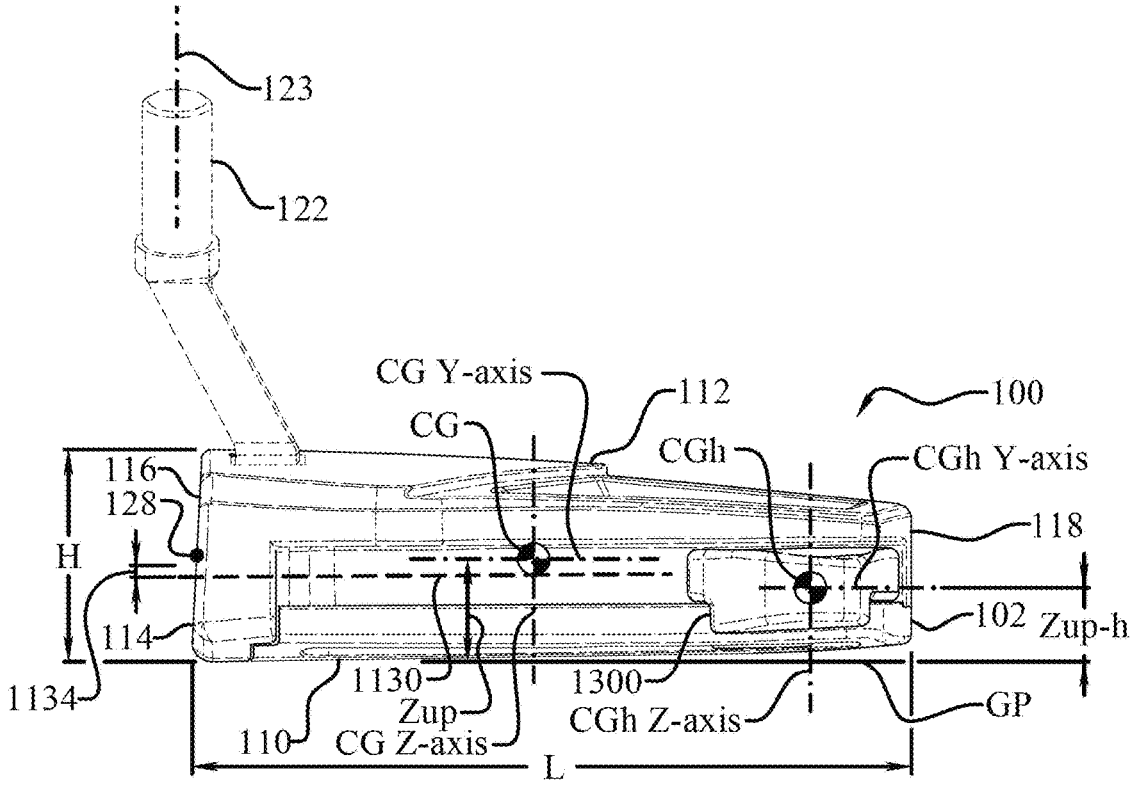
FIG. 3 is a heel side view of the golf putter head embodiment seen in FIG. 1 with the heel weight positioned at the rear portion of the putter head.
Figure 6:
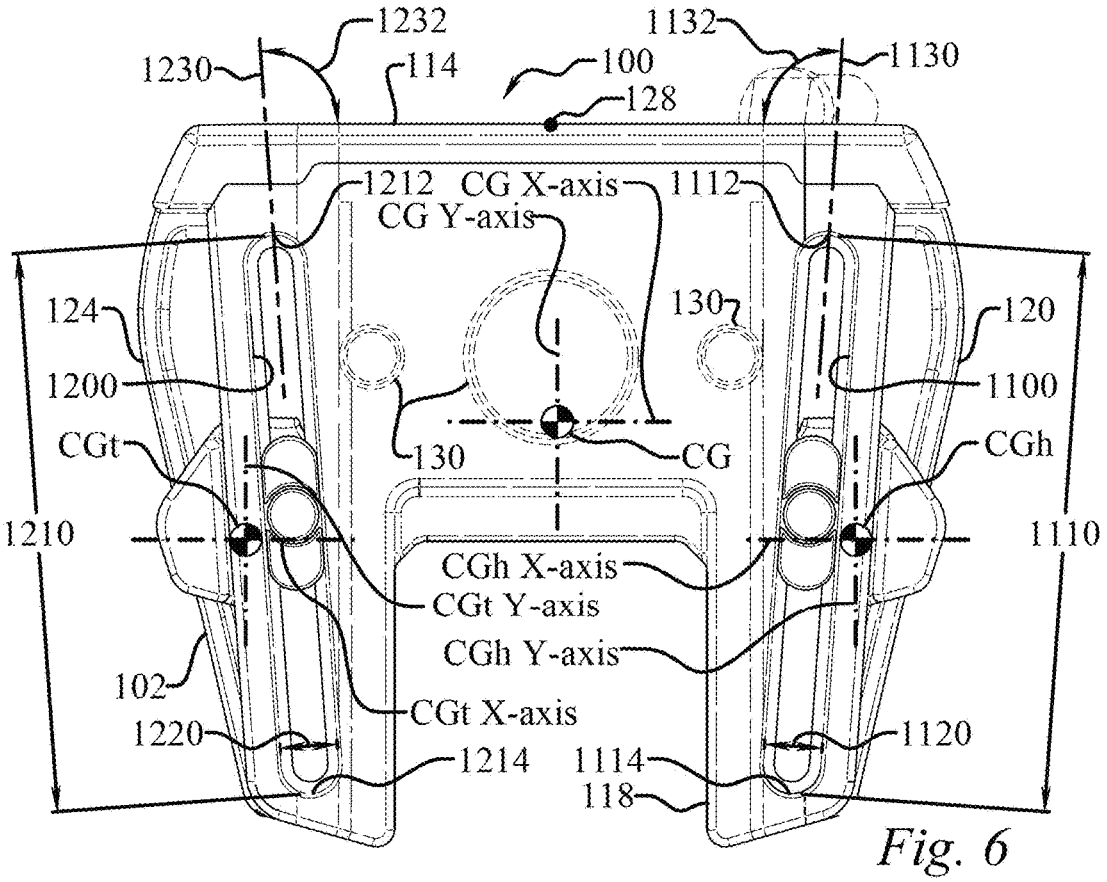
FIG. 6 is a bottom plan view of the golf putter head embodiment seen in FIG. 5 with the toe and heel weights positioned in the middle portion of the putter head.
Figure 7:
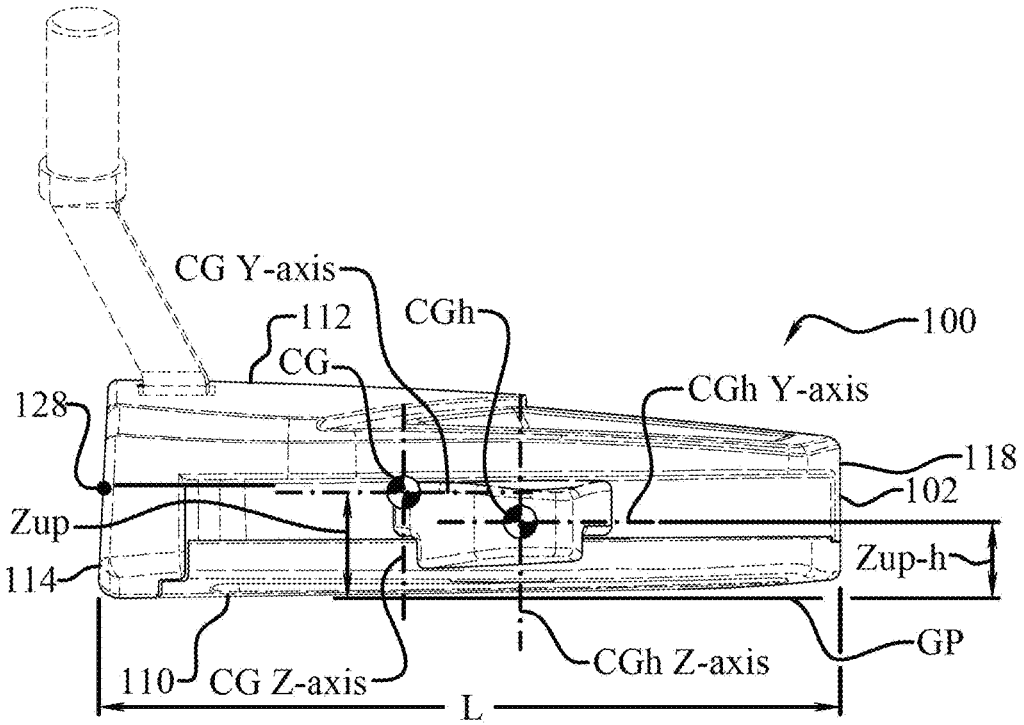
FIG. 7 is a heel side view of the golf putter head embodiment seen in FIG. 5 with the heel weight positioned in the middle portion of the putter head.
Figure 8:
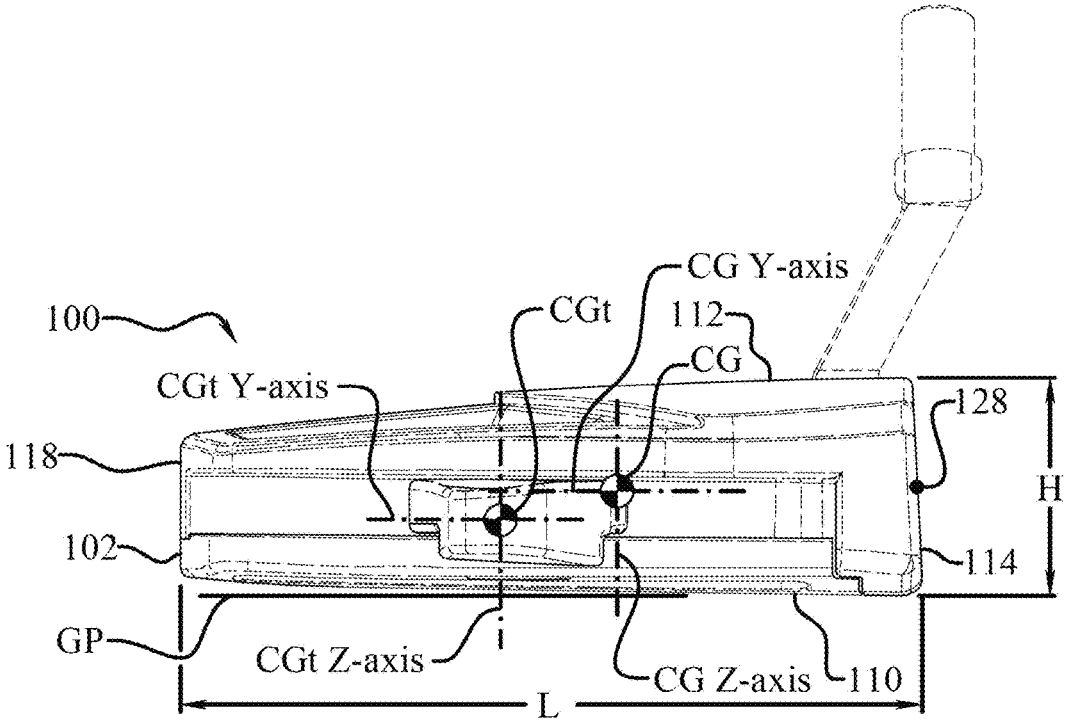
FIG. 8 is a toe side view of the golf putter head embodiment seen in FIG. 5 with the toe weight positioned in the middle portion of the putter head.
Figure 28:
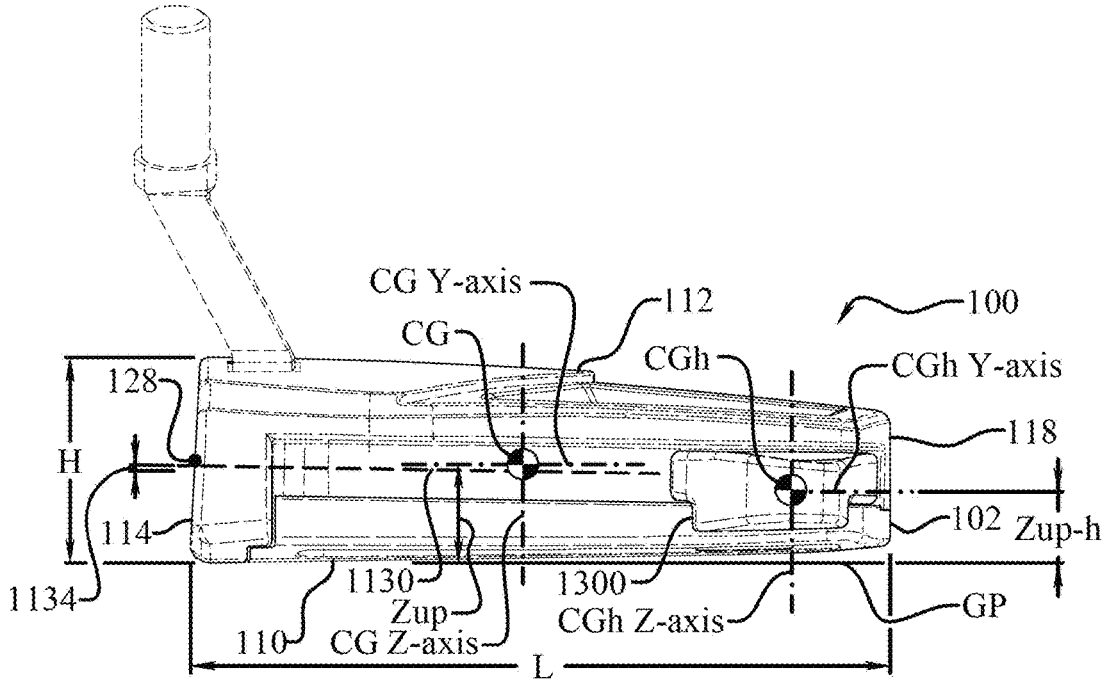
FIG. 28 is a heel side view of the golf putter head embodiment seen in FIG. 27 with the heel weight positioned at the rear portion of the putter head.
Figure 29:
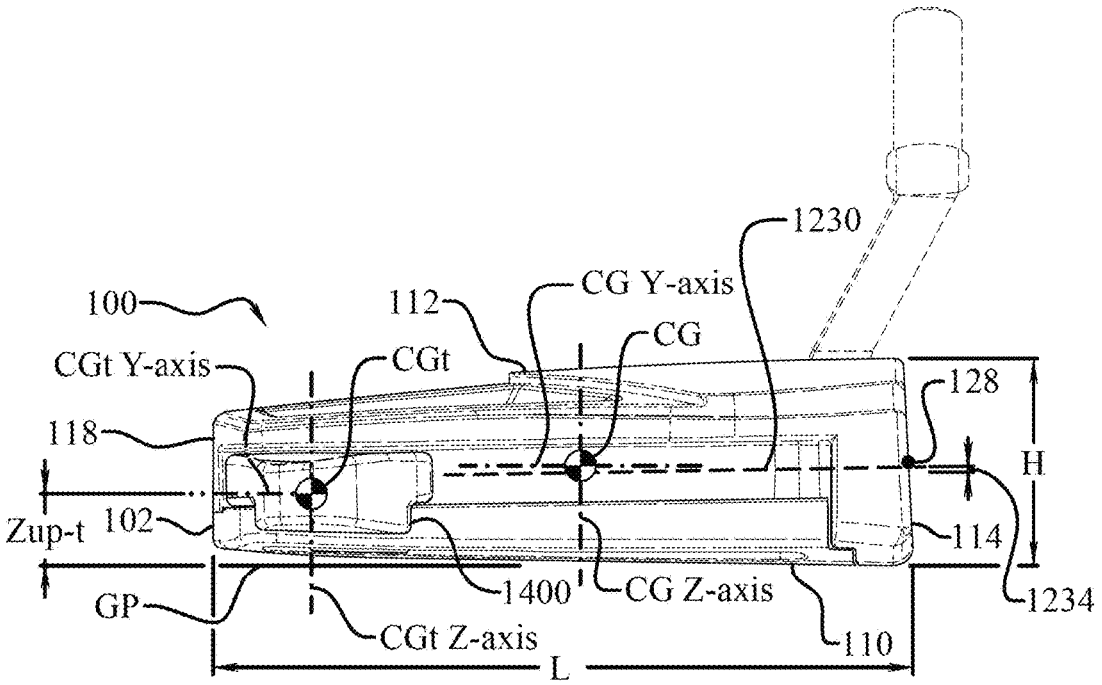
FIG. 29 is a toe side view of the golf putter head embodiment seen in FIG. 27 with the toe weight positioned at the rear portion of the putter head.
Figure 30:
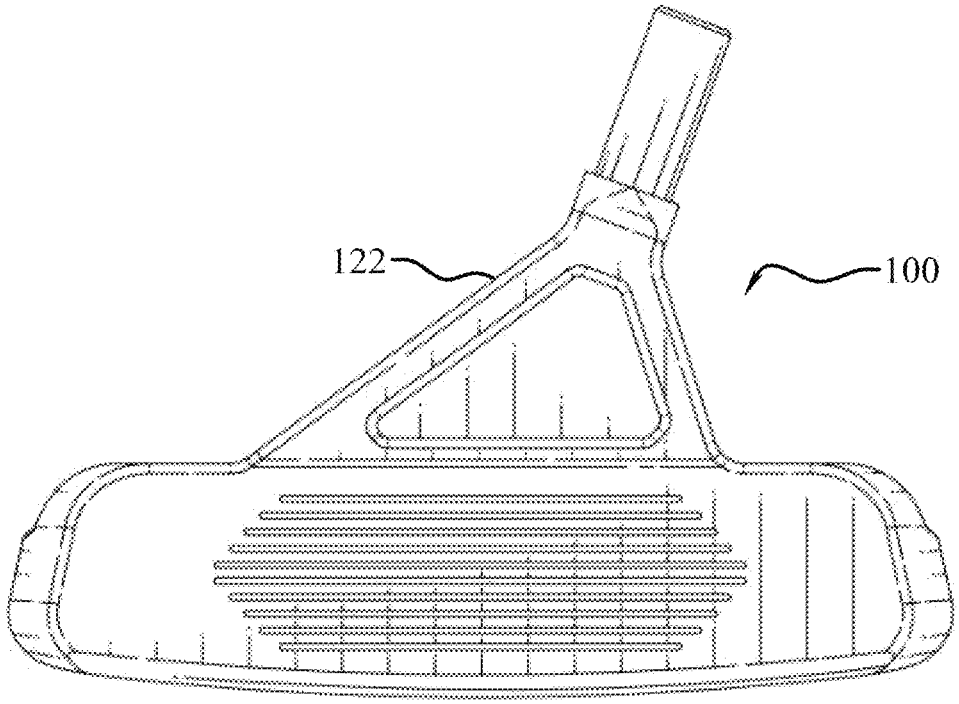
FIG. 30 is a front side view of another golf putter head embodiment.
Figure 31:
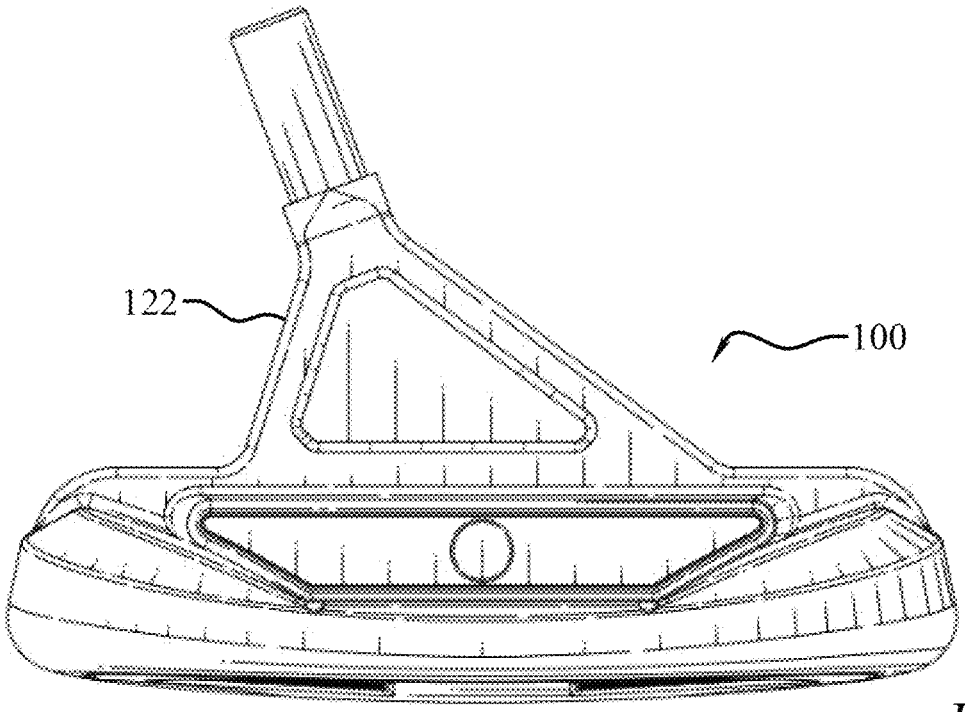
FIG. 31 is a rear side view of the golf putter head embodiment seen in FIG. 30.
Figure 32:
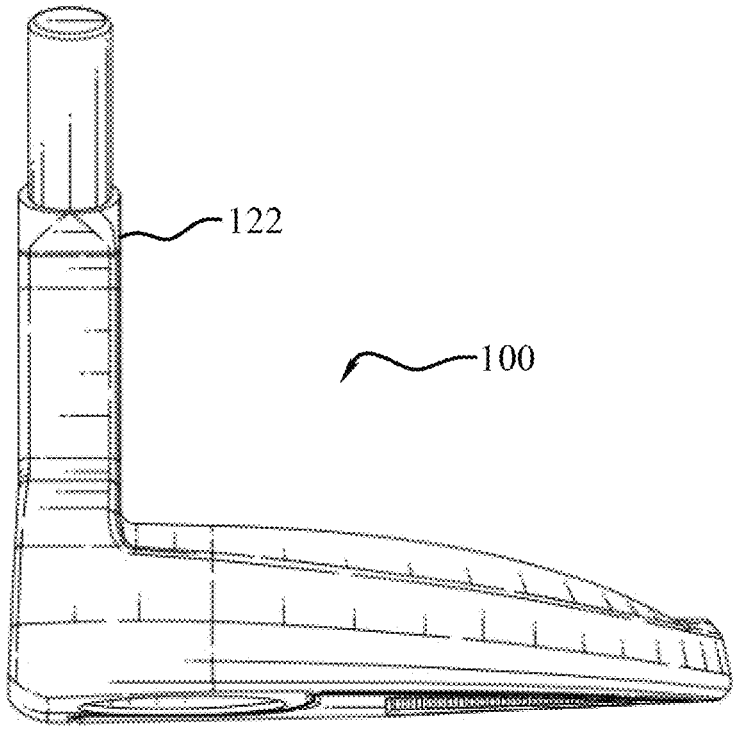
FIG. 32 is a heel side view of the golf putter head embodiment seen in FIG. 30.
Figure 33:
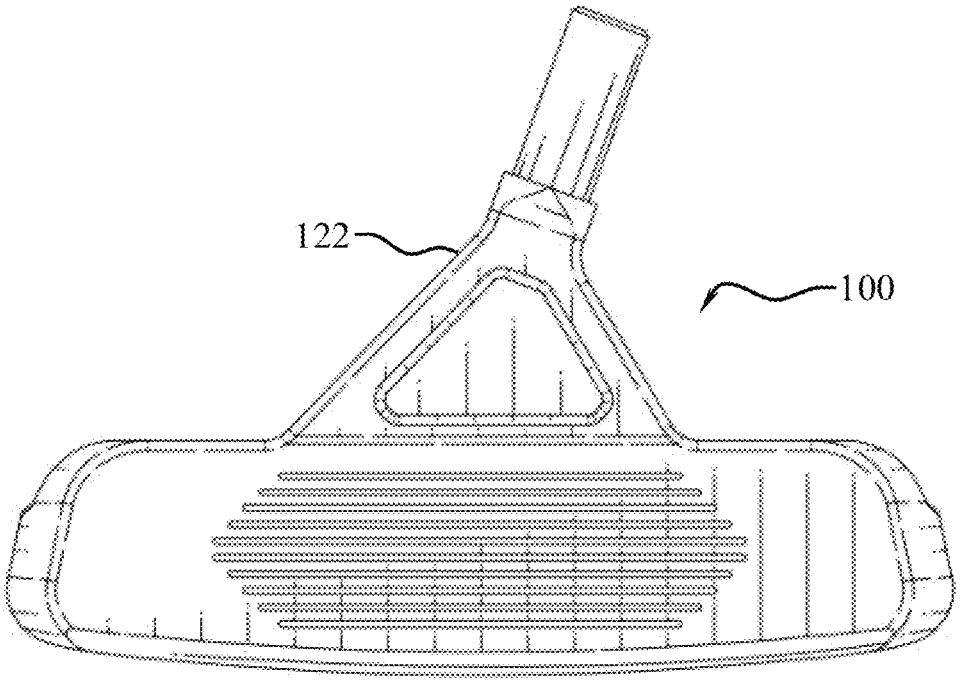
FIG. 33 is a front side view of another golf putter head embodiment.
Figure 34:
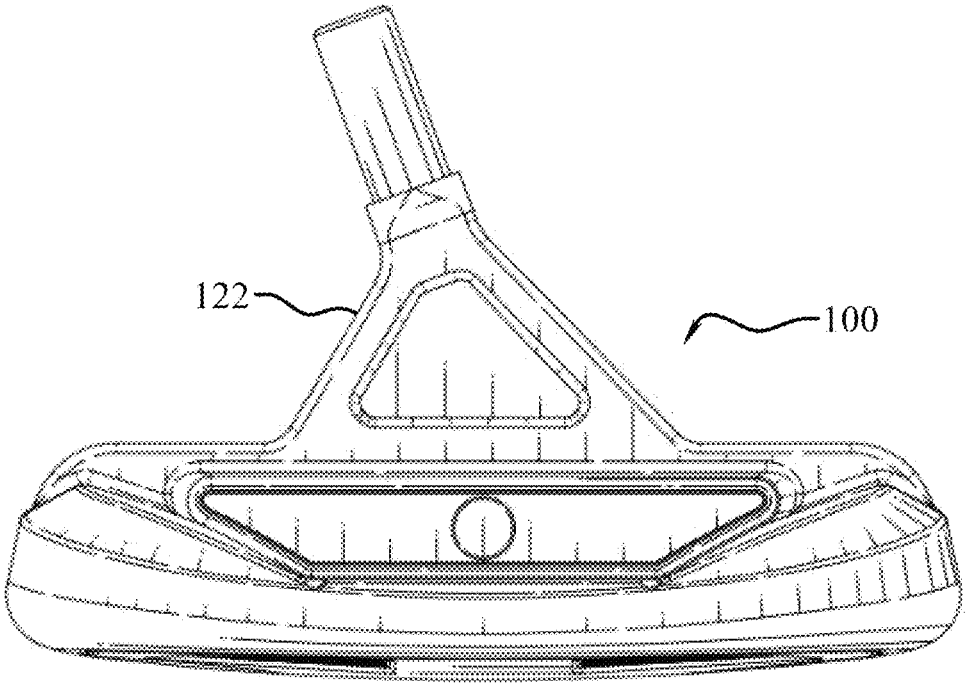
FIG. 34 is a rear side view of the golf putter head embodiment seen in FIG. 33.
Figure 35:
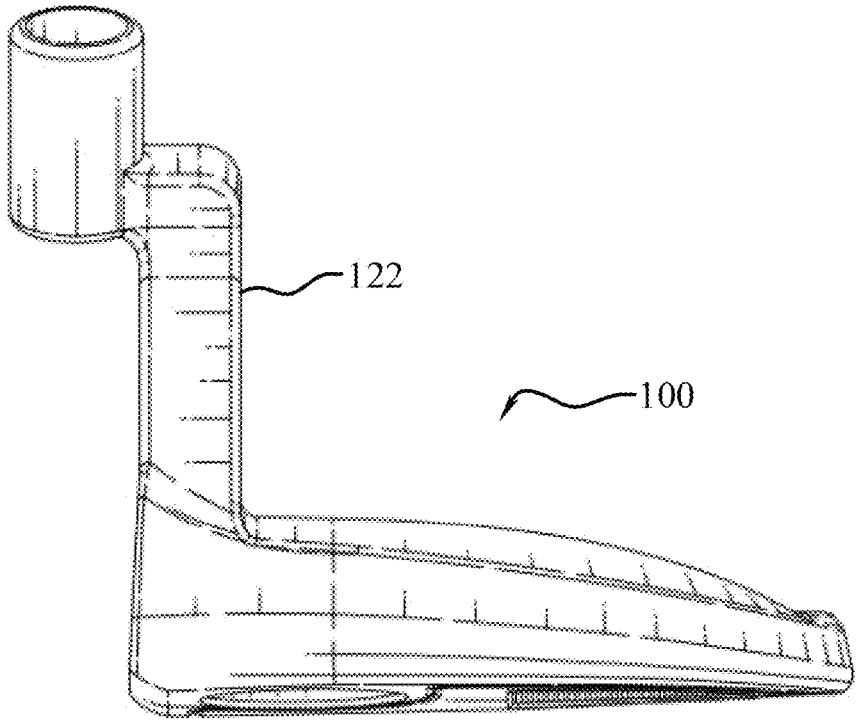
FIG. 35 is a heel side view of the golf putter head embodiment seen in FIG. 33.
Figure 36:
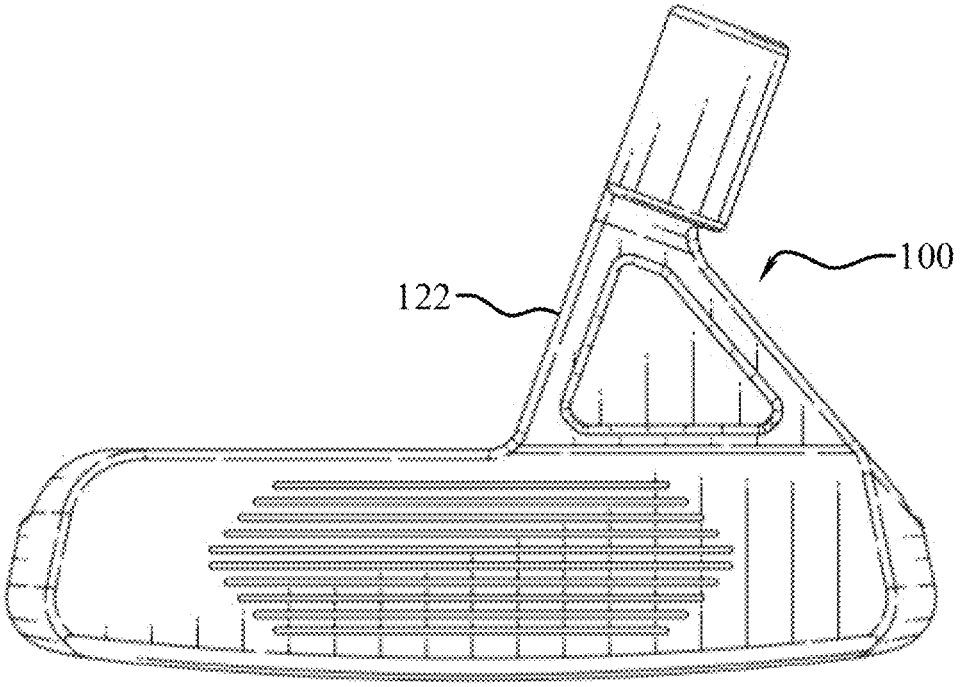
FIG. 36 is a front side view of another golf putter head embodiment.
Figure 37:
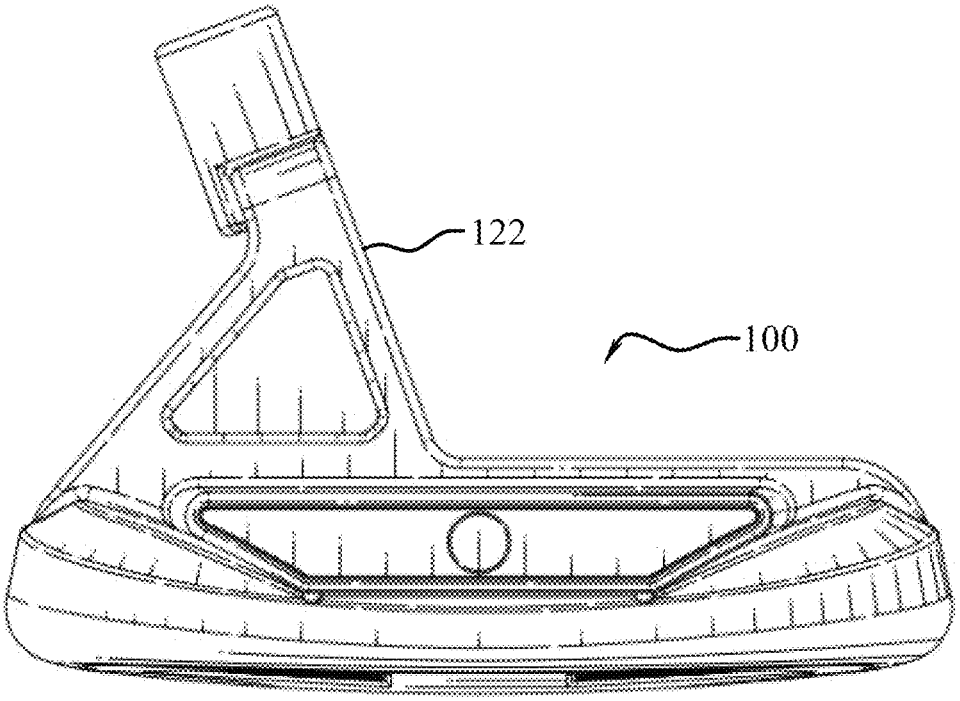
FIG. 37 is a rear side view of the golf putter head embodiment seen in FIG. 36.
Figure 38:
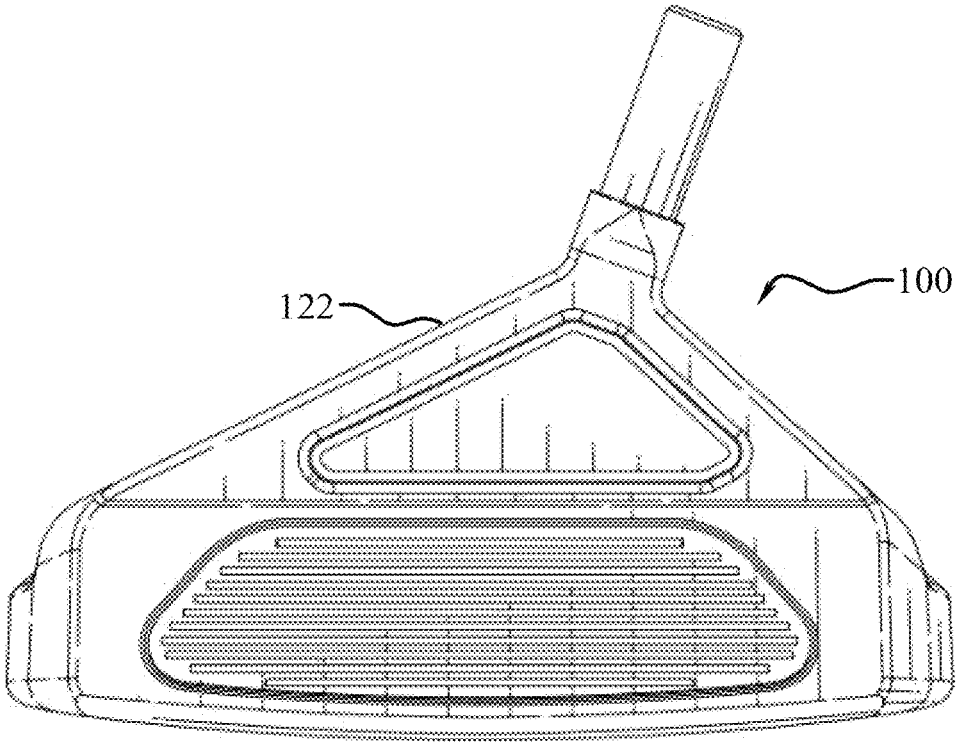
FIG. 38 is a front side view of another golf putter head embodiment.
Figure 39:
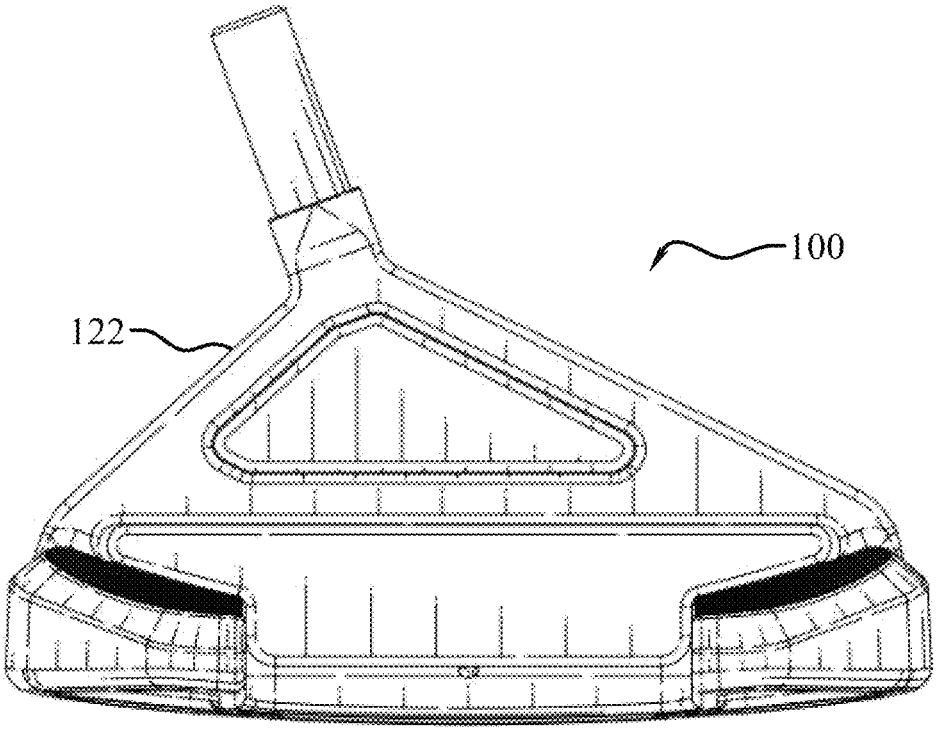
FIG. 39 is a rear side view of the golf putter head embodiment seen in FIG. 38.
Figure 40:
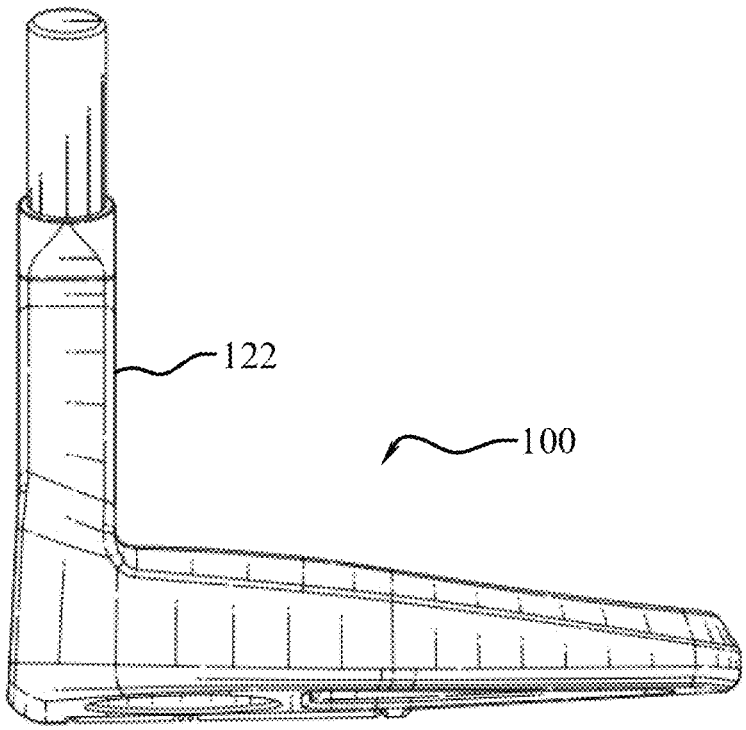
FIG. 40 is a heel side view of the golf putter head embodiment seen in FIG. 38.
Figure 41:
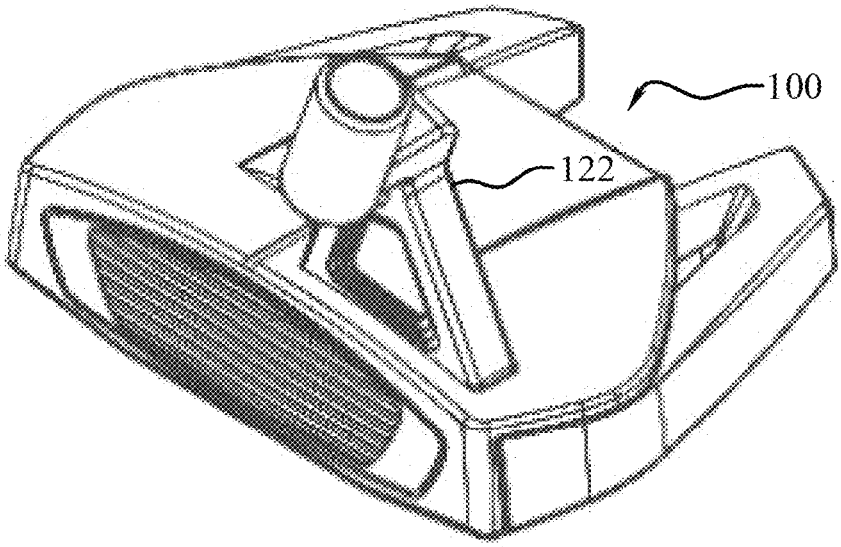
FIG. 41 is an isometric view of another golf putter head embodiment.
Figure 42:
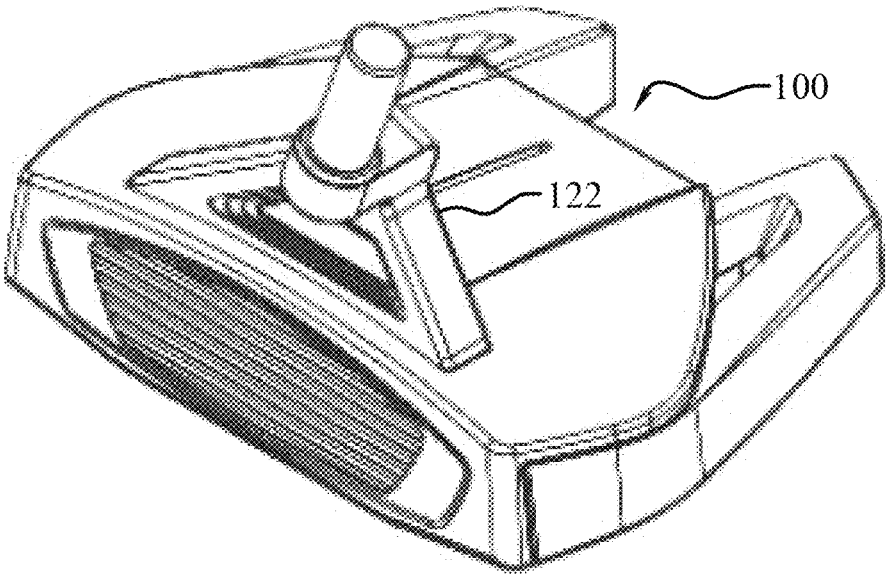
FIG. 42 is an isometric view of another golf putter head embodiment.
Figure 43:
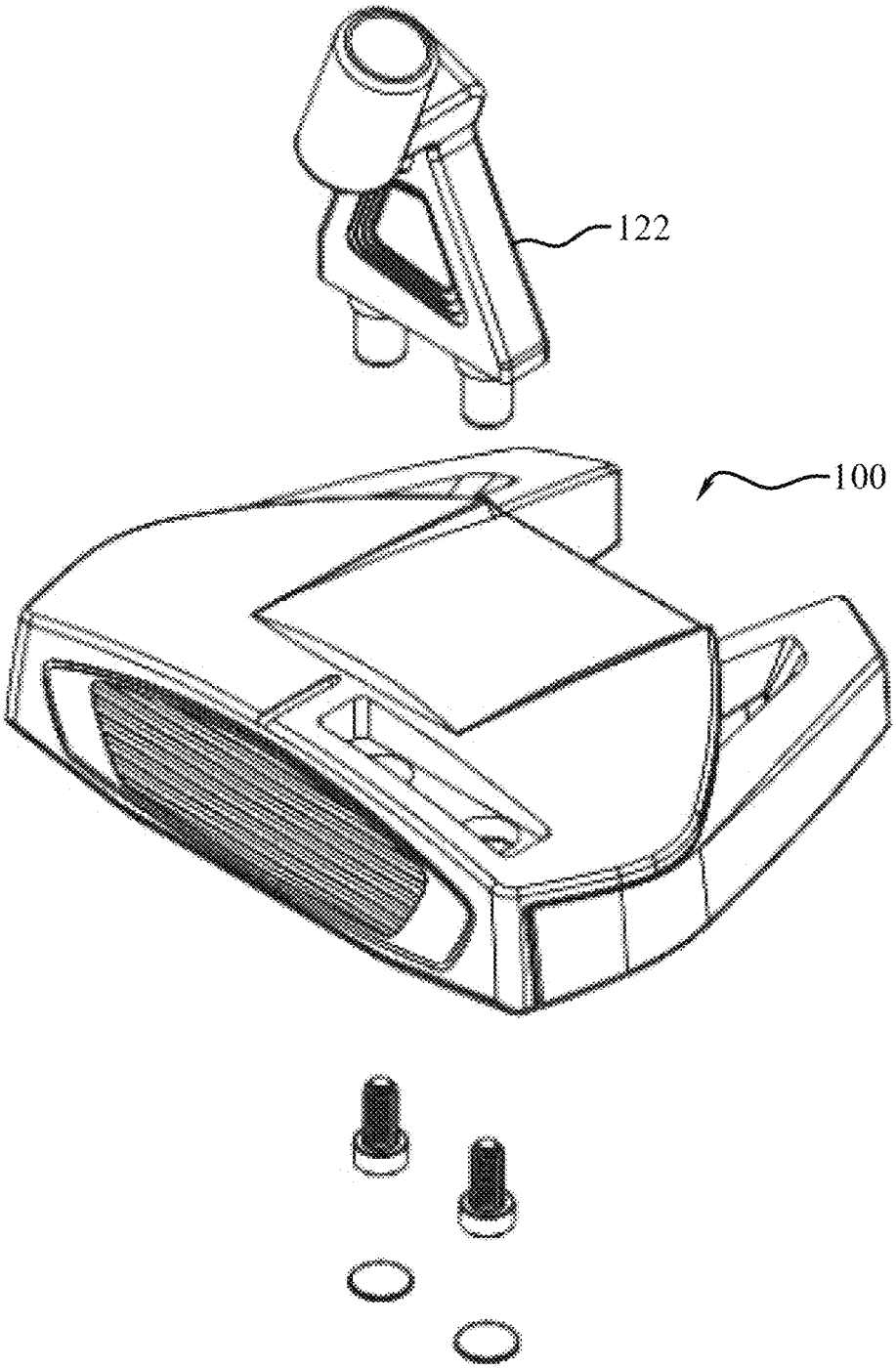
FIG. 43 is an exploded isometric view of the golf putter head embodiment seen in FIG. 41.
Figure 44:
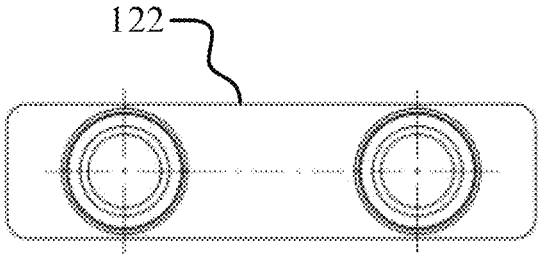
FIG. 44 is top plan view of a hosel receiver for the golf putter head seen in FIG. 41.
Figure 45:
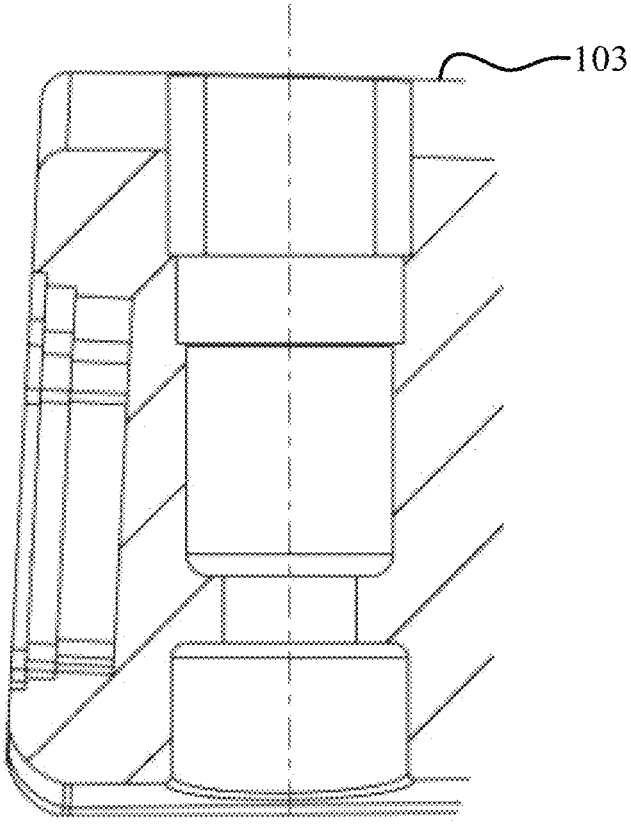
FIG. 45 is a cross-sectional view of a hosel receiver for the golf putter head seen in FIG. 41.
Figure 46:
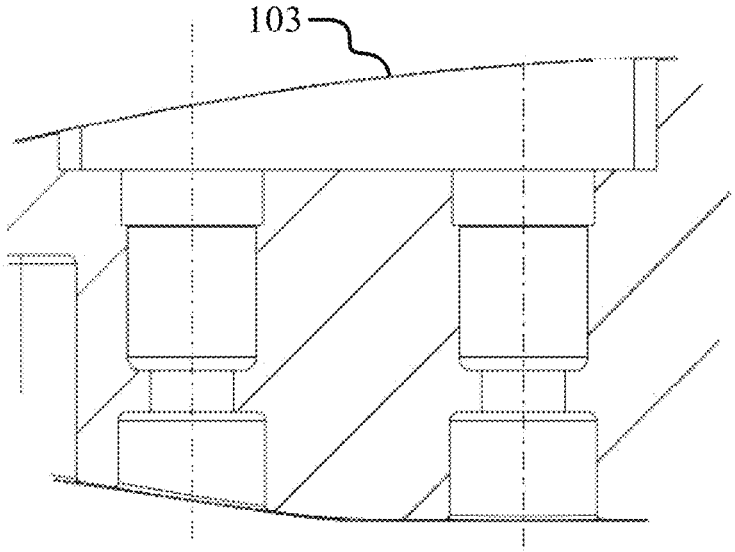
FIG. 46 is a cross-sectional view of a hosel receiver for another embodiment of golf putter head.
Figure 47:
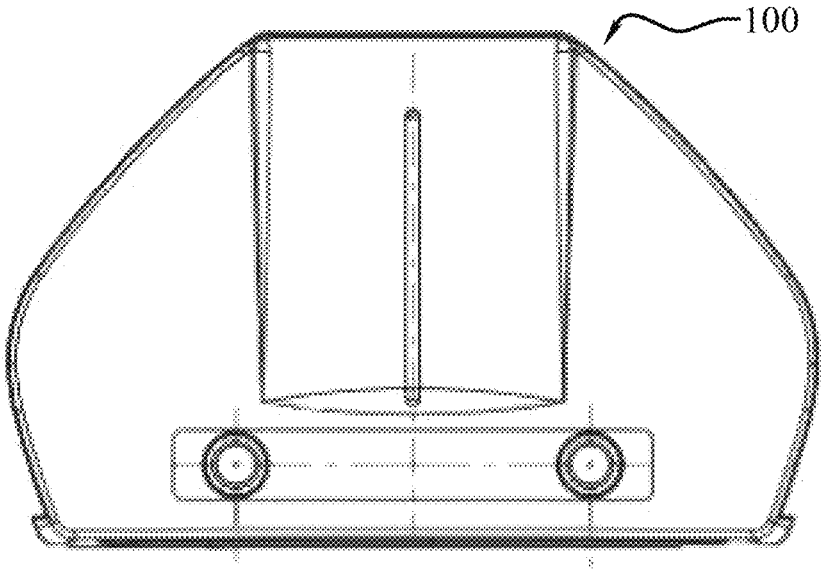
FIG. 47 is a top plan view of an embodiment of a golf putter head whose cross-sectional view is seen in FIG. 46.
Figure 48:
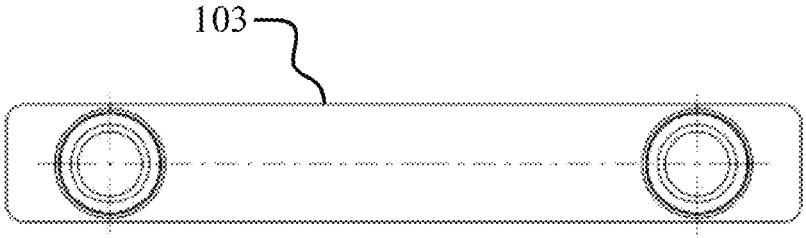
FIG. 48 is top plan view of a hosel receiver for the golf putter head seen in FIG. 47.
Figure 49:
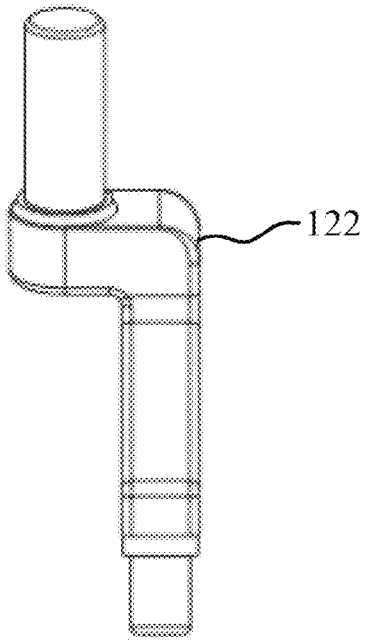
FIG. 49 is a heel side view of a hosel for the golf putter head embodiment seen in FIG. 47.
Figure 50:
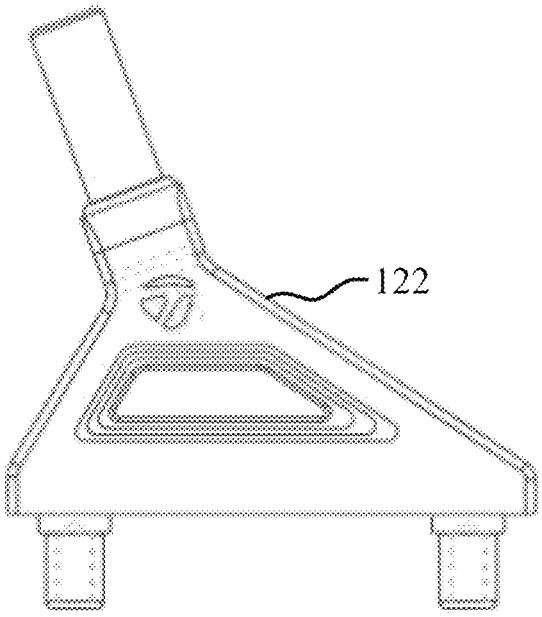
FIG. 50 is a front side view of a hosel for the golf putter head embodiment seen in FIG. 47.
Figure 51:
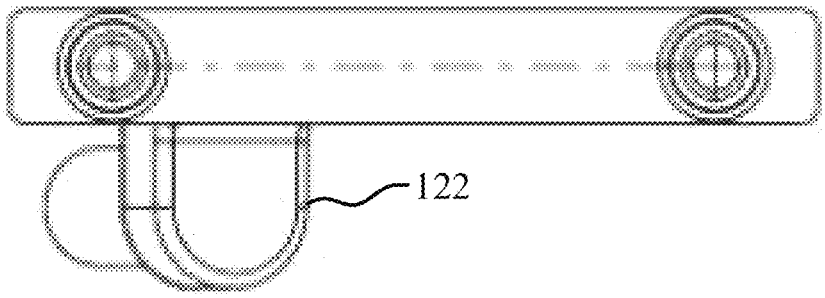
FIG. 51 is a bottom plan view of a hosel for the golf putter head embodiment seen in FIG. 47.
Figure 52:
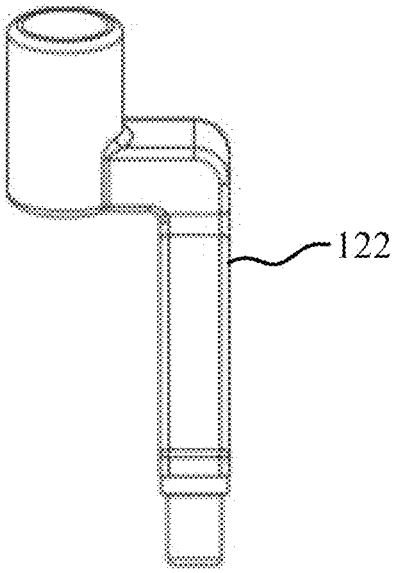
FIG. 52 is a heel side view of an embodiment of golf putter head hosel.
Figure 53:
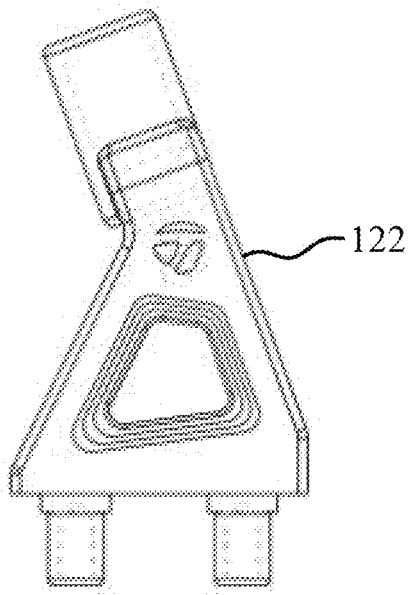
FIG. 53 is a front side view of the embodiment of hosel seen in FIG. 52.
Figure 54:
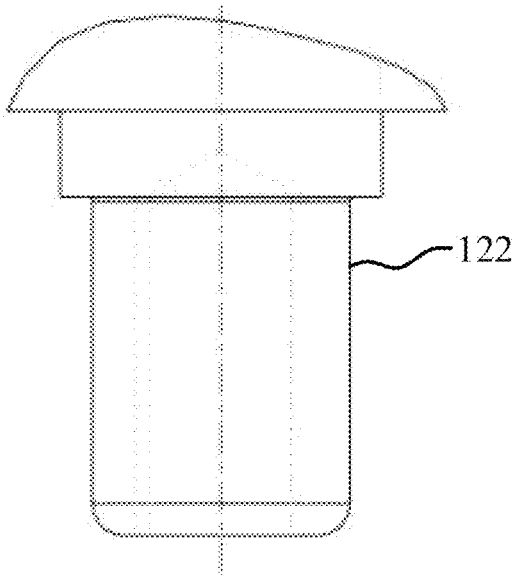
FIG. 54 is a securement post for the golf putter hosel embodiment seen head in FIG. 52.
Figure 55:
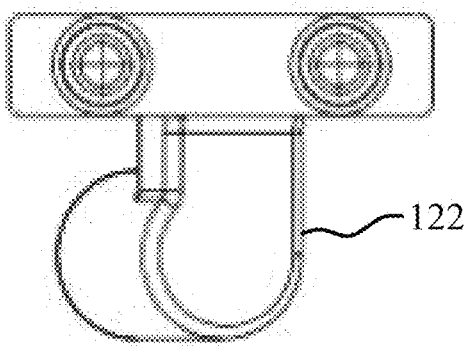
FIG. 55 is a bottom plan view for the golf putter head hosel embodiment seen in FIG. 52.

The bottom plan view of FIG. 2 illustrates an embodiment having a heel track 1100 having a HT longitudinal axis 1130 oriented at a HTLA x-axis angle 1132 from the club head X-axis, and likewise a toc track 1200 having a TT longitudinal axis 1230 oriented at a TTLA x-axis angle 1232 from the club head X-axis. Further, the HT longitudinal axis 1130 is oriented at a HTLA GP angle 1134 with respect to the ground plane GP, as seen in FIGS. 3 and 28, and the TT longitudinal axis 1230 is oriented at a TTLA GP angle 1234 with respect to the ground plane GP, as seen in FIGS. 4 and 29. As seen in FIG. 6, in one embodiment the heel track 1100 has a HT proximal end 1112 nearest the striking face 116, a HT distal end 1114 furthest from the striking face 116, a HT width 1120 measured perpendicular to the HT longitudinal axis 1130, and a HT length 1110 measured parallel to the HT longitudinal axis 1130 from the HT proximal end 1112 to the HT distal end 1114. Likewise, in one embodiment the toe track 1200 has a TT proximal end 1212 nearest the striking face 116, a TT distal end 1214 furthest from the striking face 116, a TT width 1220 measured perpendicular to the TT longitudinal axis 1230, and a TT length 1210 measured parallel to the TT longitudinal axis 1230 from the TT proximal end 1212 to the TT distal end 1214. The disclosure will first address mallet-type putter embodiments configured similar to FIGS. 1-29, while the blade-type embodiments, such as those in FIGS. 61-81 will be addressed later. Further, for easy of explanation and completeness, the disclosure will describe the illustrated embodiments, many of which contain multiple weight assemblies and tracks, however all of the disclosure applies equally to embodiments having a single weight assembly and track, or more than two weight assemblies and tracks. Thus, to be explicit, another embodiment of any of the disclosed embodiments and figures has only one of the heel weight assembly 1300 and the toe weight assembly 1400, and the associated heel track 1100 or toe track 1200. Further, the repositionable weight assembly 1000, and thus a track associated therewith, may be located anywhere on the club head including the top, bottom, and/or sides, and it may be centrally located. Thus the reference to heel track 1100 or toe track 1200 are for convenience only in describing the illustrated embodiments, and heel or toe is not meant to limit the track location to only a heel region or toe region of the putter head 100, however many disclosed embodiments do limit the track location. Additionally, as will later be described with respect to FIG. 117, the track and the repositionable weight assembly 1000 may move from the heel half of the club head across the club head Y-Z plane passing through the origin 128 to the toe half of the club head.

Figure 21:
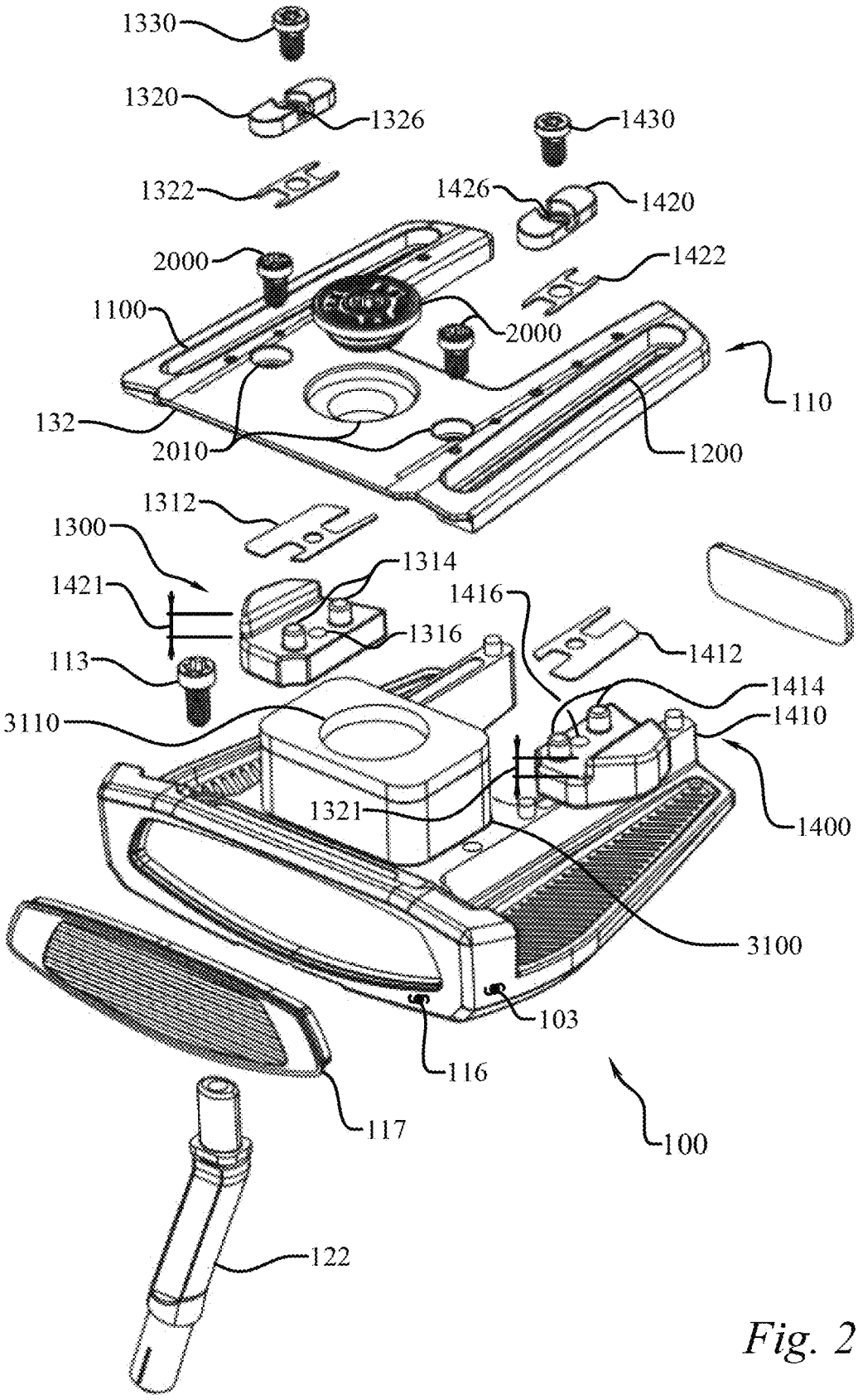
FIG. 21 is an exploded bottom isometric view of an embodiment of golf putter head.
Figure 22:
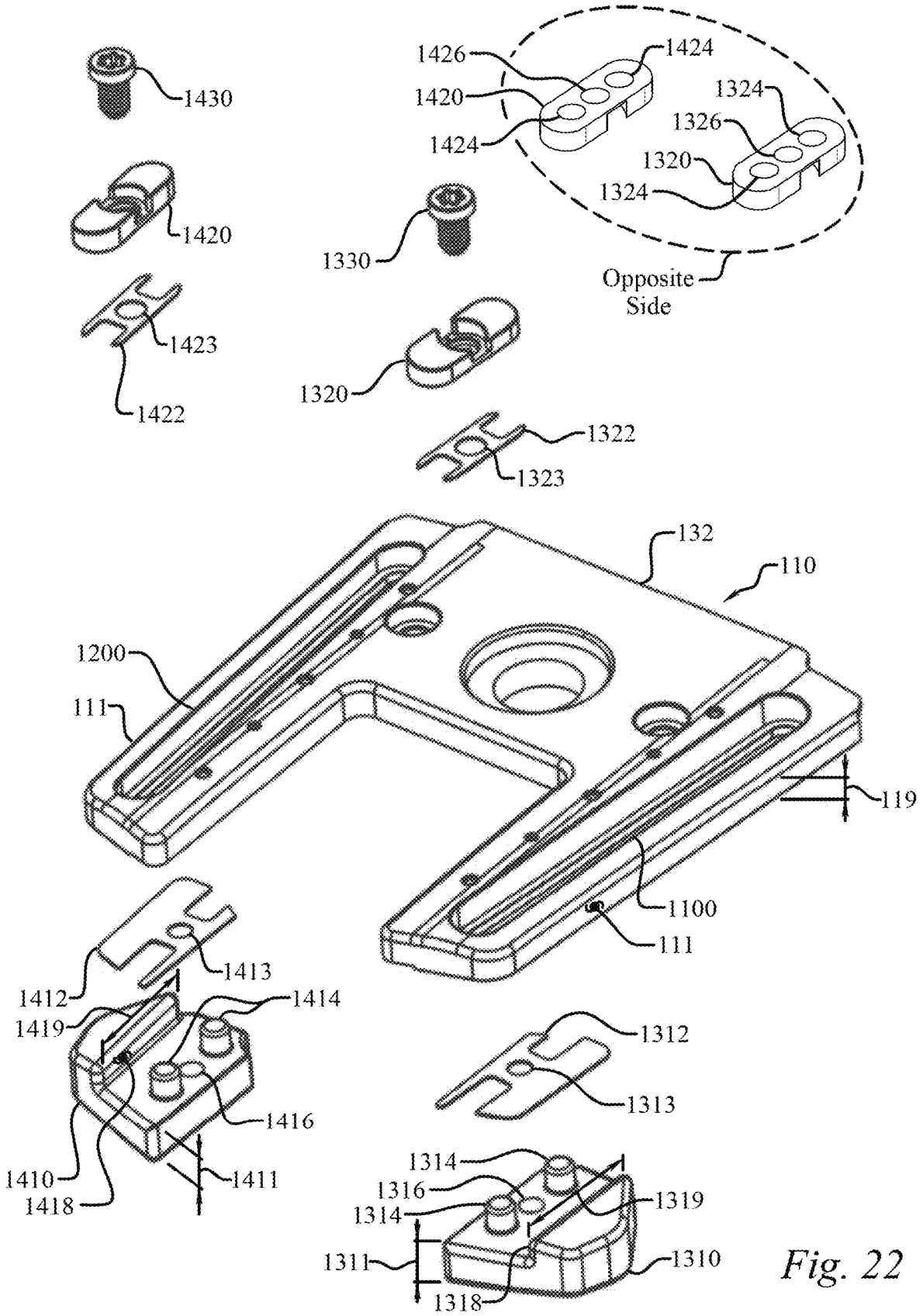
FIG. 22 is an exploded partial bottom isometric view of the embodiment of golf putter head seen in FIG. 21.

As seen in FIGS. 21-22, in one embodiment the heel weight assembly 1300 may include a heel weight portion 1310, a heel washer portion 1320, and a heel weight fastener 1330. In this illustrated embodiment the heel weight fastener 1330 passes through a heel washer portion aperture 1326, seen in FIG. 22, in the heel washer portion 1320, passes through the heel track 1100, and engages a portion of the heel weight portion 1310, specifically a heel weight portion aperture 1316 seen in FIGS. 22 and 121. In this embodiment the heel weight fastener 1330 controls the relative position of the heel washer portion 1320 and the heel weight portion 1310. One embodiment consists of a threaded heel weight fastener 1330 that engages a threaded heel weight portion 1310, which upon tightening reduces the space between the heel washer portion 1320 and the heel weight portion 1310 and clamping the heel weight assembly 1300 to a portion of the heel track 1100. Alternatively, the heel weight assembly 1300 may include a heel weight portion 1310 and a heel weight fastener 1330 whereby the heel weight fastener 1330 passes through the heel weight portion 1310 and a portion of the heel track 1100, and engages another portion of the putter head 100 to secure the heel weight assembly 1300. Thus, a portion of the putter head 100 may have multiple distinct threaded bores to receive a threaded heel weight fastener 1330 and secure the heel weight assembly 1300 at the location of the multiple distinct threaded bores. In an alternative embodiment the bores are not threaded but incorporate a quick-turn locking feature. In a further embodiment the heel weight assembly 1300 may include a heel weight portion 1310, a heel washer portion 1320, and a heel weight fastener 1330, whereby the heel weight fastener 1330 engages one, or both, the heel weight portion 1310 and/or the heel washer portion 1320, and upon tightening of the heel weight fastener 1330 the relative distance between the heel weight portion 1310 and the heel washer portion 1320 increases and thereby secures the heel weight assembly 1300 to the putter head 100. In still another embodiment the heel weight assembly 1300 may include a heel weight portion 1310 and/or a heel washer portion 1320 with an angled cam surface such that rotation of the heel weight portion 1310 and/or a heel washer portion 1320 forces the angled cam surface against a portion of the putter head 100 thereby the heel weight assembly 1300 to the putter head 100.

Figure 93:
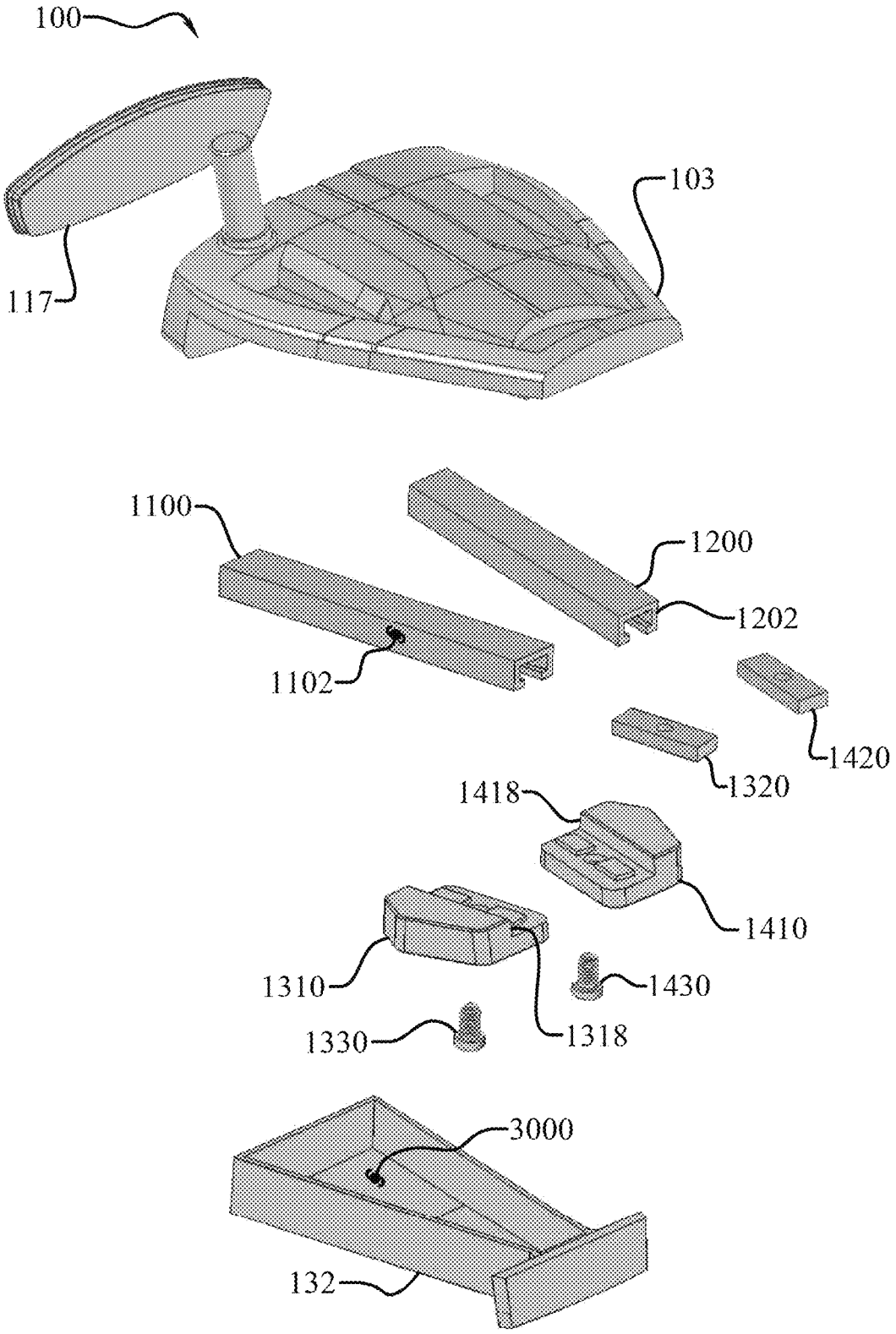
FIG. 93 is an exploded isometric view of the embodiment of golf putter head in FIG. 87.

Thus, in some embodiments the heel weight assembly 1300 may be secured to the putter head 100 at any location along the heel track 1100, while in other embodiments the heel weight assembly 1300 may be secured to the putter head 100 at only discrete locations along the heel track 1100. References to the heel weight portion 1310 and/or the heel washer portion 1320 are for convenience only and only refer to the relative mass of one another with the heel weight portion 1310 having a mass greater than that of the heel washer portion 1320, however in one embodiment they have the same mass. Further, while some embodiments, such as those seen in FIGS. 1-29, have the heel washer portion 1320 located nearer the sole portion 110 and the heel weight portion 1310 located nearer the top portion 112, the locations may be reversed such as illustrated in FIG. 93. The heel weight portion 1310 may include a heel weight portion separation layer 1312, as seen in FIG. 21, attached to the heel weight portion 1310 and/or a portion of the heel track 1100. Likewise, the heel washer portion 1320 may include a heel washer portion separation layer 1322, as seen in FIG. 21, attached to the heel washer portion 1320 and/or a portion of the heel track 1100. In one embodiment the heel weight portion separation layer 1312 and/or the heel washer portion separation layer 1322 is formed of a non-metallic material having a thickness of no more than 1 mm, and in further embodiments no more than 0.9 mm, 0.8 mm, 0.7 mm, 0.6 mm, 0.5 mm, 0.4 mm, or 0.3 mm. In another embodiment the heel weight portion separation layer 1312 and/or the heel washer portion separation layer 1322 have a mass of no more than 0.5 grams, and in further embodiments no more than 0.4 g, 0.3 g, 0.2 g, or 0.1 g. In one embodiment the heel weight portion separation layer 1312 and/or the heel washer portion separation layer 1322 is formed of a plastic polymer, and in a further embodiment is a polyethylene or polytetrafluoroethylene, and in a further embodiment is translucent or transparent, and in yet another embodiment has an adhesion to steel of less than 50 oz/in. As seen in FIG. 22 the heel weight portion separation layer 1312 may incorporate a heel weight portion separation layer aperture 1313 through which a portion of the heel weight fastener 1330 passes, and likewise the heel washer portion separation layer 1322 may incorporate a heel washer portion separation layer aperture 1323 through which a portion of the heel weight fastener 1330 passes.

The heel weight portion 1310 is formed of a heel weight portion material having a heel weight portion density and has a heel weight portion mass, and the heel washer portion 1320 is formed of a heel washer portion material having a heel washer portion density and has a heel washer portion mass. In one embodiment the heel weight portion material is different than the heel washer portion material, while in a further embodiment the heel weight portion density is at least 50% greater than the heel washer portion density, and in further embodiments at least 60%, 70%, 80%, 90%, or 100% greater. In another embodiment the heel weight portion mass is at least 100% greater than the heel washer portion mass, and in further embodiments at least 200%, 400%, 600%, 800%, 1000%, 1200%, 1400%, or 1600% greater. While in another embodiment the heel weight portion mass is no more than 4000% greater than the heel washer portion mass, and in further embodiments no more than 3800%, 3600%, 3400%, 3200%, 3000%, 2800%, 2600%, or 2400% greater. In another embodiment the heel washer portion mass is no more than 20 grams, and in further embodiments no more than 16 grams, 12 grams, 8 grams, 4 grams, or 2 grams. The heel weight portion density is at least 7 g/cc in one embodiment, and at least 9 g/cc, 11 g/cc, 13 g/cc, or 15 g/cc in further embodiments. The heel weight portion mass is at least 20 grams in one embodiment, and in further embodiments at least 24 grams, 28 grams, 32 grams, 36 grams, 40 grams, 44 grams, 48 grams, 52 grams, 56 grams, 60 grams, 64 grams, 68 grams, 72 grams, 76 grams, 80 grams, 84 grams, 88 grams, 92 grams, 96 grams, or 100 grams. In another embodiment the heel weight portion mass is no more than 150 grams in one embodiment, and in further embodiments no more than 140 grams, 130 grams, 120 grams, or 110 grams. In another embodiment the heel weight portion mass is 20-90 grams, and in further embodiments 30-85 grams, 35-80 grams, 40-75 grams, 45-70 grams, or 50-65 grams. The heel weight fastener 1330 is formed of a heel weight fastener material having a heel weight fastener density and has a heel weight fastener mass. In one embodiment the heel weight fastener material is the same as at least one of the heel weight portion material and/or the heel washer portion material. The heel weight fastener mass is less than the heel washer portion mass in one embodiment, while in a further embodiment the heel weight fastener mass is less than 4 grams, and in further embodiments less than 3 grams, 2 grams, or 1 gram. The heel washer portion mass is at least 50% greater than the heel weight fastener mass in one embodiment, and in further embodiments is at least 70%, 80%, 90%, 100%, or 100% greater. In one embodiment the heel washer portion density or the heel weight fastener density is less than 8 g/cc, and in further embodiments less than 5 g/cc, 4 g/cc, or 3 g/cc. Further, the heel weight assembly 1300 has a total heel weight assembly mass of at least 20 grams in one embodiment, and in further embodiments at least 24 grams, 28 grams, 32 grams, 36 grams, 40 grams, 44 grams, 48 grams, 52 grams, 56 grams, 60 grams, 64 grams, 68 grams, 72 grams, 76 grams, 80 grams, 84 grams, 88 grams, 92 grams, 96 grams, or 100 grams. In another embodiment the heel weight assembly 1300 mass is no more than 150 grams in one embodiment, and in further embodiments no more than 140 grams, 130 grams, 120 grams, or 110 grams. In another embodiment the heel weight assembly 1300 mass is 20-90 grams, and in further embodiments 30-85 grams, 35-80 grams, 40-75 grams, 45-70 grams, or 50-65 grams. The heel weight assembly 1300 has a total heel weight assembly mass of less than 35% of a total putter head mass in one embodiment, and in further embodiments no more than 32.5%, 30%, 27.5%, 25%, 22.5%, 20%, or 17.5%. The heel weight assembly 1300 has a total heel weight assembly mass of at least 5% of a total putter head mass in one embodiment, and in further embodiments at least 6%, 7%, 8%, 9%, 10%, 11%, or 12%. The components of the heel weight assembly 1300 and their associated locations, size, mass, density, and associated relationships significantly impact the heel weight assembly CGh location and corresponding moments of inertia of the putter head 100.

Similarly, as seen in FIGS. 21-22, in one embodiment the toc weight assembly 1400 may include a toe weight portion 1410, a toe washer portion 1420, and a toe weight fastener 1430. In this embodiment the illustrated embodiment the toc weight fastener 1430 passes through a toc washer portion aperture 1426, seen in FIG. 22, in the toc washer portion 1420, passes through the toc track 1200, and engages a portion of the toe weight portion 1410, specifically a toe weight portion aperture 1416 seen in FIGS. 22, 120, and 121. In this embodiment the toe weight fastener 1430 controls the relative position of the toe washer portion 1420 and the toe weight portion 1410. One embodiment consists of a threaded toe weight fastener 1430 that engages a threaded toe weight portion 1410, which upon tightening reduces the space between the toe washer portion 1420 and the toe weight portion 1410 and clamping the toe weight assembly 1400 to a portion of the toe track 1200. Alternatively, the toe weight assembly 1400 may include a toc weight portion 1410 and a toe weight fastener 1430 whereby the toe weight fastener 1430 passes through the toe weight portion 1410 and a portion of the toe track 1200, and engages another portion of the putter head 100 to secure the toe weight assembly 1400. Thus, a portion of the putter head 100 may have multiple distinct threaded bores to receive a threaded toe weight fastener 1430 and secure the toc weight assembly 1400 at the location of the multiple distinct threaded bores. In an alternative embodiment the bores are not threaded but incorporate a quick-turn locking feature. In a further embodiment the toe weight assembly 1400 may include a toc weight portion 1410, a toe washer portion 1420, and a toe weight fastener 1430, whereby the toc weight fastener 1430 engages one, or both, the toe weight portion 1410 and/or the toe washer portion 1420, and upon tightening of the toe weight fastener 1430 the relative distance between the toc weight portion 1410 and the toe washer portion 1420 increases and thereby secures the toe weight assembly 1400 to the putter head 100. In still another embodiment the toe weight assembly 1400 may include a toe weight portion 1410 and/or a toe washer portion 1420 with an angled cam surface such that rotation of the toe weight portion 1410 and/or a toe washer portion 1420 forces the angled cam surface against a portion of the putter head 100 thereby the toc weight assembly 1400 to the putter head 100.

Thus, in some embodiments the toc weight assembly 1400 may be secured to the putter head 100 at any location along the toe track 1200, while in other embodiments the toe weight assembly 1400 may be secured to the putter head 100 at only discrete locations along the toc track 1200. References to the toc weight portion 1410 and/or the toe washer portion 1420 are for convenience only and only refer to the relative mass of one another with the toe weight portion 1410 having a mass greater than that of the toe washer portion 1420, however in one embodiment they have the same mass. Further, while some embodiments, such as those seen in FIGS. 1-29, have the toe washer portion 1420 located nearer the sole portion 110 and the toe weight portion 1410 located nearer the top portion 112, the locations may be reversed such as illustrated in FIG. 93. The toe weight portion 1410 may include a toe weight portion separation layer 1412, as seen in FIG. 21, attached to the toe weight portion 1410 and/or a portion of the toe track 1200. Likewise, the toe washer portion 1420 may include a toe washer portion separation layer 1422, as seen in FIG. 21, attached to the toe washer portion 1420 and/or a portion of the toc track 1200. In one embodiment the toe weight portion separation layer 1412 and/or the toc washer portion separation layer 1422 is formed of a non-metallic material having a thickness of no more than 1 mm, and in further embodiments no more than 0.9 mm, 0.8 mm, 0.7 mm, 0.6 mm, 0.5 mm, 0.4 mm, or 0.3 mm. In another embodiment the toe weight portion separation layer 1412 and/or the toe washer portion separation layer 1422 have a mass of no more than 0.5 grams, and in further embodiments no more than 0.4 g, 0.3 g, 0.2 g, or 0.1 g. In one embodiment the toe weight portion separation layer 1412 and/or the toe washer portion separation layer 1422 is formed of a plastic polymer, and in a further embodiment is a polyethylene or polytetrafluoroethylene, and in a further embodiment is translucent or transparent, and in yet another embodiment has an adhesion to steel of less than 50 oz/in. As seen in FIG. 22 the toc weight portion separation layer 1412 may incorporate a toe weight portion separation layer aperture 1413 through which a portion of the toe weight fastener 1430 passes, and likewise the the toe washer portion separation layer 1422 may incorporate a toe washer portion separation layer aperture 1423 through which a portion of the toe weight fastener 1430 passes.

The toe weight portion 1410 is formed of a toe weight portion material having a toc weight portion density and has a toe weight portion mass, and the toe washer portion 1420 is formed of a toe washer portion material having a toc washer portion density and has a toe washer portion mass. In one embodiment the toe weight portion material is different than the toe washer portion material, while in a further embodiment the toe weight portion density is at least 50% greater than the toe washer portion density, and in further embodiments at least 60%, 70%, 80%, 90%, or 100% greater. In another embodiment the toe weight portion mass is at least 100% greater than the toe washer portion mass, and in further embodiments at least 200%, 400%, 600%, 800%, 1000%, 1200%, 1400%, or 1600% greater. While in another embodiment the toc weight portion mass is no more than 4000% greater than the toe washer portion mass, and in further embodiments no more than 3800%, 3600%, 3400%, 3200%, 3000%, 2800%, 2600%, or 2400% greater. In another embodiment the toe washer portion mass is no more than 20 grams, and in further embodiments no more than 16 grams, 12 grams, 8 grams, 4 grams, or 2 grams. The toc weight portion density is at least 7 g/cc in one embodiment, and at least 9 g/cc, 11 g/cc, 13 g/cc, or 15 g/cc in further embodiments. The toe weight portion mass is at least 20 grams in one embodiment, and in further embodiments at least 24 grams, 28 grams, 32 grams, 36 grams, 40 grams, 44 grams, 48 grams, 52 grams, 56 grams, 60 grams, 64 grams, 68 grams, 72 grams, 76 grams, 80 grams, 84 grams, 88 grams, 92 grams, 96 grams, or 100 grams. In another embodiment the toe weight portion mass is no more than 150 grams in one embodiment, and in further embodiments no more than 140 grams, 130 grams, 120 grams, or 110 grams. In another embodiment the toe weight portion mass is 20-90 grams, and in further embodiments 30-85 grams, 35-80 grams, 40-75 grams, 45-70 grams, or 50-65 grams. The toe weight fastener 1430 is formed of a toe weight fastener material having a toe weight fastener density and has a toe weight fastener mass. In one embodiment the toe weight fastener material is the same as at least one of the toe weight portion material and/or the toe washer portion material. The toe weight fastener mass is less than the toe washer portion mass in one embodiment, while in a further embodiment the toe weight fastener mass is less than 4 grams, and in further embodiments less than 3 grams, 2 grams, or 1 gram. The toe washer portion mass is at least 50% greater than the toe weight fastener mass in one embodiment, and in further embodiments is at least 70%, 80%, 90%, 100%, or 100% greater. In one embodiment the toe washer portion density or the toe weight fastener density is less than 8 g/cc, and in further embodiments less than 5 g/cc, 4 g/cc, or 3 g/cc. Further, the toe weight assembly 1400 has a total toe weight assembly mass of at least 20 grams in one embodiment, and in further embodiments at least 24 grams, 28 grams, 32 grams, 36 grams, 40 grams, 44 grams, 48 grams, 52 grams, 56 grams, 60 grams, 64 grams, 68 grams, 72 grams, 76 grams, 80 grams, 84 grams, 88 grams, 92 grams, 96 grams, or 100 grams. In another embodiment the toe weight assembly 1400 mass is no more than 150 grams in one embodiment, and in further embodiments no more than 140 grams, 130 grams, 120 grams, or 110 grams. In another embodiment the toe weight assembly 1400 mass is 20-90 grams, and in further embodiments 30-85 grams, 35-80 grams, 40-75 grams, 45-70 grams, or 50-65 grams. The toc weight assembly 1400 has a total heel weight assembly mass of less than 35% of a total putter head mass in one embodiment, and in further embodiments no more than 32.5%, 30%, 27.5%, 25%, 22.5%, 20%, or 17.5%. The toe weight assembly 1400 has a total toe weight assembly mass of at least 5% of a total putter head mass in one embodiment, and in further embodiments at least 6%, 7%, 8%, 9%, 10%, 11%, or 12%. The components of the toe weight assembly 1400 and their associated locations, size, mass, density, and associated relationships significantly impact the toe weight assembly CGt location and corresponding moments of inertia of the putter head 100.

In further embodiments the heel weight assembly 1300 and/or the toe weight assembly 1400 may be multi-material construction. For example in one embodiment the heel weight portion 1310 and/or the toe weight portion 1410 may be primarily constructed of non-metallic material with high-density material attached to, embedded in, or mixed with the non-metallic material.

The putter head 100 has an overall club head mass that is at least 330 grams in one embodiment, and at least 340 grams, 350 grams, and 360 grams in additional embodiments. In another series of embodiments the overall club head mass is no more than 435 grams, and in further embodiments no more than 425 grams, 415 grams, 405 grams, 395 grams, or 385 grams. The putter head 100 is attached to a putter shaft having a golf grip, thereby creating a putter having a putter length as defined by "The Equipment Rules" by The R&A and USGA, First Edition, Effective Jan. 1, 2019. In one embodiment the putter length is at least 32", and in further embodiments at least 33", 34", or 35". In a further embodiment the putter length is no more than 37", and in further embodiments no more than 36.5", 36", or 35.5". In a further embodiment the putter is counter balanced with a grip weight, shaft weight, weighted grip, and/or weighted shaft, adding a counter balance mass to the putter, and in such embodiments an additional 50-70 grams may be added to the disclosed overall club head masses. In one embodiment the counter balance mass is at least 25 grams, and in further embodiments at least 40 grams, 55 grams, or 70 grams. In another embodiment the counter balance mass is no more than 150 grams, and in further embodiments no more than 130 grams, 110 grams, or 80 grams.

The one or more repositionable weight assemblies 1000, whether it includes a heel weight assembly 1300 and/or a toe weight assembly 1400, as seen in FIGS. 1-4, or additional repositionable weight assemblies 1000, has a total repositionable mass. The term "heel" in heel weight assembly 1300 and the term "toe" in toe weight assembly are used for convenience and any reference herein to heel weight assembly 1300 is interchangeable with first weight assembly 1300, and any reference herein to toe weight assembly 1400 is interchangeable with second weight assembly 1400, or alternatively the heel weight assembly 1300 is interchangeable with second weight assembly 1300, and any reference to toe weight assembly 1400 is interchangeable with first weight assembly 1400. In one embodiment the total repositionable mass is at least 20% of the overall club head mass, and in further embodiments at least 22.5%, 25%, 27.5%, 30%, 32.5%, 35%, 37.5%, 40%, 42.5%, 45%, 47.5%, 50%, 52.5%, or 55%. In a further embodiment the total repositionable mass is no more than 80% of the overall club head mass, and in further embodiments no more than 75%, 70%, 65%, or 60%. In one embodiment, the toe half of the club head has a toe half repositionable mass that is at least 10% of the overall club head mass, and in further embodiments at least 12%, 14%, 16%, 18%, 20%, 22%, 24% or 26%. In a further embodiment the toc half repositionable mass is no more than 40% of the overall club head mass, and in further embodiments no more than 38%, 36%, 34%, 32%, 30%, or 28%. Similarly, the heel half of the club head has a heel half repositionable mass that is at least 10% of the overall club head mass in one embodiment, and in further embodiments at least 12%, 14%, 16%, 18%, 20%, 22%, 24% or 26%. In a further embodiment the heel half repositionable mass is no more than 40% of the overall club head mass, and in further embodiments no more than 38%, 36%, 34%, 32%, 30%, or 28%.

As seen in FIGS. 21-22, the heel weight portion 1310 may have at least one heel weight portion projection 1314 configured to extend through at least a portion of the heel track 1100 and engage at least one heel washer portion receptacle 1324 in the heel washer portion 1320. Alternatively or in addition to, not shown but easily understood, the heel washer portion 1320 may have at least one heel washer portion projection configured to extend through at least a portion of the heel track 1100 and engage at least one heel weight portion receptacle in the heel weight portion 1310. The heel weight portion 1310 has a heel weight portion center of gravity CGhwgt, which establishes X, Y, and Z axis passing through the heel weight portion center of gravity CGhwgt when installed in the putter head 100 and oriented as disclosed with respect the overall heel weight assembly CGh, thereby facilitating the disclosure of the location of aspects of the heel weight portion 1310 with respect to its own center of gravity. For instance in one embodiment the at least one heel weight portion projection 1314 is heel projection offset an offset distance from the heel weight portion center of gravity CGhwgt, and thus a longitudinal axis of the heel weight portion projection 1314 is not aligned with a Z-axis passing through the heel weight portion center of gravity CGhwgt; and in further embodiments the heel projection offset distance is at least 1 mm, 2 mm, 3 mm, 4 mm, or 5 mm. Similarly in another embodiment the heel weight portion aperture 1316 is offset a heel aperture offset distance from the heel weight portion center of gravity CGhwgt, and thus a longitudinal axis of the heel weight portion aperture 1316 is not aligned with the Z-axis passing through the heel weight portion center of gravity CGhwgt; and in further embodiments the heel aperture offset distance is at least 1 mm, 2 mm, 3 mm, 4 mm, or 5 mm. One embodiment includes two heel weight portion projections 1314 on opposite sides of the heel weight portion aperture 1316, and in a further embodiment the two heel weight portion projections 1314 are equally spaced apart from the heel weight portion aperture 1316. Such features play a significant role in increasing durability and limiting rotation and/or binding of the heel weight assembly 1300 as it is repositioned.

Figure 87:
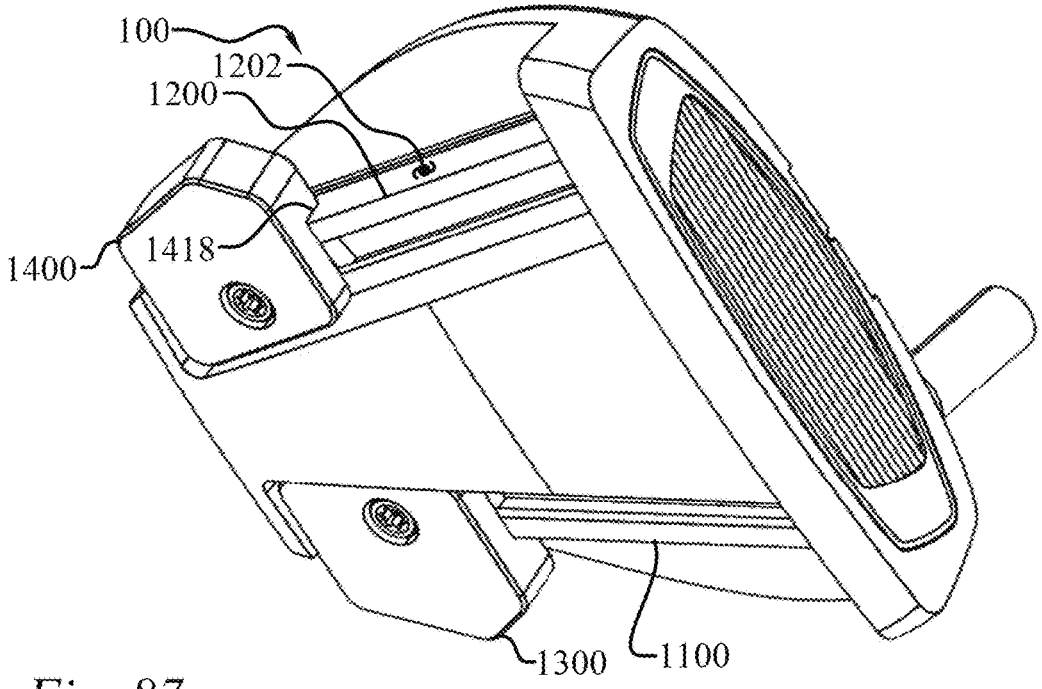
FIG. 87 is an isometric view of another golf putter head embodiment.
Figure 88:
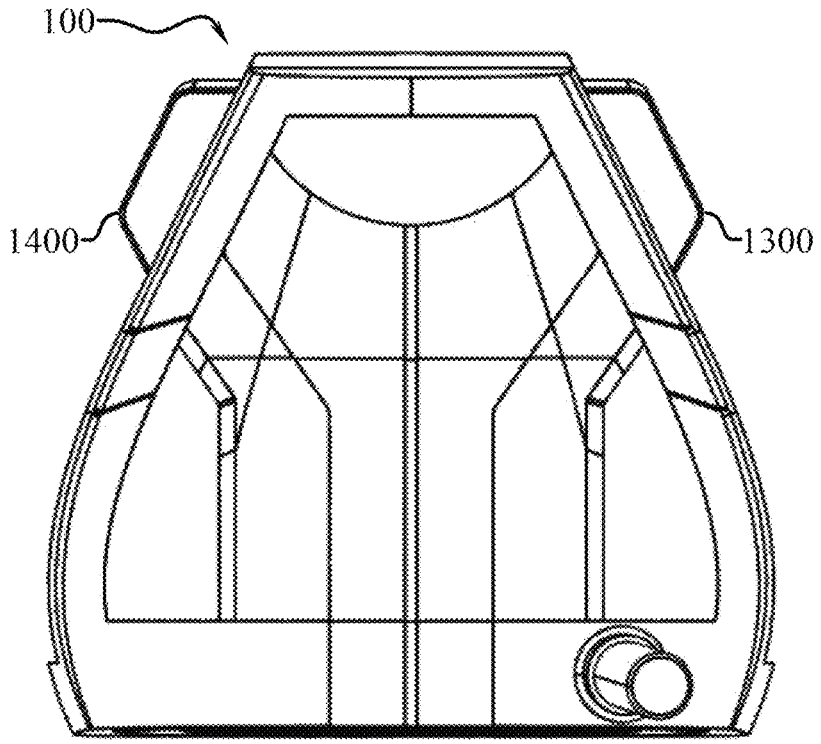
FIG. 88 is a top plan view of the golf putter head embodiment seen in FIG. 87.
Figure 89:
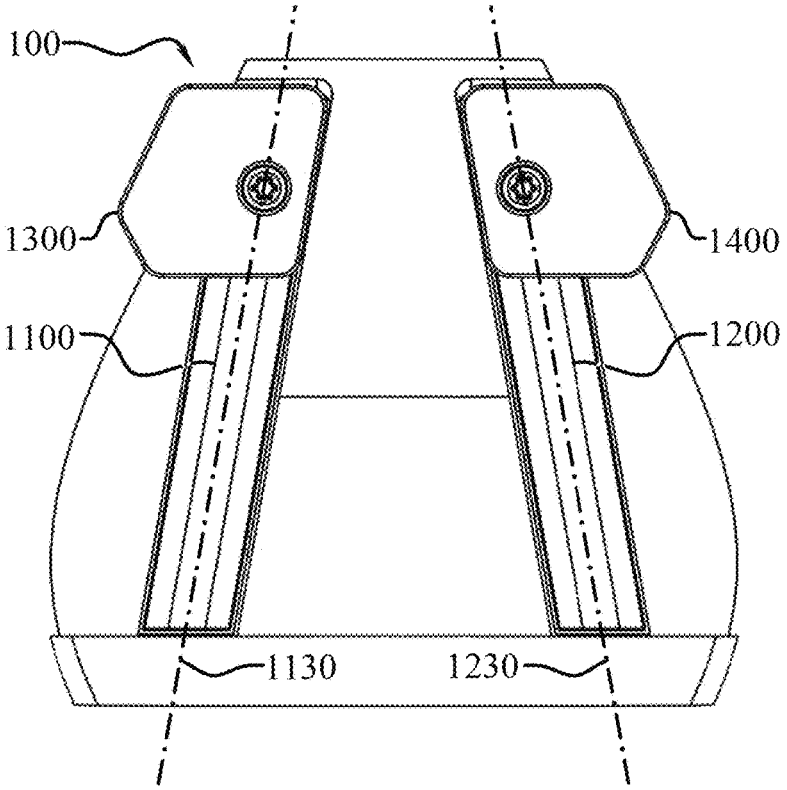
FIG. 89 is a bottom plan view of the golf putter head embodiment seen in FIG. 87.
Figure 90:
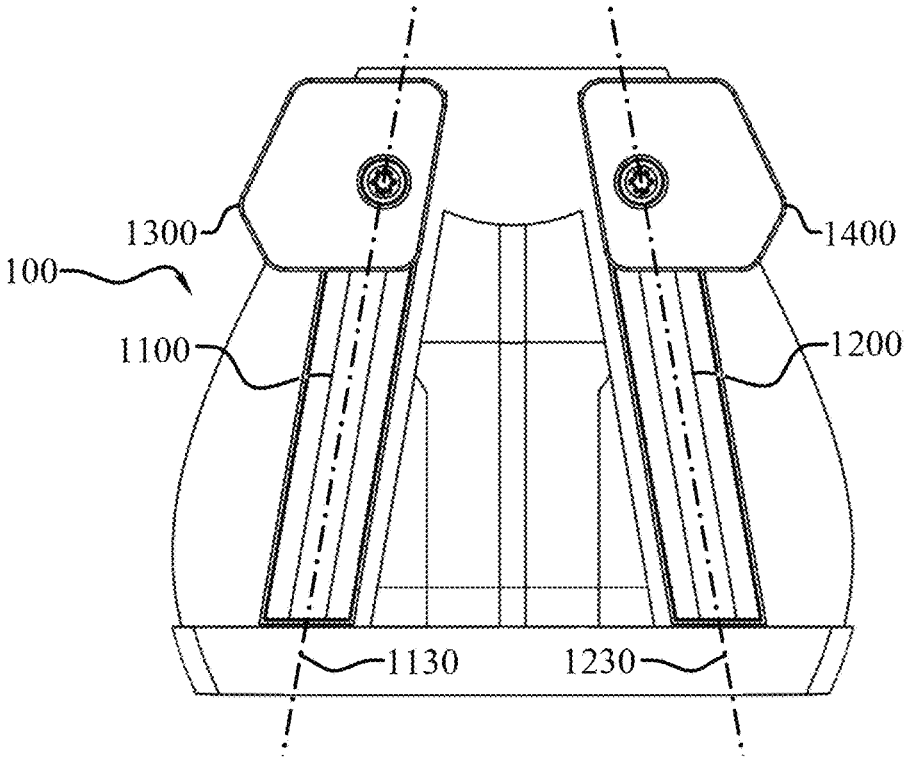
FIG. 90 is a bottom plan view of another golf putter head embodiment.
Figure 91:
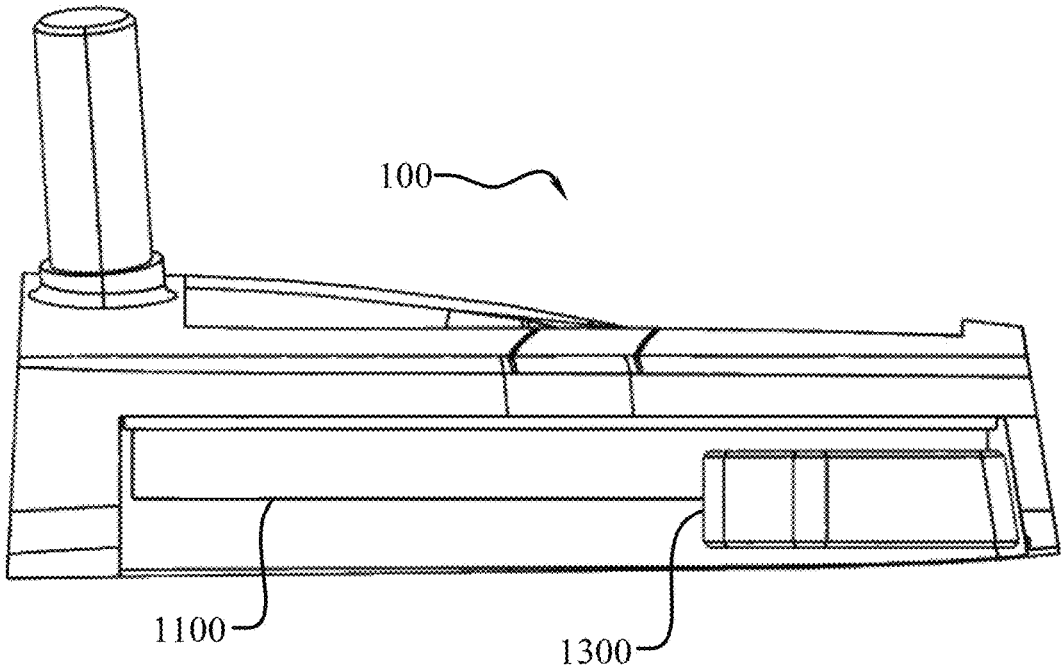
FIG. 91 is a heel side view of the golf putter head embodiment seen in FIG. 90.
Figure 92:
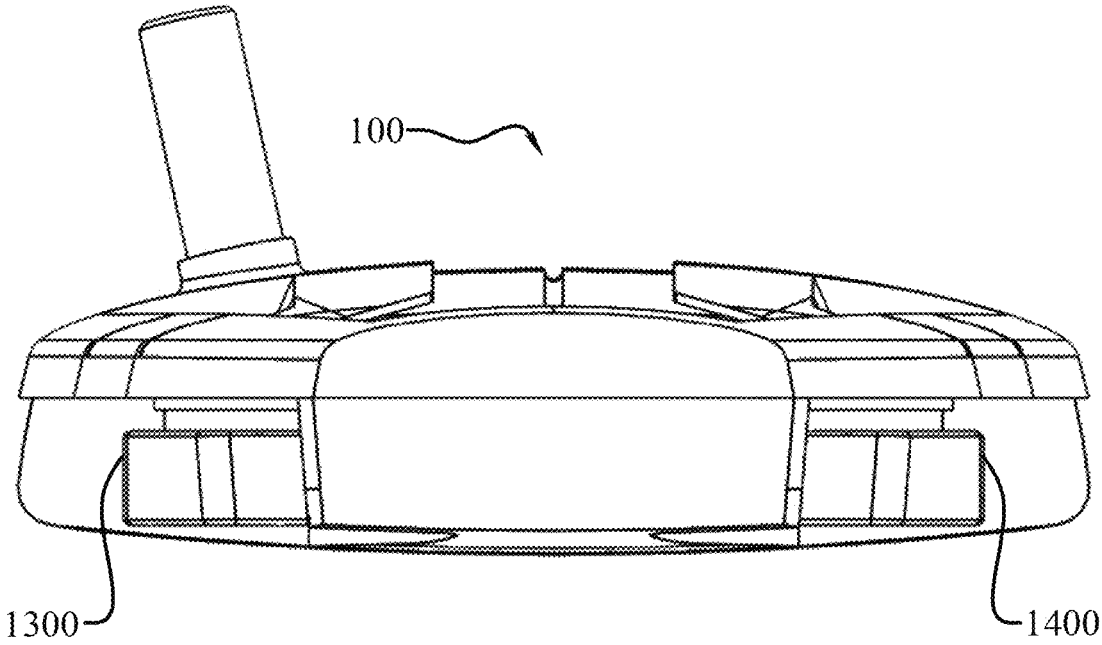
FIG. 92 is a rear side view of the golf putter head embodiment seen in FIG. 90.
Figure 94:
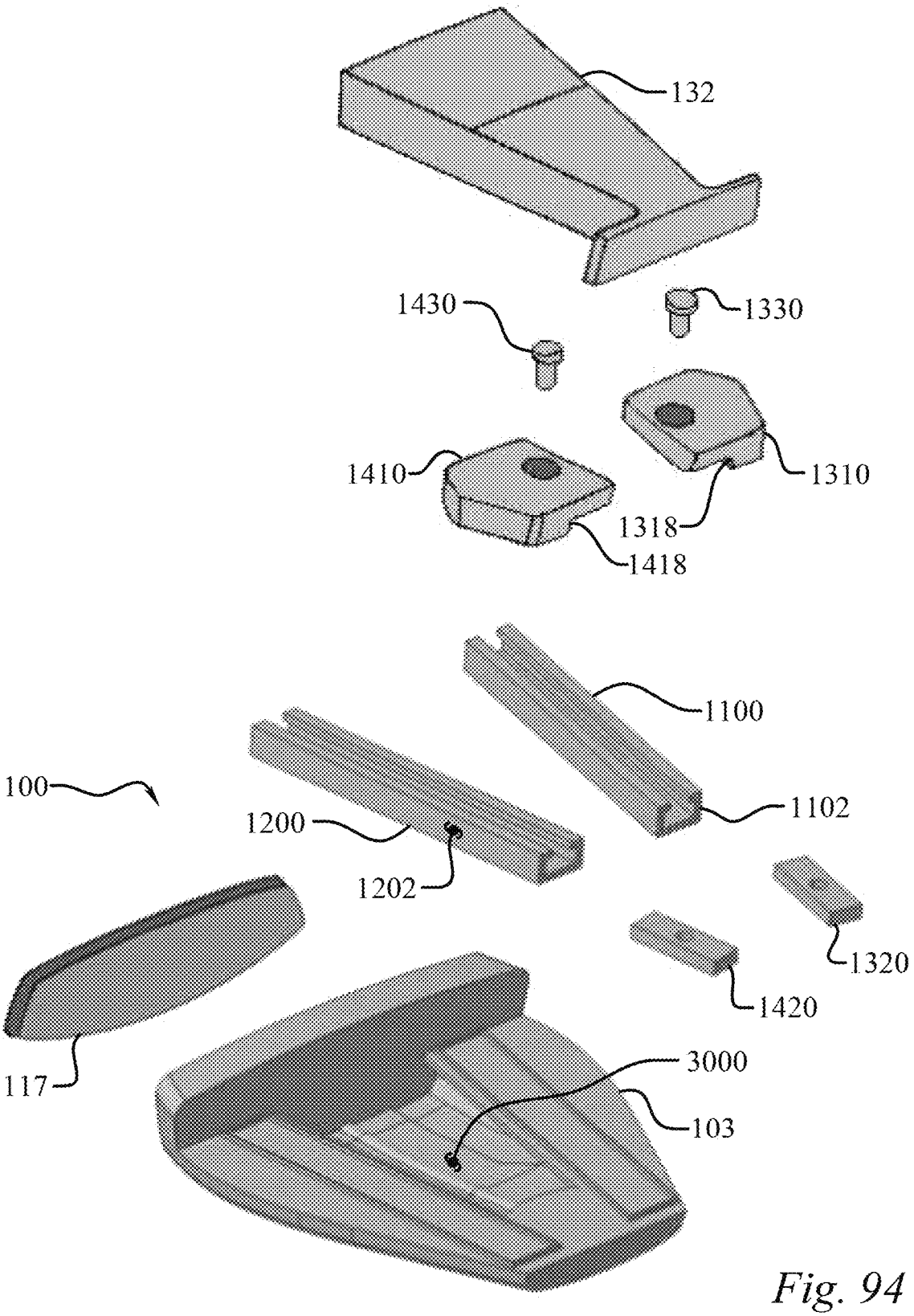
FIG. 94 is another exploded isometric view of the golf putter head embodiment seen in FIG. 87.
Figure 95A:
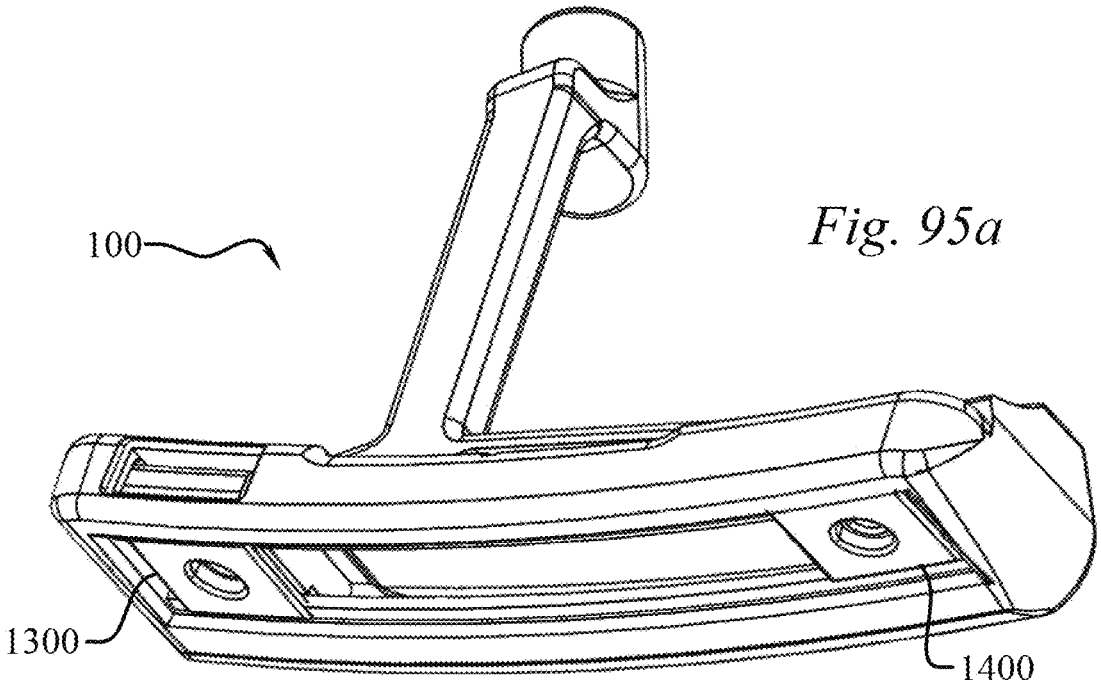
FIG. 95*a* is an isometric view of another golf putter head embodiment.
Figure 95B:
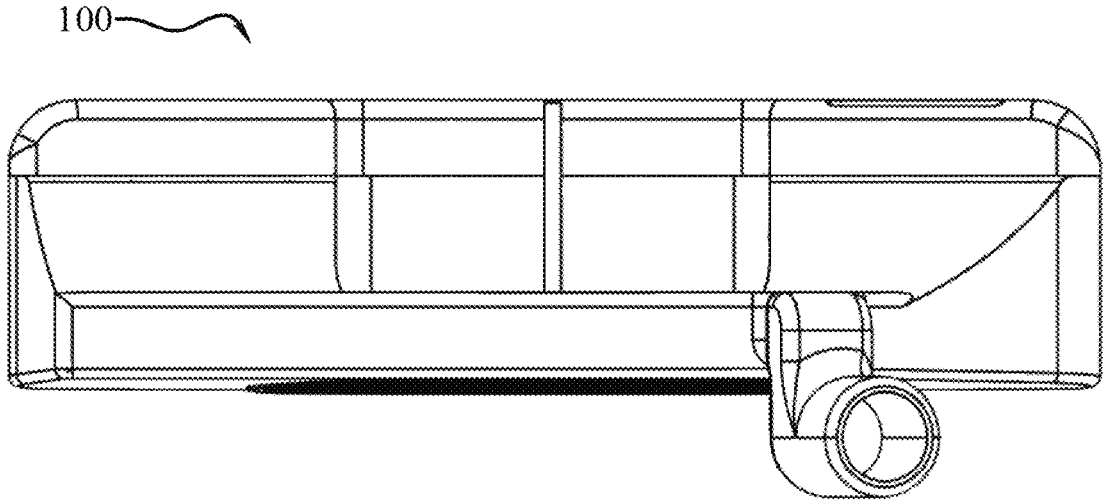
FIG. 95*b* is a top plan view of the golf putter head embodiment seen in FIG. 95*a;*
Figure 96:
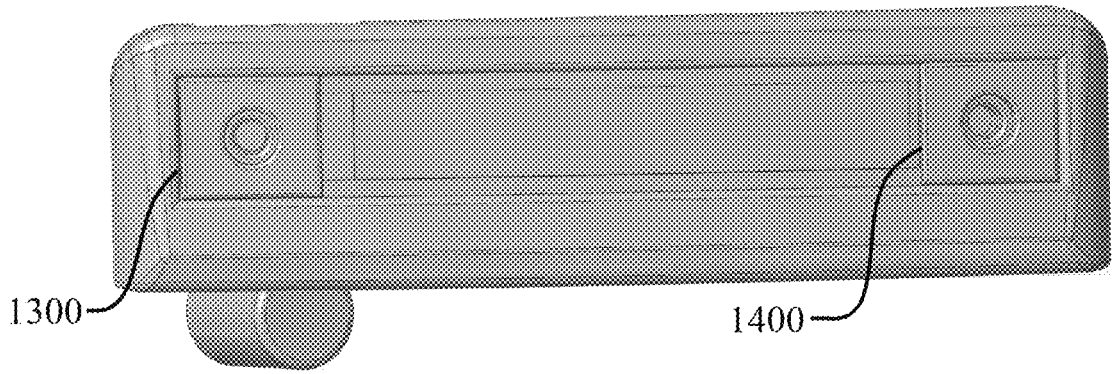
FIG. 96 is a bottom plan view of the golf putter head embodiment seen in FIG. 95*a;*
Figure 97:
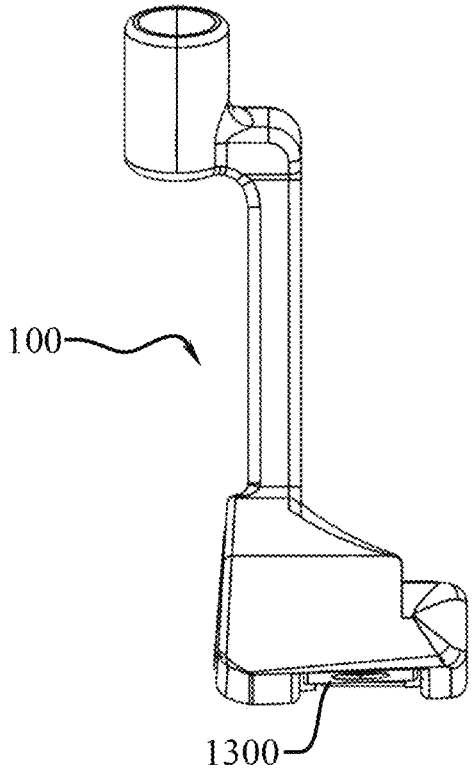
FIG. 97 is a heel side view of the golf putter head embodiment seen in FIG. 95*a;*
Figure 98:
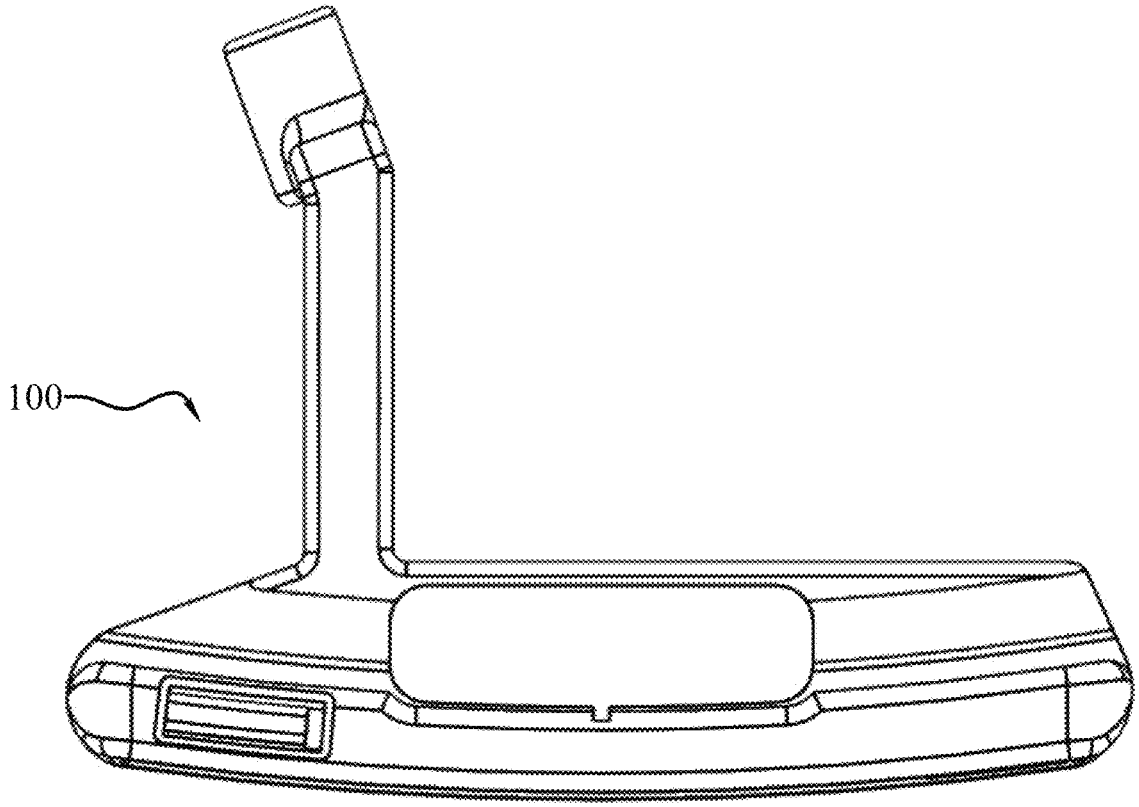
FIG. 98 is a rear side view of the golf putter head embodiment seen in FIG. 95*a;*
Figure 99:
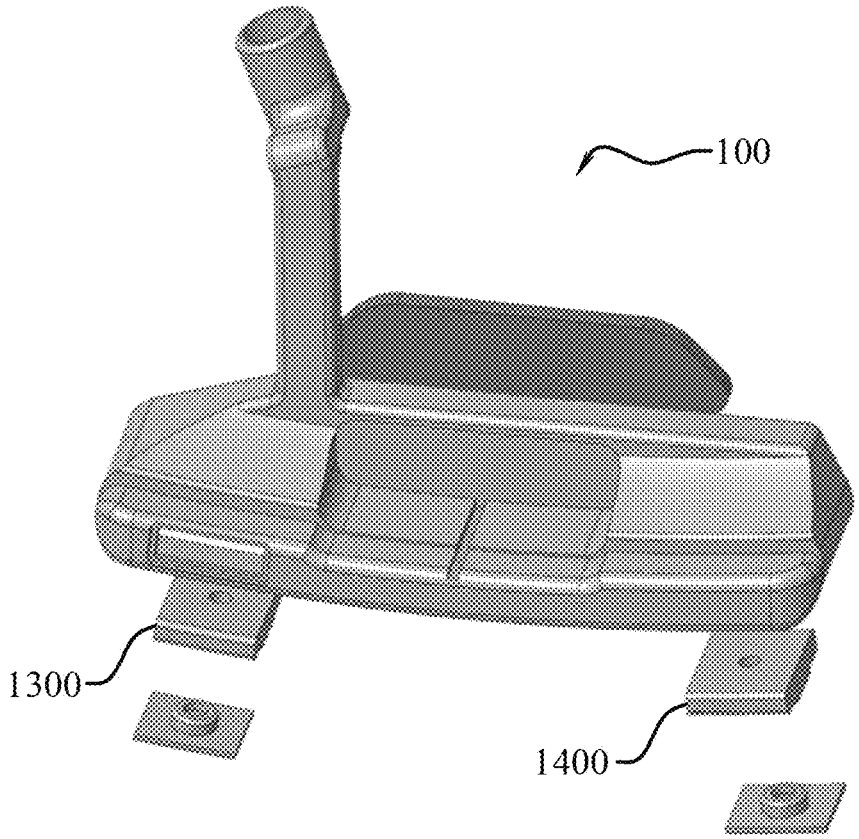
FIG. 99 is an exploded isometric view of the golf putter head embodiment seen in FIG. 95*a;*
Figure 100:
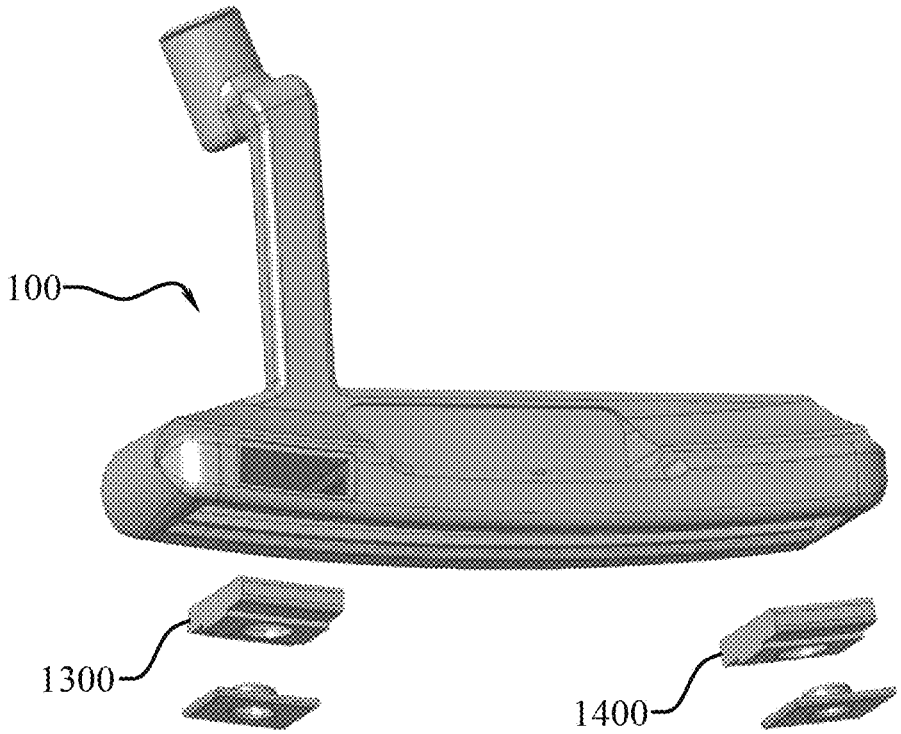
FIG. 100 is another exploded isometric view of the golf putter head embodiment seen in FIG. 95*a;*
Figure 101:
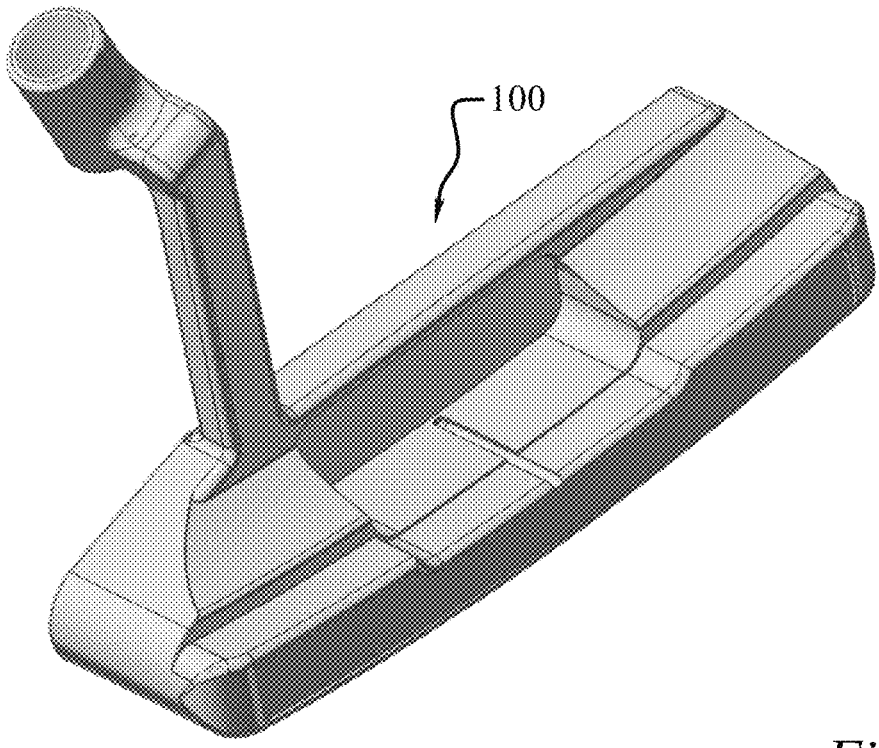
FIG. 101 is an isometric view of another golf putter head embodiment.
Figure 102:
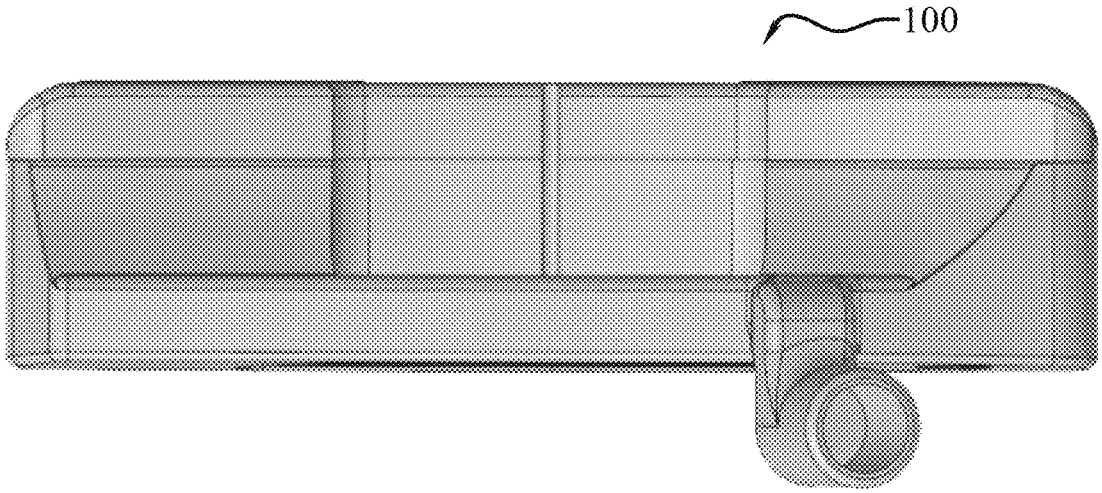
FIG. 102 is a top plan view of the golf putter head embodiment seen in FIG. 101.
Figure 103:
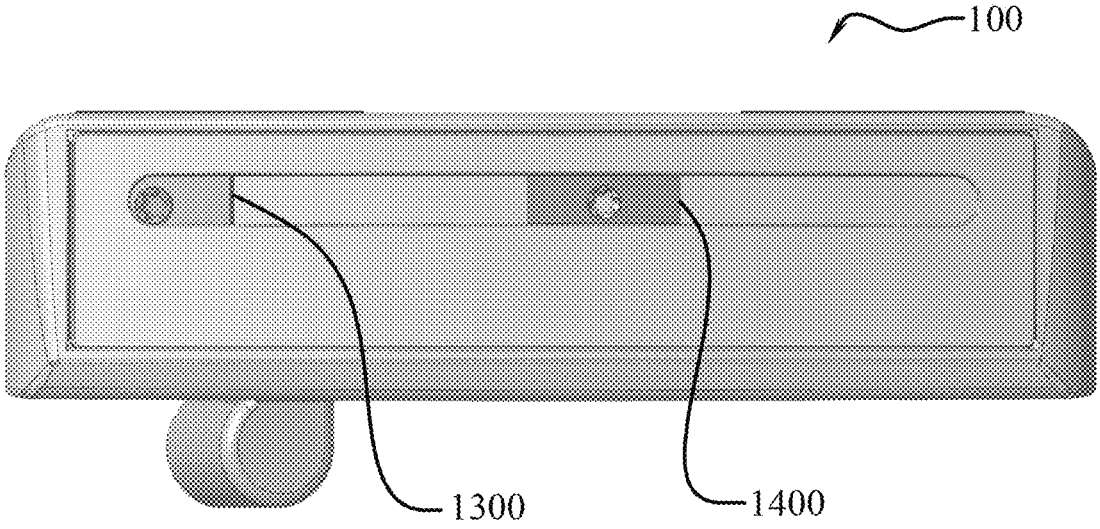
FIG. 103 is a bottom plan view of the golf putter head embodiment seen in FIG. 101.

The heel weight portion 1310 has a heel weight portion thickness 1311, seen in FIG. 22, and measured parallel to the CGh Z-axis. In the illustrated embodiment the heel weight portion thickness 1311 varies from a minimum thickness to a maximum thickness, whereby the maximum thickness is at least 20% greater than the minimum thickness, and in further embodiments at least 30%, 40%, 50%, or 60% greater. In another embodiment the maximum thickness is less than 300% greater than the minimum thickness, and in further embodiments less than 250%, 225%, 200%, 175%, 150%, 125%, or 100% greater. The variable heel weight portion thickness 1311 forms a heel weight portion guide-wall 1318 designed to abut a portion of a sole sidewall 111, seen in FIG. 22, in one embodiment, and/or abut a portion of the heel track 1100, or heel track sidewall 1102, as seen in FIGS. 93, 94, and 87. The heel weight portion guide-wall 1318 has a heel guide-wall length 1319, measured parallel to the HT longitudinal axis 1130, that is at least 200% of the minimum heel weight portion thickness 1311, and in further embodiments at least 250%, 300%, or 350%; while in a another embodiment the heel guide-wall length 1319 is no more than 1000% of the minimum heel weight portion thickness 1311, and in further embodiments is no more than 900%, 800%, 700%, or 600%. A separation distance between the heel weight portion guide-wall 1318 and a nearest point on the heel weight portion projection 1314 is greater than the minimum heel weight portion thickness 1311, and in further embodiments at least 10%, 15%, 20%, or 25% greater; while in an additional embodiment the separation distance is no more than 300% of the minimum heel weight portion thickness 1311, and in further embodiments no more than 275%, 250%, 225%, 200%, or 175%. The heel weight portion projection 1314 projects from the adjacent surface a projection distance that is at least 50% of the minimum heel weight portion thickness 1311 in one embodiment, and at least 60%, 70%, 80%, and 90% in further embodiments; while the projection distance is no more than 250% of the minimum heel weight portion thickness 1311 in one embodiment, and no more than 225%, 200%, 175%, 150%, or 125% in further embodiments. The heel weight portion projection 1314 extends beyond the heel weight portion guide-wall 1318 in one embodiment, while in an alternative embodiment the heel weight portion projection 1314 does not project beyond the heel weight portion guide-wall 1318. The heel weight portion guide-wall 1318 has a heel weight portion guide-wall height 1321, seen in FIG. 21, and thus in one embodiment the projection distance is less than the heel weight portion guide-wall height 1321, while in another embodiment the projection distance is greater than the heel weight portion guide-wall height 1321, while in another embodiment they are equal. The illustrated heel weight portion projection 1314 has a round cross-sectional shape, however it may be triangular, square, rectangular, or composed of straight segments, curved segments, or a combination thereof; regardless of the cross-sectional shape the heel weight portion projection 1314 has a maximum cross-sectional dimension, which in the illustrated embodiment is a diameter. In one embodiment the maximum cross-sectional dimension is at least 2 mm, 3 mm, or 4 mm, while in further embodiments it is no more than 15 mm, 13 mm, 11 mm, or 9 mm. The projection distance is at least 2 mm in one embodiment, and at least 3 mm, 4 mm, or 5 mm in further embodiments. The heel guide-wall length 1319 is at least 5 mm in one embodiment, and at least 7 mm, 9 mm, or 11 mm in further embodiments; while it is less than 40 mm in one embodiment, and less than 35 mm, 30 mm, 25 mm, or 20 mm in further embodiments. The maximum cross-sectional dimension is within 30% of a diameter of the heel weight portion aperture 1316 in one embodiment, and within 25%, 20%, 15%, or 10% in further embodiments.

Figure 120:
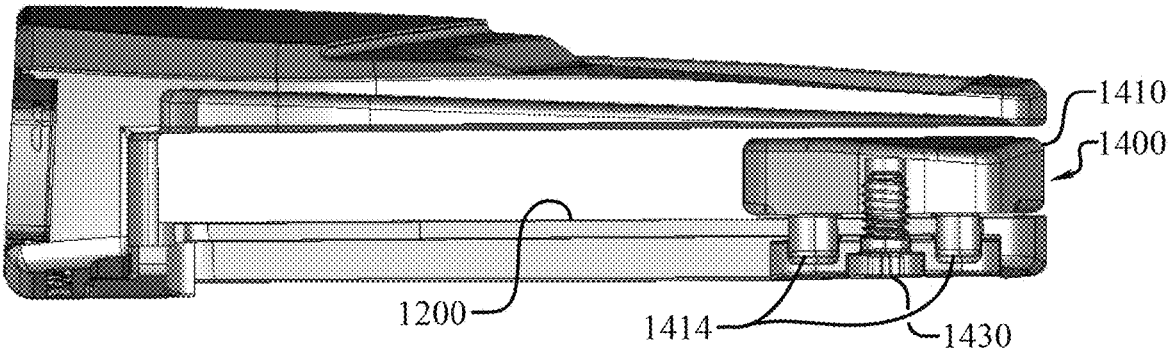

As seen in FIGS. 21, 120, and 121, the toe weight portion 1410 may have at least one toc weight portion projection 1414 configured to extend through at least a portion of the toe track 1200 and engage at least one toe washer portion receptacle 1424 in the toe washer portion 1420. Alternatively or in addition to, not shown but easily understood, the toe washer portion 1420 may have at least one toe washer portion projection configured to extend through at least a portion of the toe track 1200 and engage at least one toe weight portion receptacle in the toc weight portion 1410. The toe weight portion 1410 has a toe weight portion center of gravity CGtwgt, which establishes X, Y, and Z axis passing through the toe weight portion center of gravity CGtwgt when installed in the putter head 100 and oriented as disclosed with respect the overall heel weight assembly CGh, thereby facilitating the disclosure of the location of aspects of the toc weight portion 1410 with respect to its own center of gravity. For instance in one embodiment the at least one toe weight portion projection 1414 is offset a toe projection offset distance from the toe weight portion center of gravity CGtwgt, and thus a longitudinal axis of the toc weight portion projection 1414 is not aligned with a Z-axis passing through the toe weight portion center of gravity CGtwgt; and in further embodiments the toe projection offset distance is at least 1 mm, 2 mm, 3 mm, 4 mm, or 5 mm. Similarly in another embodiment the toe weight portion aperture 1416 is offset a toe aperture offset distance from the toe weight portion center of gravity CGtwgt, and thus a longitudinal axis of the toe weight portion aperture 1416 is not aligned with the Z-axis passing through the toe weight portion center of gravity CGtwgt; and in further embodiments the toe aperture offset distance is at least 1 mm, 2 mm, 3 mm, 4 mm, or 5 mm. One embodiment includes two toe weight portion projections 1414 on opposite sides of the toe weight portion aperture 1416, and in a further embodiment the two toe weight portion projections 1414 are equally spaced apart from the toe weight portion aperture 1416. Such features play a significant role in increasing durability and limiting rotation and/or binding of the toe weight assembly 1400 as it is repositioned.

The toe weight portion 1410 has a toe weight portion thickness 1411, seen in FIG. 22, and measured parallel to the CGt Z-axis. In the illustrated embodiment the toe weight portion thickness 1411 varies from a minimum thickness to a maximum thickness, whereby the maximum thickness is at least 20% greater than the minimum thickness, and in further embodiments at least 30%, 40%, 50%, or 60% greater. In another embodiment the maximum thickness is less than 300% greater than the minimum thickness, and in further embodiments less than 250%, 225%, 200%, 175%, 150%, 125%, or 100% greater. The variable toe weight portion thickness 1411 forms a toe weight portion guide-wall 1418 designed to abut a portion of a sole sidewall 111, seen in FIG. 22, in one embodiment, and/or abut a portion of the toe track 1200, or toe track sidewall 1202, as seen in FIGS. 93, 94, and 87. The toe weight portion guide-wall 1418 has a toe guide-wall length 1419, measured parallel to the TT longitudinal axis 1230, that is at least 200% of the minimum toc weight portion thickness 1411, and in further embodiments at least 250%, 300%, or 350%; while in a another embodiment the toe guide-wall length 1419 is no more than 1000% of the minimum toe weight portion thickness 1411, and in further embodiments is no more than 900%, 800%, 700%, or 600%. A separation distance between the toc weight portion guide-wall 1418 and a nearest point on the toe weight portion projection 1414 is greater than the minimum toe weight portion thickness 1411, and in further embodiments at least 10%, 15%, 20%, or 25% greater; while in an additional embodiment the separation distance is no more than 300% of the minimum toc weight portion thickness 1411, and in further embodiments no more than 275%, 250%, 225%, 200%, or 175%. The toe weight portion projection 1414 projects from the adjacent surface a projection distance that is at least 50% of the minimum toe weight portion thickness 1411 in one embodiment, and at least 60%, 70%, 80%, and 90% in further embodiments; while the projection distance is no more than 250% of the minimum toe weight portion thickness 1411 in one embodiment, and no more than 225%, 200%, 175%, 150%, or 125% in further embodiments. The toe weight portion projection 1414 extends beyond the toe weight portion guide-wall 1418 in one embodiment, while in an alternative embodiment the toe weight portion projection 1414 does not project beyond the toe weight portion guide-wall 1418. The toe weight portion guide-wall 1418 has a toe weight portion guide-wall height 1421, seen in FIG. 21, and thus in one embodiment the projection distance is less than the toe weight portion guide-wall height 1421, while in another embodiment the projection distance is greater than the toe weight portion guide-wall height 1421, while in another embodiment they are equal. The illustrated toe weight portion projection 1414 has a round cross-sectional shape, however it may be triangular, square, rectangular, or composed of straight segments, curved segments, or a combination thereof; regardless of the cross-sectional shape the toc weight portion projection 1414 has a maximum cross-sectional dimension, which in the illustrated embodiment is a diameter. In one embodiment the maximum cross-sectional dimension is at least 2 mm, 3 mm, or 4 mm, while in further embodiments it is no more than 15 mm, 13 mm, 11 mm, or 9 mm. The projection distance is at least 2 mm in one embodiment, and at least 3 mm, 4 mm, or 5 mm in further embodiments. The toe guide-wall length 1419 is at least 5 mm in one embodiment, and at least 7 mm, 9 mm, or 11 mm in further embodiments; while it is less than 40 mm in one embodiment, and less than 35 mm, 30 mm, 25 mm, or 20 mm in further embodiments. The maximum cross-sectional dimension is within 30% of a diameter of the toe weight portion aperture 1416 in one embodiment, and within 25%, 20%, 15%, or 10% in further embodiments. Such features play a significant role in increasing durability and limiting rotation and/or binding of the heel weight assembly 1300 and/or toe weight assembly 1400 as it is repositioned.

Figure 114:
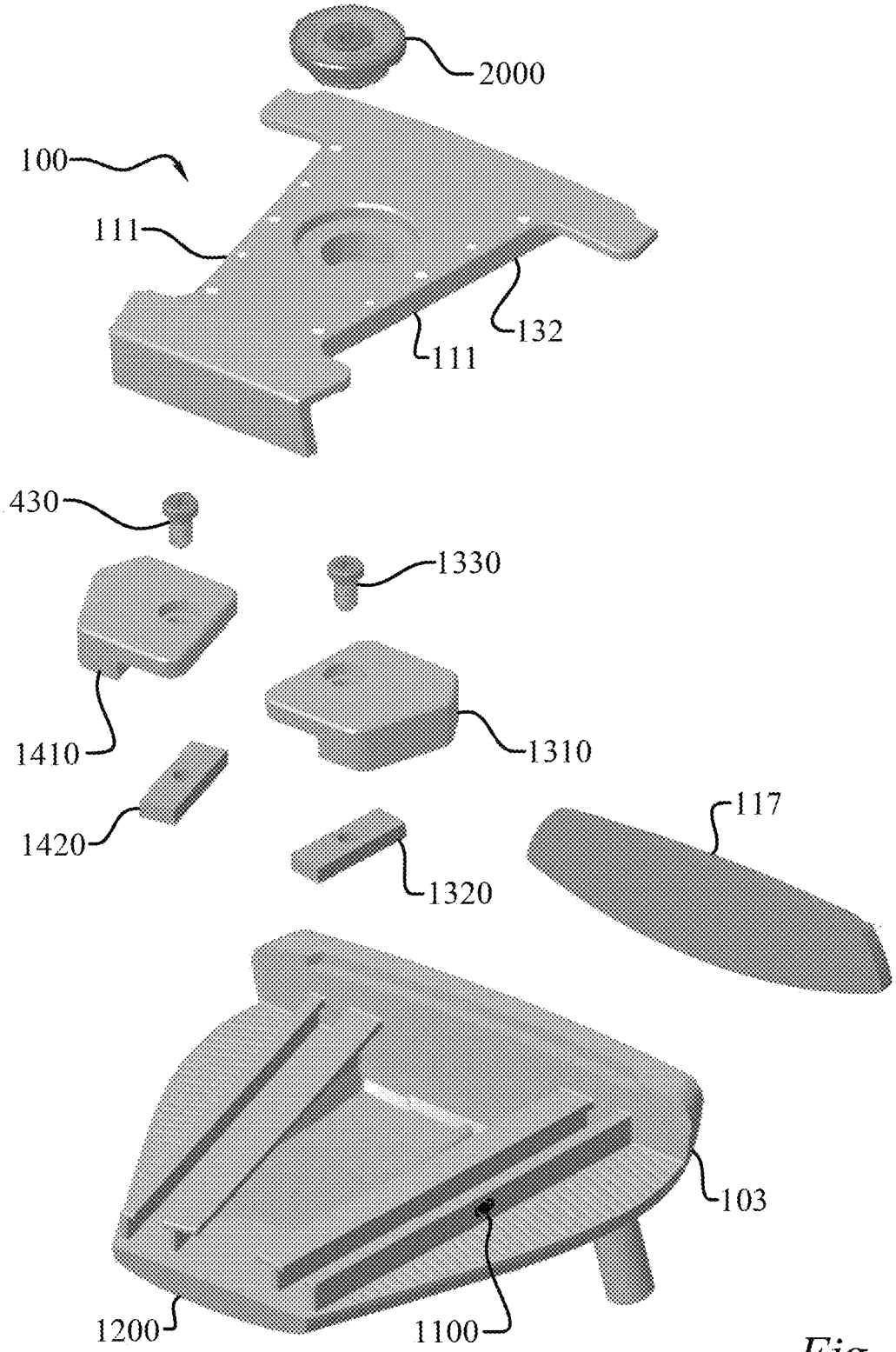
FIG. 114 is an exploded isometric view of the golf putter head embodiment seen in FIG. 106.
Figure 115:
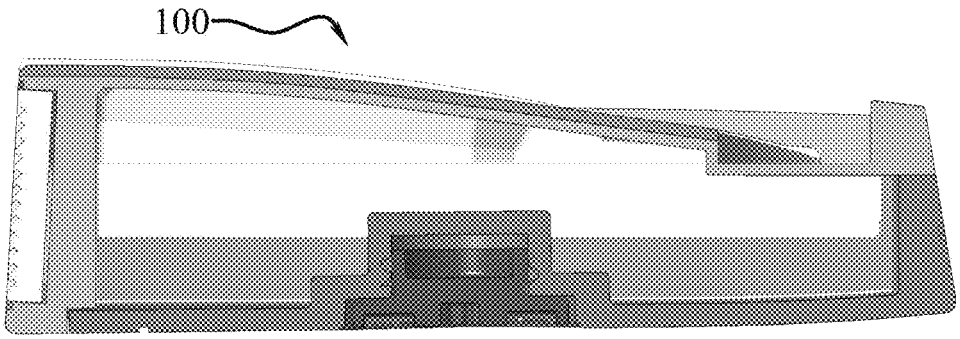
FIG. 115 is a cross sectional view of the golf putter head embodiment seen in FIG. 106.
Figure 116:
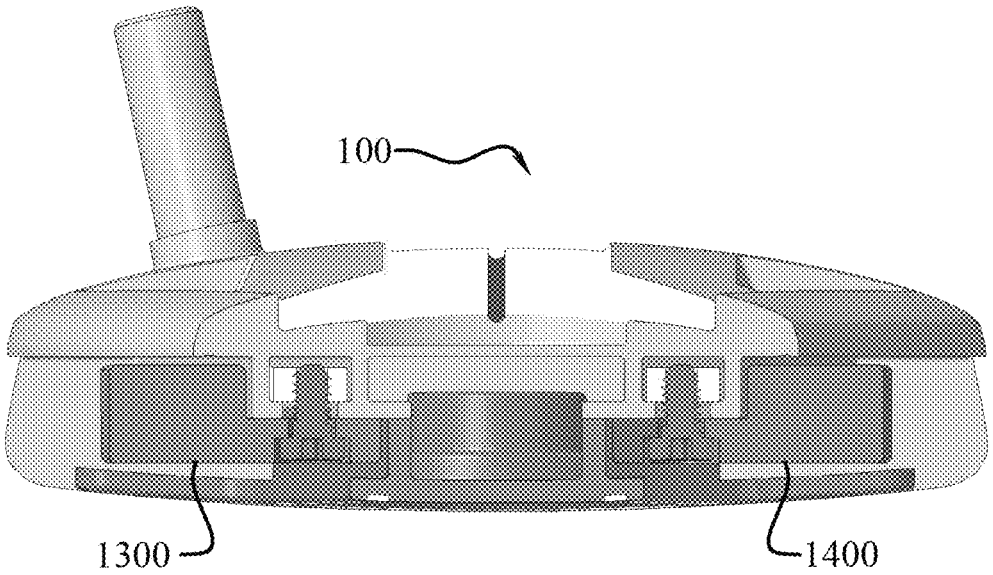

The sole sidewall 111, seen in FIGS. 22 and 114, adjacent to the heel weight portion guide-wall 1318 and/or toe weight portion guide-wall 1418, has a sidewall height 119, as seen in FIG. 22. In one embodiment the sidewall height 119 is less than the heel weight portion guide-wall height 1321, while in another embodiment the sidewall height 119 is greater than the heel weight portion guide-wall height 1321, while in another embodiment they are equal. In one embodiment the absolute value of the difference between the sidewall height 119 and the heel weight portion guide-wall height 1321 is less than 7 mm, and in further embodiments less than 6 mm, 5 mm, 4 mm, 3 mm, 2 mm, or 1 mm. In another embodiment the sidewall height 119 is less than the toe weight portion guide-wall height 1421, while in another embodiment the sidewall height 119 is greater than the toe weight portion guide-wall height 1421, while in another embodiment they are equal. In one embodiment the absolute value of the difference between the sidewall height 119 and the toe weight portion guide-wall height 1421 is less than 7 mm, and in further embodiments less than 6 mm, 5 mm, 4 mm, 3 mm, 2 mm, or 1 mm.

The one or more repositionable weight assemblies 1000, whether it includes a heel weight assembly 1300 and/or a toe weight assembly 1400, and/or the heel track 1100 or toe track 1200, and variations thereof, may be implemented in any other type of golf club, such as a driver, fairway wood, hybrid, rescue, iron (cavity back, muscle back, hollow iron), wedge, or other golf club type, to provide the adjustability and performance benefits disclosed herein. Thus, references to putter head herein may be interchanged with the term club head, driver club head, fairway wood club head, hybrid or rescue club head, iron club head, cavity back iron club head, muscle back iron club head, hollow iron club head, and/or wedge club head. For example, any of the disclosed features may be incorporated into the club heads disclosed in U.S. patent application Ser. No. 17/864,171, filed Jul. 13, 2022, Ser. No. 17/881,339, filed Aug. 4, 2022, Ser. No. 17/505,511, filed Oct. 19, 2021, Ser. No. 18/137,065, filed Apr. 20, 2023, Ser. No. 17/565,580, filed Dec. 30, 2021, Ser. No. 17/696,664, filed Mar. 16, 2022, Ser. No. 17/564,077, filed Dec. 28, 2021, Ser. No. 17/974,279, filed Oct. 26, 2022, Ser. No. 18/122,487, filed Mar. 16, 2023, and Ser. No. 17/722,632, filed Apr. 18, 2022, which are incorporated by reference herein in their entirety.

In FIGS. 1-4 and 24 the heel weight assembly 1300 and the toe weight assembly 1400 are located at a rearward position, and in a further embodiment a portion of heel weight assembly 1300 and the toe weight assembly 1400 create a portion of an outer perimeter of the putter head 100 when viewed straight down in a top plan view. In FIGS. 5-8 and 25 the heel weight assembly 1300 and the toc weight assembly 1400 are located at a mid-position at the midpoint between the HT proximal end 1112 and the HT distal end 1114, or at the midpoint between the TT proximal end 1212 to the TT distal end 1214, and in a further embodiment a portion of heel weight assembly 1300 and the toe weight assembly 1400 create a portion of an outer perimeter of the putter head 100 when viewed straight down in a top plan view. In FIGS. 9-12 and 26 the heel weight assembly 1300 and the toe weight assembly 1400 are located at a forward position, and in a further embodiment a portion of heel weight assembly 1300 and the toe weight assembly 1400 do not create a portion of an outer perimeter of the putter head 100 when viewed straight down in a top plan view, and are hidden from view.

All embodiments referencing visible surface area of a weight assembly are determined when viewed straight down in a top plan view with the putter head 100 in the normal address position, unless noted otherwise as in the embodiments specifically mentioning bottom view visible surface area, which is determined when viewed straight down at a bottom plan view with the putter head 100 in the normal address position. For example in one embodiment the heel weight assembly 1300 and/or the toe weight assembly 1400 has a maximum visible surface area and a minimum visible surface area depending upon the location. In one embodiment the minimum visible surface area is at least 20% less than the maximum visible surface area, and in further embodiments at least 30%, 40%, 50%, 60%, 70%, or 80%. In one embodiment at least one position of the heel weight assembly 1300 and/or the toe weight assembly 1400 results in a visible surface area of zero, meaning no portion of it is exposed to view when viewed straight down in a top plan view with the putter head 100 in the normal address position. In another embodiment the maximum visible surface area of either the heel weight assembly 1300 and/or the toc weight assembly 1400 is at least 1 cm^2, and in further embodiments at least 1 cm^2, 1.25 cm^2, 1.5 cm^2, 1.75 cm^2, or 2 cm^2. In a further embodiment the maximum visible surface area of either the heel weight assembly 1300 and/or the toe weight assembly 1400 is no more than 20 cm^2, and in further embodiments no more than 18 cm^2, 16 cm^2, 14 cm^2, 12 cm^2, 10 cm^2, 8 cm^2, or 6 cm^2. In one embodiment the bottom view visible surface area is always greater than the visible surface area, aka top visible surface area, regardless of the position of the heel weight assembly 1300 and/or the toe weight assembly 1400.

All embodiments referencing visible perimeter length of a weight assembly are determined when viewed straight down in a top plan view with the putter head 100 in the normal address position, and likewise for the visible perimeter length of the overall putter head 100. For example in one embodiment, in at least one location the heel weight assembly 1300 or the toc weight assembly 1400 has a weight assembly visible perimeter length that is at least 5% of the maximum length L and/or the maximum width W of the putter head 100, and in further embodiments at least 10%, 15%, 20%, or 25%. In a further embodiment a maximum weight assembly visible perimeter length the heel weight assembly 1300 or the toe weight assembly 1400 is no more than 75% of the maximum length L and/or the maximum width W of the putter head 100, and in further embodiments no more than 65%, 55%, 45%, or 35%.

Another embodiment recognizes that some golfers prefer not to see any unusual changes to the perimeter of the putter head 100 near the point that they are focusing on while addressing a golf ball and during the stroke, namely the striking face 116, but are less distracted by perimeter changes when they are further from the striking face 116. Thus, in one embodiment the heel weight assembly 1300 and/or the toe weight assembly 1400 create no portion of the visible perimeter length of the overall putter head 100 within a visual clearance distance behind the striking face 116 and measured in the club head Y-axis direction. In a further embodiment there is no visible surface area of the heel weight assembly 1300 and/or the toe weight assembly 1400 within the visual clearance distance behind the striking face 116. Further the desired visual clearance distance is impacted by the maximum length L and/or the maximum width W. In one embodiment the visual clearance distance is at least 10% of the maximum length L and/or the maximum width W, and in further embodiments at least 15%, 20%, 25%, or 30%. In a further embodiment the visual clearance distance is no more than 70% of the maximum length L and/or the maximum width W, and in further embodiments no more than 60%, 50%, 45%, or 40%. The embodiment of FIGS. 58-61, described later in detail, balances the best of both worlds whereby windows allow a portion of the heel weight assembly 1300 and/or the toe weight assembly 1400 to be seen within the visual clearance distance, yet the heel weight assembly 1300 and/or the toc weight assembly 1400 do not create a portion of the visible perimeter length of the overall putter head 100 within the visual clearance distance. However, in one embodiment no portion of the heel weight assembly 1300 and/or the toe weight assembly 1400 creates a portion of the visible perimeter length of the overall putter head 100, regardless of the position and are thus hidden from view at address.

Additionally, the visual asymmetry created by the position of the heel weight assembly 1300 and/or the toe weight assembly 1400 is confidence inspiring for certain known tendencies. For example, a golfer that tends to leave the face open at impact, in other words-struggles to return the face to square, would find the confidence in the visual characteristics of the positions illustrated in FIG. 13 by seeing a rear heel weight assembly 1300, and not seeing the toe weight assembly 1400, and thus knowing it is forward, thereby suggesting to the player that the club will be easy to square-up at impact. Alternatively, a golfer that tends to have the face closed at impact would find confidence in the visual characteristics of the positions illustrated in FIG. 17 by seeing a rear toe weight assembly 1400, and not seeing the heel weight assembly 1300, and thus knowing it is forward, thereby suggesting to the player that they don't have to worry about unintentionally having the face closed at impact. Such visual cues are very confidence inspiring and improve putting performance without the player needing to change their natural stroke.

In another embodiment the maximum visible surface area of the heel weight assembly 1300 and/or the toe weight assembly 1400 occurs at the location furthest from the striking face 116, while in a further embodiment the visible surface area decreases as the heel weight assembly 1300 and/or the toe weight assembly 1400 is moved toward the striking face 116. In the illustrated embodiment and positions of FIGS. 1-16, in no position does the heel weight assembly 1300 and/or the toe weight assembly 1400 change the maximum width W of the putter head 100. However, in some embodiments at least one location of the heel weight assembly 1300 and/or the toe weight assembly 1400 does change the maximum width W of the putter head 100, as would be easily understood to one skilled in the art, such as via the shape of the heel weight assembly 1300 and/or the toe weight assembly 1400, the position and/or angle of the track(s), and/or the shape, or perimeter profile, of the top portion 112.

In one embodiment the heel weight assembly 1300 and/or the toe weight assembly 1400 is hidden from view regardless of the position, again as determined when viewed straight down in a top plan view with the putter head 100 in the normal address position, as some golfers prefer not to see a change in the shape of the perimeter of the club head as the heel weight assembly 1300 and/or the toe weight assembly 1400 is repositioned. In fact, an embodiment includes at least one faux weight assembly to provide the appearance of a weight assembly, but does not move as the real heel weight assembly 1300 and/or the toe weight assembly 1400 is repositioned. For instance either, or both, of the illustrated heel weight assembly 1300 and/or the toe weight assembly 1400 may be a one faux weight assembly For example in one embodiment the heel weight assembly 1300 and/or the toe weight assembly 1400 has a maximum visible surface area and a minimum visible surface area depending upon the location. In one embodiment the minimum visible surface area is at least 20% less than the maximum visible surface area, and in further embodiments at least 30%, 40%, 50%, 60%, 70%, or 80%. In one embodiment at least one position of the heel weight assembly 1300 and/or the toe weight assembly 1400 results in a visible surface area of zero, meaning no portion of it is exposed to view when viewed straight down in a top plan view with the putter head 100 in the normal address position. In another embodiment the maximum visible surface area of either the heel weight assembly 1300 and/or the toe weight assembly 1400 is at least 1 cm^2, and in further embodiments at least 1 cm^2, 1.25 cm^2, 1.5 cm^2, 1.75 cm^2, or 2 cm^2. In a further embodiment the maximum visible surface area of either the heel weight assembly 1300 and/or the toe weight assembly 1400 is no more than 20 cm^2, and in further embodiments no more than 18 cm^2, 16 cm^2, 14 cm^2, 12 cm^2, 10 cm^2, 8 cm^2, or 6 cm^2. In one embodiment the bottom view visible surface area is always greater than the visible surface area, aka top visible surface area, regardless of the position of the heel weight assembly 1300 and/or the toe weight assembly 1400.

The HTLA x-axis angle 1132 and the TTLA x-axis angle 1232 are measured as illustrated in FIG. 2 where the angle is measured inward toward the origin 128. In the illustrated embodiment both the HTLA x-axis angle 1132 and the TTLA x-axis angle 1232 are obtuse angles and thus the absolute value of CGhx and CGtx increase as the heel weight assembly 1300 and the toc weight assembly 1400 move toward the striking face 116. Such obtuse embodiments provide the benefit of reducing the drop-off in Izz as the weights are moved forward when compared to an acute HTLA x-axis angle 1132 and/or an acute the TTLA x-axis angle 1232, or angles that are ninety degrees; while capitalizing on the significant movement of CGy. Conversely, in the embodiment illustrated in FIG. 27 both the HTLA x-axis angle 1132 and the TTLA x-axis angle 1232 are acute angles and thus the absolute value of CGhx and CGtx decrease as the heel weight assembly 1300 and the toe weight assembly 1400 move toward the striking face 116. Such acute embodiments provide the benefit of increasing the drop-off in Izz as the weights are moved forward when compared to an acute HTLA x-axis angle 1132 and/or an acute the TTLA x-axis angle 1232, or angles that are ninety degrees, which may promote the feel of a blade putter that can be desirable for some golfers; while capitalizing on the significant movement of CGy. In a further embodiment one, or both, of the HTLA x-axis angle 1132 and the TTLA x-axis angle 1232 are ninety degrees and thus the absolute value of CGhx and CGtx is constant as the heel weight assembly 1300 and the toe weight assembly 1400 move toward, or away from, the striking face 116. Thus, in one embodiment movement of the heel weight assembly 1300 changes the CGhx value from a minimum CGhx to a maximum CGhx, with the difference between them defining a CGhx differential, and likewise movement of the toe weight assembly 1400 changes the CGtx from a minimum CGtx to a maximum CGtx, with the difference between them defining a CGtx differential. In one embodiment the CGhx differential and/or the CGtx differential is at least 1 mm, and in further embodiments at least 1.5 mm, 2 mm, 2.5 mm, or 3 mm. In another embodiment the CGhx differential and/or the CGtx differential is no more than 14 mm, and in further embodiments no more than 12 mm, 10 mm, 8 mm, or 6 mm. The CGhx differential is equal to the CGtx differential in the embodiment illustrated in FIG. 2, however in a further embodiment the CGhx differential is greater than the CGtx differential, and in another embodiment the CGhx differential is less than the CGtx differential. A x-delta is an absolute value of the difference between the CGhx differential and the CGtx differential, and in one embodiment the x-delta is at least 1 mm, and in further embodiments at least 1.5 mm, 2 mm, or 2.5 mm. The x-delta is no more than 10 mm in another embodiment, and in further embodiments no more than 8 mm, 6 mm, or 4 mm.

In one embodiment both the HTLA x-axis angle 1132 and the TTLA x-axis angle 1232 are either obtuse or acute. In another embodiment one of the angles is obtuse or acute and the other angle is ninety degrees. In a further embodiment one of the angles is obtuse while the other angle is acute. In a further embodiment the HTLA x-axis angle 1132 and the TTLA x-axis angle 1232 are equal, while in another embodiment the HTLA x-axis angle 1132 and the TTLA x-axis angle 1232 are not equal. In particular embodiment the HTLA x-axis angle 1132 and the TTLA x-axis angle 1232 are not equal and differ by a predetermined x-axis angle differential, which in one embodiment is at least 0.5 degrees, and in further embodiments is at least 1.0, 1.5, 2.0, 2.5, 3.0, 3.5, 4.0, 4.5, 5.0, 5.5, 6.0, 6.5, 7.0, or 7.5 degrees. Another series of embodiments caps the predetermined x-axis angle differential to no more than 90 degrees, and in further embodiments no more than 80, 70, 60, 50, 40, 30, 20, or 10 degrees.

Further, in an embodiment of FIG. 2 the HTLA x-axis angle 1132 and/or the TTLA x-axis angle 1232 are at least 91 degrees, and in further embodiments at least 92, 94, 96, 98, 100, 102, 104, 106, 108, or 110 degrees. Another embodiment caps the HTLA x-axis angle 1132 and/or the TTLA x-axis angle 1232 to no more than 135 degrees, and in additional embodiments no more than 130, 125, 120, or 115 degrees. Additionally, in an embodiment of FIG. 27 the HTLA x-axis angle 1132 and/or the TTLA x-axis angle 1232 are no more than 89 degrees, and in further embodiments no more than 88, 86, 84, 82, 80, 78, 76, 74, 72, or 70 degrees. Another embodiment caps the HTLA x-axis angle 1132 and/or the TTLA x-axis angle 1232 to at least 45 degrees, and in additional embodiments at least 50, 55, 60, or 65 degrees.

In FIG. 28 the HTLA GP angle 1134 is positive, meaning the elevation increases at it approaches the club head X-axis and thus the Zup-h dimension increases as the heel weight assembly 1300 approaches the striking face 116; and likewise in FIG. 29 the TTLA GP angle 1234 is positive, meaning the elevation increases at it approaches the club head X-axis and thus the Zup-t dimension increases as the toe weight assembly 1400 approaches the striking face 116, and such embodiments promote the feel of a blade putter to some golfers thereby providing significant adjustability in feel within a single putter head 100. In the embodiment of FIGS. 3-4 the HTLA GP angle 1134 and the TTLA GP angle 1234 are parallel to the ground plane GP, meaning the angles are zero, however the angles are schematically labeled to illustrate other embodiments where the angles are negative meaning the meaning the elevation decreases as it approaches the club head X-axis and thus the hypothetical Zup-t and Zup-h dimensions decreases as the heel weight assembly 1300 and the toe weight assembly 1400 approaches the striking face 116. However, when the angles are zero the Zup-t and Zup-h dimensions remain constant as the heel weight assembly 1300 and the toe weight assembly 1400 move toward, or away from, the striking face 116 thereby promoting a feeling of consistency to the golfer regardless of the position of the weight assemblies. In a further embodiment both of the HTLA GP angle 1134 and the TTLA GP angle 1234 are either positive or negative. In another embodiment one of the angles is positive and one of the angles is negative. In still a further embodiment one of the angles is zero and one of the angles is non-zero and is either positive or negative. In yet another embodiment the HTLA GP angle 1134 and the TTLA GP angle 1234 are not equal and differ by a predetermined GP angle differential, which in one embodiment is at least 0.5 degrees, and in further embodiments is at least 1.0, 1.5, 2.0, 2.5, 3.0, 3.5, 4.0, 4.5, 5.0, 5.5, 6.0, 6.5, 7.0, or 7.5 degrees. Another series of embodiments caps the predetermined GP angle differential to no more than 30 degrees, and in further embodiments no more than 25, 20, 17.5, 15, 12.5, or 10 degrees. For example if the HTLA GP angle 1134 is positive 2 degrees and the TTLA GP angle 1234 is negative 3 degrees, the predetermined GP angle differential is 5 degrees; whereas if the HTLA GP angle 1134 is positive 2 degrees and the TTLA GP angle 1234 is positive 3 degrees, the predetermined GP angle differential is 1 degree; whereas if the HTLA GP angle 1134 is negative 4 degrees and the TTLA GP angle 1234 is negative 3 degrees, the predetermined GP angle differential is 1 degree.

Thus, similar to the previously disclosed CGhx differential and the CGtx differential, in one embodiment movement of the heel weight assembly 1300 changes the Zup-h value from a minimum Zup-h to a maximum Zup-h, with the difference between them defining a Zup-h differential, and likewise movement of the toe weight assembly 1400 changes the Zup-t from a minimum Zup-t to a maximum Zup-t, with the difference between them defining a Zup-t differential. In one embodiment the Zup-h differential and/or the Zup-t differential is at least 4% of the maximum height H, and in further embodiments at least 5%, 6%, 7%, 8%, 9%, or 10%. In another embodiment the Zup-h differential and/or the Zup-t differential is no more than 80% of the maximum height H, and in further embodiments no more than 70%, 60%, 50%, 40%, or 30%. In one embodiment the Zup-h differential and/or the Zup-t differential is at least 1 mm, and in further embodiments at least 1.5 mm, 2 mm, 2.5 mm, or 3 mm. In another embodiment the Zup-h differential and/or the Zup-t differential is no more than 14 mm, and in further embodiments no more than 12 mm, 10 mm, 8 mm, or 6 mm. The Zup-h differential is equal to the Zup-t differential in some embodiments, however in a further embodiment the Zup-h differential is greater than the Zup-t differential, and in another embodiment the Zup-h differential is less than the Zup-t differential. The CGhx differential is greater than the Zup-h differential in one embodiment, the CGhx differential is less than the Zup-h differential in another embodiment, and the CGhx differential is equal to the Zup-h differential yet a further embodiment. Similarly, the CGtx differential is greater than the Zup-t differential in one embodiment, the CGtx differential is less than the Zup-t differential in another embodiment, and the CGtx differential is equal to the Zup-t differential yet a further embodiment.

A heel x-z delta is an absolute value of a difference between the CGhx differential and the Zup-h differential, and in one embodiment the heel x-z delta is at least 1 mm, and in further embodiments at least 1.5 mm, 2 mm, or 2.5 mm. In a further series of embodiments the heel x-z delta is no more than 14 mm, and in further embodiments no more than 12 mm, 10 mm, 8 mm, 6 mm, or 4 mm. Similarly, a toe x-z delta is an absolute value of a difference between the CGtx differential and the Zup-t differential, and in one embodiment the toe x-z delta is at least 1 mm, and in further embodiments at least 1.5 mm, 2 mm, or 2.5 mm. In a further series of embodiments the toe x-z delta is no more than 14 mm, and in further embodiments no more than 12 mm, 10 mm, 8 mm, 6 mm, or 4 mm. For example if the CGhx differential is 8 mm and the Zup-h differential is 2 mm, the heel x-z delta is 6 mm; and if the CGhx differential is 2 mm and the Zup-h differential is 8 mm, the heel x-z delta is also 6 mm.

The location, size, and orientation of the heel track 1100 or toe track 1200 significantly influence the performance of the putter head 100, and so to do the attributes of the one or more repositionable weight assemblies 1000. Referring again to the heel weight assembly 1300 and the toe weight assembly 1400 of FIG. 2 for convenience, as previously explained the toe weight assembly CG, labeled CGt in the figures, defines the CGt X-axis, the CGt Y-axis, and the CGt Z-axis, as seen in FIGS. 2 and 4, and the heel weight assembly CG, labeled CGh in the figures, defines the CGh X-axis, the CGh Y-axis, and the CGh Z-axis, as seen in FIGS. 2 and 3. In one embodiment the toe weight assembly CGt is offset from the TT longitudinal axis 1230 in at least one direction. Stated another way, at least one of the CGt X-axis, the CGt Y-axis, and the CGt Z-axis do not intersect the TT longitudinal axis 1230. For example in one embodiment, in FIG. 2 the TT longitudinal axis 1230 defines a TT longitudinal vertical plane perpendicular to the ground plane GP, and a TTLVP separation distance from the CGt Z-axis to the TT longitudinal vertical plane is at least 1 mm in at least one weight position, but may also be true in all weight positions, and in further embodiments at least 2 mm, 3 mm, 4 mm, or 5 mm. In another embodiment the TTLVP separation distance is no more than 20 mm, and in further embodiments no more than 18 mm, 16 mm, 14 mm, 12 mm, 10 mm, or 8 mm. The TTLVP separation distance is at least 50% of the TT width 1220 in one embodiment in at least one weight position, but may also be true in all weight positions, and at least 55%, 60%, 65%, or 70% in further embodiments.

In one embodiment the heel weight assembly CGh is offset from the HT longitudinal axis 1130 in at least one direction. Stated another way, at least one of the CGh X-axis, the CGh Y-axis, and the CGh Z-axis do not intersect the HT longitudinal axis 1130. For example in one embodiment, in FIG. 2 the HT longitudinal axis 1130 defines a HT longitudinal vertical plane perpendicular to the ground plane GP, and a HTLVP separation distance from the CGh Z-axis to the HT longitudinal vertical plane is at least 1 mm in at least one weight position, but may also be true in all weight positions, and in further embodiments at least 2 mm, 3 mm, 4 mm, or 5 mm. In another embodiment the HTLVP separation distance is no more than 20 mm, and in further embodiments no more than 18 mm, 16 mm, 14 mm, 12 mm, 10 mm, or 8 mm. The HTLVP separation distance is at least 50% of the HT width 1120 in one embodiment in at least one weight position, but may also be true in all weight positions, and at least 55%, 60%, 65%, or 70% in further embodiments. This offset nature of the CG of the heel weight assembly 1300 and/or the toe weight assembly 1400, i.e. offset from a longitudinal vertical plane perpendicular to the ground plane GP containing a longitudinal axis of a track, provides great flexibility and performance benefits compared to traditional sliding weight designs having the center of gravity of the weight assembly essentially aligned with the axis of the track, which is also particularly useful in the driver, fairway wood, and rescue embodiments.

Figure 118:
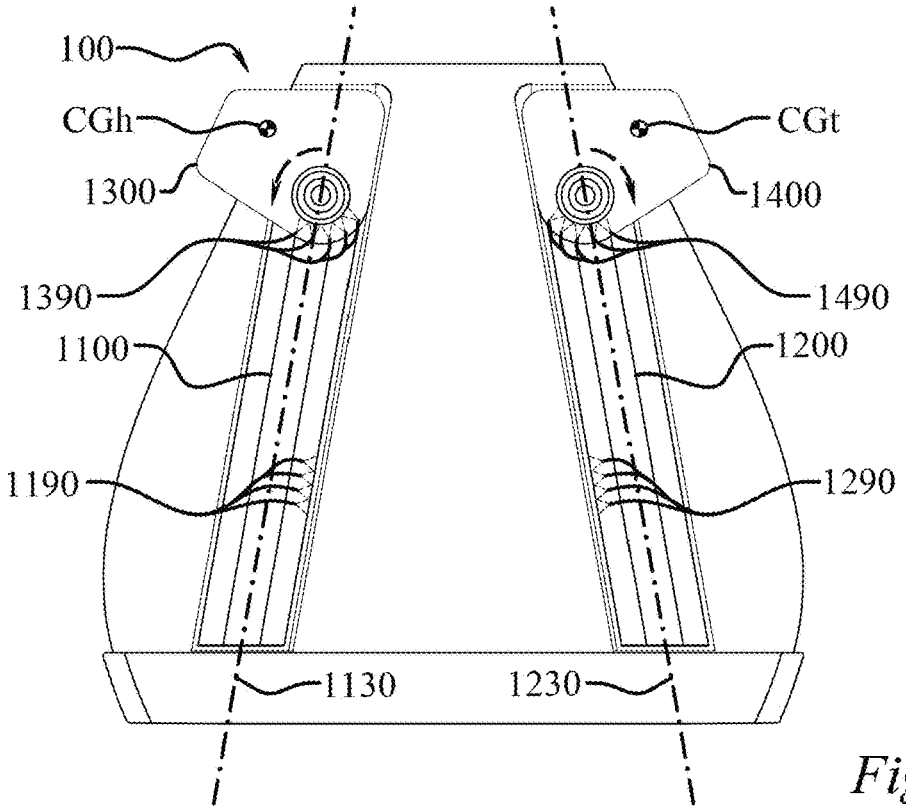

In one embodiment the TTLVP separation distance and/or the HTLVP separation distance is constant through the range of motion of the toe weight assembly 1400 and/or the heel weight assembly 1300. However, in a further embodiment the TTLVP separation distance and/or the HTLVP separation distance may vary through the range of motion of the toe weight assembly 1400 and/or the heel weight assembly 1300. In such variable separation distance embodiments, as seen in FIG. 118, the heel track 1100 has at least one heel track rotation promoting feature 1190, and the heel weight assembly 1300 has at least one HWA rotation promoting feature 1390. Similarly, in another embodiment the toe track 1200 has at least one toe track rotation promoting feature 1290, and the toe weight assembly 1400 has at least one TWA rotation promoting feature 1490. Cooperation of the heel track rotation promoting feature 1190 and the HWA rotation promoting feature 1390 cause the heel weight assembly 1300 to rotate when a desired location is reached. Cooperation of the toe track rotation promoting feature 1290 and the TWA rotation promoting feature 1490 cause the toe weight assembly 1400 to rotate when a desired location is reached. The rotation of the heel weight assembly 1300 and/or the toc weight assembly 1400 facilitates the disclosed changes in TTLVP separation distance and/or the HTLVP separation distance. In one such embodiment the TTLVP separation distance varies from a maximum TTLVP separation distance to a minimum TTLVP separation distance, wherein the maximum TTLVP separation distance is at least 10% greater than the minimum TTLVP separation distance, and in further embodiments at least 20%, 30%, 40%, 50%, 60%, 70%, 80%, 90%, or 100%. In another embodiment the maximum TTLVP separation distance is no more than 500% greater than the minimum TTLVP separation distance, and in further embodiments no more than 450%, 400%, 350%, 300%, 250%, 200%, or 150%. Similarly, in another embodiment the HTLVP separation distance varies from a maximum HTLVP separation distance to a minimum HTLVP separation distance, wherein the maximum HTLVP separation distance is at least 10% greater than the minimum HTLVP separation distance, and in further embodiments at least 20%, 30%, 40%, 50%, 60%, 70%, 80%, 90%, or 100%. In another embodiment the maximum HTLVP separation distance is no more than 500% greater than the minimum HTLVP separation distance, and in further embodiments no more than 450%, 400%, 350%, 300%, 250%, 200%, or 150%. In one embodiment the minimum TTLVP separation distance is zero and the maximum TTLVP separation distance is at least 1 mm, and in further embodiments at least 2 mm, 3 mm, 4 mm, 5 mm, or 6 mm; while in a further embodiment the maximum TTLVP separation distance is no more than 30 mm, and in further embodiments no more than 25 mm, 20 mm, 18 mm, 16 mm, 14 mm, 12 mm, or 10 mm. Likewise, in another embodiment the minimum HTLVP separation distance is zero and the maximum HTLVP separation distance is at least 1 mm, and in further embodiments at least 2 mm, 3 mm, 4 mm, 5 mm, or 6 mm; while in a further embodiment the maximum HTLVP separation distance is no more than 30 mm, and in further embodiments no more than 25 mm, 20 mm, 18 mm, 16 mm, 14 mm, 12 mm, or 10 mm. In one embodiment the TTLVP separation distance is positive when located between the TT longitudinal vertical plane and the perimeter of the toe portion 124, and negative when located between the TT longitudinal vertical plane and heel portion 120; and likewise the HTLVP separation distance is positive when located between the HT longitudinal vertical plane and the perimeter of the heel portion 120, and negative when located between the HT longitudinal vertical plane and toe portion 124. Further, in a one embodiment in a first location the TTLVP separation distance is positive and in a second location the TTLVP separation distance is negative; while in a further embodiment the second location is closer to the striking face 116 than the first location, however in an alternative embodiment the first location is closer to the striking face 116 than the second location. Further, in a one embodiment in a first location the HTLVP separation distance is positive and in a second location the HTLVP separation distance is negative; while in a further embodiment the second location is closer to the striking face 116 than the first location, however in an alternative embodiment the first location is closer to the striking face 116 than the second location. Such embodiments facilitate the control of the changes in moments of inertia and CG location with the changes in the locations of the toe weight assembly 1400 and/or the heel weight assembly 1300, even if the HTLA x-axis angle 1132 and/or the TTLA x-axis angle 1232 is ninety degrees.

In one embodiment the heel track 1100 and/or toe track 1200 are configured, and work in conjunction with the shape of the heel weight assembly 1300 and/or the toe weight assembly 1400, such that in at least one position no portion of the heel weight assembly 1300 and/or the toc weight assembly 1400 is above the origin 128, while in a second position at least a portion of the heel weight assembly 1300 and/or the toe weight assembly 1400 is above the origin 128. Taken even further, in another embodiment in at least one position the Zup-t and/or Zup-h is below the elevation of the origin 128, while in a second position the Zup-t and/or Zup-h is above the elevation of the origin 128. In still another embodiment at least one position of the repositionable weight assembly 1000 results in a club head Zup that is below the elevation of the origin 128, while a second position of the repositionable weight assembly 1000 results in a club head Zup that is above the elevation of the origin 128.

In the illustrated mallet-style putter head 100 embodiments the HT length 1110 and/or TT length 1210, seen in FIG. 6, is at least 50% of the maximum length L and/or the maximum width W, and at least 60%, 70%, 80%, or 90% in further embodiments. The HT length 1110 and/or TT length 1210, seen in FIG. 6, is at least 50 mm in one embodiment, and at least 55 mm, 60 mm, or 65 mm in further embodiments. In another series of embodiments the HT length 1110 and/or TT length 1210 is no more than 140 mm in one embodiment, and no more than 130 mm, 120 mm, 110 mm, 100 mm, 90 mm, or 80 mm in further embodiments. The maximum length L is at least 70 mm in one embodiment, and at least 75 mm, 80 mm, or 85 mm in further embodiments. In another embodiment the maximum length L is no more than 125 mm, and no more than 115 mm, 105 mm, 100 mm, 95 mm, or 90 mm in further embodiments. The maximum width W is at least 80 mm in one embodiment, and at least 85 mm, 90 mm, or 95 mm in further embodiments. In another embodiment the maximum width W is no more than 140 mm in one embodiment, and no more than 130 mm, 120 mm, 110 mm, or 100 mm in further embodiments. The maximum height H is no more than 35 mm in one embodiment, and no more than 30 mm, 28 mm, 26 mm, or 25 mm in further embodiments. In another embodiment the maximum height His at least 18 mm in one embodiment, and at least 20 mm, 22 mm, or 24 mm in further embodiments. The HT width 1120 and/or TT width 1220 is at least 1 mm in one embodiment, and in further embodiments at least 2 mm, 3 mm, 4 mm, 5 mm, or 6 mm. The HT width 1120 and/or TT width 1220 is no more than 40 mm in one embodiment, and in further embodiments no more than 35 mm, 30 mm, 25 mm, 20 mm, 15 mm, 13 mm, 11 mm, or 9 mm.

While the heel track 1100 and the toc track 1200 may be distinct and separate, as seen in FIGS. 1-4, and in one embodiment confined such that the toe track 1200 is only on the toe half of the club head and/or the heel track 1100 is only on the heel half of the club head, this is not required in other embodiments. For example the embodiment of FIG. 117 includes a track having a heel track 1100 portion and a toe track 1200 portion, but they are interconnected such that a repositionable weight assembly 1000 may move from the heel half of the club head, across the club head Y-Z plane, to the toe half of the club head via track connection segment. The illustrated embodiment includes both a heel weight assembly 1400 and a toe weight assembly 1300, and either may be positioned entirely on the toe half or heel half of the club head. Further, a single repositionable weight assembly 1000 may be utilized in an embodiment. The track connection segment may be curved, and in the illustrated embodiment is entirely curved and consists of a portion of a circle. Similarly, while the heel track 1100 and the toe track 1200 are straight in the illustrated embodiments, either, or both, may be curved. Further, the elevation of the track connection segment may change, or may be constant, as it approaches the striking face 116 and thus all of the disclosure relating to the HTLA GP angle 1134 and/or the TTLA GP angle 1234 applies equally to the track connection segment. In one embodiment the track connection segment is confined to the front half of the club head, meaning between the striking face 116 and a vertical heel-toe plane containing a midpoint of the maximum length L. In one embodiment a greatest elevation of the heel track 1100, the toe track 1200, and/or the track connection segment occurs at the intersection with the club head Y-Z plane. In one embodiment at least a portion the track connection segment has a radius of curvature, measured at the centerline of the track connection segment, and the radius of curvature is the 60-140% of the HT length 1110 and/or TT length 1210, and in further embodiments the radius of curvature is at least 75%, 85%, 95%, or 105% of the HT length 1110 and/or TT length 1210, and in still additional embodiments the radius of curvature is no more than 130%, 120%, or 110% of the HT length 1110 and/or TT length 1210. In another embodiment a point of the track connection segment nearest to the striking face 116 occurs at the club head Y-Z plane, while in other embodiments the point of the track connection segment nearest to the striking face 116 is offset from the club head Y-Z plane by an offset distance measured in the direction of the club head X-axis. In one embodiment the offset distance is at least 25% of Zup, and in further embodiments at least 35%, 45%, 55%, 65%, or 75% of Zup. In another embodiment the offset distance is no more than 200% of Zup, and in further embodiments no more than 180%, 160%, 140%, or 120% of Zup. In one embodiment the offset distance is toward the toe portion 124, while in another embodiment the offset distance is toward the heel portion 120. In one embodiment at least a portion the track connection segment is located in front of the forwardmost hosel interface point 202, meaning behind the striking face 116 but in front of a vertical plane containing the forwardmost hosel interface point 202 and parallel to the striking face 116.

The location of the heel track 1100, and/or heel weight assembly 1400, in relation to the hosel 122 also plays a significant role in the performance. With reference again to FIG. 5, in one embodiment the hosel interface 200 has a forwardmost hosel interface point 202 and a rearwardmost hosel interface point 204. One skilled in the art will appreciate that regardless of the type of hosel 122, and whether round, rectangular, square, or other, it will have a forwardmost hosel interface point 202 and a rearwardmost hosel interface point 204. This applies to hosel types with distinct exposed hosels 122 such as plumber neck hosels, L-neck hosels, flow neck hosels, slant neck hosels, and truss neck hosels, as well as hosel types having hosel posts designed to be received within the end of a putter shaft such as straight neck hosel posts, single bend hosel posts, double bend hosel posts, center shaft hosel posts, and offset shaft hosel posts. In one embodiment a first distance between the HT proximal end 1112 and the striking face 116, referred to as a heel track-face offset distance, is less than a second distance between the rearwardmost hosel interface point 204 and the striking face 116, referred to as a rear interface offset distance. In another embodiment the heel track-face offset distance is at least 1 mm less than the rear interface offset distance, and in further embodiments at least 2 mm, 3 mm, 4 mm, or 5 mm. In another embodiment a difference between the rear interface offset distance and the heel track-face offset distance is no more than 15 mm, and in further embodiments no more than 13 mm, 11 mm, 9 mm, or 7 mm.

In another embodiment a first distance between a portion of the heel weight assembly 1300 and the striking face 116, referred to as a heel weight-face offset distance, is less than a second distance between the rearwardmost hosel interface point 204 and the striking face 116, referred to as a rear interface offset distance. In another embodiment the heel weight-face offset distance is at least 1 mm less than the rear interface offset distance, and in further embodiments at least 2 mm, 3 mm, 4 mm, or 5 mm. In another embodiment a difference between the rear interface offset distance and the heel weight-face offset distance is no more than 15 mm, and in further embodiments no more than 13 mm, 11 mm, 9 mm, or 7 mm.

Similarly, in one embodiment a first distance between the TT proximal end 1212 and the striking face 116, referred to as a toe track-face offset distance, is less than a second distance between the rearwardmost hosel interface point 204 and the striking face 116, referred to as a rear interface offset distance. In another embodiment the toe track-face offset distance is at least 1 mm less than the rear interface offset distance, and in further embodiments at least 2 mm, 3 mm, 4 mm, or 5 mm. In another embodiment a difference between the rear interface offset distance and the toe track-face offset distance is no more than 15 mm, and in further embodiments no more than 13 mm, 11 mm, 9 mm, or 7 mm.

In another embodiment a first distance between a portion of the toe weight assembly 1400 and the striking face 116, referred to as a toe weight-face offset distance, is less than a second distance between the rearwardmost hosel interface point 204 and the striking face 116, referred to as a rear interface offset distance. In another embodiment the toe weight-face offset distance is at least 1 mm less than the rear interface offset distance, and in further embodiments at least 2 mm, 3 mm, 4 mm, or 5 mm. In another embodiment a difference between the rear interface offset distance and the toe weight-face offset distance is no more than 15 mm, and in further embodiments no more than 13 mm, 11 mm, 9 mm, or 7 mm.

In another embodiment at least a portion of the heel track 1100 is between the hosel interface front-back toeward plane 220 and the perimeter of the heel portion 120. In another embodiment at least a portion of the heel track 1100 is between the hosel interface front-back centerline plane 210 and the perimeter of the heel portion 120. In another embodiment at least a portion of the heel track 1100 is between the hosel interface front-back heelward plane 230 and the perimeter of the heel portion 120. In another embodiment, the HT longitudinal axis 1130 located between the HT proximal end 1112 and the HT distal end 1114 intersects the hosel interface front-back heelward plane 230. In another embodiment, the HT longitudinal axis 1130 located between the HT proximal end 1112 and the HT distal end 1114 intersects the hosel interface front-back centerline plane 210. In another embodiment, the HT longitudinal axis 1130 located between the HT proximal end 1112 and the HT distal end 1114 intersects the hosel interface front-back toward plane 220. In another embodiment at least two locations of the heel weight assembly 1300 are located at least 25 mm apart and at both locations the heel weight assembly CGh is located between the hosel interface front-back heelward plane 230 and the perimeter of the heel portion 120, while in further embodiments the locations are at least 30 mm, 35 mm, 40 mm, 45 mm, 50 mm, 55 mm, 60 mm, 65 mm, or 70 mm apart. In one embodiment every location of the heel weight assembly 1300 has the heel weight assembly CGh located between the hosel interface front-back heelward plane 230 and the perimeter of the heel portion 120. Another embodiment has at least one location of the heel weight assembly 1300 has the heel weight assembly CGh located between the hosel interface front-back heelward plane 230 and the perimeter of the toc portion 124.

In some examples, the putter head 100 can also include various other features, such as a sole plate 132 attached to the bottom of the body 102, a crown insert (not shown) attached to the top of the body, etc. For instance, in one embodiment such as that illustrated in FIGS. 21-23, the body 102 includes a sole plate 132 that attaches to an upper body portion 103. Here, the heel track 1100 and the toe track 1200 are formed in the sole plate 132. In the illustrated embodiment a portion of the heel weight assembly 1300 and the toe weight assembly 1400 is captively trapped between the sole plate 132 and the upper body portion 103 when the sole plate 132 is attached. The sole plate 132 may be permanently attached, meaning attached in a fashion such that it is not easily removable after manufacture such as with tamper-resistant or security mechanical fastener like a button Torx head, epoxy, welding, or brazing, or it may be releasably attached. Thus, in one embodiment a portion of the heel weight assembly 1300 and the toc weight assembly 1400 cannot be removed post-manufacture, providing additional durability and safety in that the portion, generally the heaviest portion, cannot come out of the putter head 100 even if a golfer where to take full swings at a golf ball as if they were hitting a drive with the putter head 100, and many of the disclosed embodiments incorporate design features enhancing the durability of the connection.

Figure 23:
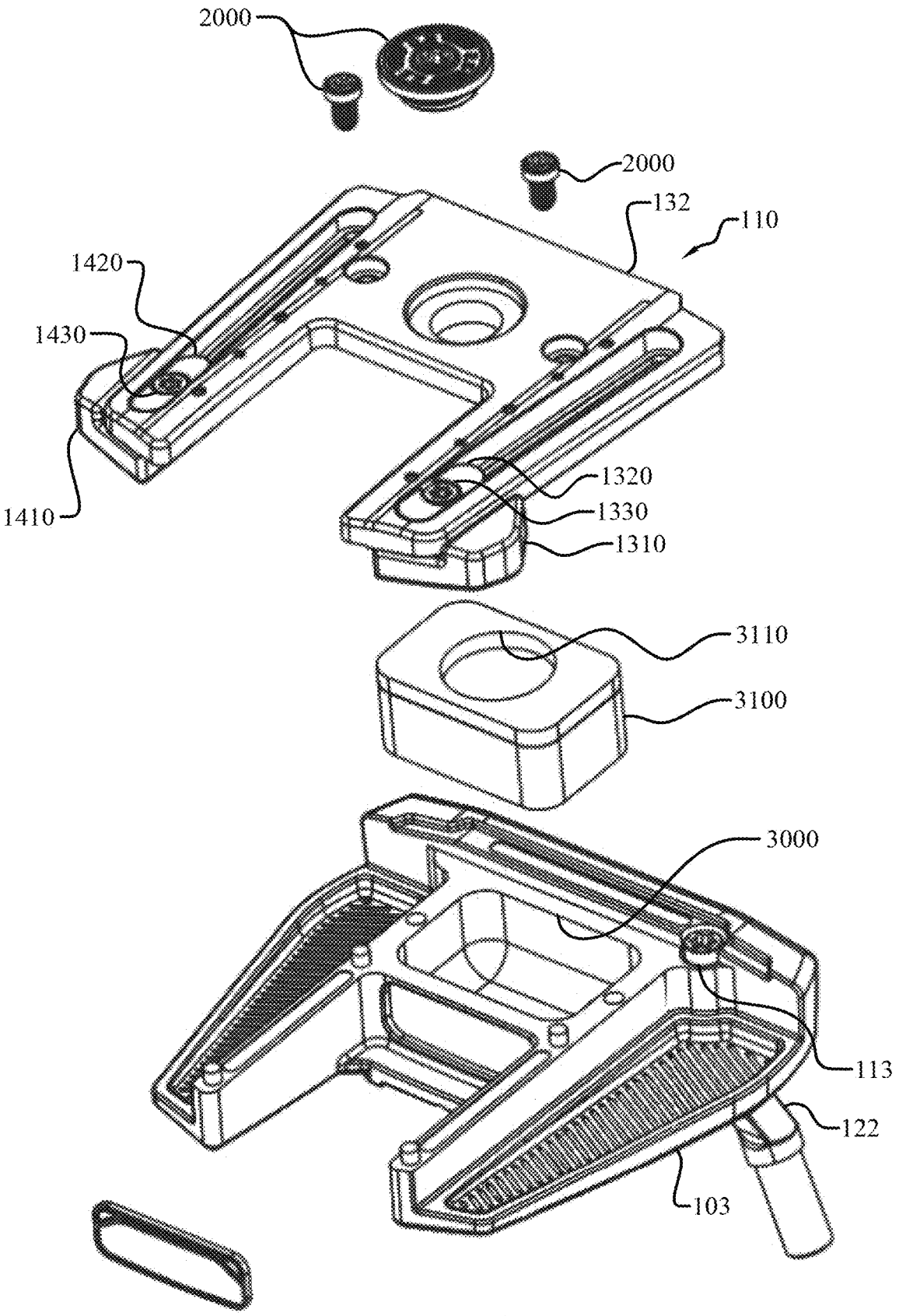
FIG. 23 is another exploded bottom isometric view of the embodiment of golf putter head seen in FIG. 21.

In the embodiment illustrated in FIGS. 21-23, the sole plate 132 and the upper body portion 103 are formed of different materials. In one embodiment the sole plate 132 has a sole plate mass and is formed of a sole plate material having a sole plate density, while the upper body portion 103 has an upper body mass is formed of an upper body material having an upper body material density. In one embodiment the sole plate density is at least twice the upper body material density. In another embodiment the upper body mass is greater than the sole plate mass, while in further embodiments the upper body mass is at least 10%, 20%, or 30% greater than the sole plate mass. The upper body mass is no more than 100% greater than the sole plate mass in one embodiment, and no more than 90%, 80%, 70%, 60%, 50%, or 40% in further embodiments. The sole plate mass is at least 50 grams in one embodiment, and at least 60 grams, 70 grams, 80 grams, or 90 grams in further embodiments. The sole plate mass is no more than 150 grams in one embodiment, and no more than 140 grams, 130 grams, 120 grams, 110 grams, or 100 grams in additional embodiments. The upper body mass is at least 80 grams in one embodiment, and at least 90 grams, 100 grams, 110 grams, 120 grams, or 130 grams in further embodiments. In another embodiment the upper body mass is no more than 200 grams, and no more than 190 grams, 180 grams, 170 grams, 160 grams, or 150 grams in additional embodiments. In particular embodiment the sole plate 132 is formed of a steel alloy, while the upper body portion 103 is formed of an aluminum alloy, thereby affording additional performance and durability associated with the high density and strength low in the putter head 100 and forming the tracks, with low density material higher in the putter head 100.

FIG. 114 illustrates an alternative embodiment where the heel track 1100 and the toc track 1200 are formed in the upper body portion 103, which may include being integrally cast or molded with the upper body portion 103, or created by removing material from the upper body portion 103, such as by milling, or created by additive manufacturing techniques. Such a configuration may eliminate the need for a sole plate 132, however the illustrated embodiment includes a sole plate 132. In one such embodiment the upper body density is at least twice the sole plate density. The sole plate mass is no more than 60 grams in one embodiment, while the upper body mass is at least 150 grams. In further embodiments the sole plate mass is no more than 50 grams, 45 grams, 40 grams, or 35 grams, and the upper body mass is at least 160 grams, 170 grams, 180 grams, 190 grams, or 200 grams. The upper body mass is no more than 300 grams in one embodiment, and no more than 290 grams, 280 grams, 270 grams, 260 grams, 250 grams, 240 grams, 230 grams, of 220 grams in additional embodiments. In one particular embodiment the upper body material is a steel alloy, and the sole plate material is an aluminum alloy, magnesium alloy, or nonmetallic material. This embodiment again benefits by having the heel track 1100 and the toe track 1200 are formed in the high strength material.

FIGS. 93-94 illustrate yet another appealing alternative where the heel track 1100 and the toe track 1200 are formed separately of a track material, and are attached to the upper body portion 103, or formed in the upper body portion 103, such as by co-molding. In such an embodiment the track material has a track material density, which in one embodiment is at least 60% greater than the upper body density and/or sole plate density, and at least 100% greater in a further embodiment. In one such embodiment the upper body mass is at least 50 grams in one embodiment, and at least 55 grams, 60 grams, or 65 grams. In another embodiment the upper body mass is no more than 170 grams, and no more than 160 grams, 150 grams, 140 grams, 130 grams, 120 grams, 110 grams, 100 grams, 90 grams, or 80 grams in additional embodiments. Further, the heel track 1100 and the toe track 1200 each have a track mass, and in one embodiment the track mass is at least 10 grams, and at least 15 grams, or 20 grams in additional embodiments. In a further series of embodiments the track mass is no more than 50 grams, and in additional embodiments no more than 45 grams, 40 grams, 35 grams, or 30 grams. In an embodiment having a sole plate 132, the sole plate mass is no more than 35 grams, and in additional embodiments no more than 30 grams, 25, grams, 20 grams, or 15 grams. In one particular embodiment the track material is a steel alloy, and the upper body material and/or the sole plate material is an aluminum alloy, magnesium alloy, or nonmetallic material. Such an embodiment frees up significant mass from the upper body portion 102, which in one embodiment is utilized to increase the total repositionable mass. In one such embodiment the total repositionable mass is at least 40% of the overall club head mass, and in further embodiments at least 42.5%, 45%, 47.5%, 50%, 52.5%, 55%, 57.5%, 60%, or 62.5%. In a further embodiment the total repositionable mass is no more than 80% of the overall club head mass, and in further embodiments no more than 75%, 70%, or 65%. The heel track 1100 and the toe track 1200 may be mechanically attached to the upper body portion 103 via fasteners or interlocking joint configurations, such as a dovetail joint, and/or adhesively attached.

Figure 82A:
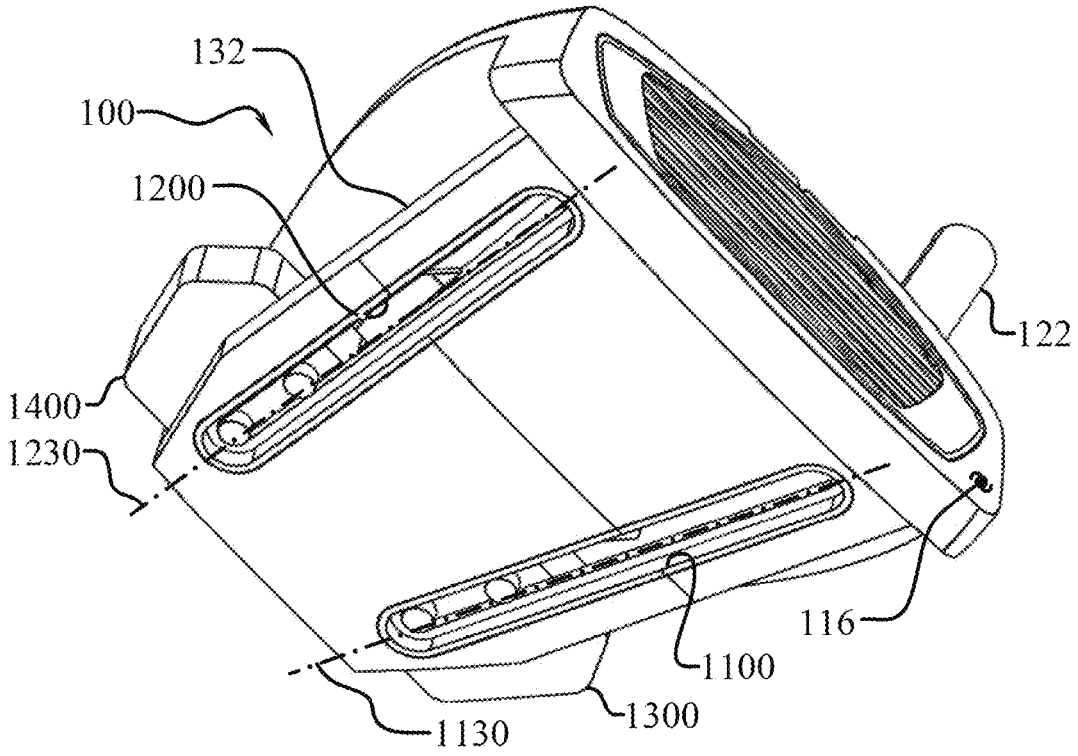
FIG. 82*a* is a bottom isometric view of another golf putter head embodiment.
Figure 82B:
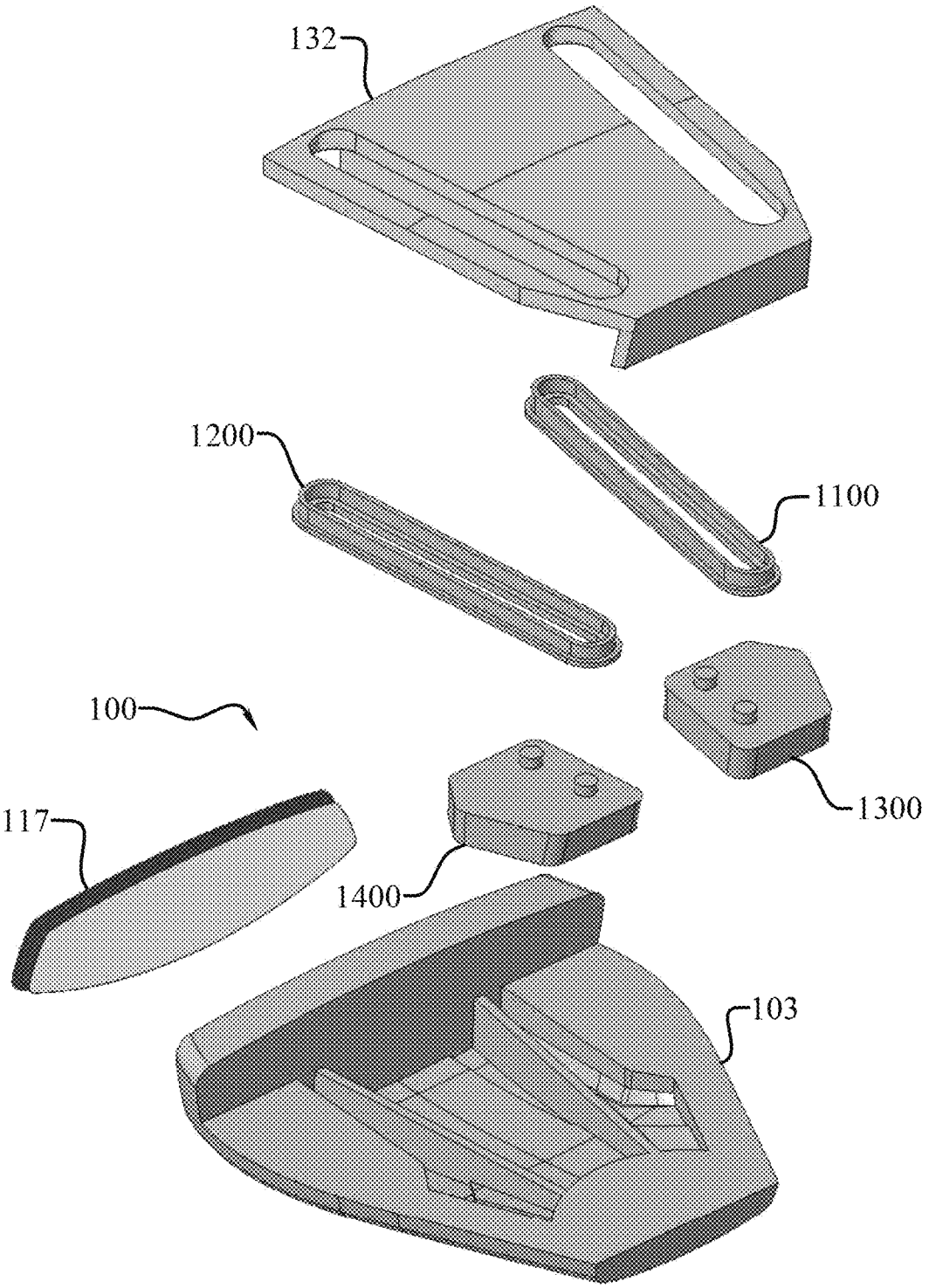
FIG. 82*b* is an exploded isometric view of the golf putter head embodiment seen in FIG. 82*a;*
Figure 82C:
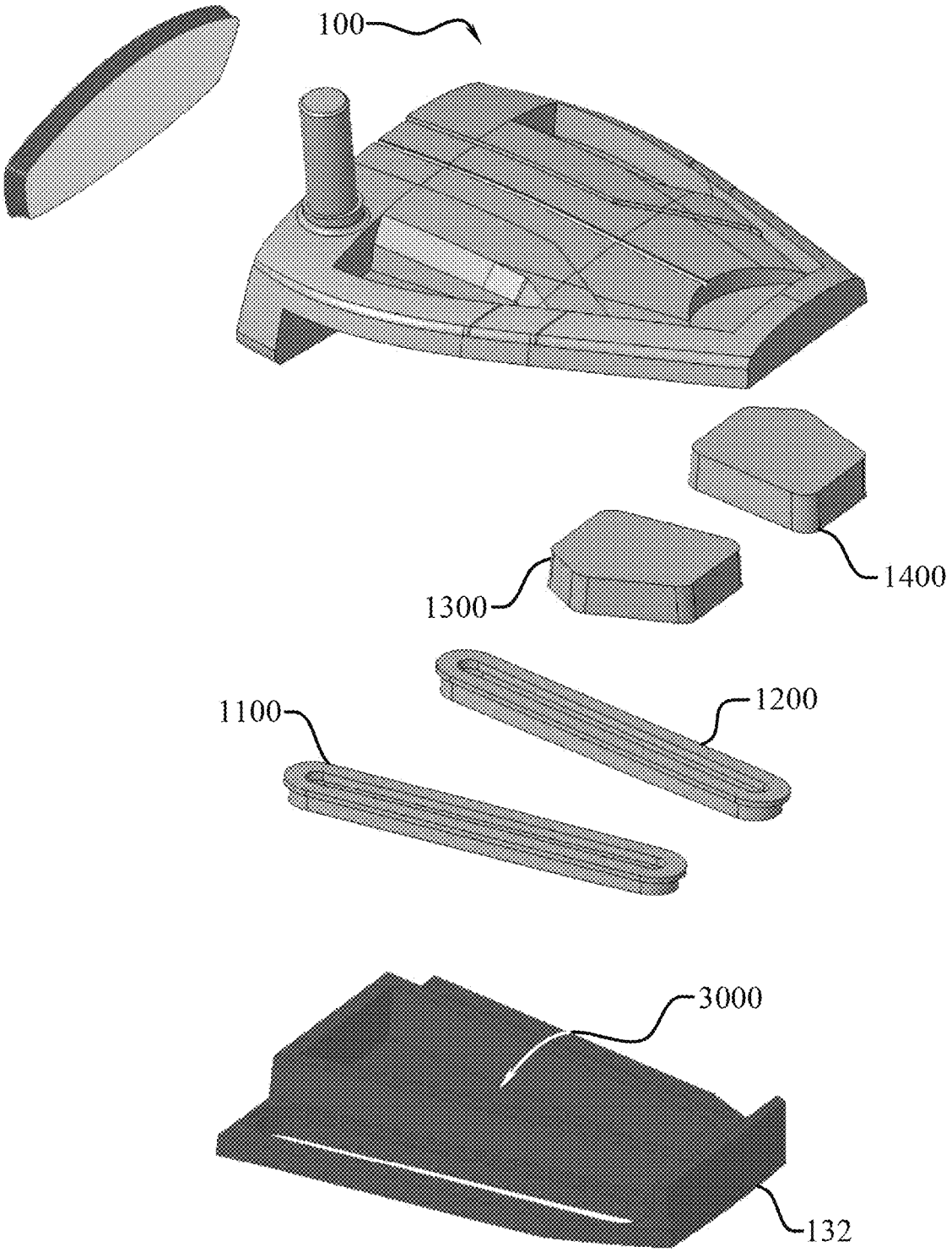
FIG. 82*c* is an exploded isometric view of the golf putter head embodiment seen in FIG. 82*a;*
Figure 83:
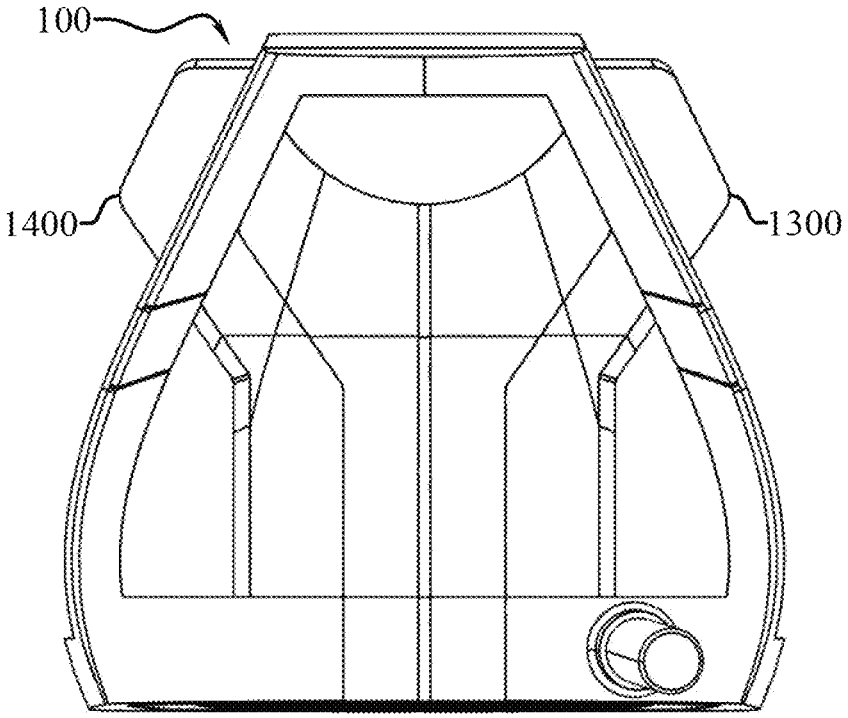
FIG. 83 is an a top plan view of the golf putter head embodiment seen in FIG. 82*a;*
Figure 84:
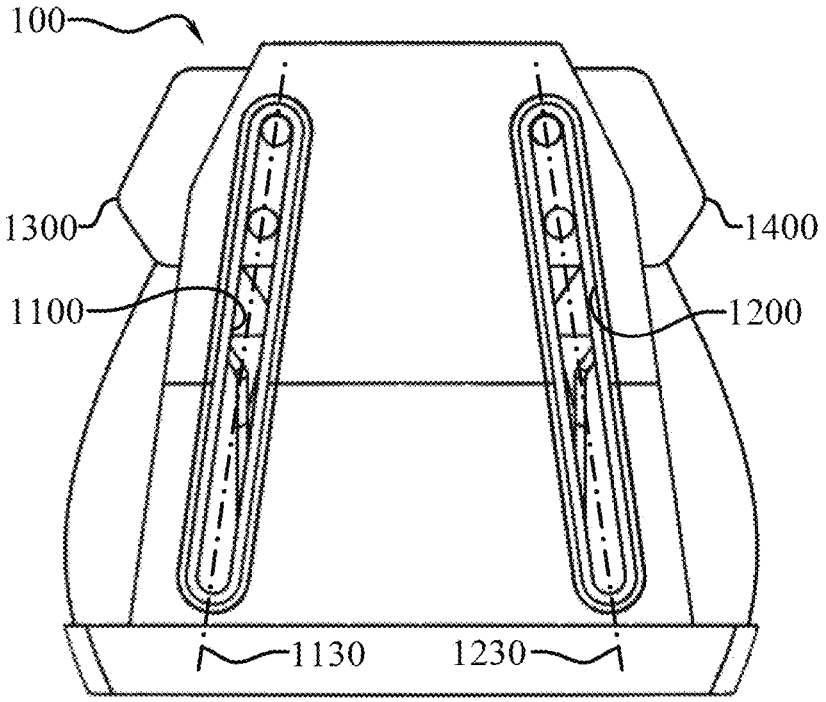
FIG. 84 is a bottom plan view of the golf putter head embodiment seen in FIG. 82*a;*
Figure 85:
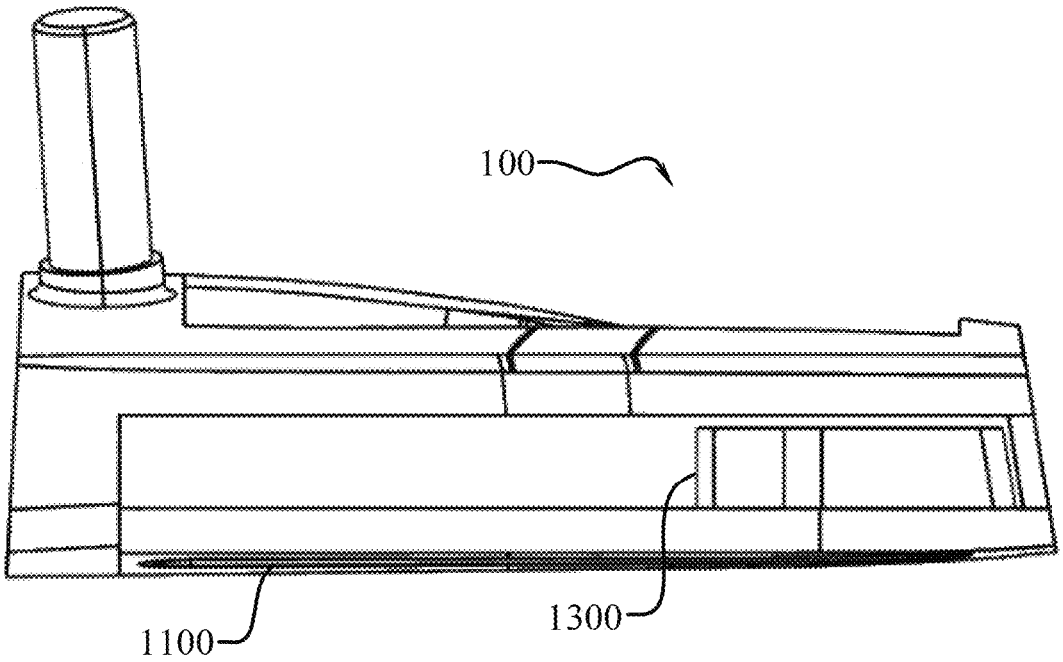
FIG. 85 is a heel side view of the golf putter head embodiment seen in FIG. 82*a;*
Figure 86:
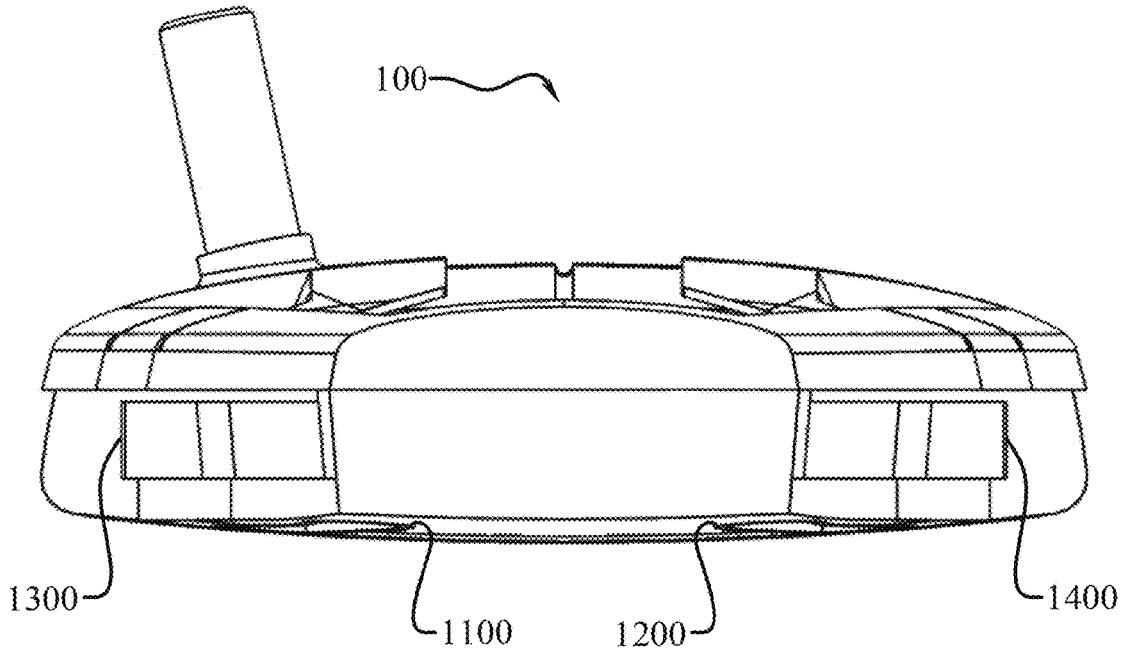
FIG. 86 is a rear side view of the golf putter head embodiment seen in FIG. 82*a;*

FIGS. 82A, 82B, and 82C illustrate yet another appealing alternative where the heel track 1100 and the toe track 1200 are formed separately of a track material, and are attached to the sole plate 132, or formed in the sole plate 132, such as by co-molding. In such an embodiment the track material has a track material density, which in one embodiment is at least 60% greater than the upper body density and/or sole plate density, and at least 100% greater in a further embodiment. In one such embodiment the upper body mass is at least 50 grams in one embodiment, and at least 55 grams, 60 grams, or 65 grams. In another embodiment the upper body mass is no more than 170 grams, and no more than 160 grams, 150 grams, 140 grams, 130 grams, 120 grams, 110 grams, 100 grams, 90 grams, or 80 grams in additional embodiments. Further, the heel track 1100 and the toe track 1200 each have a track mass, and in one embodiment the track mass is at least 10 grams, and at least 15 grams, or 20 grams in additional embodiments. In a further series of embodiments the track mass is no more than 50 grams, and in additional embodiments no more than 45 grams, 40 grams, 35 grams, or 30 grams. In an embodiment having a sole plate 132, the sole plate mass is no more than 35 grams, and in additional embodiments no more than 30 grams, 25, grams, 20 grams, or 15 grams. In one embodiment the sole plate mass is less than the total mass of the tracks combined, while in another embodiment the sole plate mass is less than the mass of the heel track or the toe track individually. In one particular embodiment the track material is a steel alloy, and the upper body material and/or the sole plate material is an aluminum alloy, magnesium alloy, or nonmetallic material. Such an embodiment frees up significant mass from the upper body portion 102, which in one embodiment is utilized to increase the total repositionable mass. In one such embodiment the total repositionable mass is at least 40% of the overall club head mass, and in further embodiments at least 42.5%, 45%, 47.5%, 50%, 52.5%, 55%, 57.5%, 60%, or 62.5%. In a further embodiment the total repositionable mass is no more than 80% of the overall club head mass, and in further embodiments no more than 75%, 70%, or 65%. The heel track 1100 and the toe track 1200 may be mechanically attached to the upper body portion 103 via fasteners or interlocking joint configurations, such as a dovetail joint, and/or adhesively attached.

Figure 111:
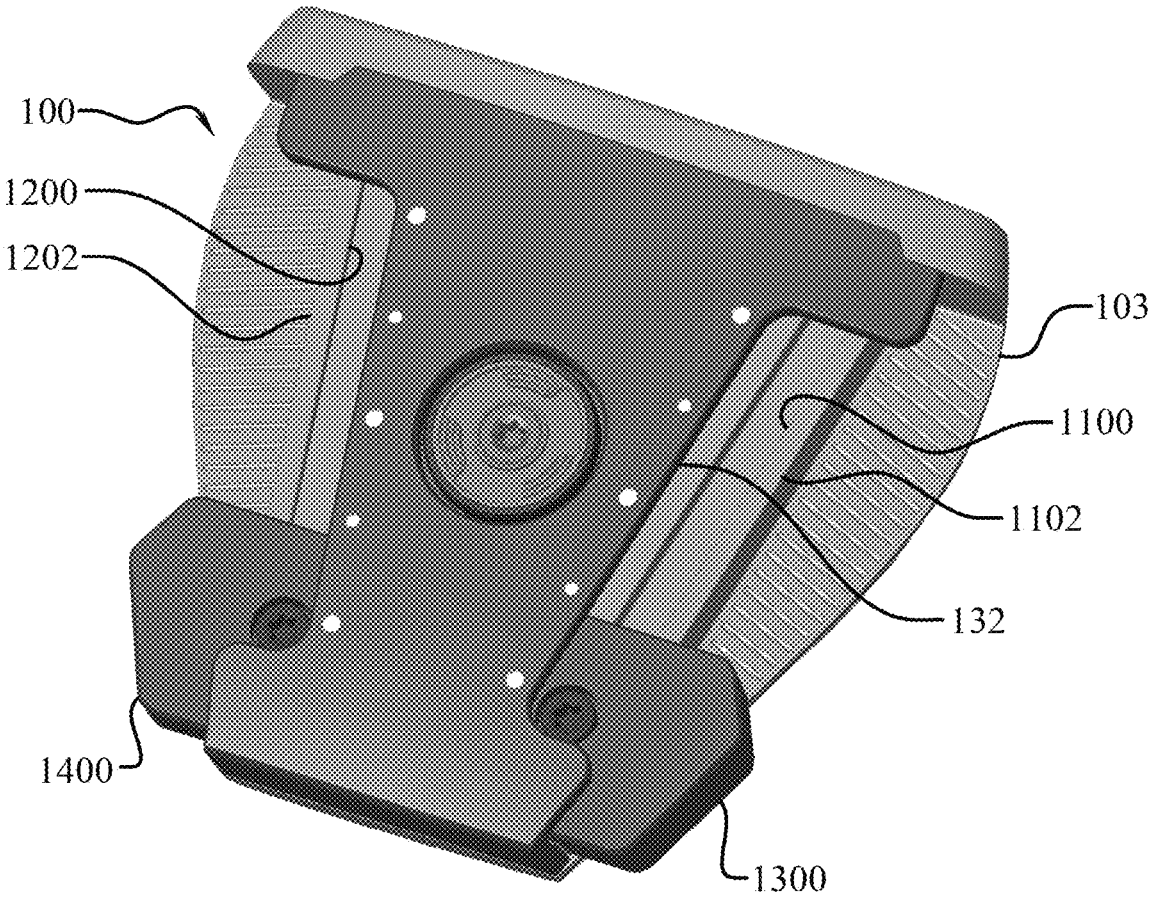
FIG. 111 is a bottom isometric view of the golf putter head embodiment seen in FIG. 106.
Figure 112:
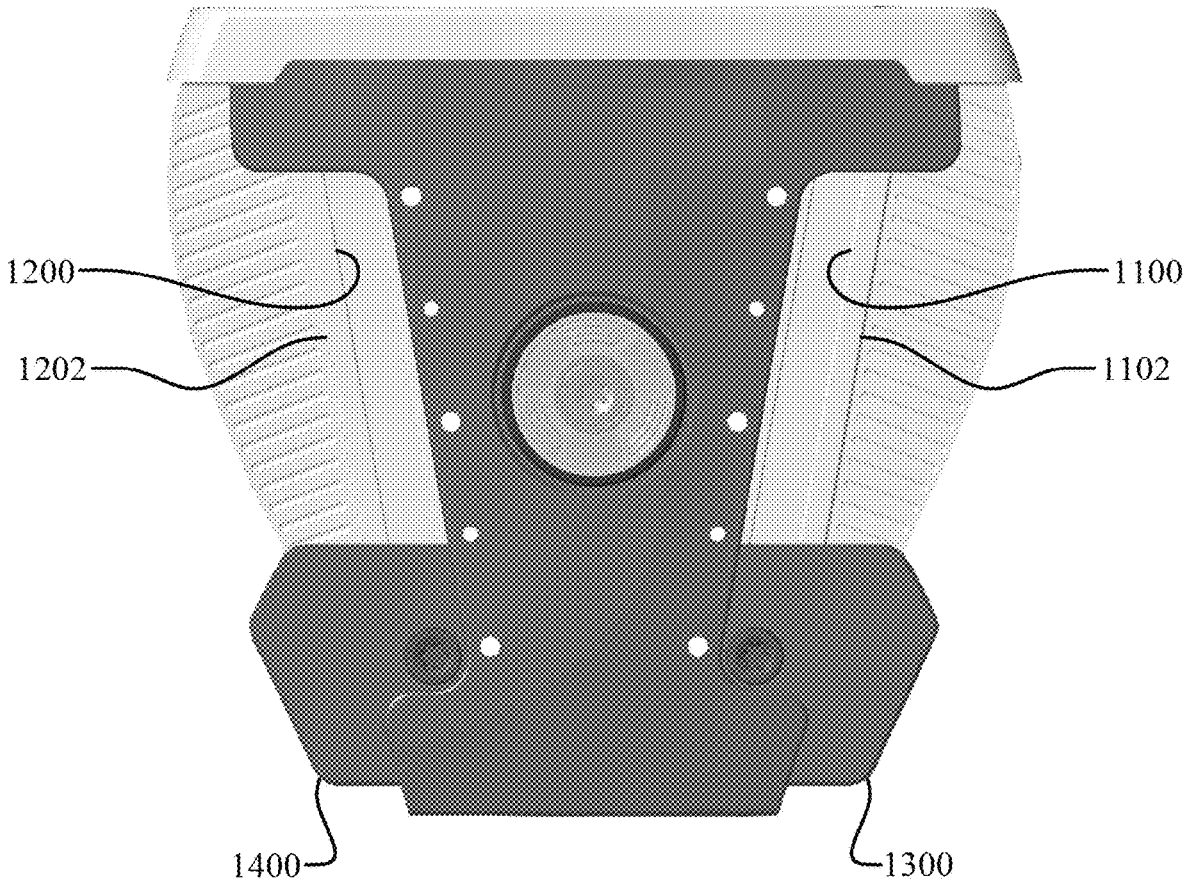
FIG. 112 is a bottom plan view of the golf putter head embodiment seen in FIG. 106.
Figure 113:
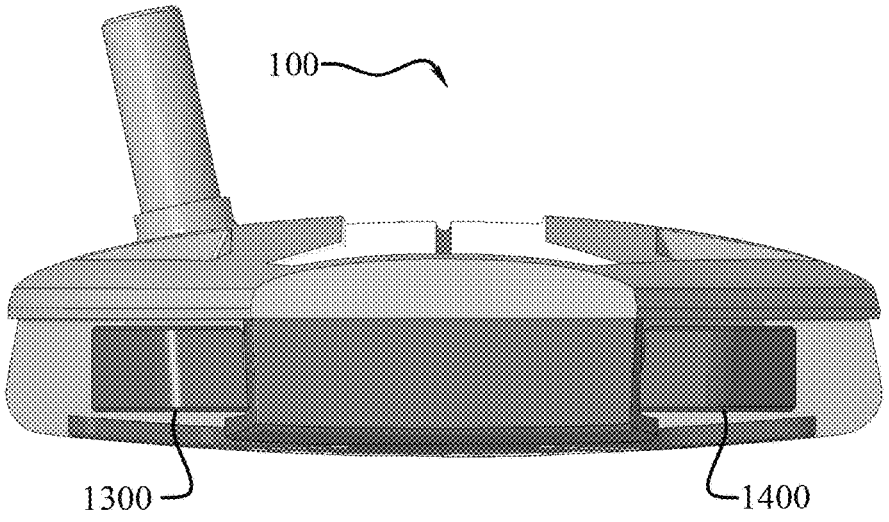
FIG. 113 is a rear view of the golf putter head embodiment seen in FIG. 106.

At least one secondary weight 2000, as seen in FIGS. 2, 111, and 114 may be attached to the sole portion 110, sole plate 132, and/or the top portion 112, in any of the disclosed embodiments. In one such embodiment the at least one secondary weight 2000 has a total secondary weight mass that is no more than the total mass of the one or more repositionable weight assemblies 1000, while in a further embodiment the total secondary weight mass that is no more than 75%, 50%, 40%, 30%, or 20% of the total mass of the one or more repositionable weight assemblies 1000. In another embodiment the total secondary weight mass is at least 2.5% of the putter head mass, and in further embodiments at least 3.5% or 4.5%. A further series of embodiments caps the total secondary weight mass to no more than 12.5%, 10%, or 7.5% of the putter head mass. In FIG. 21 two of the three illustrated secondary weights 2000 additionally serve as fasteners to secure the sole plate 132 to the upper body portion 103, and in one embodiment each have a mass of less than 2.5 grams, 1.5 grams, or 1 gram. In the illustrated embodiment the third, or central, secondary weight 2000 is located such that the club head Y-Z plane passes through the center of the central secondary weight 2000. One embodiment includes a secondary weight port 2010, seen in FIG. 21, formed in the sole plate 132, sole portion 110, and/or the top portion 112 to receive at least a portion of the at least one secondary weight 2000.

The putter head 100 may include an internal cavity 3000, seen formed in the upper body portion 103 in FIG. 23, and formed in the sole plate 132 in FIG. 82C. In one embodiment the internal cavity 3000 contains a cavity insert 3100, as seen in FIGS. 21 and 23, to improve the sound and/or feel of the putter head 100. In one embodiment the internal cavity 3000 has a cavity volume that is at least 2.5% of a putter head volume, and at least 5%, 7.5%, or 10% in further embodiments. The putter head volume is determined by a water displacement test and does not include any portion of the hosel 122. In further series of embodiment the caps the cavity volume to no more than 30%, 25%, 20%, or 15% of the putter head volume. The cavity insert 3100 occupies at least 20% of the cavity volume in one embodiment, and at least 30%, 40%, 50%, 60%, 70%, 80%, 90%, or 100% in additional embodiments. The cavity insert 3100 may be a manufactured component that is placed in the internal cavity 3000 during assembly, or it may be a material that is injected into the internal cavity 3000 and cures-in-place. In one embodiment the cavity insert 3100 is formed with a cavity insert recess 3110, seen in FIG. 21, that receives a portion of the sole plate 132 and/or the central secondary weight 2000. In one embodiment a portion of the internal cavity 3000 is within 20 mm of the front 114, and in further embodiments is within 18 mm, 16 mm, 14 mm, 12 mm, or 10 mm. In another embodiment no portion of the internal cavity 3000 extends rearward of a vertical boundary plane, which is perpendicular to the ground plane GP and parallel to the X-axis, where in one embodiment the vertical boundary plane is a boundary plane offset distance behind the origin 128 that is 65% of the maximum length L, and in further embodiments 55%, 50%, 45%, or 40% of the maximum length L. In a further embodiment at least a portion of the internal cavity 3000 is at least 10 mm from a face center vertical plane, which passes through the origin 128, is perpendicular to the ground plane, and contains the Y-axis. In a further embodiment at least a portion of the internal cavity 3000 is at least 10 mm toeward of the face center vertical plane, and in further embodiments at least 12 mm, 14 mm, or 16 mm. In a further embodiment at least a portion of the internal cavity 3000 is at least 10 mm heelward of the face center vertical plane, and in further embodiments at least 12 mm, 14 mm, or 16 mm. In yet another embodiment no portion of the internal cavity 3000 is more than 60 mm from the face center vertical plane, and in further embodiments no more than 55 mm, 50 mm, 45 mm, 40 mm, 35 mm, or 30 mm. In another embodiment a portion of the internal cavity 3000 extends to an elevation above the origin 128, and in a further embodiment to an elevation of at least 110%, 120%, 130%, or 140% of the elevation of the origin 128. In another embodiment a portion of the cavity insert 3100 extends to an elevation above the origin 128, and in a further embodiment to an elevation of at least 110%, 120%, 130%, or 140% of the elevation of the origin 128.

In one embodiment the cavity insert 3100 is formed of a nonmetallic cavity insert material having a cavity insert material density of less than 2 g/cc, and in further embodiments less than 1.8 g/cc, 1.6 g/cc, 1.4 g/cc, 1.2 g/cc, 1 g/cc, 0.8 g/cc, 0.6 g/cc, or 0.4 g/cc. The cavity insert 3100 may be formed of any of the filler materials or damper materials disclosed in U.S. patent application Ser. No. 18/506,843, filed Nov. 10, 2023, which is incorporated by reference herein in its entirety. A variety of materials and manufacturing processes may be used in providing the cavity insert 3100. In one or more embodiments, the cavity insert 3100 is a combination of Santoprene and Hybrar. For example, using different ratios of Santoprene to Hybrar, the durometer of the cavity insert 3100 may be manipulated to provide for different damping characteristics, such as interference, dampening, and stiffening properties. In one embodiment, a ratio of about 85% Santoprene to about 15% Hybrar is used. In another embodiment, a ratio of at least about 80% Santoprene to about 10% Hybrar is used. In another embodiment the cavity insert is at least 60% Santoprene, and no more than 25% Hybrar.

Examples of materials that may be suitable for use as a cavity insert 3100 include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; hydrogenated styrenic thermoplastic elastomers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchweld™ (e.g., DP-105™) and Scotchdamp™ from 3M, Sorbothane™ from Sorbothane, Inc., DYAD™ and GP™ from Soundcoat Company Inc., Dynamat™ from Dynamat Control of North America, Inc., NoViFlex™ Sylomer™ from Pole Star Maritime Group, LLC, Isoplast™ from The Dow Chemical Company, Legetolex™ from Piqua Technologies, Inc., and Hybrar™ from the Kuraray Co., Ltd.

In some embodiments, the cavity insert 3100 may have a modulus of elasticity ranging from about 0.001 GPa to about 25 GPa, and a durometer ranging from about 5 to about 95 on a Shore D scale. In other examples, gels or liquids can be used, and softer materials which are better characterized on a Shore A or other scale can be used. The Shore D hardness on a polymer is measured in accordance with the ASTM (American Society for Testing and Materials) test D2240.

In some embodiments, the cavity insert 3100 may have a density of about 0.95 g/cc to about 1.75 g/cc, or about 1 g/cc. The cavity insert 3100 may have a hardness of about 10 to about 70 shore A hardness. In certain embodiments, a shore A hardness of about 40 or less is preferred. In certain embodiments, a shore D hardness of up to about 40 or less is preferred.

In some embodiments, the cavity insert 3100 may have a density between about 0.16 g/cc and about 0.19 g/cc or between about 0.03 g/cc and about 0.19 g/cc. In certain embodiments, the density of the cavity insert 3100 is in the range of about 0.03 g/cc to about 0.2 g/cc, about 0.04-0.18 g/cc, about 0.05-0.16 g/cc, about 0.06-0.12 g/cc, or less than 0.10 g/cc. The density of the cavity insert 3100 may impact the COR, durability, strength, and damping characteristics of the club head. The cavity insert 3100 material may have a hardness range of about 15-85 Shore OO hardness or about 80 Shore OO hardness or less.

In one or more embodiments, the cavity insert 3100 may be provided with different durometers across a length of the cavity insert 3100. For example, the cavity insert 3100 may be co-molded using different materials with different durometers, masses, densities, colors, and/or other material properties. In one embodiment, the cavity insert 3100 may be provided with a softer durometer adjacent to the ideal striking location of the strike face than adjacent to the heel and toe portions. In another embodiment, the cavity insert 3100 may be provided with a harder durometer adjacent to the ideal striking location of the strike face than adjacent to the heel and toe portions. In these examples, the different material properties used to co-mold the cavity insert 3100 may provide for better performance and appearance.

Additional and different damper materials and manufacturing processes can be used in one or more embodiments. For example, additional cavity insert 3100 materials and manufacturing processes are described in U.S. Pat. Nos. 10,427,018, 9,937,395, 9,044,653, 8,920,261, and 8,088,025, which are incorporated by reference herein in their entireties. For example, the cavity insert 3100 may be manufactured at least in part of rubber, silicone, elastomer, another relatively low modulus material, metal, another material, or any combination thereof. For example, a foam, hot melt, epoxy, adhesive, liquified thermoplastic, or another material can be injected into the club head filling or partially filling the internal cavity 3000. In some embodiments, the filler material is heated past melting point and injected into the club head.

In some embodiments, a filler material is used to secure the cavity insert 3100 in place during installation, such as using hot melt, epoxy, adhesive, or another filler material. In some embodiments, a filler material can be injected into the internal cavity 3000 to make minor changes to the weight of the club head, such as to adjust the club head for proper swing weight, to account for manufacturing variances between club heads, and to achieved a desired weight of each head. In some embodiments, the cavity insert 3100 is a two-part polyurethane foam that is a thermoset and is flexible after it is cured. In one embodiment, the two-part polyurethane foam is any methylene diphenyl diisocyanate (a class of polyurethane prepolymer) or silicone based flexible or rigid polyurethane foam. In some implementations, the cavity insert 3100 is made from a non-metal, such as a thermoplastic material and/or a thermoset material.

The striking face 116 may include a face insert 117, as seen in FIG. 21, that constitutes all of, or any a portion of, the striking face 116. The face insert 117 may include grooves and/or texturing in some embodiments, and may be grooveless and/or textureless in further embodiments. The striking face 116 may include an insert recess, having a recess depth, to receive the face insert 117. In one embodiment the face insert 117 includes a nonmetallic material, and in a further embodiment the face insert nonmetallic material has a density greater than the cavity insert material density, and in further embodiments at least 10%, 20%, 30%, 40%, or 50% greater than the cavity insert material density. In a further embodiment the face insert 117 also includes a metallic portion, wherein in one embodiment the metallic portion is exposed and intended to contact a golf ball upon impact. In one embodiment the face insert nonmetallic material is a polymeric material, such as a two-part polyurethane material, according to certain examples. In other examples, the insert recess is made of a first type of metallic material and a portion of the face insert 117 is made of a second type of metallic material different from the first metallic material. In some examples, at least a portion of the face insert 117 has an exposed surface that visually contrasts with the surface of the front 114 that surrounds the insert recess. According to one example, the face insert 117 has a color that contrasts with the color of the front 114 that surrounds the insert recess. For example, the color of a portion of the face insert 117 is white and the color of the front 114 surrounding the insert recess is non-white, such as metallic-colored. In the same or an alternative example, a portion of the face insert 117 has a surface texture that is different than the surface texture of the front 114 surrounding the insert recess. According to one example, the face insert 117 is smooth relative to the front 114 surrounding the insert recess (e.g., one or more of toe region, toeward of the face insert 117, a heel region, heelward of the face insert 117, or the entire region surrounding the face insert 117 is roughened or milled). The face insert 117 has a length defined as the distance, in a heel-to-toc direction from a heelward end to a toward end of the face insert 117. The length of the face insert 117 in constant from a top of the face insert 117 to a bottom of the face insert 117, in some examples. However, in other examples, the length of the face insert 117 changes from the top to the bottom of the face insert 117. According to one example, the length of the face insert 117 decreases in a sole-to-top direction along the front 114. For example, the length of the face insert 117 can decrease or taper from a maximum face insert length to a minimum face insert length, where the maximum face insert length is greater than the minimum face insert length. In such an example, the face insert 117 can have a generally trapezoidal shape. The face insert 117 has a face insert height FIH defined as the distance from the bottom of the face insert 117 to the top of the face insert 117. According to some examples, a ratio of a blade length to the length of the face insert 117, which is the maximum face insert length in certain examples, is between, and inclusive of, 1.2 and 1.8, between, and inclusive of, 1.1 and 1.5, or between, and inclusive of, 1.6 and 1.9. The blade length is the heel-toe length of the front 114 of the body 102.

In one embodiment the face insert 117 comprises nonmetallic material, composite material, hard plastic, resilient elastomeric material, and/or carbon-fiber reinforced thermoplastic with short or long fibers, and/or any other materials and coatings disclosed herein, and any method of formation and attachment disclosed herein. In another embodiment the face insert 117 can comprise a thermoplastic material, such as fiber-reinforced thermoplastic. In certain embodiments, the face insert 117 comprise a polyamide material such as nylon. Particular examples include polyphthalamide (PPA) resin, polycarbonate resin, etc., reinforced with carbon fibers (e.g., chopped fibers). The composite material can include 20% to 60% fiber by mass, or by volume. Particular examples include 20% to 50% fiber, 30% to 40% fiber, 60% fiber or less, 50% fiber or less, 40% fiber or less, 30% fiber or less, etc., by mass or by volume. In certain embodiments, the face insert 117 can be injection molded. The face insert 117 may include a metal film deposited on its surface. The face insert 117 can comprise PPA or similar resins compatible with primer materials for metal film deposition. The face insert 117 may comprise a composite material, such as a fiber-reinforced plastic or a chopped-fiber compound (e.g., bulk molded compound or sheet molded compound), or an injection-molded polymer either alone or in combination with prepreg plies. In one embodiment the face insert 117 achieve desirable strain relationships by being formed of a polyamide resin, while in a further embodiment the polyamide resin includes fiber reinforcement, and in yet another embodiment the polyamide resin includes at least 35% fiber reinforcement. In one such embodiment the fiber reinforcement includes long-glass fibers having a length of at least 10 millimeters pre-molding and produce a finished component having fiber lengths of at least 3 millimeters, while another embodiment includes fiber reinforcement having short-glass fibers with a length of at least 0.5-2.0 millimeters pre-molding. Incorporation of the fiber reinforcement increases the tensile strength of the component, however it may also reduce the elongation to break therefore a careful balance must be struck to maintain sufficient elongation. Therefore, one embodiment includes 35-55% long fiber reinforcement, while in an even further embodiment has 40-50% long fiber reinforcement. One specific example is a long-glass fiber reinforced polyamide 66 compound with 40% carbon fiber reinforcement, such as the XuanWu XW5801 resin having a tensile strength of 245 megapascal and 7% elongation at break. Long fiber reinforced polyamides, and the resulting melt properties, produce a more isotropic material than that of short fiber reinforced polyamides, primarily due to the three-dimensional network formed by the long fibers developed during injection molding. Another advantage of long-fiber material is the almost linear behavior through to fracture resulting in less deformation at higher stresses. In one particular embodiment the face insert 117 is formed of a polycaprolactam, a polyhexamethylene adipinamide, or a copolymer of hexamethylene diamine adipic acid and caprolactam, however other embodiments may include polypropylene (PP), nylon 6 (polyamide 6), polybutylene terephthalates (PBT), thermoplastic polyurethane (TPU), PC/ABS alloy, PPS, PEEK, and semi-crystalline engineering resin systems that meet the claimed mechanical properties. In one embodiment the face insert 117 includes at least two layers that are separately formed of thermoplastic material having compatible resins and are subsequently joined via heat and/or pressure, and without the use of a bonding agent. In another embodiment the face insert 117 comprises an injection molded component and over-molded component to joint the first component and the second component. In another embodiment the face insert 117 is joined to the club head via through the use of a thermoset adhesive tape or a thermoset gasket located between a portion of the two components, and application of heat and/or pressure bonds the two components together.

In addition to those noted above, some examples of nonmetallic composites that can be used to form the face insert 117 include, without limitation, glass fiber reinforced polymers (GFRP), carbon fiber reinforced polymers (CFRP), metal matrix composites (MMC), ceramic matrix composites (CMC), and natural composites (e.g., wood composites). Further, some examples of polymers that can be used to form the components include, without limitation, thermoplastic materials (e.g., polyethylene, polypropylene, polystyrene, acrylic, PVC, ABS, polycarbonate, polyurethane, polyphenylene oxide (PPO), polyphenylene sulfide (PPS), polyether block amides, nylon, and engineered thermoplastics), thermosetting materials (e.g., polyurethane, epoxy, and polyester), copolymers, and elastomers (e.g., natural or synthetic rubber, EPDM, and Teflon®)

In other embodiments, the face insert 117 is formed as a multi-layered structure comprising an injection molded inner layer and an outer layer comprising a thermoplastic composite laminate. The injection molded inner layer may be prepared from the thermoplastic polymers, with preferred materials including a polyamide (PA), or thermoplastic urethane (TPU) or a polyphenylene sulfide (PPS). Typically the thermoplastic composite laminate structures used to prepare the outer layer are continuous fiber reinforced thermoplastic resins. The continuous fibers may include glass fibers (both roving glass and filament glass) as well as aramid fibers and carbon fibers. The thermoplastic resins may be impregnated into these fibers to make the laminate materials include polyamides (including but not limited to PA, PA6, PA12 and PA6), polypropylene (PP), thermoplastic polyurethane or polyureas (TPU) and polyphenylene sulfide (PPS).

In some embodiments the face insert 117 comprises multiple laminates that may be formed in a continuous process in which the thermoplastic matrix polymer and the individual fiber structure layers are fused together under high pressure into a single consolidated laminate, which can vary in both the number of layers fused to form the final laminate and the thickness of the final laminate. Typically the laminate sheets are consolidated in a double-belt laminating press, resulting in products with less than 2 percent void content and fiber volumes ranging anywhere between 35 and 55 percent, in thicknesses as thin as 0.5 mm to as thick as 6.0 mm, and may include up to 20 layers. Further information on the structure and method of preparation of such laminate structures is disclosed in European patent No. EP1923420B1 issued on Feb. 25, 2009 to Bond Laminates GMBH, the entire contents of which are incorporated by reference herein. The composite laminates structure of the outer layer may also be formed from the TEPEX® family of resin laminates available from Bond Laminates which preferred examples are TEPEX® dynalite 201, a PA66 polyamide formulation with reinforcing carbon fiber, which has a density of 1.4 g/cm$^3$, a fiber content of 45 vol %, a Tensile Strength of 785 mPa as measured by ASTM D 638; a Tensile Modulus of 53 gPa as measured by ASTM D 638; a Flexural Strength of 760 mPa as measured by ASTM D 790; and a Flexural Modulus of 45 GPa) as measured by ASTM D 790. Another preferred example is TEPEX® dynalite 208, a thermoplastic polyurethane (TPU)-based formulation with reinforcing carbon fiber, which has a density of 1.5 g/cc, a fiber content of, 45 vol %, a Tensile Strength of 710 mPa as measured by ASTM D 638; a Tensile Modulus of 48 gPa as measured by ASTM D 638; a Flexural Strength of 745 mPa as measured by ASTM D 790; and a Flexural Modulus of 41 gPa as measured by ASTM D 790.

Another preferred example is TEPEX® dynalite 207, a polyphenylene sulfide (PPS)-based formulation with reinforcing carbon fiber, which has a density of 1.6 g/cc, a fiber content of 45 vol %, a Tensile Strength of 710 mPa as measured by ASTM D 638; a Tensile Modulus of 55 gPa as measured by ASTM D 638; a Flexural Strength of 650 mPa as measured by ASTM D 790; and a Flexural Modulus of 40 gPa as measured by ASTM D 790.

There are various ways in which the multilayered face insert 117 may be formed. In some embodiments the outer layer, is formed separately and discretely from the forming of the injection molded inner layer. The outer layer may be formed using known techniques for shaping thermoplastic composite laminates into parts including but not limited to compression molding or rubber and matched metal press forming or diaphragm forming. The inner layer may be injection molded using conventional techniques and secured to the outer layer by bonding methods known in the art including but not limited to adhesive bonding, including gluing, welding (preferable welding processes are ultrasonic welding, hot element welding, vibration welding, rotary friction welding or high frequency welding. Before the inner layer is secured to the outer layer, the outer surface of the inner layer and/or the inner of the outer layer may be pretreated by means of one or more of the following processes: mechanical treatment, such as by brushing or grinding; cleaning with liquids, preferably with aqueous solutions or organics solvents for removal of surface deposits; flame treatment, such as with propane gas, natural gas, town gas or butane; corona treatment (potential-loaded atmospheric pressure plasma); potential-free atmospheric pressure plasma treatment; low pressure plasma treatment (air and 02 atmosphere); UV light treatment; chemical pretreatment, e.g. by wet chemistry by gas phase pretreatment; and/or primers and coupling agents.

In an especially preferred method of preparation a so called hybrid molding process may be used in which the composite laminate outer layer is insert molded to the injection molded inner layer to provide additional strength. Typically the composite laminate structure is introduced into an injection mold as a heated flat sheet or, preferably, as a preformed part. During injection molding, the thermoplastic material of the inner layer is then molded to the inner surface of the composite laminate structure the materials fuse together to form the face insert 117 as a highly integrated part. Typically the injection molded inner layer is prepared from the same polymer family as the matrix material used in the formation of the composite laminate structures used to form the outer layer so as to ensure a good weld bond.

A further embodiment includes a polymer layer on the striking surface of the face insert 117. The polymer layer can be provided on the outer surface of the face insert 117 to provide for better performance of the face insert 117, such as in wet conditions. Exemplary polymer layers are described in U.S. patent application Ser. No. 13/330,486 (patented as U.S. Pat. No. 8,979,669), which is incorporated by reference. The polymer layer may include polyurethane and/or other polymer materials. The polymer layer may have a polymer thickness of at least 0.05 mm, and in further embodiments at least 0.1 mm, 0.15 mm, 0.2 mm, 0.25 mm, or 0.3 mm. In another embodiment the polymer thickness is no more than 1 mm, and in further embodiments no more than 0.9 mm, 0.8 mm, 0.6 mm, or 0.5 mm. The polymer layer can be configured with alternating maximum thicknesses and minimum thicknesses to create score lines on the face insert 117. Further, in some embodiments, teeth and/or another texture may be provided on the thicker areas of the polymer layer between the score lines, such as those disclosed in U.S. Ser. No. 18/109,760, filed Feb. 14, 2023, which is incorporated herein by reference in its entirety.

The size and shape of the insert recess corresponds with the size and shape of the face insert 117. For example, the insert recess has the same peripheral shape as the face insert 117. Moreover, the size of the outer periphery of and the depth of the insert recess is just larger than the outer periphery and thickness of the face insert 117, respectively. In some examples, the outer periphery of the insert recess is sized so that the edge of the recess contacts the edge of the face insert 117. Unless otherwise noted, the term "substantially" or "about" means within 5% of a defined characteristic. According to certain examples, a depth of the insert recess is substantially equal to a thickness of the face insert 117, which can be a constant or variable thickness. The depth of the insert recess and the thickness of the face insert 117 are selected so that when the face insert 117 is seated in the insert recess, the face insert 117 is between, and inclusive of, 0.15 mm proud and 0.1 mm recessed, between, and inclusive of, 0.1 mm proud and 0.05 mm recessed, or between, and inclusive of, 0.05 mm proud and 0.05 mm recessed relative to the portion of the front 114 that surrounds the insert recess. In some examples, the depth of the insert recess is between, and inclusive of, 3 mm and 5 mm. The face insert 117 may further include any of the materials and variations disclosed in U.S. Pat. No. 7,465,240, issued Dec. 16, 2008, U.S. Pat. No. 6,089,993 issued Jul. 18, 2000, which are incorporated by reference herein in their entirety. Further, the striking face 116 may include a plurality of grooves, include any of those disclosed in U.S. Pat. No. 5,637,044, issued Jun. 10, 1997, which is incorporated by reference herein in the entirety.

As previously disclosed, a number of variations of the hosel 122 may be incorporated in the present putter head 100, including the variations illustrated in the embodiments of FIGS. 30-55. In fact, U.S. Provisional Patent Application No. 63/436,330, titled "PUTTER-TYPE GOLF CLUB HEAD, filed Dec. 30, 2022, is incorporated by reference herein in its entirety, and particularly applies to FIGS. 30-55.

Figure 56:
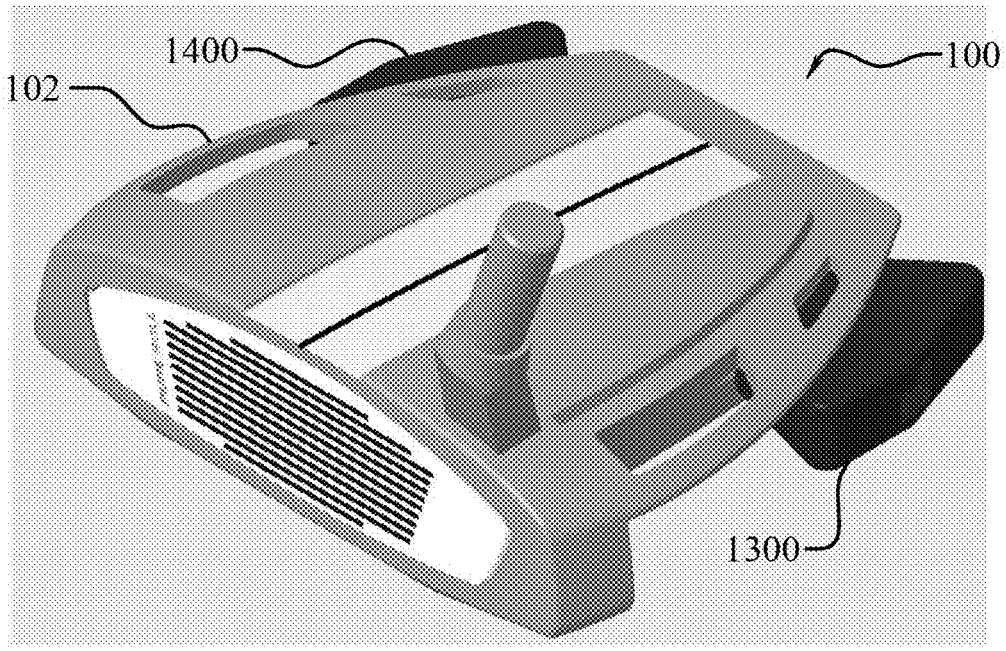
FIG. 56 is an isometric view of another golf putter head embodiment with the toe and heel weights positioned at the rear portion of the putter head.
Figure 57:
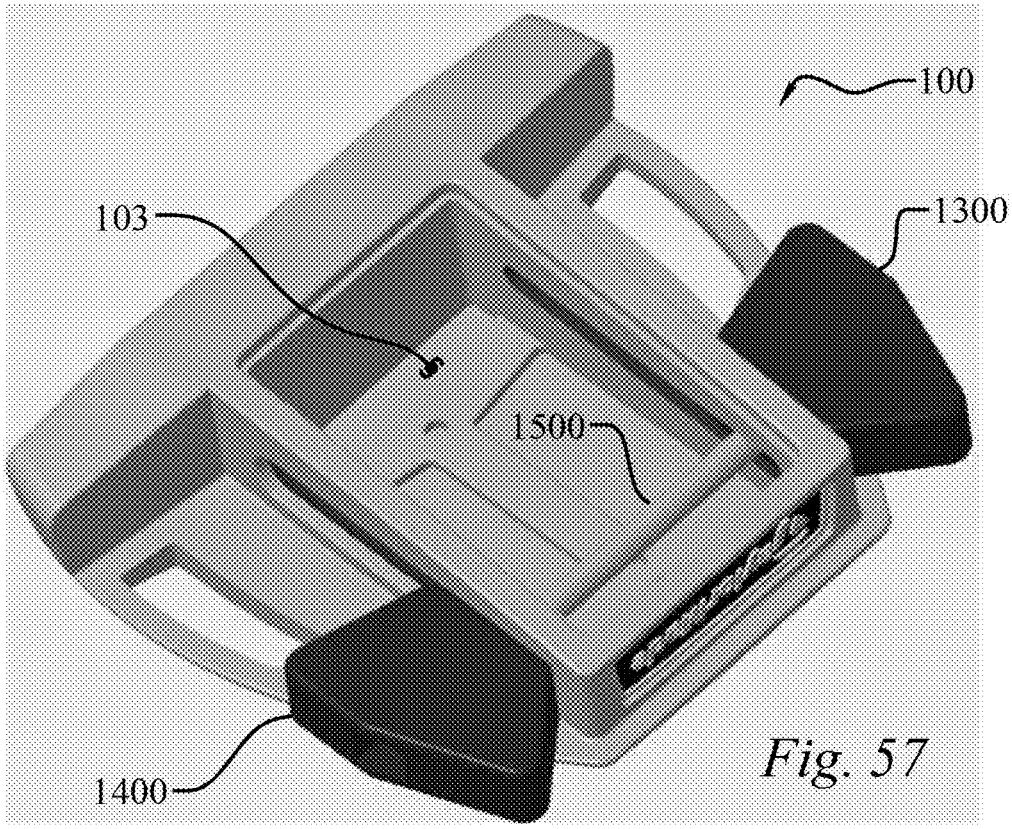
FIG. 57 is a bottom isometric view of the golf putter head embodiment seen in FIG. 56 with the toe and heel weights positioned at the rear portion of the putter head.

While most of the illustrated embodiments show the heel weight assembly 1300 and the toe weight assembly 1400 as independently repositionable, in the embodiment of FIGS. 56-57 the heel weight assembly 1300 and the toe weight assembly 1400 are joined by a weight assembly interconnect 1500 such that they must move in unison. All of the disclosure applies equally to such an embodiment. For example, while the illustrated tracks are perpendicular to the striking face 116, they may be angled as disclosed throughout, both with respect to getting further apart, or closer together, as the weight assemblies approach the striking face, and with respect to the changes in elevation of the weight assemblies as they approach the striking face.

Another embodiment includes at least one toe window 1600 and/or at least one heel window 1700, formed in the top portion 112, the sole portion 110, and/or a side portion, as seen in FIGS. 58-61. The toe window 1600 has a toe window length 1610, measured in the direction of the club head Y-axis, and a toe window width 1620, measured in the direction of the club head X-axis, and having a toe window open area. Likewise, the heel window 1700 has a heel window length 1710, measured in the direction of the club head Y-axis, and a heel window width 1720, measured in the direction of the club head X-axis, and having a heel window open area. In one embodiment the toe window length 1610 and/or heel window length 1710 varies depending upon the location along the club head X-axis between a maximum length and a minimum length, and in one embodiment the maximum length is at least 5% greater than the minimum length, and at least 7.5%, 10%, or 12.5% greater in additional embodiments. The relationship is capped in a further series of embodiments where the maximum length is no more than 155% of the minimum length in one embodiment, and no more than 145%, 135%, and 125% in additional embodiments. In another embodiment the toe window width 1620 and/or heel window width 1720 varies depending upon the location along the club head Y-axis between a maximum width and a minimum width, and in one embodiment the maximum width is at least 5% greater than the minimum width, and at least 7.5%, 10%, or 12.5% greater in additional embodiments. The relationship is capped in a further series of embodiments where the maximum width is no more than 155% of the minimum width in one embodiment, and no more than 145%, 135%, and 125% in additional embodiments. In one embodiment the toe window open area and/or the heel window open area is at least 20 mm^2, and in further embodiments at least 25 mm^2, 30 mm^2, 35 mm^2, 40 mm^2, 45 mm^2, or 50 mm^2. Another series of embodiments caps the toe window open area and/or the heel window open area to no more than 150 mm^2, and in further embodiments no more than 130 mm^2, 110 mm^2, 100 mm^2, 90 mm^2, 80 mm^2, or 70 mm^2.

Another embodiment includes a forward toe window 1600 and a rearward toe window 1600, and/or a forward heel window 1700 and a rearward heel window 1700. In a further embodiment the toe window open area of the forward toe window 1600 is greater than that of the rearward toe window 1600, and in additional embodiments at least 10%, 20%, or 30% greater; while another series of embodiments caps the toe window open area of the forward toe window 1600 to no more than 1000% of that of the rearward toe window 1600, and in additional embodiments no more than 900%, 850%, 800%, 750%, 700%, 650%, 600%, or 550%. In a further embodiment the heel window open area of the forward heel window 1700 is greater than that of the rearward heel window 1700, and in additional embodiments at least 10%, 20%, or 30% greater; while another series of embodiments caps the heel window open area of the forward heel window 1700 to no more than 1000% of that of the rearward heel window 1700, and in additional embodiments no more than 900%, 850%, 800%, 750%, 700%, 650%, 600%, or 550%.

As previously disclosed, the heel weight assembly 1300 and/or the toe weight assembly 1400 has a maximum visible surface area and a minimum visible surface area. In one embodiment the toe window open area is at least 25% of the maximum visible surface area of the toe weight assembly 1400, and in additional embodiments at least 35%, 45%, 55%, or 65%. Another series of embodiments caps this relationship such that the toe window open area is no more than 100% of the maximum visible surface area of the toe weight assembly 1400, and in additional embodiments no more than 95%, 90%, or 85%. Similarly, in one embodiment the heel window open area is at least 25% of the maximum visible surface area of the heel weight assembly 1300, and in additional embodiments at least 35%, 45%, 55%, or 65%. Another series of embodiments caps this relationship such that the heel window open area is no more than 100% of the maximum visible surface area of the heel weight assembly 1300, and in additional embodiments no more than 95%, 90%, or 85%.

In one embodiment the at least one toe window 1600 and/or at least one heel window 1700 is within the visible clearance distance, thereby allowing the user to visually see a portion of the heel weight assembly 1300 and/or the toe weight assembly 1400 within the visual clearance distance, yet the heel weight assembly 1300 and/or the toe weight assembly 1400 do not create a portion of the visible perimeter length of the overall putter head 100 within the visual clearance distance. This allows the user to note the location of the heel weight assembly 1300 and/or the toc weight assembly 1400 even when it would otherwise be hidden by the visible perimeter of the overall putter head 100, and the location's impact on the performance of the putter head 100. Thus, in one embodiment at least 5 mm^2 of the toe window open area and/or the heel window open area is within the visual clearance distance, and in further embodiments at least 7.5 mm^2, 10 mm^2, 12.5 mm^2, 15 mm^2, 17.5 mm^2, or 20 mm^2. Another series of embodiments caps the toe window open area, and/or the heel window open area, within the visual clearance distance to no more than 140 mm^2, and in further embodiments no more than 120 mm^2, 100 mm^2, 90 mm^2, 80 mm^2, 70 mm^2, or 60 mm^2.

In a further embodiment the visibility of the heel weight assembly 1300 and/or the toc weight assembly 1400 within the toc window 1600 and/or heel window 1700 is emphasized by having a contrast whereby the weight assembly contrasts with the top portion 112 around the perimeter of the toc window 1600 and/or heel window 1700. Further, in another embodiment a portion of the sole plate 132 is visible through the toe window 1600 and/or heel window 1700 when the sole plate 132 is not visually obscured by the location of the heel weight assembly 1300 and/or the toe weight assembly 1400. For instance, in FIG. 59 a portion of the sole plate 132 is visible through the rearward toe window 1600 and/or rearward heel window 1700, and in a further embodiment the visible portion of the sole plate 132 contrasts with the top portion 112 around the perimeter of the toe window 1600 and/or heel window 1700. Additionally, the weight assembly may contrast with the visible portion of the sole plate 132. The term contrasts refers to a shade, color, finish, and/or texture that contrasts and/or is different from the shade, color, finish, and/or texture of the portion of the club head described as creating a contrast and a visual cue to the user. In one example of a combination of contrasting colors or shades would be for example a black or metallic grey or silver color contrasting with white, but also included are other combinations which provide at a minimum a "just noticeable difference" to the human eye. A color difference between two colors can then be quantified using the following formula;

$$\Delta E^*_{ab} = \sqrt{(L_2^* - L_1^*)^2 + (a_2^* - a_1^*)^2 + (b_2^* - b_1^*)^2}$$

where ($L^*_1$, $a^*_1$ and $b^*_1$) and ($L^*_2$, $a^*_2$ and $b^*_2$) represents two colors in the L, a, b space and where $\Delta E^*_{ab}$=2.3 sets the threshold for the "just noticeable difference" under illuminant conditions using the reference illuminant D65 (similar to outside day lighting) as described in CIE 15.2-1986. Thus, in one embodiment the color contrast is present when a contrasting color difference, $\Delta E^*_{ab}$, is greater than 2.3, preferably greater than 10, more preferably greater than 20, even more preferably greater than 40 and even more preferably greater than 60.

In another example the contrast is provided solely by the finish whereby one surface may be provided as a matte, semigloss, or low gloss surface area having a CIELab gloss value of less than about 60, about 50, or about 40 gloss units and a second contrasting surface having a CIELab gloss value of greater than about 40, about 50, about 60, and about 70 gloss units. For example, a matte or low gloss face insert may have gloss values of less than 10, 8, 5, 4, or 2 gloss units. The contrast may be provided by color, brightness, texture, finish, or another visual difference. For example, different finishes may be used, such gloss, semigloss, low gloss, matte, or another finish. Different textures may also be used, such textures manufactured into the club head components, ridges, valleys, patterns of material, composite weaves, and other textures.

In some embodiments, a first contrast surface may be a dark surface area having a CIELab brightness (L) of less than about 40 and a second contrast surface may be a bright surface area having a CIELab brightness of between about 50 and about 100. In some embodiments, the difference in brightness ($\Delta L$) between the contrasting surfaces is at least 5, at least 10, at least 20, at least 30, at least 40, or at least 50. Further, all of the disclosed contrast relationships between the weight assembly and the top portion 112, apply equally other components as such visual distinctions aid in alignment of the putter head 100, including (a) a contrast between the face insert 117 and a portion of the striking face 116 surrounding the face insert, (b) a contrast between a portion of the striking face 116 and a portion of the top portion 112 adjacent to the striking face 116, (c) a contrast between the hosel 122 and a portion of the top portion 112 adjacent to the hosel 122, and/or (d) a contrast between the one or more repositionable weight assemblies 1000 and the top portion 112 adjacent to the perimeter of the putter head 100.

Figure 58:
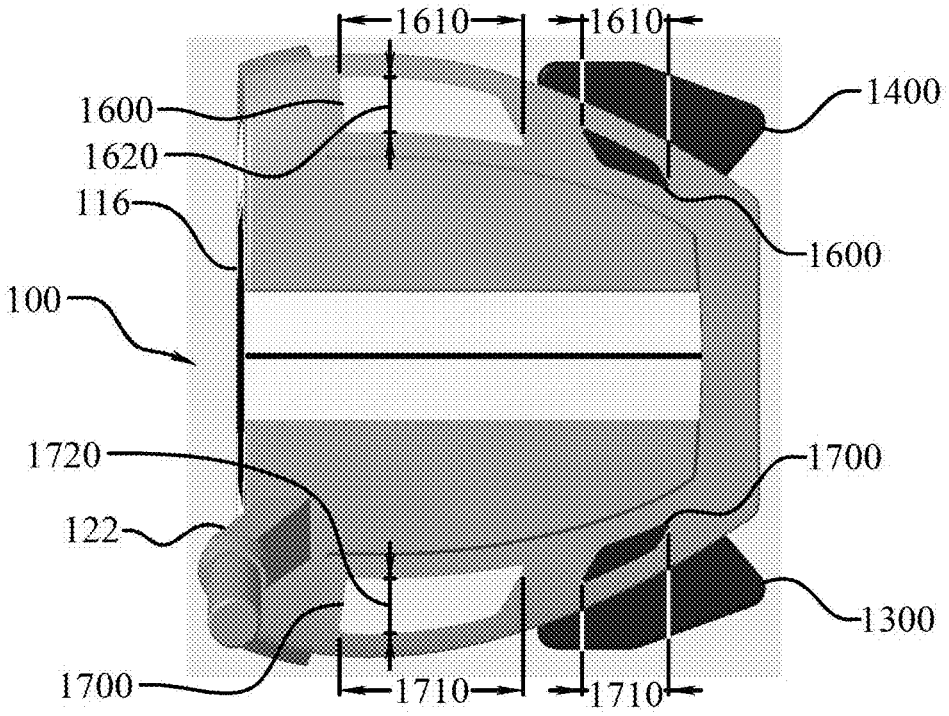
FIG. 58 is a top plan view of the golf putter head embodiment seen in FIG. 56 with the toe and heel weights positioned at the rear portion of the putter head.
Figure 59:
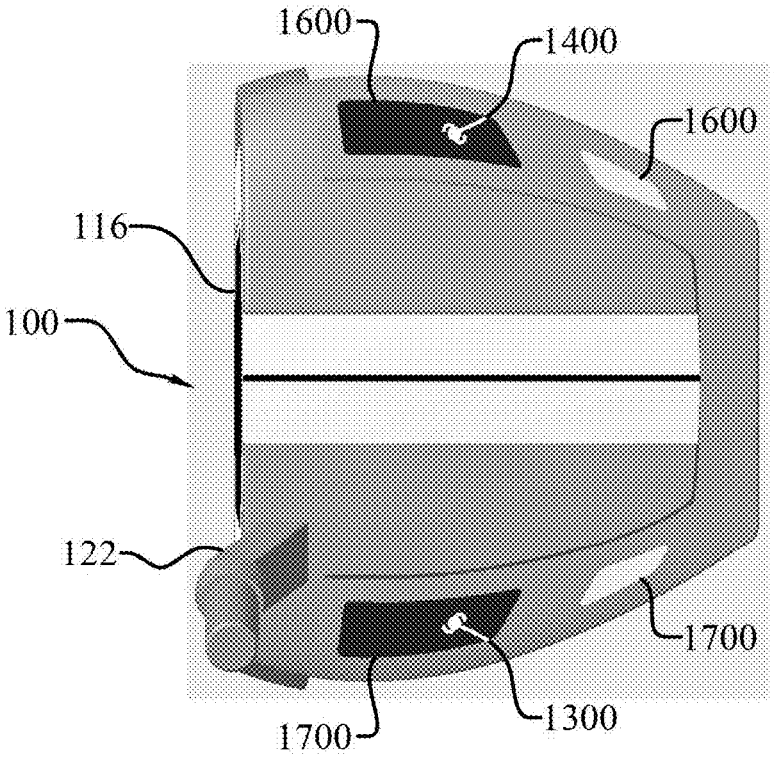
FIG. 59 is a top plan view of the golf putter head embodiment seen in FIG. 56 with the toe and heel weights positioned at the front portion of the putter head.

Another embodiment the toe window 1600 has a toe window perimeter that includes at least one straight toe window perimeter section. In one embodiment the straight toe window perimeter section is located along the toe window perimeter nearest the striking face 116 and is referred to as a face side straight toe window perimeter section. The face side straight toe window perimeter section is parallel to the club head X-axis in one embodiment. In an alternative embodiment the face side straight toe window perimeter section is not parallel to the club head X-axis, and in a further embodiment creates an acute angle, toward the face, from the club head Y-Z plane, as seen in FIG. 58. In one embodiment the acute angle is 65-89 degrees, and in further embodiments 70-85 degrees or 75-80 degrees.

In one embodiment the straight toe window perimeter section is located along the toc window perimeter nearest the rearward portion 118 and is referred to as a rear side straight toe window perimeter section. The rear side straight toe window perimeter section is parallel to the club head X-axis in one embodiment. In an alternative embodiment the rear side straight toe window perimeter section is not parallel to the club head X-axis, and in a further embodiment creates an acute angle, toward the face, from the club head Y-Z plane, as seen in FIG. 58, which in still a further embodiment is a less than the angle than that created by the face side straight toe window perimeter section. In yet another embodiment the toe window perimeter that includes at least one curved toe window perimeter section, which in a further embodiment has a curved length that is greater than a length of the face side straight toe window perimeter section and/or a length of the rear side straight toe window perimeter section. Yet another embodiment has two curved toe window perimeter sections, which in a further embodiment has curved lengths that are greater than the length of the face side straight toe window perimeter section and/or the length of the rear side straight toe window perimeter section.

The toe weight assembly 1400 may also have a straight face side toe weight assembly perimeter section that mimics the attributes described with respect to the face side straight toe window perimeter section. For instance, the straight face side toe weight assembly perimeter section is parallel to the club head X-axis in one embodiment. In an alternative embodiment the straight face side toe weight assembly perimeter section is not parallel to the club head X-axis, and in a further embodiment creates an acute angle, toward the face, from the club head Y-Z plane, as seen in FIG. 58. In one embodiment the acute angle is 65-89 degrees, and in further embodiments 70-85 degrees or 75-80 degrees.

Another embodiment the heel window 1700 has a heel window perimeter that includes at least one straight heel window perimeter section. In one embodiment the straight heel window perimeter section is located along the heel window perimeter nearest the striking face 116 and is referred to as a face side straight heel window perimeter section. The face side straight heel window perimeter section is parallel to the club head X-axis in one embodiment. In an alternative embodiment the face side straight heel window perimeter section is not parallel to the club head X-axis, and in a further embodiment creates an acute angle, toward the face, from the club head Y-Z plane, as seen in FIG. 58. In one embodiment the acute angle is 65-89 degrees, and in further embodiments 70-85 degrees or 75-80 degrees.

In one embodiment the straight heel window perimeter section is located along the heel window perimeter nearest the rearward portion 118 and is referred to as a rear side straight heel window perimeter section. The rear side straight heel window perimeter section is parallel to the club head X-axis in one embodiment. In an alternative embodiment the rear side straight heel window perimeter section is not parallel to the club head X-axis, and in a further embodiment creates an acute angle, toward the face, from the club head Y-Z plane, as seen in FIG. 58, which in still a further embodiment is a less than the angle than that created by the face side straight heel window perimeter section. In yet another embodiment the heel window perimeter includes at least one curved heel window perimeter section, which in a further embodiment has a curved length that is greater than a length of the face side straight heel window perimeter section and/or a length of the rear side straight heel window perimeter section. Yet another embodiment has two curved heel window perimeter sections, which in a further embodiment has curved lengths that are greater than the length of the face side straight heel window perimeter section and/or the length of the rear side straight heel window perimeter section. In a further embodiment at least one of the curved heel window perimeter sections has a curvature that is substantially similar to the adjacent perimeter of the overall putter head 100; and in another embodiment at least one of the curved toe window perimeter sections has a curvature that is substantially similar to the adjacent perimeter of the overall putter head 100. For instance in one embodiment a distance measured from the curved heel window perimeter section has a perimeter offset distance measured along the club head X-axis between the curved heel window perimeter section and the adjacent perimeter of the overall putter head 100, and the perimeter offset distance is substantially constant throughout at least 50%, 60%, 70%, 80%, 90%, or 100% of the length of the curved heel window perimeter section. Likewise, in another embodiment a distance measured from the curved toe window perimeter section has a perimeter offset distance measured along the club head X-axis between the curved toe window perimeter section and the adjacent perimeter of the overall putter head 100, and the perimeter offset distance is substantially constant throughout at least 50%, 60%, 70%, 80%, 90%, or 100% of the length of the curved toe window perimeter section.

The heel weight assembly 1300 may also have a straight face side heel weight assembly perimeter section that mimics the attributes described with respect to the face side straight heel window perimeter section. For instance, the straight face side heel weight assembly perimeter section is parallel to the club head X-axis in one embodiment. In an alternative embodiment the straight face side heel weight assembly perimeter section is not parallel to the club head X-axis, and in a further embodiment creates an acute angle, toward the face, from the club head Y-Z plane, as seen in FIG. 58. In one embodiment the acute angle is 65-89 degrees, and in further embodiments 70-85 degrees or 75-80 degrees. Each of these straight sections influences club head alignment.

Figure 60:
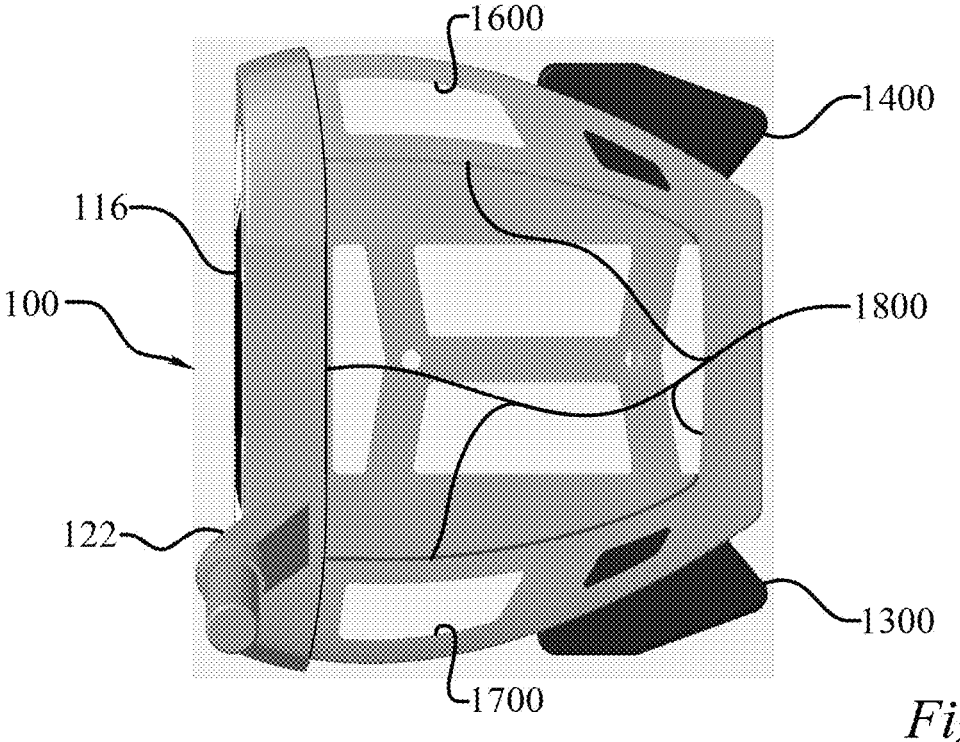
FIG. 60 is a top plan view of another golf putter head embodiment with the toe and heel weights positioned at the rear portion of the putter head.
Figure 61:
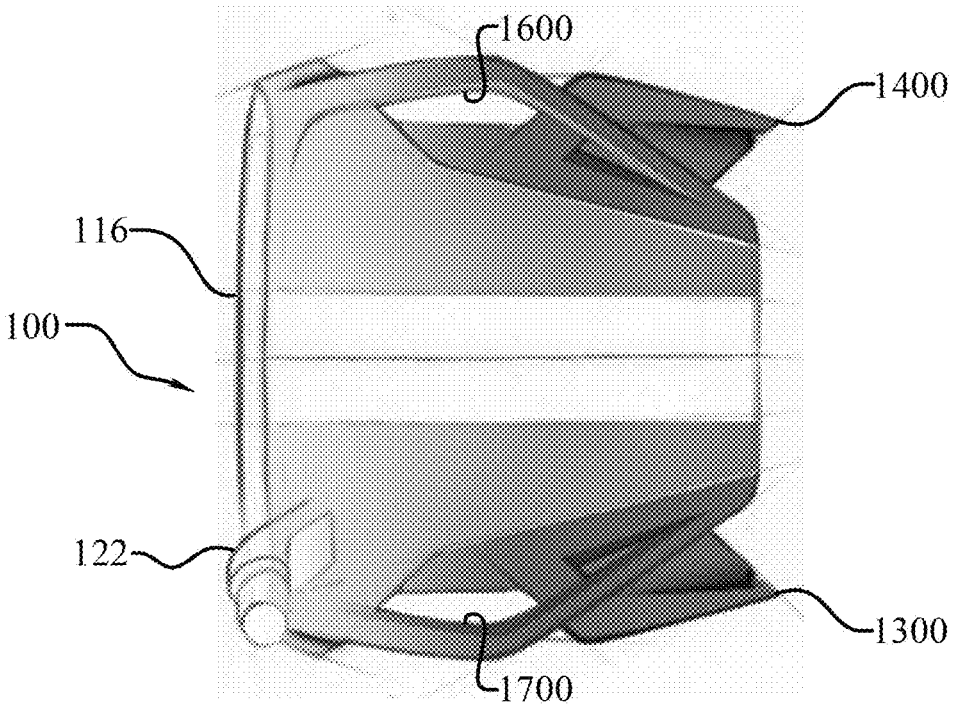
FIG. 61 is a top plan view of another golf putter head embodiment with the toe and heel weights positioned at the rear portion of the putter head.

All, or a portion, of the top portion 112 may include a separate cap attached to the putter head 100. In one such embodiment a portion of the cap may be recessed in a top portion recess 1800, as seen in FIG. 60. In one embodiment the cap has a cap density that is less than the density of the upper body portion 103 and/or the sole plate 132, while in further embodiments the cap density is no more than 80%, 70%, 60%, or 50% of the density of the upper body portion 103 and/or the sole plate 132. The cap may be formed of non-metallic material in an embodiment, including any of the non-metallic materials and densities disclosed herein. The upper body portion 103 of FIG. 60 is formed with at least one opening completely through the upper body portion 103 in the direction of the club head Z-axis, and in in a further embodiment the opening extends across the club head Y-Z plane passing through the origin 128 from the heel half of the club head to the toe half of the club head; in fact the embodiment of FIG. 60 has two such openings. In a further embodiment the upper body portion 103 of FIG. 60 is formed with at least one opening completely through the upper body portion 103 in the direction of the club head Z-axis that does not extend across the club head Y-Z plane passing through the origin 128, and is therefore confined to only the heel half of the club head and/or the toe half of the club head. In a further embodiment the upper body portion 103 of FIG. 60 is formed with at least one opening completely through the upper body portion 103 in the direction of the club head Z-axis that is circular and centered on the club head Y-Z plane passing through the origin 128, and in a further embodiment a diameter of the circular opening is at least 31 mm, 34 mm, 37 mm, or 40 mm; while in further embodiments the diameter is no more than 85 mm, 80 mm, 75 mm, 70 mm, 65 mm, 60 mm, 55 mm, 50 mm, or 45 mm.

Figure 106:
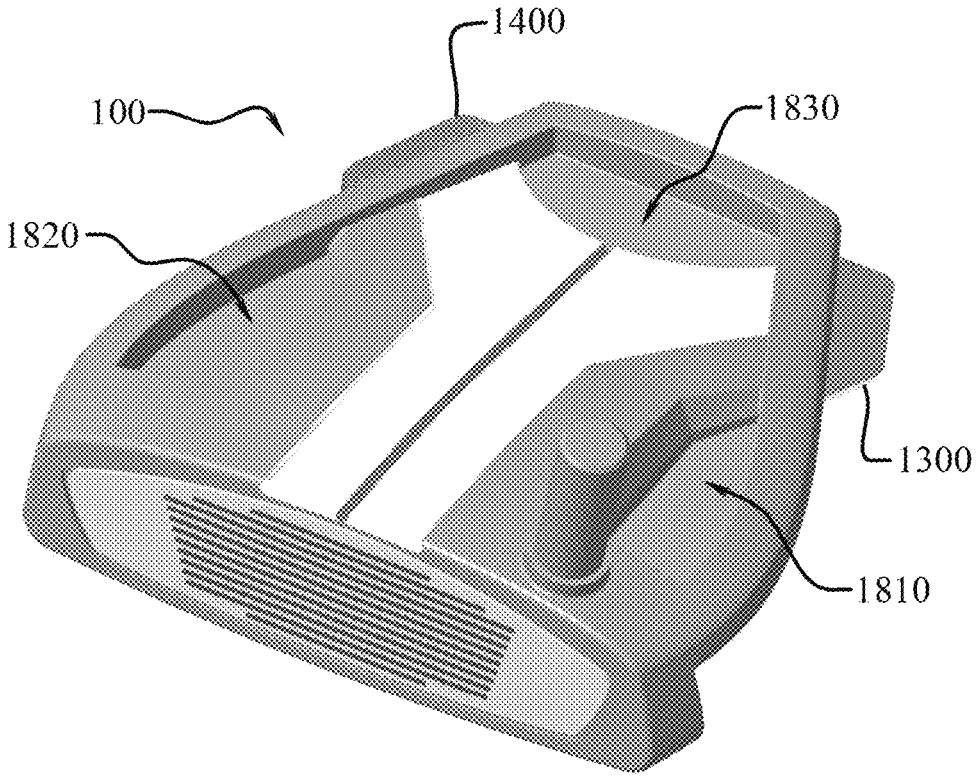
FIG. 106 is an isometric view of another golf putter head embodiment.
Figure 107:
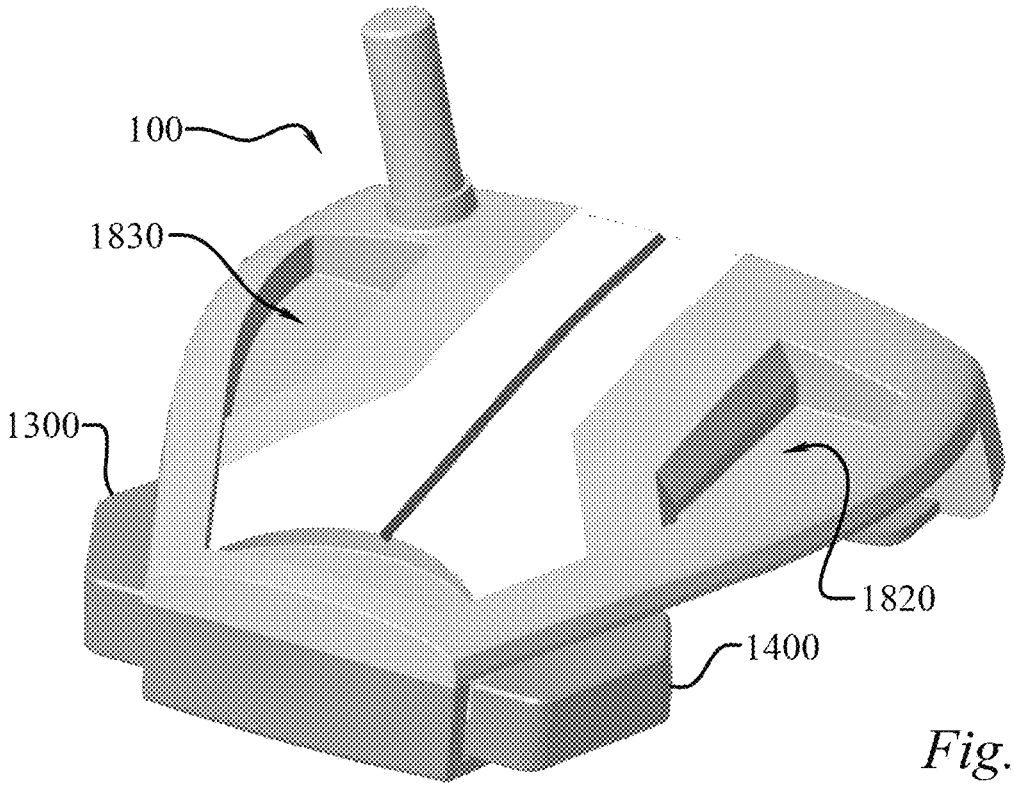
FIG. 107 is another isometric view of the golf putter head embodiment seen in FIG. 106.
Figure 108:
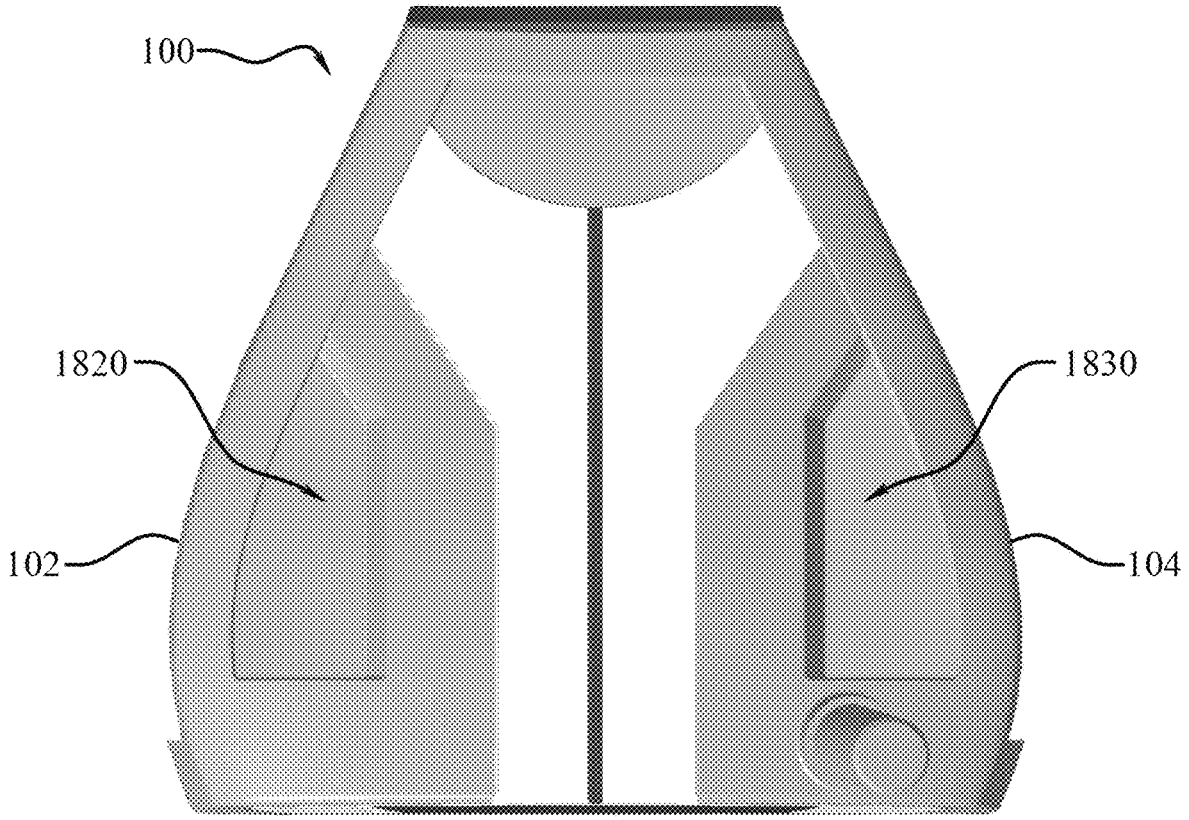
FIG. 108 is a top plan view of the golf putter head embodiment seen in FIG. 106 with the toe and heel weights located in the front portion of the golf putter head.
Figure 109:
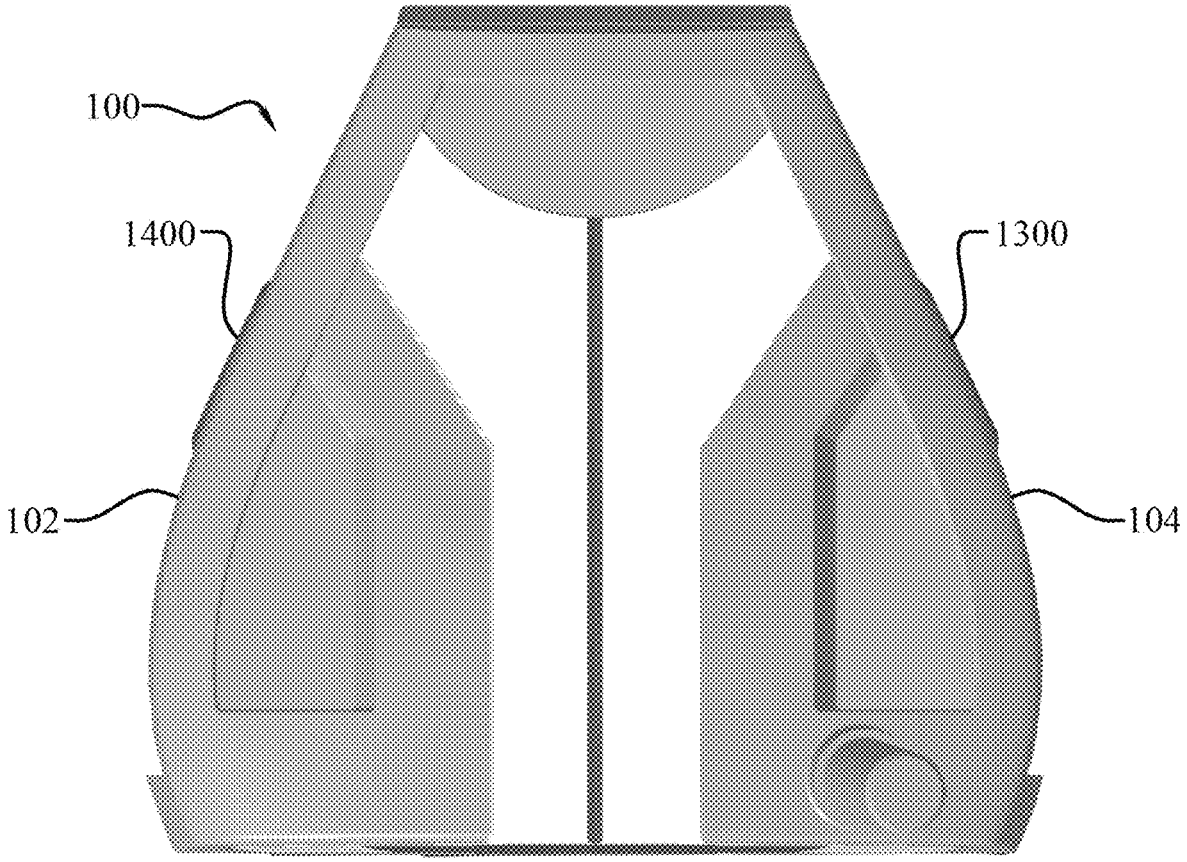
FIG. 109 is a top plan view of the golf putter head embodiment seen in FIG. 106 with the toe and heel weights located in the middle portion of the golf putter head.
Figure 110:
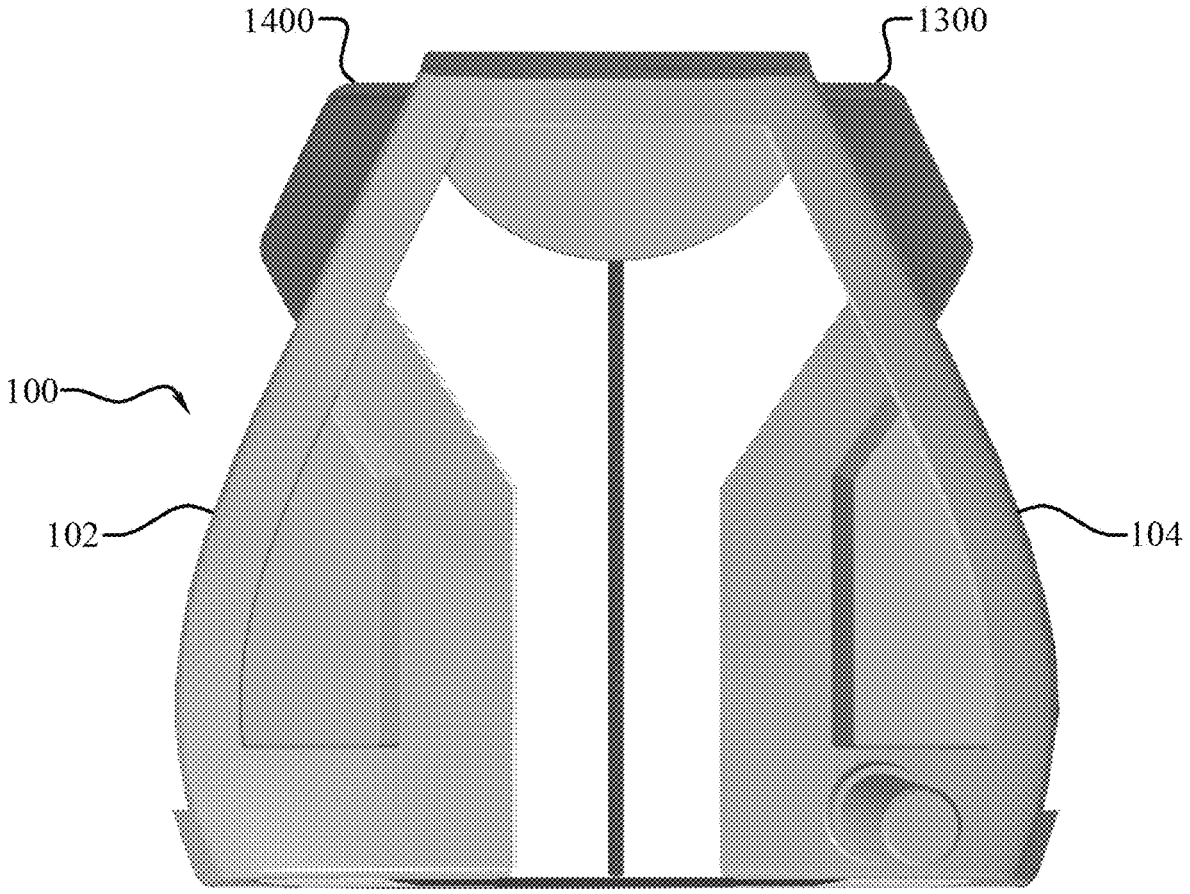
FIG. 110 is a top plan view of the golf putter head embodiment seen in FIG. 106 with the toe and heel weights located in the rear portion of the golf putter head.

As seen in FIG. 106, the top portion 112 may include a top portion heel recess 1810, a top portion toe recess 1820, and/or a top portion rear recess 1830. Further, any of these recesses may be openings extending through the upper body portion 103, and/or the entire putter head 100, in the direction of the club head Z-axis. In one embodiment the top portion rear recess 1830 is symmetric about the club head Y-axis and has a curved forward wall with a radius of curvature that is at least 75% of a golf ball radius, which in one embodiment is 0.84"-0.94", while in further embodiments the forward wall radius of curvature that is at least 85%, 95%, 100%, 110%, or 120% of the golf ball radius. A further embodiment caps the forward wall radius of curvature to no more than 200% of the golf ball radius, and no more than 180%, 160%, or 140% in additional embodiments. Each recess has a recess depth measured from the highest adjacent surface of the top portion 112, and in one embodiment at least a portion of the recess has a recess depth of 3 mm, and at least 4 mm, 5 mm, or 6 mm in further embodiments. Further, each recess has a recess volume measured by filling the recess with clay until there is no distinguishable recess relative the adjacent top portion 112, and then the volume of the clay is measured using a water displacement test. In one such embodiment at least one recess has a volume of at least 2 cubic centimeters, or cc, and in further embodiments at least 3 cc, 4 cc, 5 cc, 6 cc, or 7 cc. The recess volume is no more than no more than 50 cc in one embodiment, and no more than 45 cc, 40 cc, 35 cc, 30 cc, or 25 cc in additional embodiments. In one embodiment the top portion 112 includes a recessed alignment aid, which may extend all the way to the striking face 116 and form a portion of a perimeter of the striking face 116. In a further embodiment the recesses alignment aid extends to a point behind the CG, while in another embodiment is a Y-shaped alignment feature with the tips of the Y extending toward the heel weight assembly 1300 and the toe weight assembly 1400. The opening(s), recess(es), alignment feature(s), and overall club head shapes may include any of those disclosed in U.S. application Ser. No. 18/140,184 filed Apr. 27, 2023, U.S. Pat. No. 9,050,510 issued Jun. 9, 2015, U.S. Pat. No. 7,815,520 issued Oct. 19, 2010, U.S. Pat. No. 7,648,425 issued Jan. 19, 2010, D966449 issued Oct. 11, 2022, D865885 issued Sep. 5, 2019, D859545 issued Sep. 10, 2019, D837911 issued Jan. 8, 2019, D645923 issued Sep. 27, 2011, D607952 issued Jan. 12, 2010, D569460 issued May 20, 2008, D587326 issued Feb. 24, 2009, D584780 issued Jan. 13, 2009, which are all incorporated by reference herein in their entirety.

As noted throughout, all of the disclosure with respect to the one or more repositionable weight assemblies 1000, seen in FIGS. 1 and 2, which is often directed to a heel weight assembly 1300 and/or a toe weight assembly 1400, is equally applicable to embodiments with a single repositionable weight assembly 1000 as well as embodiments having more than two weight assemblies. Likewise, all of the disclosure with respect to the heel track 1100 and/or the toe track 1200 is equally applicable to embodiments with a single track as well as embodiments having more than two tracks. Further, any weight assembly may be positionable and securable to any location along the track in one embodiment, however in other embodiments the weight assembly may be only secured at distinct locations along the track. Further, while the disclosure is generally associated with one or more repositionable weight assemblies 1000 and an associated track, however the disclosure is equally directed to embodiments in which the repositionable weight assembly is repositionable within at least 3 distinct attachment locations, which may be receptacles such as cavities, recesses, weight ports, or similar attachment interfaces in the putter head 100 without the existence of a track. One such embodiment has least 3 distinct attachment locations on one side of the club head Y-Z plane passing through the origin 128, whereby a centroid of the forwardmost attachment location and a centroid of the rearwardmost attachment location establish an attachment orientation line joining the two centroids, and the third attachment location is between the forwardmost attachment location and the rearwardmost attachment location with a centroid of the third attachment location located within 10 mm of the attachment orientation line; and thus all of the disclosure relating to the HT longitudinal axis 1130 and/or TT longitudinal axis 1230 is equally applicable to the attachment orientation line. Further, such distinct attachment locations may have different elevations from the ground plane thereby achieving the disclosed Zup relationships of the weight assembly when installed at the different attachment locations. A simple illustration of such an embodiment has at least 3 distinct attachment locations on one side of the club head Y-Z plane, with the attachment locations being in the form of weight ports, the weight assembly is a weight that may be attached in any of the weight ports, and the weight ports may be at different distances from the ground plane. In such an embodiment the location of the weight assembly CG within the forwardmost weight port and the rearwardmost weight port establish the attachment orientation line, and similarly all of the disclosure relating to the HTLA GP angle 1134 and the TTLA GP angle 1234, movement of the weight assembly CG, and the putter head CG apply equally to such embodiments. Therefore one skilled in the art will appreciate that an alternative embodiment of FIG. 2 includes a repositionable heel weight assembly 1300 and/or a repositionable toe weight assembly 1400, with at least 3 distinct attachment locations for each weight assembly, rather than being repositionable at various points along the tracks.

Tables 1 and 2 illustrate mass property relationships of an embodiment of the putter head 100 associated with five different positions of the heel weight assembly 1300 and the toe weight assembly 1400. For ease of explanation, position 1 is similar to FIG. 24 whereby both the heel weight assembly 1300 and the toc weight assembly 1400 are rearward, position 2 is similar to FIG. 25 whereby both the heel weight assembly 1300 and the toe weight assembly 1400 in a mid-body region, position 3 is similar to FIG. 26 whereby both the heel weight assembly 1300 and the toe weight assembly 1400 are located toward the forward portion 114, position 4 is similar to FIGS. 13-14 whereby the heel weight assembly 1300 is rearward and the toe weight assembly 1400 is located toward the forward portion 114, and position 5 is similar to FIGS. 17-18 whereby both the heel weight assembly 1300 is located toward the forward portion 114 and the toe weight assembly 1400 is rearward; as further defined by the relationships in Tables 1 and 2.

TABLE 1

| | POSITION 1 | POSITION 2 | POSITION 3 |
|---|---|---|---|
| CGhy | >Ω | Ω − Ψ | <Ψ |
| CGty | >Ω | Ω − Ψ | <Ψ |
| Ixx | Ixx1 | Ixx2 = (α1) × (Ixx1) | Ixx3 = (β1) × (Ixx1) |
| Iyy | Iyy1 | Iyy2 = (α2) × (Iyy1) | Iyy3 = (β2) × (Iyy1) |
| Izz | Izz1 | Izz2 = (α3) × (Izz1) | Izz3 = (β3) × (Izz1) |
| Toe Hang | 17 ± Φ | 20 ± Φ | 23 ± Φ |
| CGy | CGy1 | CGy2 = (ε1) × (CGy1) | CGy3 = (ε2) × (CGy1) |

TABLE 2

| | POSITION 4 | POSITION 5 |
|---|---|---|
| CGhy | >Ω | <Ψ |
| CGty | <Ψ | >Ω |
| Ixx | Ixx4 = (γ1) × (Ixx1) | Ixx5 = (δ1) × (Ixx1) |
| Iyy | Iyy4 = (γ2) × (Iyy1) | Iyy5 = (δ2) × (Iyy1) |
| Izz | Izz4 = (γ3) × (Izz1) | Izz5 = (δ3) × (Izz1) |
| Toe Hang | 20 ± Φ | 19 ± Φ |
| CGy | CGy4 = (ε3) × (CGy1) | CGy5 = (ε4) × (CGy1) |

Greek letters omega, Ω, and psi, Ψ, are used in Tables 1 and 2 to identify boundary values for the y-coordinate of heel weight assembly CGh and the y-coordinate of toe weight assembly CGt. Omega, Ω, is 55 mm in one embodiment, and 60 mm, 65 mm, or 70 mm in further embodiments. A further set of embodiments caps omega, Ω, to no more than 125 mm in one embodiment, and no more than 120 mm, 110 mm, 100 mm, 90 mm, or 80 mm in further embodiments. Psi, Ψ, is 30 mm in one embodiment, and 30 mm, 28 mm, 26 mm, or 24 mm in further embodiments. A further set of embodiments caps psi, Ψ, to at least 10 mm in one embodiment, and at least 12 mm, 14 mm, 16 mm, 18 mm, or 20 mm in further embodiments.

Greek letter alpha, α, is used in Tables 1 and 2 to identify boundary values of the moments of inertia in position 2, namely Ixx2, Iyy2, and Izz2, relative to the moments of inertia in position 1, namely Ixx1, Iyy1, and Izz1. Alpha1, α1, is used in the relation of Ixx, Alpha2, α2, is used in the relation of Iyy, while Alpha3, α3, is used in the relation of Izz. Alpha1, α1, is at least 0.65 in one embodiment, and is at least 0.66, 0.67, 0.68, or 0.69 in further embodiments. A further set of embodiments caps Alpha1, α1, to no more than 0.76 in one embodiment, and no more than 0.75, 0.74, 0.73, 0.72, or 0.71 in further embodiments. Alpha2, α2, is at least 1.00 in one embodiment, and is at least 1.01, 1.02, 1.03, 1.04, 1.05, 1.06, 1.07, 1.08, or 1.09 in further embodiments. A further set of embodiments caps Alpha2, α2, to no more than 1.16 in one embodiment, and no more than 1.15, 1.14, 1.13, 1.12, or 1.11 in further embodiments. Alpha3, α3, is at least 0.81 in one embodiment, and is at least 0.82, 0.83, 0.84, or 0.85 in further embodiments. A further set of embodiments caps Alpha3, α3, to no more than 0.95 in one embodiment, and no more than 0.94, 0.93, 0.92, 0.91, 0.90, 0.89, 0.88, or 0.87 in further embodiments.

Greek letter beta, β, is used in Tables 1 and 2 to identify boundary values of the moments of inertia in position 3, namely Ixx3, Iyy3, and Izz3, relative to the moments of inertia in position 1, namely Ixx1, Iyy1, and Izz1. Beta1, β1, is used in the relation of Ixx, Beta2, β2, is used in the relation of Iyy, while Beta3, β3, is used in the relation of Izz. Beta1, β1, is at least 0.60 in one embodiment, and is at least 0.61, 0.62, 0.63, 0.64, or 0.65 in further embodiments. A further set of embodiments caps Beta1, β1, to no more than 0.73 in one embodiment, and no more than 0.72, 0.71, 0.70, 0.69, 0.68, 0.67, or 0.66 in further embodiments. Beta2, β2, is at least 1.02 in one embodiment, and is at least 1.03, 1.04, 1.05, 1.06, 1.07, 1.08, or 1.09 in further embodiments. A further set of embodiments caps Beta1, β2, to no more than 1.17 in one embodiment, and no more than 1.16, 1.15, 1.14, 1.13, 1.12, or 1.11 in further embodiments. Beta3, β3, is at least 0.80 in one embodiment, and is at least 0.81, 0.82, 0.83, 0.84, 0.85, 0.86, or 0.87 in further embodiments. A further set of embodiments caps Beta3, β3, to no more than 0.92 in one embodiment, and no more than 0.91, 0.90, or 0.89 in further embodiments.

Greek letter gamma, γ, is used in Tables 1 and 2 to identify boundary values of the moments of inertia in position 4, namely Ixx4, Iyy4, and Izz4, relative to the moments of inertia in position 1, namely Ixx1, Iyy1, and Izz1. Gamma1, γ1, is used in the relation of Ixx, Gamma2, γ2, is used in the relation of Iyy, while Gamma3, γ3, is used in the relation of Izz. Gamma1, γ1, is at least 0.80 in one embodiment, and is at least 0.81, 0.82, 0.83, 0.84, or 0.85 in further embodiments. A further set of embodiments caps Gamma1, γ1, to no more than 0.94 in one embodiment, and no more than 0.93, 0.92, 0.91, 0.90, or 0.89 in further embodiments. Gamma2, γ2, is at least 1.00 in one embodiment, and is at least 1.01, 1.02, 1.03, 1.04, 1.05, 1.06, 1.07, 1.08, or 1.09 in further embodiments. A further set of embodiments caps Gamma2, γ2, to no more than 1.16 in one embodiment, and no more than 1.15, 1.14, 1.13, 1.12, or 1.11 in further embodiments. Gamma3, γ3, is at least 0.89 in one embodiment, and is at least 0.90, 0.91, 0.92, 0.93, 0.94, 0.95, 0.96, or 0.97 in further embodiments. A further set of embodiments caps Gamma3, γ3, to no more than 0.99 in one embodiment, and no more than 0.98 in a further embodiment.

Greek letter delta, δ, is used in Tables 1 and 2 to identify boundary values of the moments of inertia in position 5, namely Ixx5, Iyy5, and Izz5, relative to the moments of inertia in position 1, namely Ixx1, Iyy1, and Izz1. Delta1, δ1, is used in the relation of Ixx, Delta2, δ2, is used in the relation of Iyy, while Delta3, δ3, is used in the relation of Izz. Delta1, δ1, is at least 0.80 in one embodiment, and is at least 0.81, 0.82, 0.83, 0.84, or 0.85 in further embodiments. A further set of embodiments caps Delta1, δ1, to no more than 0.94 in one embodiment, and no more than 0.93, 0.92, 0.91, 0.90, or 0.89 in further embodiments. Delta2, δ2, is at least 1.00 in one embodiment, and is at least 1.01, 1.02, 1.03, 1.04, 1.05, 1.06, 1.07, 1.08, or 1.09 in further embodiments. A further set of embodiments caps Delta2, δ2, to no more than 1.16 in one embodiment, and no more than 1.15, 1.14, 1.13, 1.12, or 1.11 in further embodiments. Delta3, δ3, is at least 0.89 in one embodiment, and is at least 0.90, 0.91, 0.92, 0.93, 0.94, 0.95, 0.96, or 0.97 in further embodiments. A further set of embodiments caps Delta3, δ3, to no more than 0.99 in one embodiment, and no more than 0.98 in a further embodiment.

Ixx1 is at least 2600 g*cm^2 in one embodiment, and at least 2650 g*cm^2, 2700 g*cm^2, 2750 g*cm^2, 2800 g*cm^2, 2850 g*cm^2, 2900 g*cm^2, or 2950 g*cm^2 in further embodiments. A further set of embodiments caps Ixx1 to no more than 6000 g*cm^2 in one embodiment, and no more than 5500 g*cm^2, 5250 g*cm^2, 5000 g*cm^2, 4750 g*cm^2, 4500 g*cm^2, 4250 g*cm^2, 4000 g*cm^2, 3750 g*cm^2, 3450 g*cm^2, 3400 g*cm^2, 3350 g*cm^2, 3300 g*cm^2, 3250 g*cm^2, or 3200 g*cm^2 in further embodiments.

Iyy1 is at least 2100 g*cm^2 in one embodiment, and at least 2200 g*cm^2, or 2300 g*cm^2 in further embodiments. A further set of embodiments caps Iyy1 to no more than 3500 g*cm^2 in one embodiment, and no more than 5500 g*cm^2, 5250 g*cm^2, 5000 g*cm^2, 4750 g*cm^2, 4500 g*cm^2, 4250 g*cm^2, 4000 g*cm^2, 3750 g*cm^2, 3450 g*cm^2, 3400 g*cm^2, 3300 g*cm^2, 3200 g*cm^2, 3100 g*cm^2, 3000 g*cm^2, or 2900 g*cm^2 in further embodiments.

Izz1 is at least 4500 g*cm^2 in one embodiment, and at least 4600 g*cm^2, 4700 g*cm^2, 4800 g*cm^2, 4900 g*cm^2, or 5000 g*cm^2 in further embodiments. A further set of embodiments caps Izz1 to no more than 14000 g*cm^2 in one embodiment, and no more than 13000 g*cm^2, 12000 g*cm^2, 11000 g*cm^2, 10000 g*cm^2, 9000 g*cm^2, 8000 g*cm^2, 7000 g*cm^2, 6000 g*cm^2, 5900 g*cm^2, 5800 g*cm^2, 5700 g*cm^2, 5600 g*cm^2, 5500 g*cm^2, 5400 g*cm^2, or 5300 g*cm^2 in further embodiments.

Greek letter phi, Φ, is used in Tables 1 and 2 to identify tolerances of the toe hang value, which is measured in degrees. Phi, Φ, is 2.5 degrees in one embodiment, and is 2.0, 1.5, 1.0, or 0.5 degree(s) in further embodiments. As illustrated, the amount of toe hang is adjustable from a minimum toe hang to a maximum toe hang, with a toe hang differential being the difference therebetween. Thus, in one embodiment the toe hang differential is at least 3 degrees, and in further embodiments at least 4, 5, or 6 degrees. Another series of embodiments caps the toc hang differential to no more than 12 degrees, and in further embodiments no more than 10 degrees, 9 degrees, 8 degrees, or 7 degrees. In a further embodiment the minimum toe hang is 19 degrees or less, while in additional embodiments the minimum toe hang is 18 degrees or less, or 17 degrees or less. In another embodiment the maximum toe hang is at least 21 degrees, and in additional embodiments is at least 22 degrees or 23 degrees. Another embodiment caps the maximum toe hang to no more than 30 degrees, and in additional embodiments no more than 28 degrees, 27 degrees, 26 degrees, 25 degrees, or 24 degrees.

Greek letter epsilon, ε, is used in Tables 1 and 2 to identify boundary values of the CGy coordinates of the putter head 100 in position 2, namely CGy2, position 3, namely CGy3, position 4, namely CGy4, and position 5, namely CGy5, relative to the CGy coordinate of the putter head 100 in position 1, namely CGy1. Epsilon1, ε1, is no more than 0.91 in one embodiment, and no more than 0.90, 0.89, 0.88, 0.87, or 0.86 in further embodiments. A further set of embodiments caps Epsilon1, ε1, to at least 0.78 in one embodiment, and is at least 0.79, 0.80, 0.81, 0.82, or 0.83 in further embodiments. Epsilon2, ε2, is no more than 0.75 in one embodiment, and no more than 0.74, 0.73, 0.72, or 0.71 in further embodiments. A further set of embodiments caps Epsilon2, ε2, to at least 0.63 in one embodiment, and is at least 0.64, 0.65, 0.66, 0.67, 0.68, 0.69, or 0.70 in further embodiments. Epsilon3, ε3, is no more than 0.89 in one embodiment, and no more than 0.88, 0.87, 0.86, or 0.85 in further embodiments. A further set of embodiments caps Epsilon3, ε3, to at least 0.79 in one embodiment, and is at least 0.80, 0.81, 0.82, or 0.83 in further embodiments. Epsilon4, ε4, is no more than 0.89 in one embodiment, and no more than 0.88, 0.87, 0.86, or 0.85 in further embodiments. A further set of embodiments caps Epsilon4, ε4, to at least 0.79 in one embodiment, and is at least 0.80, 0.81, 0.82, or 0.83 in further embodiments.

Further, CGy3 is at least 7 mm less than CGy1 in one embodiment, and at least 8 mm, 9 mm, 10 mm, 11 mm, 12 mm, or 13 mm less in further embodiments. Additionally, CGy1 is at least 35 mm in one embodiment, and at least 36 mm, 37 mm, 38 mm, 39 mm, or 40 mm in further embodiments. Another set of embodiments caps CGy1 to no more than 50 mm in one embodiment, and no more than 48 mm, 46 mm, 44 mm, or 42 mm in further embodiments. Still further, CGy3 and/or CGy4 is at least 4 mm less than CGy1 in one embodiment, and in further embodiments at least 4.5, 5.0, 5.5, 6.0, or 6.5 less. In another series of embodiments the difference between CGy1 and CGy3, or CGy4, is no more than 10 mm, and in further embodiments no more than 9 mm, 8 mm, 7.5 mm, or 7 mm.

The orientation of the HTLA x-axis angle 1132 and the TTLA x-axis angle 1232 play a significant role in controlling the changes in mass properties to achieve desirable performance. This is illustrated by comparing a reference embodiment with straight-back tracks, namely the HTLA x-axis angle 1132 and the TTLA x-axis angle 1232 set to 90 degrees, with a symmetrically angled embodiment with the HTLA x-axis angle 1132 and the TTLA x-axis angle 1232 set to 94 degrees. The reference embodiment in position 1 has an Izz1 of 5233 g*cm^2, which dropped to 4146 g*cm^2 in position 3, for a difference of 1087 g*cm^2; while the angled embodiment in position 1 has an Izz1 of 5233 g*cm^2, which dropped to just 4353 g*cm^2 in position 3, for a difference of 880 g*cm^2. Thus, the Izz drop-off for the angled embodiment is 19% less than the Izz drop-off for the reference embodiment, which is significant.

Another example of the impact of the orientation of the HTLA x-axis angle 1132 and the TTLA x-axis angle 1232 plays in controlling the changes in mass properties to achieve desirable performance is related to CGx. This is illustrated by comparing a reference embodiment with straight-back tracks, namely the HTLA x-axis angle 1132 and the TTLA x-axis angle 1232 set to 90 degrees, with a symmetrically angled embodiment with the HTLA x-axis angle 1132 and the TTLA x-axis angle 1232 set to 94 degrees. In the reference embodiment CGx is 1.8 mm when the heel weight assembly 1300 and the toe weight assembly 1400 are positioned such that CGhy and CGty are equal, and is referred to as a unity CGx value; whereas in position 4 CGx shifts about 0.004 mm heelward from the unity CGx value, and in position 5 CGx shifts about 0.05 mm heelward from the unity CGx value; thereby illustrating the insignificant movement of CGx. Conversely, in the angled embodiment CGx is 1.8 mm when the heel weight assembly 1300 and the toe weight assembly 1400 are positioned such that CGhy and CGty are equal, again referred to as the unity CGx value; whereas in position 4 CGx shifts about 0.4 mm toeward of the unity CGx value to a CGx of 1.4 mm, and in position 5 CGx shifts about 0.4 mm heelward of the unity CGx value to a CGx of 2.2 mm; thereby illustrating a significant adjustability of the CGx value, including the ability to shift CGx both toeward from the unity CGx and heelward from the unity CGx, depending on the locations of the heel weight assembly 1300 and the toe weight assembly 1400.

In a second symmetrically angled embodiment further illustrates the ability to significantly adjust the CGx value. In the second angled embodiment the mass of the heel weight assembly 1300 was increased by 10 grams compared to the first angled embodiment discussed above, and the mass of the toe weight assembly 1400 was increased by 10 grams compared to the first angled embodiment discussed above. The second angled embodiment likewise had a unity CGx of 1.8 mm, however in position 4 CGx shifts about 1.2 mm toeward of the unity CGx value to a CGx of 0.6 mm, and in position 5 CGx shifts about 1.2 mm heelward of the unity CGx value to a CGx of 3.0 mm; thereby illustrating an even greater adjustability of the CGx value, again including the ability to shift CGx both toeward from the unity CGx and heelward from the unity CGx, depending on the locations of the heel weight assembly 1300 and the toe weight assembly 1400. Thus, in one embodiment a CGx is adjustable from the unity CGx value by a CGx shift value that is at least 0.2 mm toeward, and in further embodiments at least 0.3 mm, 0.4 mm, 0.5 mm, 0.6 mm, 0.7 mm, 0.8 mm, 0.9 mm, 1.0 mm, 1.1 mm, or 1.2 mm. In another embodiment a CGx is adjustable from the unity CGx value by a CGx shift value that is at least 0.2 mm heelward, and in further embodiments at least 0.3 mm, 0.4 mm, 0.5 mm, 0.6 mm, 0.7 mm, 0.8 mm, 0.9 mm, 1.0 mm, 1.1 mm, or 1.2 mm. A further embodiment enables any of the disclosed CGx shift values both heelward and toeward.

Stated another way the putter head 100 has a CGx value that is adjustable from a minimum CGx value to a maximum CGx value depending on the position of the at least one repositionable weight assembly 1000. In one embodiment the minimum CGx value is less than 0, meaning toward of the origin, while in further embodiments the minimum CGx value is less than −0.1 mm, −0.2 mm, or −0.3 mm. 20230615

Now, one example from Tables 1 and 2 will be discussed for clarity, but applies to all disclosed embodiments and ranges. In this example omega, Ω, is 55 mm and psi, Ψ, is 30 mm. Therefore, in position 1 CGhy is greater than 55 mm, CGty is greater than 55 mm, and in position 2 CGhy is 55-30 mm and CGty is 55-30 mm, and in position 3 CGhy is less than 30 mm and CGty is less than 30 mm, and in position 4 CGhy is greater than 55 mm and CGty is less than 30 mm, and finally in position 5 CGhy is less than 30 mm and CGty is greater than 55 mm.

Now, continuing with the above example, in position 1 Ixx1 is at least 2600 g*cm^2, so for this example 2600 g*cm^2 will be used, Iyy1 is least 2100 g*cm^2, so for this example 2100 g*cm^2 will be used, and Izz1 is at least 4500 g*cm^2, so for this example 4500 g*cm^2 will be used. One skilled in the art will appreciate that all of the disclosed design features, including, but not limited to, the materials of construction, sizes, mass distribution, and the arrangement, location, shape, and orientation of the repositionable weight assembly 1000 and the track associated therewith, all significantly influence the moments of inertia, toe hang, and overall putter head CG location as the repositionable weight assembly 1000, in this example both the heel weight assembly 1300 and the toe weight assembly 1400, is repositioned.

Thus, continuing with the above example, in position 2 the Ixx2=(α1)×(Ixx1). For this example we will use the disclosed upper and lower boundary of α1, namely at least 0.65 and no more than 0.76. Therefore, with Ixx1 at 2600 g*cm^2, the Ixx2 is at least 1690 g*cm^2, from 0.65×2600, and no more than 1976 g*cm^2, from 0.76×2600.

Similarly, in position 3 the Ixx3=(β1)×(Ixx1), and for this example we will use the disclosed upper and lower boundary of β1, namely at least 0.60 and no more than 0.73. Therefore, with Ixx1 at 2600 g*cm^2, the Ixx3 is at least 1560 g*cm^2, from 0.60×2600, and no more than 1898 g*cm^2, from 0.73×2600. Likewise, in position 4 the Ixx4=(γ1)×(Ixx1), and for this example we will use the disclosed upper and lower boundary of γ1, namely at least 0.80 and no more than 0.94. Therefore, with Ixx1 at 2600 g*cm^2, the Ixx4 is at least 2080 g*cm^2, from 0.80×2600, and no more than 2444 g*cm^2, from 0.94×2600. Finally, in position 5 the Ixx5=(δ1)×(Ixx1), and for this example we will use the disclosed upper and lower boundary of δ1, namely at least 0.80 and no more than 0.94. Therefore, with Ixx1 at 2600 g*cm^2, the Ixx5 is at least 2080 g*cm^2, from 0.80×2600, and no more than 2444 g*cm^2, from 0.94×2600.

Thus, continuing with the above example, in position 2 the Iyy2=(α2)×(Iyy1). For this example we will use the disclosed upper and lower boundary of α2, namely at least 1.00 and no more than 1.16. Therefore, with Iyy1 at 2100 g*cm^2, the Iyy2 is at least 2100 g*cm^2, from 1.00×2100, and no more than 2436 g*cm^2, from 1.16×2100.

Similarly, in position 3 the Iyy3=(β2)×(Iyy1), and for this example we will use the disclosed upper and lower boundary of β2, namely at least 1.02 and no more than 1.17. Therefore, with Iyy1 at 2100 g*cm^2, the Iyy3 is at least 2142 g*cm^2, from 1.02×2100, and no more than 2457 g*cm^2, from 1.17×2100. Likewise, in position 4 the Iyy4=(¥2)×(Iyy1), and for this example we will use the disclosed upper and lower boundary of γ2, namely at least 1.00 and no more than 1.16. Therefore, with Iyy1 at 2100 g*cm^2, the Iyy4 is at least 2100 g*cm^2, from 1.00×2100, and no more than 2436 g*cm^2, from 1.16×2100. Finally, in position 5 the Iyy5=(δ2)×(Iyy1), and for this example we will use the disclosed upper and lower boundary of δ2, namely at least 1.00 and no more than 1.16. Therefore, with Iyy1 at 2100 g*cm^2, the Iyy5 is at least 2100 g*cm^2, from 1.00×2100, and no more than 2436 g*cm^2, from 1.16×2100.

Thus, continuing with the above example, in position 2 the Izz2=(α3)×(Izz1). For this example we will use the disclosed upper and lower boundary of α3, namely at least 0.81 and no more than 0.95. Therefore, with Izz1 at 4500 g*cm^2, the Izz2 is at least 3645 g*cm^2, from 0.81×4500, and no more than 4275 g*cm^2, from 0.95×4500.

Similarly, in position 3 the Izz3=(3)×(Izz1), and for this example we will use the disclosed upper and lower boundary of β3, namely at least 0.80 and no more than 0.92. Therefore, with Izz1 at 4500 g*cm^2, the Izz3 is at least 3600 g*cm^2, from 0.80×4500, and no more than 4140 g*cm^2, from 0.92×4500. Likewise, in position 4 the Izz4=(γ3)×(Izz1), and for this example we will use the disclosed upper and lower boundary of γ3, namely at least 0.89 and no more than 0.99. Therefore, with Izz1 at 4500 g*cm^2, the Izz4 is at least 4005 g*cm^2, from 0.89×4500, and no more than 4455 g*cm^2, from 0.99×4500. Finally, in position 5 the Izz5=(δ3)×(Izz1), and for this example we will use the disclosed upper and lower boundary of δ3, namely at least 0.89 and no more than 0.99. Therefore, with Izz1 at 4500 g*cm^2, the Izz5 is at least 4005 g*cm^2, from 0.89×4500, and no more than 4455 g*cm^2, from 0.99×4500.

Now, continuing with the above example, in position 1 CGy1 is at least 35 mm, so for this example a CGy1 of 35 mm will be used for illustration. In position 2 the CGy2=(ε1)×(CGy1). For this example we will use the disclosed upper and lower boundaries of ε1, namely at least 0.78 no more than 0.91. Therefore, with CGy1 at 35 mm, the CGy2 is at least 27.3 mm, from 0.78×35, and no more than 31.85 mm, from 0.91×35. Similarly, in position 3 the CGy3=(ε2)×(CGy1), and for this example we will use the disclosed upper and lower boundary of &2, namely at least 0.63 and no more than 0.75. Therefore, with CGy1 at 35 mm, the CGy3 is at least 22.05 mm, from 0.63×35, and no more than 26.25 mm, from 0.75×35. Similarly, in position 4 the CGy4=(ε3)×(CGy1), and for this example we will use the disclosed upper and lower boundary of ε3, namely at least 0.79 and no more than 0.89. Therefore, with CGy1 at 35 mm, the CGy4 is at least 27.65 mm, from 0.79×35, and no more than 29.75 mm, from 0.85×35. Similarly, in position 5 the CGy5=(ε4)×(CGy1), and for this example we will use the disclosed upper and lower boundary of ε4, namely at least 0.79 and no more than 0.89. Therefore, with CGy1 at 35 mm, the CGy5 is at least 27.65 mm, from 0.79×35, and no more than 29.75 mm, from 0.85×35.

A Y-CG differential value represents the difference between the CGy value of the putter head 100 minus the y-coordinate of the heel weight assembly CGh, namely CGhy, or the toe weight assembly CGt, namely CGty. For example, in one embodiment the heel weight assembly 1300 is rearward having a CGhy of 67.5 mm and producing a CGy of 40 mm, therefore a HWA Y-CG differential is −27.5, with the negative value meaning the CG of the heel weight assembly 1300 is rearward of the CG of the putter head 100. In one embodiment the toe weight assembly 1400 is rearward having a CGty of 67.5 mm and producing a CGy of 40 mm, therefore a TWA Y-CG differential is −27.5, with the negative value meaning the CG of the toe weight assembly 1400 is rearward of the CG of the putter head 100.

In one embodiment at least one of the HWA Y-CG differential or the TWA Y-CG differential becomes positive, meaning the CG of the heel weight assembly 1300 and/or the toe weight assembly 1400 is forward of the CG of the putter head 100. For example, in one embodiment the heel weight assembly 1300 is forward having a CGhy of 21.4 mm and producing a CGy of 26.4 mm, therefore a HWA Y-CG differential is +5, with the positive value meaning the CG of the heel weight assembly 1300 is forward of the CG of the putter head 100, as seen in FIGS. 10 and 26. In one embodiment the toe weight assembly 1400 is forward having a CGty of 21.4 mm and producing a CGy of 26.4 mm, therefore a TWA Y-CG differential is +5, with the positive value meaning the CG of the toe weight assembly 1400 is forward of the CG of the putter head 100, as seen in FIGS. 10 and 26.

Figure 18:
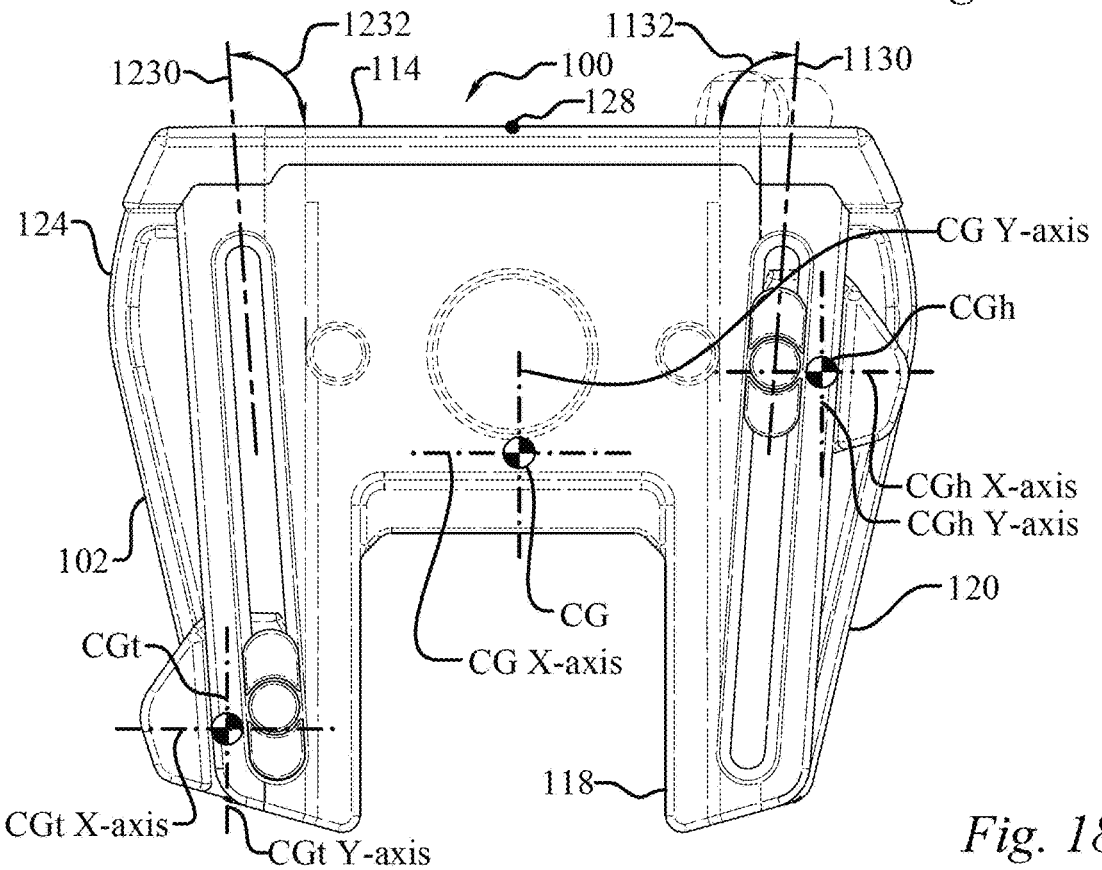
FIG. 18 is a bottom plan view of the golf putter head embodiment seen in FIG. 17 with the heel weight positioned in the front portion of the putter head and the toe weight positioned in the rear portion of the putter head.
Figure 19:
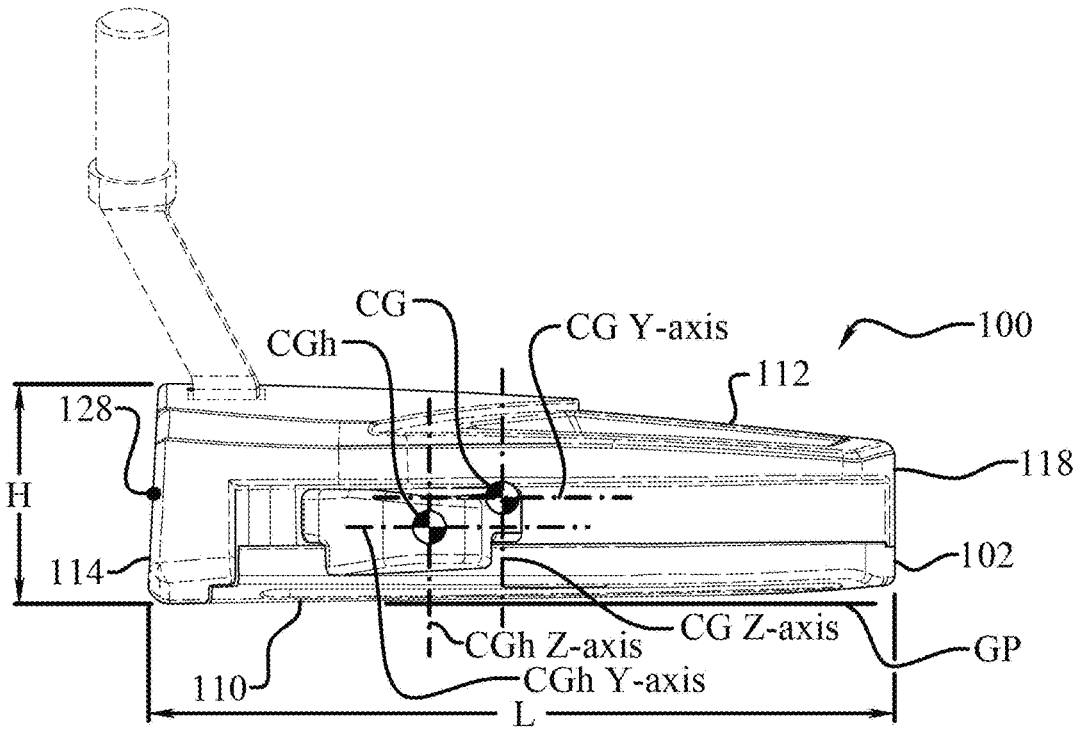
FIG. 19 is a heel side view of the golf putter head embodiment seen in FIG. 17 with the heel weight positioned in the front portion of the putter head.
Figure 20:
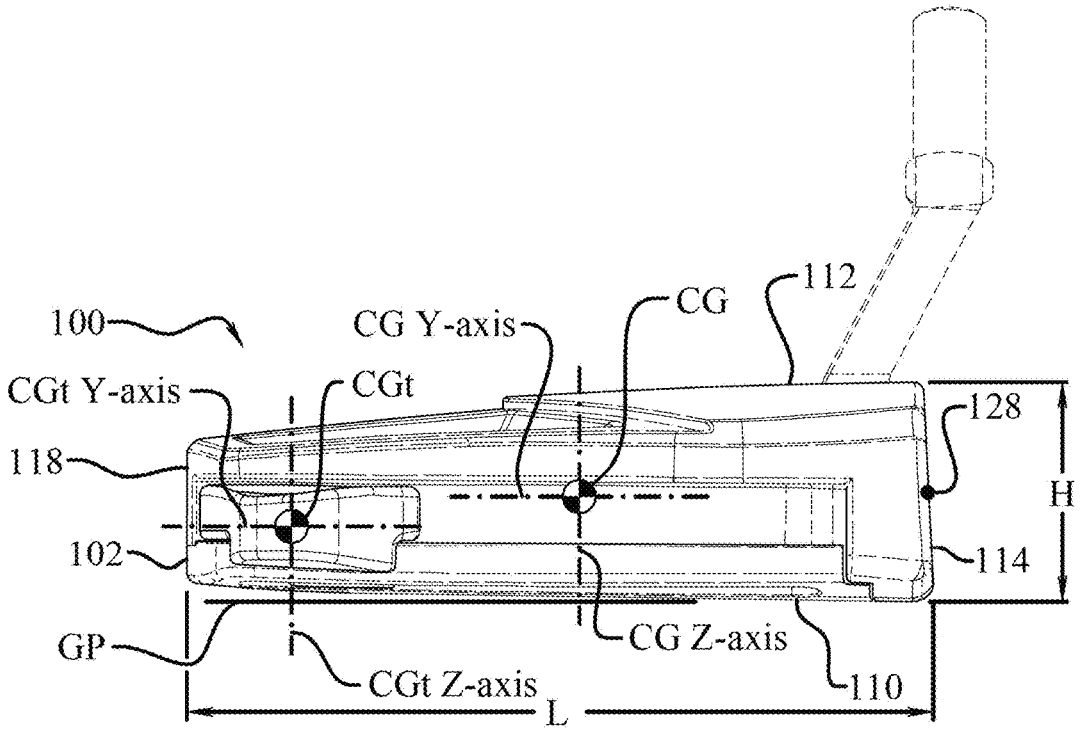
FIG. 20 is a toe side view of the golf putter head embodiment seen in FIG. 17 with the toe weight positioned in the rear portion of the putter head.

Thus, in one embodiment, such as that seen in FIG. 18, the HWA Y-CG differential is positive while the TWA Y-CG differential is negative. Here, the CG of the heel weight assembly 1300 is forward of the CG of the putter head 100, while the CG of the toe weight assembly 1400 is rearward of the CG of the putter head 100, producing a CGy of 33.2 mm. For example, in one embodiment the heel weight assembly 1300 is forward having a CGhy of 21.4 mm, therefore a HWA Y-CG differential is +11.8. While in this example the toe weight assembly 1400 is rearward having a CGty of 67.5 mm, therefore a TWA Y-CG differential is −34.3. Thus a differential spread, meaning the sum of the HWA Y-CG differential and the absolute value of the TWA Y-CG differential is 46.1 mm.

Therefore, in one embodiment the heel weight assembly 1300 and the toe weight assembly 1400 may be positioned such that the HWA Y-CG differential is positive and at least 1 mm, while the TWA Y-CG differential is negative with an absolute value of at least 25 mm; while in a further embodiment the HWA Y-CG differential is positive and at least 2 mm, 3 mm, 4 mm, 5 mm, 6 mm, or 7 mm, and the TWA Y-CG differential is negative with an absolute value of at least 30 mm, 35 mm, 37.5 mm, 40 mm, 42.5 mm, or 45 mm. Another embodiment caps the HWA Y-CG differential to no more than 20 mm, and no more than 18 mm, 16 mm, 14 mm, or 12 mm in further embodiments. Additionally, a further embodiments caps the TWA Y-CG differential so that is negative with an absolute value of no more than 65 mm, and no more than 60 mm, 55 mm, 50 mm, or 45 mm in further embodiments.

Similarly, in one embodiment, such as that seen in FIG. 14, the TWA Y-CG differential is positive while the HWA Y-CG differential is negative. Here, the CG of the toe weight assembly 1400 is forward of the CG of the putter head 100, while the CG of the heel weight assembly 1300 is rearward of the CG of the putter head 100, producing a CGy of 33.2 mm. For example, in one embodiment the toe weight assembly 1400 is forward having a CGty of 21.4 mm, therefore a TWA Y-CG differential is +11.8. While in this example the heel weight assembly 1300 is rearward having a CGhy of 67.5 mm, therefore a HWA Y-CG differential is −34.3. Thus a differential spread, meaning the sum of the TWA Y-CG differential and the absolute value of the HWA Y-CG differential is 46.1 mm.

Therefore, in one embodiment the heel weight assembly 1300 and the toe weight assembly 1400 may be positioned such that the TWA Y-CG differential is positive and at least 1 mm, while the HWA Y-CG differential is negative with an absolute value of at least 25 mm; while in a further embodiment the TWA Y-CG differential is positive and at least 2 mm, 3 mm, 4 mm, 5 mm, 6 mm, or 7 mm, and the HWA Y-CG differential is negative with an absolute value of at least 30 mm, 35 mm, 37.5 mm, 40 mm, 42.5 mm, or 45 mm. Another embodiment caps the TWA Y-CG differential to no more than 20 mm, and no more than 18 mm, 16 mm, 14 mm, or 12 mm in further embodiments. Additionally, a further embodiment caps the HWA Y-CG differential so that is negative with an absolute value of no more than 65 mm, and no more than 60 mm, 55 mm, 50 mm, or 45 mm in further embodiments.

Figure 119:
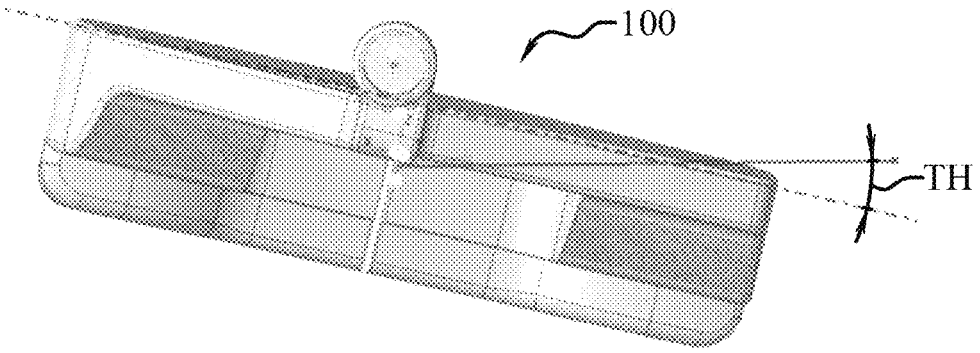

As previously mentioned, repositioning the heel weight assembly 1300 and/or the toc weight assembly 1400 facilitates significant adjustability of the toe hang, labeled TH in FIG. 119, and thus the putter head 100 has a minimum toe hang and a maximum toe hang depending on the placement of the heel weight assembly 1300 and/or the toe weight assembly 1400. As referred to herein the toc hang TH is an angle measure between the striking face 116 and a horizontal plane when the putter head is positioned such that the hosel axis 123 extends perpendicularly out of the page of FIG. 119 directly at the viewer, and the CG of the putter head 100 is positioned vertically directly below hosel axis 123. This may be determined in the physical environment by mounting a shaft in the putter head 100 and placing the shaft on a horizontal surface while allowing the putter head 100 to hang freely off the edge of the horizontal surface, thereby naturally aligning the CG of the putter head 100 below the hosel axis 123, and measuring the angle between the striking face 116 and the horizontal surface.

One skilled in the art will appreciate that the ability to obtain the disclosed relationships involves significantly more than merely optimizing, or maximizing, a single design variable, but rather is a complex balancing of positive and negative tradeoffs to obtain this ability and achieve the other disclosed and desirable performance attributes. Further, while the disclosure tracks the illustrated embodiments and generally refers to embodiments having a heel weight assembly 1300 and a toe weight assembly 1400, the disclosure is intended to cover single weight assembly embodiments, as well as those where the track is centrally positioned, and thus all the disclosure with respect to a heel weight assembly 1300 and a toe weight assembly 1400 applies equally to single weight assembly embodiments, as well as those having more than two weight assemblies, and a track in general, whether positioned toward the toe, heel, or centrally.

FIGS. 62-81 and 95-105 illustrate embodiments of blade-style putter heads. FIGS. 62-81 illustrate embodiments having a heel weight assembly 1300 and/or a toe weight assembly 1400, and an accompanying heel track 1100 and/or toe track 1200. All of the disclosure herein also applies to these blade-style putter head embodiments and will not be repeated for the sake of brevity, however some aspects will be discussed in greater detail. It is important to note that while the illustrated embodiments show the weight assembly CG to be located on the track axis, this is for simplicity of illustration and these designs may also incorporate the previously discussed offset nature of the CG of the heel weight assembly 1300 and/or the toe weight assembly 1400, i.e. offset from a longitudinal vertical plane perpendicular to the ground plane GP containing a longitudinal axis of a track, or as in the case of the embodiment of FIG. 62, offset from a longitudinal horizontal plane, parallel to the ground plane GP, and containing the longitudinal axis of a track. Again, this offset weight assembly CG from the track axis provides great flexibility and performance benefits compared to traditional sliding weight designs having the center of gravity of the weight assembly essentially aligned with the axis of the track, which is also particularly useful in the driver, fairway wood, and rescue embodiments.

Figure 64:
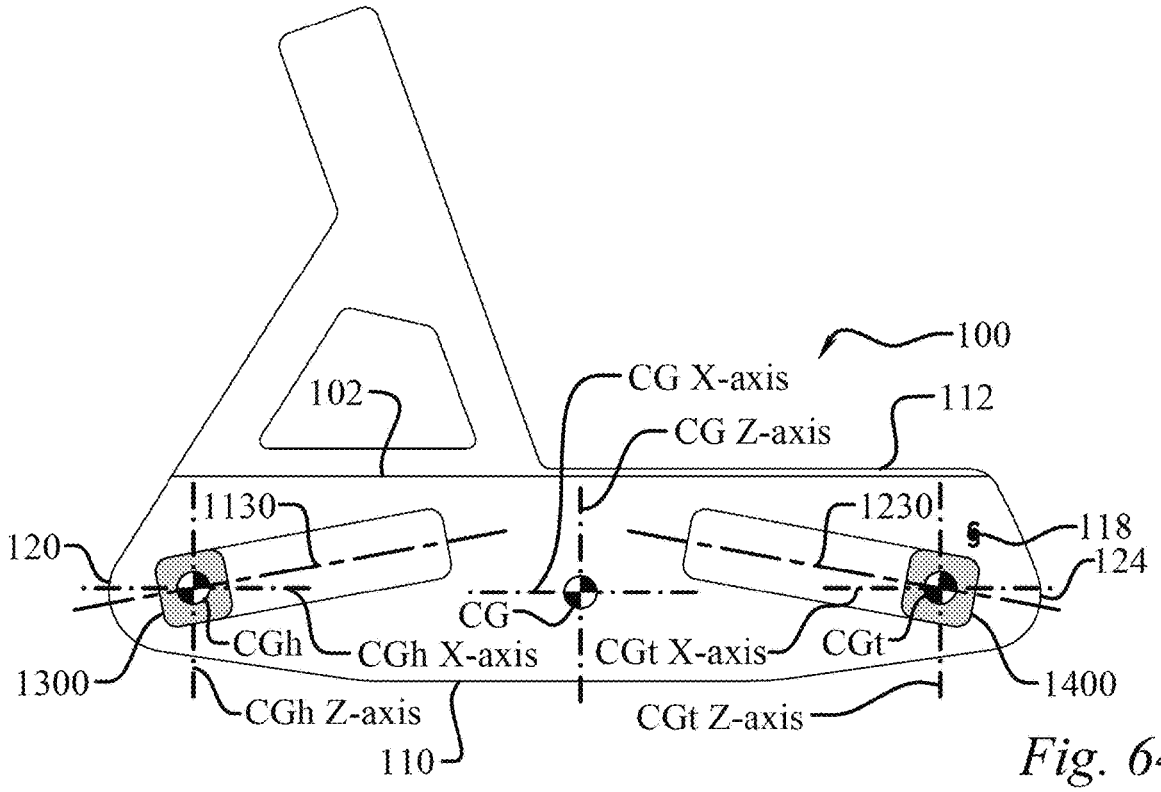
FIG. 64 is a rear side view of another golf putter head embodiment with the heel weight located at heel portion, and the toe weight located at the toe portion of the golf putter head.
Figure 65:
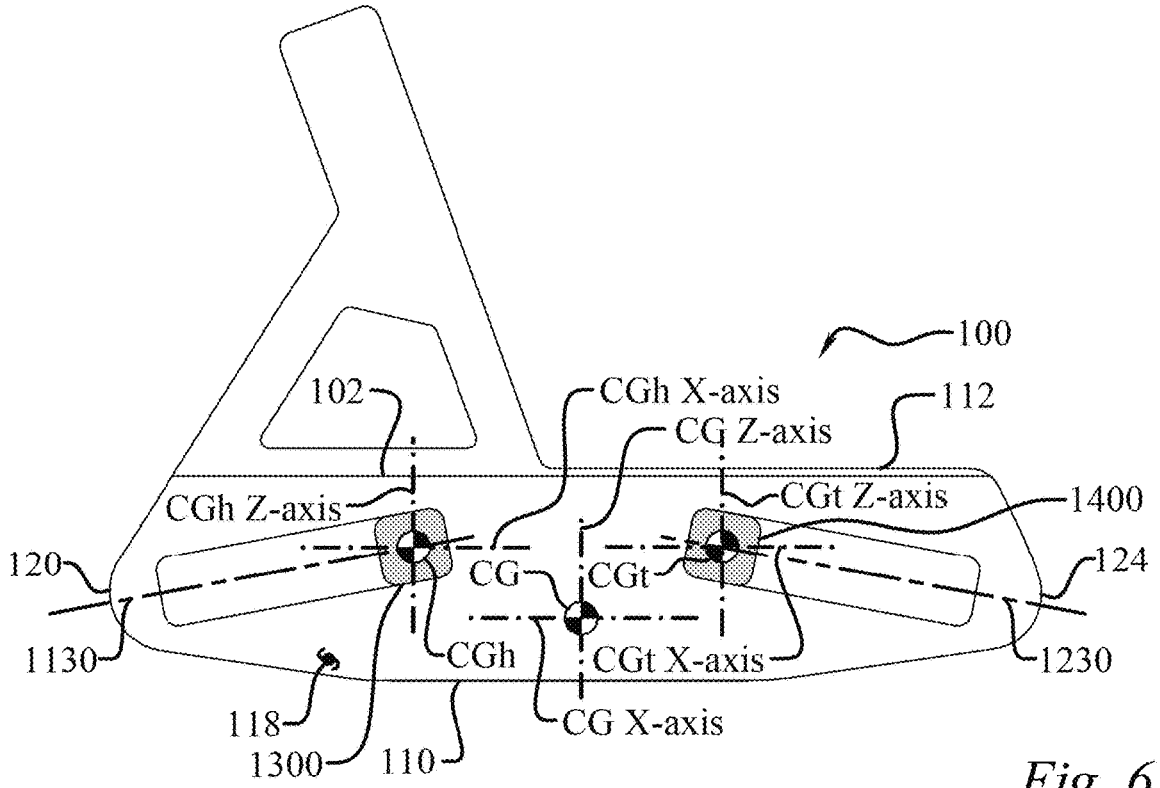
FIG. 65 is a rear side view of the golf putter head embodiment seen in FIG. 64 with the heel and toe weights located at middle portion of the golf putter head.
Figure 66:
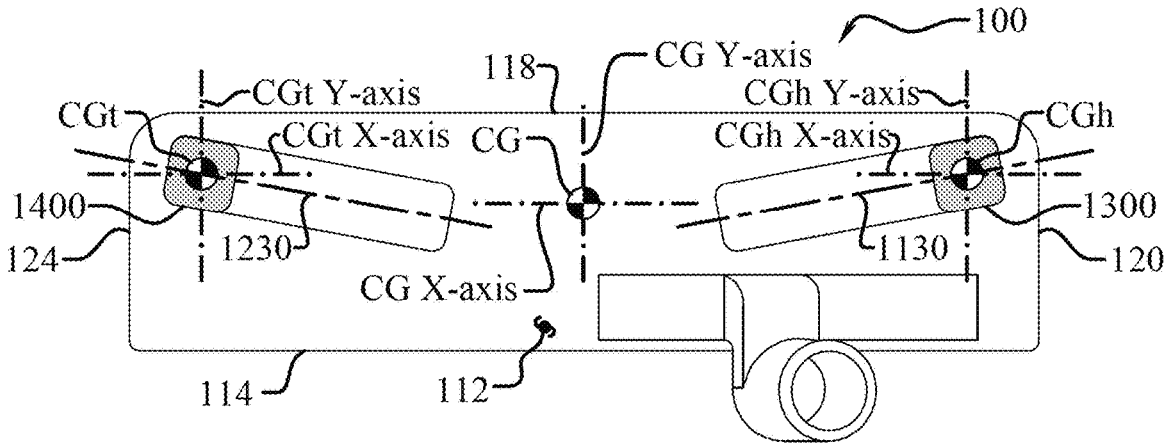
FIG. 66 is a top plan view of another golf putter head embodiment with the heel weight located at heel portion, and the toe weight located at the toe portion of the golf putter head.
Figure 67:
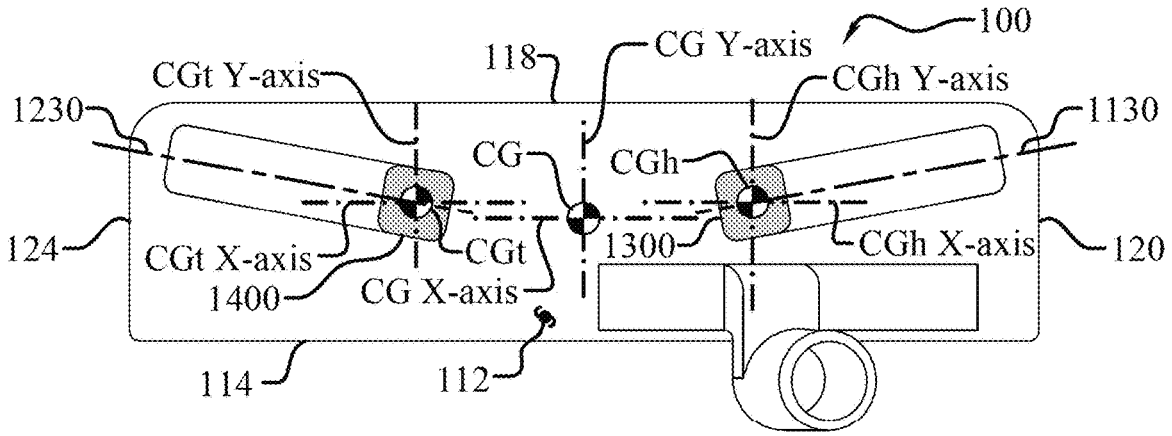
FIG. 67 is a top plan view of the golf putter head embodiment seen in FIG. 66 with the heel and toe weights located at middle portion of the golf putter head.
Figure 68:
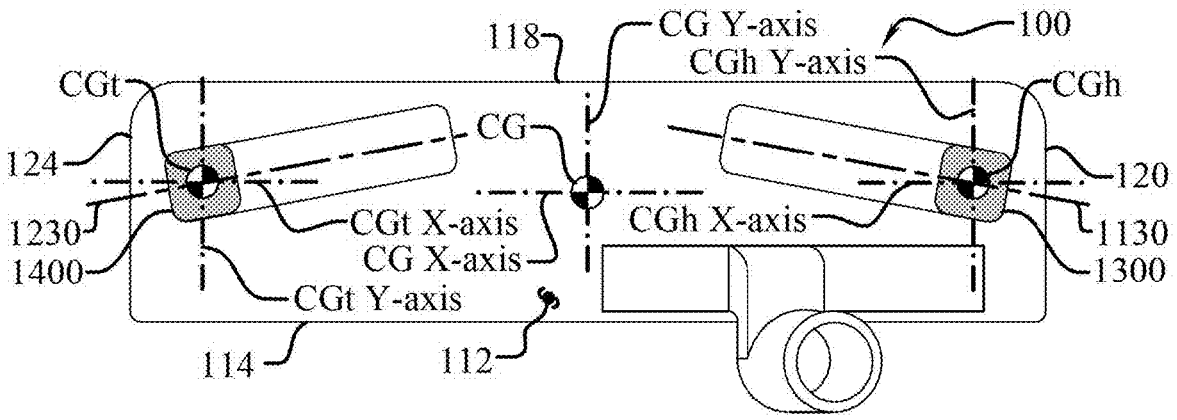
FIG. 68 is a top plan view of another golf putter head embodiment with the heel weight located at heel portion and the toe weight located at the toe portion of the golf putter head.
Figure 69:
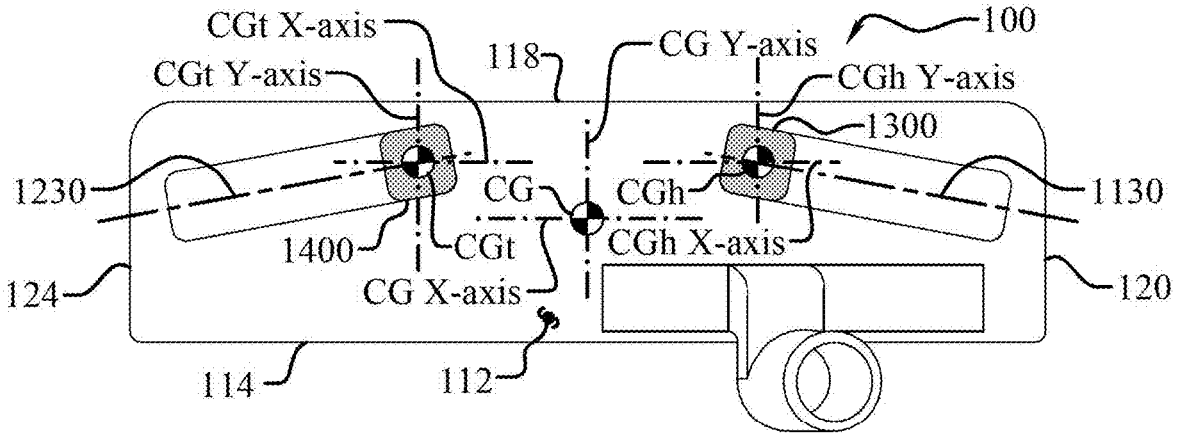
FIG. 69 is a top plan view of the golf putter head embodiment seen in FIG. 68 with the heel and toe weights located at middle portion of the golf putter head.
Figure 70:
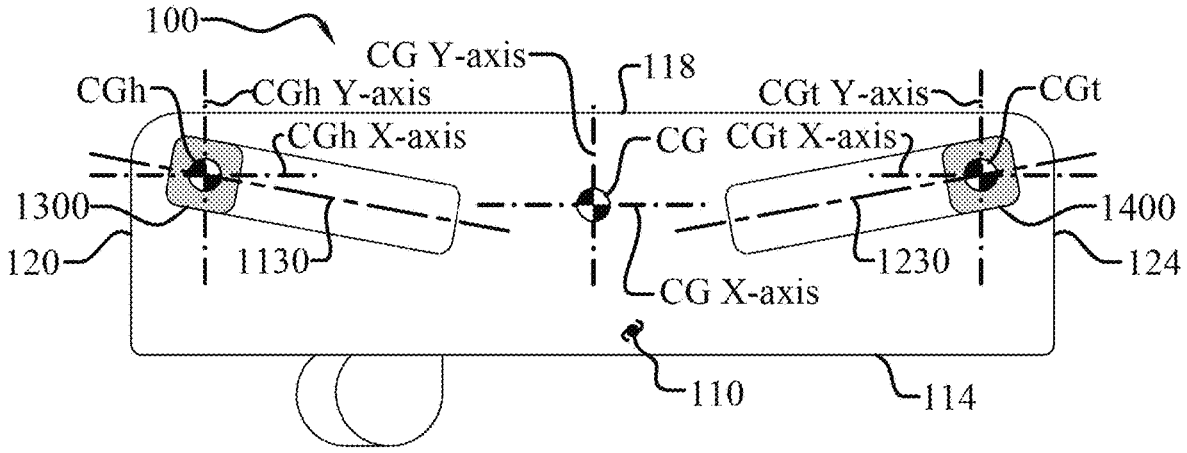
FIG. 70 is a bottom plan view of another golf putter head embodiment with the heel weight located at heel portion and the toe weight located at the toe portion of the golf putter head.
Figure 71:
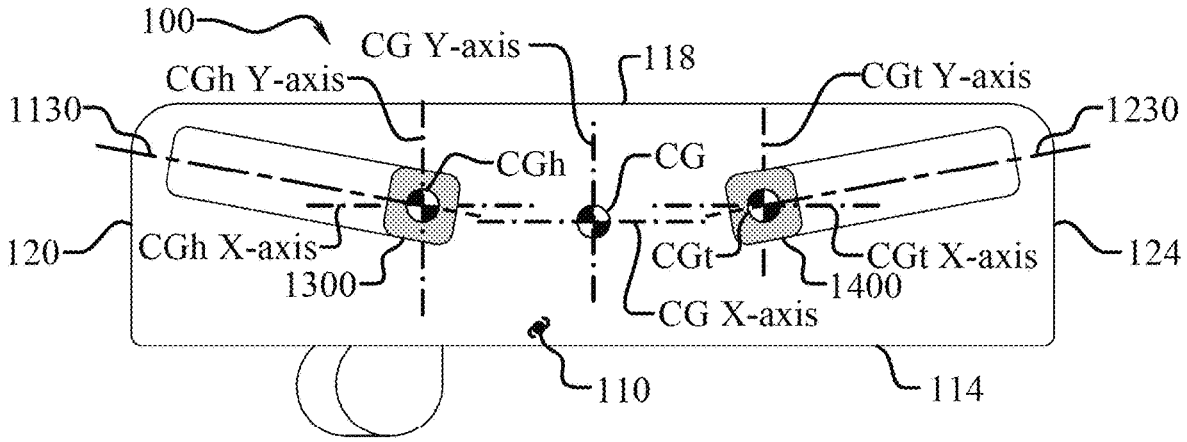
FIG. 71 is a bottom plan view of the golf putter head embodiment seen in FIG. 70 with the heel and toe weights located at middle portion of the golf putter head.
Figure 72:
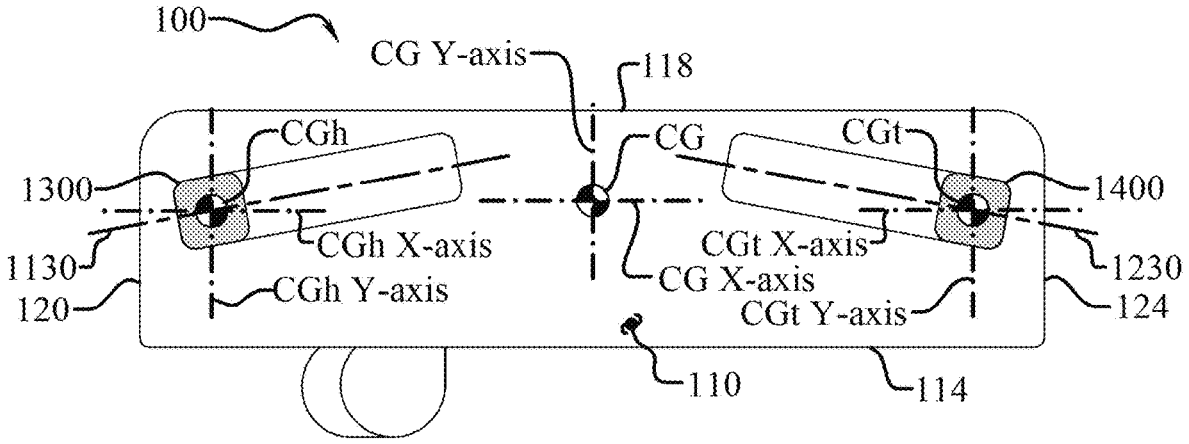
FIG. 72 is a bottom plan view of another golf putter head embodiment with the heel weight located at heel portion and the toe weight located at the toe portion of the golf putter head.
Figure 73:
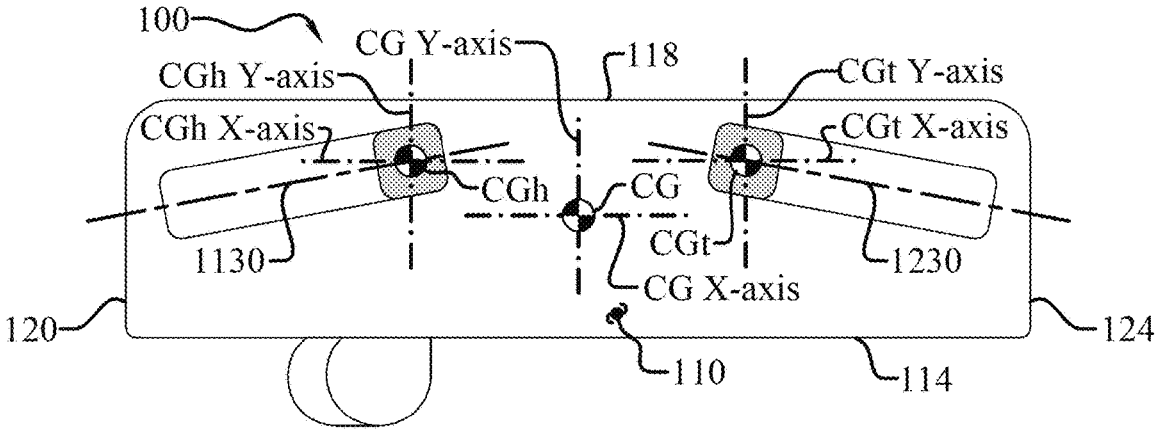
FIG. 73 is a bottom plan view of the golf putter head embodiment seen in FIG. 72 with the heel and toe weights located at middle portion of the golf putter head.
Figure 74:
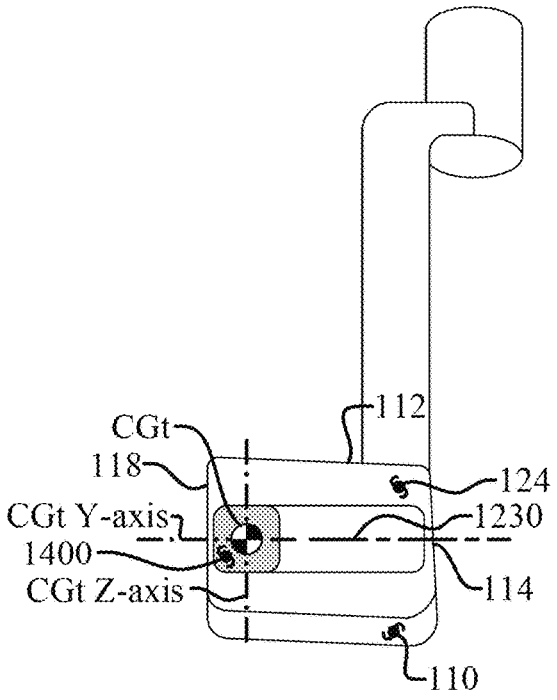
FIG. 74 is a toe side view of another golf putter head embodiment with the toe weight located at the rear portion of the golf putter head.
Figure 75:
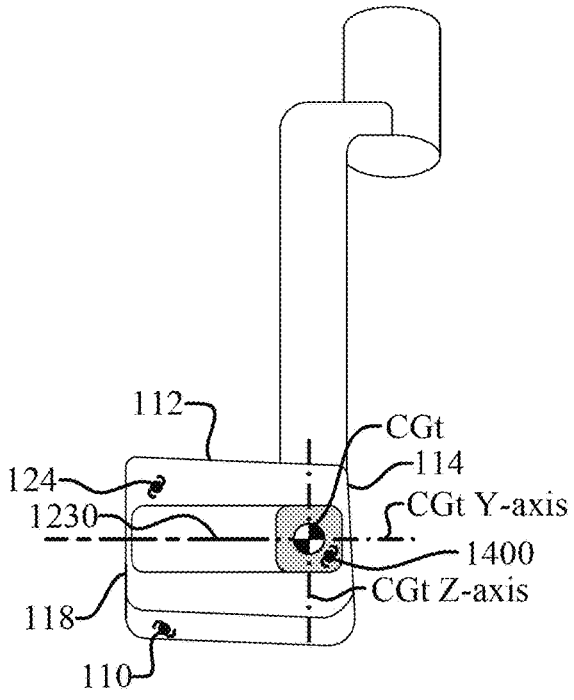
FIG. 75 is a toe side view of the golf putter head embodiment seen in FIG. 74 with the toe weight located at the front portion of the golf putter head.
Figure 76:
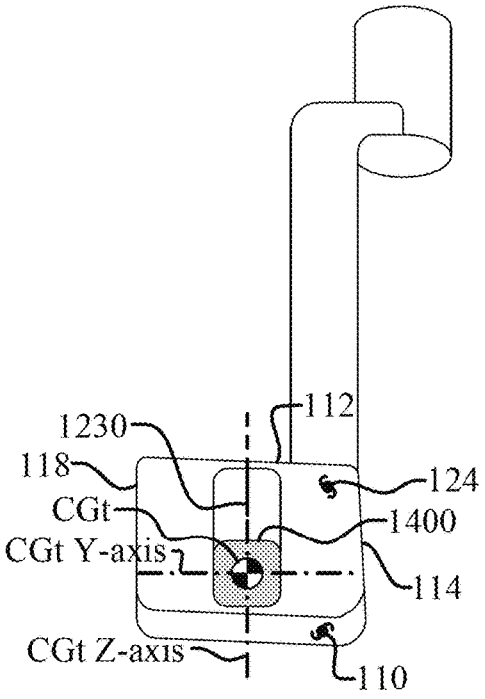
FIG. 76 is a toe side view of another golf putter head embodiment with the toe weight located at the sole portion of the golf putter head.
Figure 77:
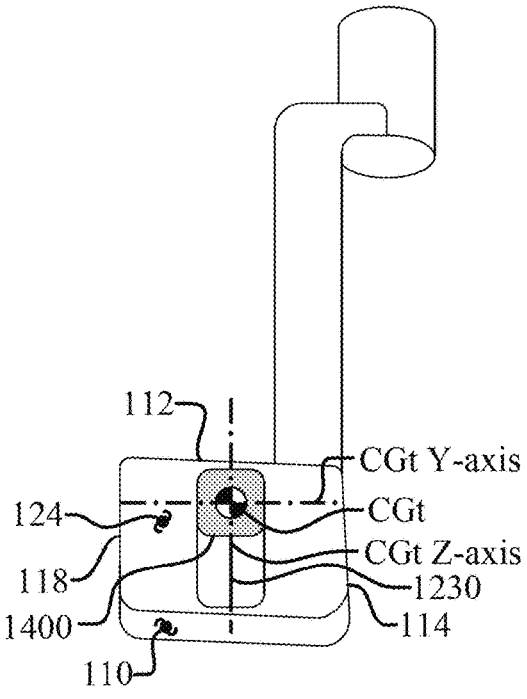
FIG. 77 is a toe side view of the golf putter head embodiment seen in FIG. 76 with the toe weight located at the crown portion of the golf putter head.
Figure 78:
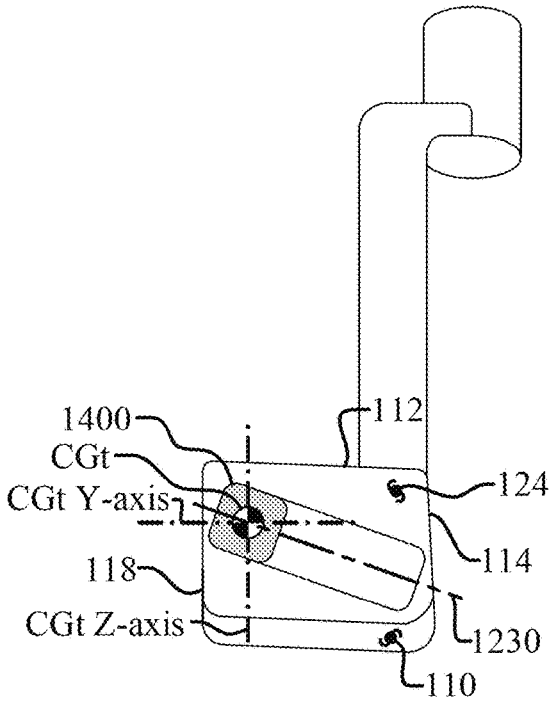
FIG. 78 is a toe side view of another golf putter head embodiment with the toe weight located at the crown and rear portion of the golf putter head.
Figure 79:
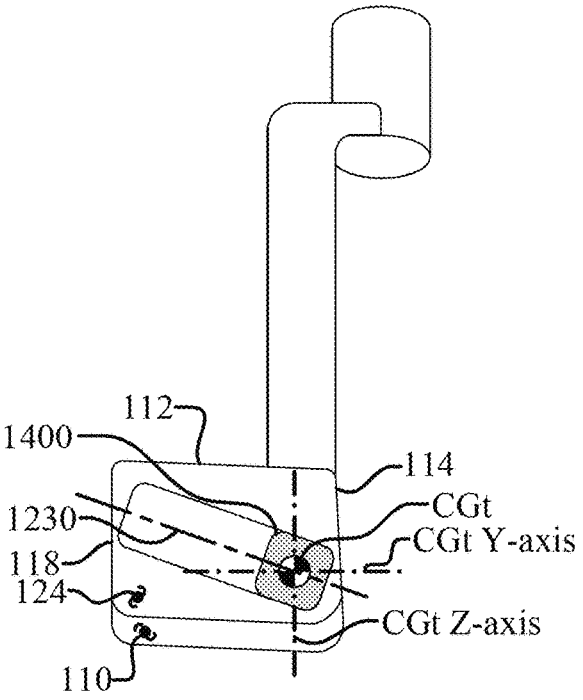
FIG. 79 is a toe side view of the golf putter head embodiment seen in FIG. 78 with the toe weight located at the sole and front portion of the golf putter head.
Figure 80:
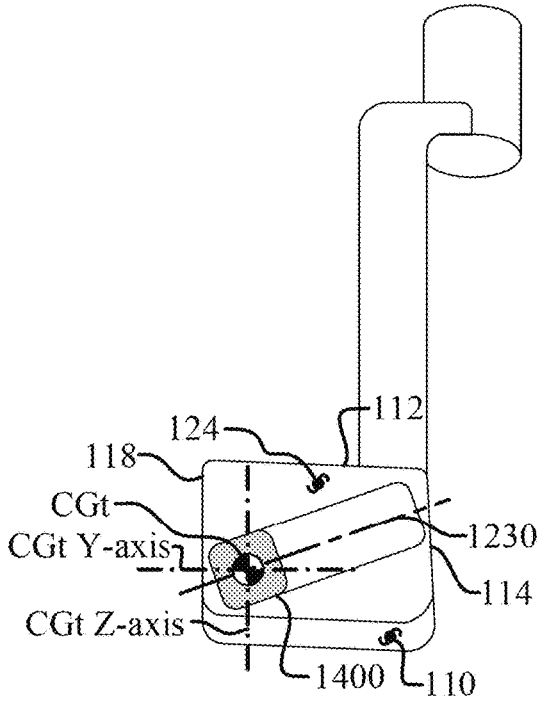
FIG. 80 is a toe side view of another golf putter head embodiment with the toe weight located at the sole and rear portion of the golf putter head.
Figure 81:
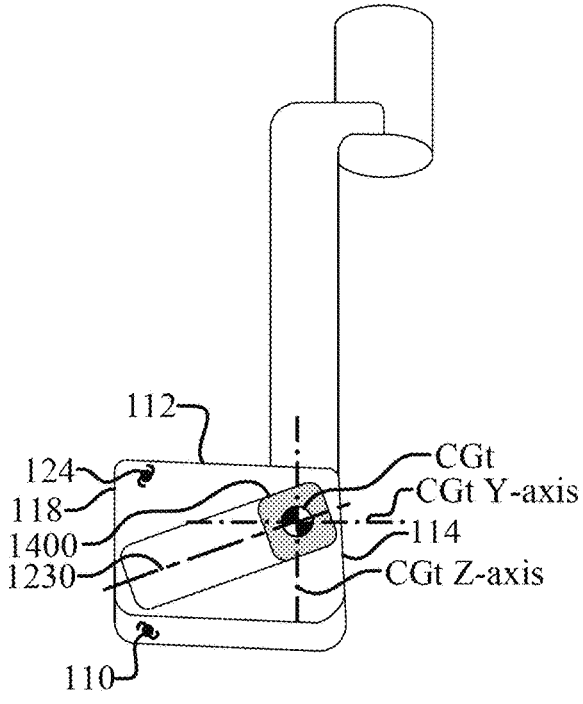
FIG. 81 is a toe side view of the golf putter head embodiment seen in FIG. 80 with the toe weight located at the crown and front portion of the golf putter head.

As illustrated in FIGS. 62-81, the HT longitudinal axis 1130 and/or the TT longitudinal axis 1230 may be oriented such that as a weight assembly is moved toward center face the elevation of the weight assembly is reduced. Alternatively, as seen in FIGS. 64-65, the opposite may also be true, whereby as a weight assembly is moved toward center face the elevation of the weight assembly is increased. Additionally, as seen in FIGS. 66-67, in one embodiment the HT longitudinal axis 1130 and/or the TT longitudinal axis 1230 may be oriented such that as a weight assembly is moved toward center face the distance from the weight assembly CG to the origin is reduced. Alternatively, as seen in FIGS. 68-69, the opposite may also be true, whereby as a weight assembly is moved toward center face the distance from the weight assembly CG to the origin is increased. In one embodiment, any of these relationships may be achieved with the weight assembly, or assemblies, accessible from the rear of the club head, as seen in FIGS. 64-65, while in another embodiment any of these relationships may be achieved with the weight assembly, or assemblies, accessible from the sole of the club head, and likewise for a combination thereof, as well as from the toe side, the heel side, and/or the face side.

Now, with continued reference to FIGS. 62-81, attributes of the HT longitudinal axis 1130 will be disclosed with respect to the CGt X-axis, CGt Y-axis, and/or CGt Z-axis and they are equally applicable to the TT longitudinal axis 1230 and the CGh X-axis, CGh Y-axis, and/or CGh Z-axis, regardless of whether there is a single weight assembly or multiple weight assemblies. In one embodiment the angle of the HT longitudinal axis 1130 is at least 1 degree from the CGh X-axis, when measured in a X-Z plane (i.e. a plane containing the CGh X-axis and the CGh Z-axis), and in further embodiments the angle is at least 2 degrees, 3 degrees, or 4 degrees. In another embodiment the angle of the HT longitudinal axis 1130 is no more than 20 degrees from the CGh X-axis, when measured in a X-Z plane, and in further embodiments no more than 18 degrees, 16 degrees, 14 degrees, or 12 degrees. In one embodiment the angle of the HT longitudinal axis 1130 is at least 1 degree from the CGh X-axis, when measured in a X-Y plane (i.e. a plane containing the CGh X-axis and the CGh Y-axis), and in further embodiments the angle is at least 2 degrees, 3 degrees, or 4 degrees. In another embodiment the angle of the HT longitudinal axis 1130 is no more than 20 degrees from the CGh X-axis, when measured in a X-Y plane, and in further embodiments no more than 18 degrees, 16 degrees, 14 degrees, or 12 degrees. In one embodiment the angle of the HT longitudinal axis 1130 is at least 1 degree from the CGh Y-axis, when measured in a Y-Z plane (i.e. a plane containing the CGh Y-axis and the CGh Z-axis), and in further embodiments the angle is at least 2 degrees, 3 degrees, or 4 degrees. In another embodiment the angle of the HT longitudinal axis 1130 is no more than 30 degrees from the CGh Y-axis, when measured in a Y-Z plane, and in further embodiments no more than 28 degrees, 26 degrees, 24 degrees, or 22 degrees.

Figure 62:
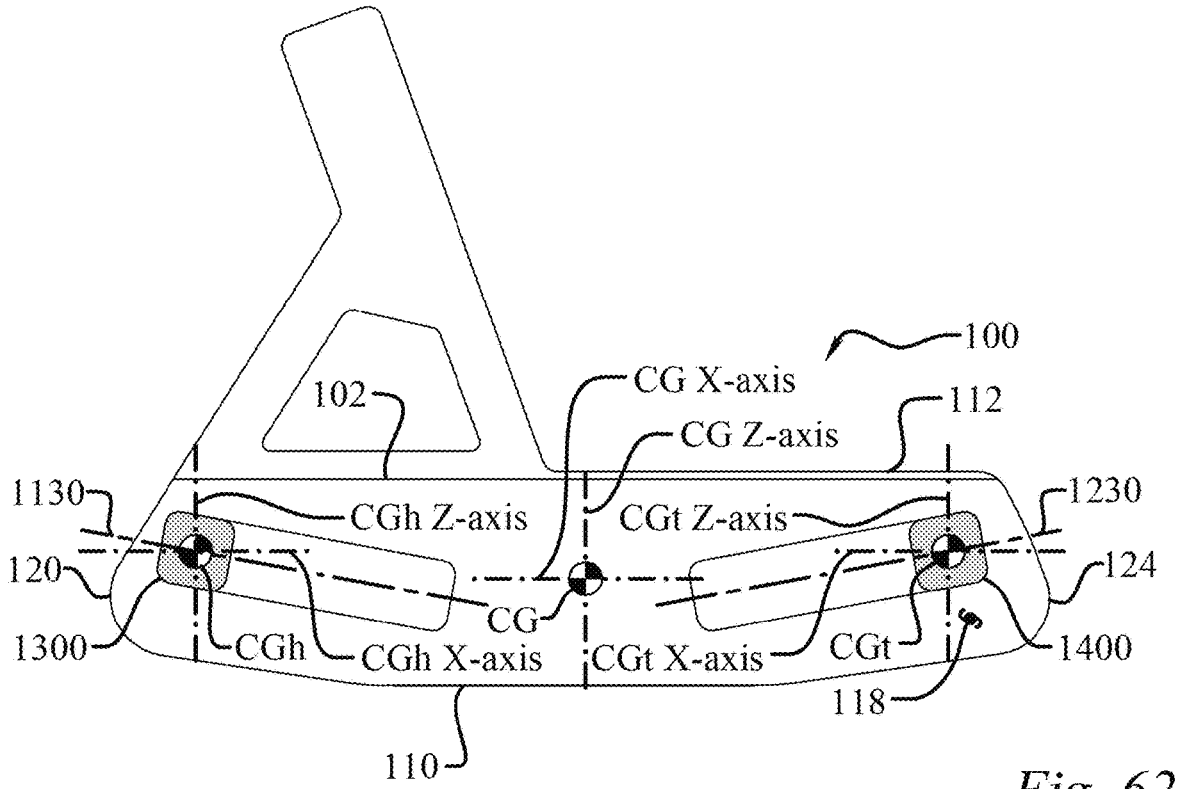
FIG. 62 is a rear side view of another golf putter head embodiment with the heel weight located at heel portion, and the toe weight located at the toe portion of the golf putter head.
Figure 63:
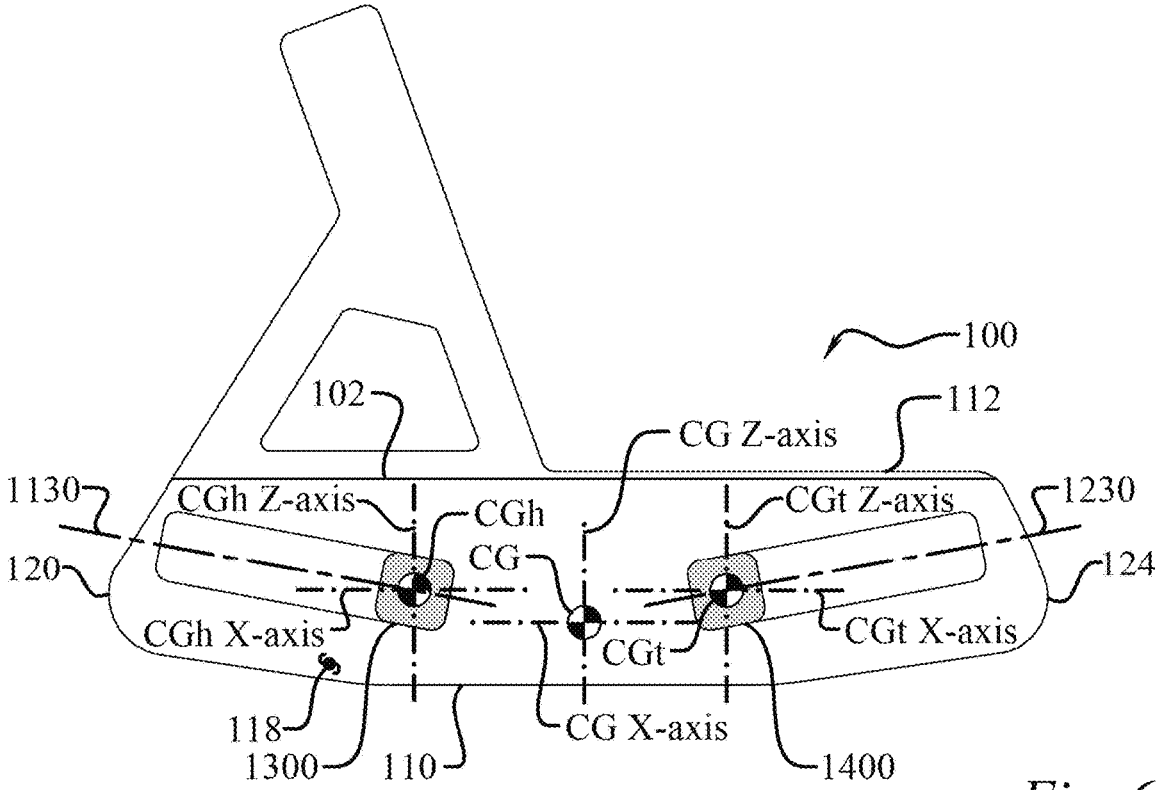
FIG. 63 is a rear side view of the golf putter head embodiment seen in FIG. 62 with the heel and toe weights located at middle portion of the golf putter head.

The blade-style putter head embodiments have a maximum length L, a maximum height H, and a maximum width W, as illustrated and disclosed with respect to FIGS. 3 and 5. As previously disclosed, the toe weight assembly 1400 has a Zup-t dimension, and likewise the heel weight assembly 1300 has a Zup-h dimension. Again, disclosure made with respect to one weight assembly applies equally to all weight assemblies. In one embodiment the Zup-t dimension is adjustable from a minimum Zup-t value to a maximum Zup-t value as it is repositioned, establishing a Zup-t delta therebetween. In one embodiment the Zup-t delta is at least 10% of the maximum height H, and in further embodiments it is at least 15%, 20%, 25%, 30%, 35%, 40%, 45%, 50%, or 55%. As previously disclosed, the toe weight assembly 1400 has a CGty value, which varies from a minimum CGty value to a maximum CGty value as it is repositioned, establishing a CGty delta therebetween. In one embodiment the CGty delta is at least 10% of the maximum length L, and in further embodiments at least 15%, 20%, 25%, 30%, 35%, 40%, 45%, 50%, or 55%. In another embodiment the toe weight assembly 1400 is repositionable along the origin X-axis throughout at least 20% of the maximum width W, and in further embodiments at least 25%, 30%, 35%, or 40%, while in a single track embodiment, such as that of FIGS. **95*a*-105 the weight assembly is further repositionable along the origin X-axis throughout at least 55% of the maximum width W, and in further embodiments at least 60%, 65%, 70%, or 75%. One skilled in the art will appreciated that in one embodiment the dual tracks of FIG. 62 may be joined to create a single track. Similarly, one skilled in the art will appreciate that the single track embodiments of FIGS. 95*a*-105 may incorporate a curved track to achieve the weight assembly elevation changes disclosed with respect to the embodiments of FIGS. 62-81. For example, in one embodiment the tracks of FIG. 62 are joined creating a single track with the lowest weight assembly elevation at center face, with a weight assembly Zup that is less than the club head Zup, and a portion of the track toward the heel and/or toe reaches an elevation above the origin. Similarly, in another embodiment the tracks of FIG. 64** are joined creating a single track with a highest weight assembly elevation at center face, with a weight assembly Zup that is greater than the club head Zup, and a portion of the track toward the heel and/or toc reaches and elevation below the origin.

Figure 104:
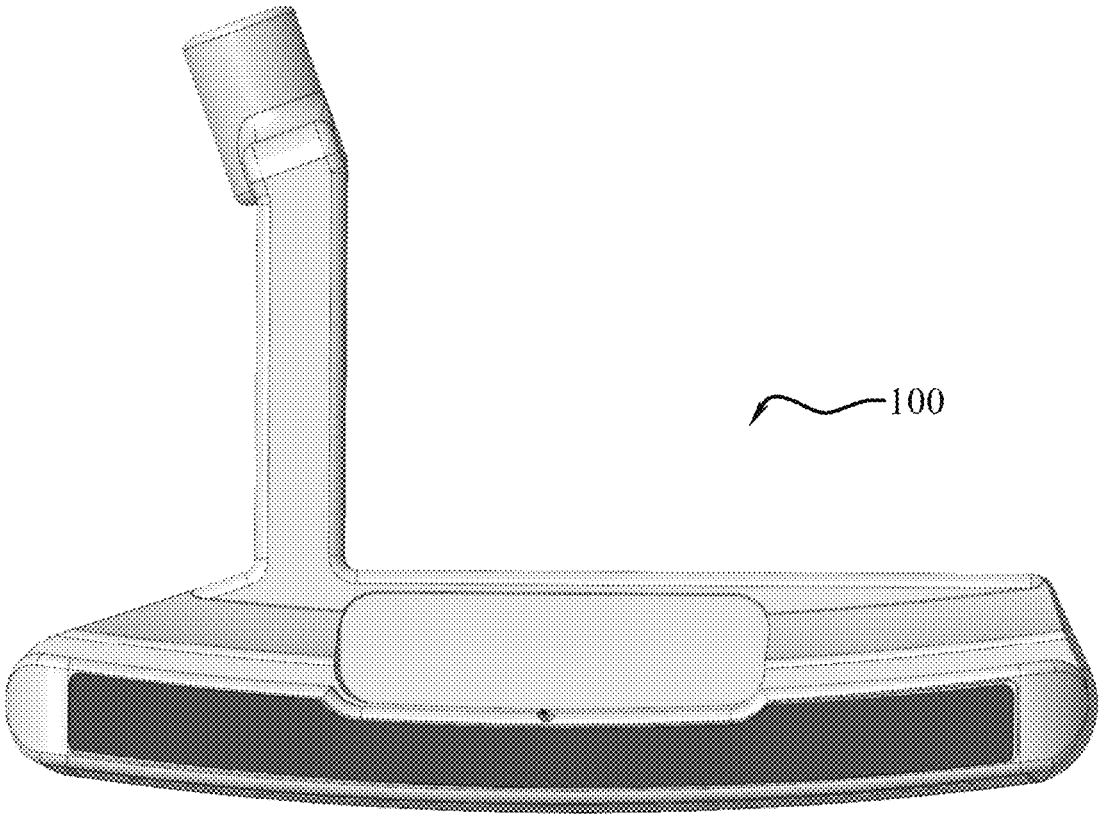
FIG. 104 is a rear side view of the golf putter head embodiment seen in FIG. 101.
Figure 105:
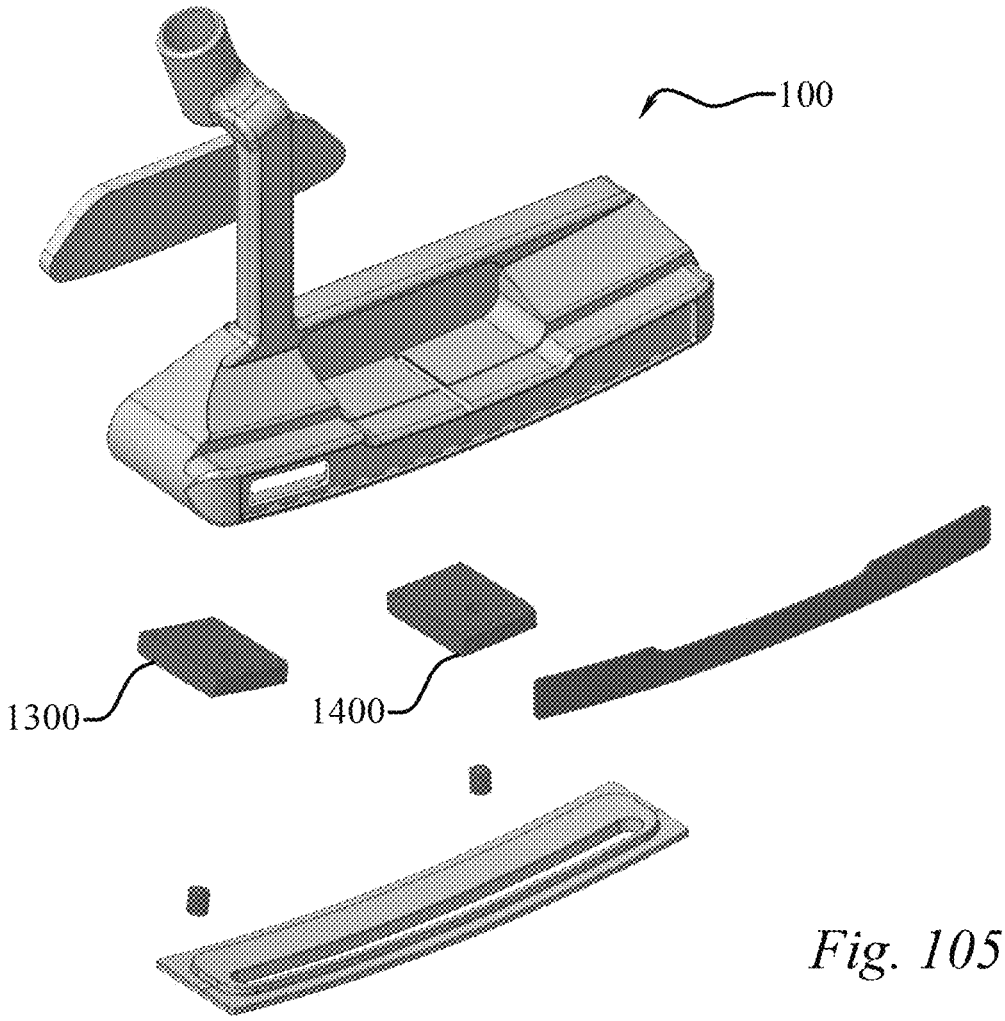
FIG. 105 is an exploded isometric view of the golf putter head embodiment seen in FIG. 101.

The embodiment of FIG. **95*a* has a weight insertion access port located between the hosel and the heel end of the club head. In this embodiment the weight insertion access port is located in a rear surface of the club head and facilitates entry of a portion of the weight assembly into the club head. In another embodiment the weight insertion access port located between the hosel and the toe end of the club head, and in a further embodiment the weight insertion access port is located between the origin and the toe end of the club head. The weight insertion access port located at the toe end side surface of the club head in another embodiment, and similarly it may be located at the heel end side surface of the club head in yet a further embodiment. Further, in one embodiment the weight insertion access port extends throughout majority of the maximum width W of the club head, as seen in FIG. 104. One single track embodiment, such as that of FIGS. 95*a*-105**, includes multiple weight assemblies having a total repositionable mass of at least 30 grams, and in further embodiments at least 40 grams, 50 grams, 60 grams, 70 grams, 80 grams, or 90 grams.

As seen in FIGS. 30-55, any of the embodiments may incorporate a hosel 122 having a strut-based design, as disclosed in detail in U.S. patent application Ser. No. 18/402,495, filed Jan. 2, 2024, which is incorporated by reference herein in the entirety.

As previously noted, this disclosure applies equally to other iron type golf club heads conventionally referred to as a 3-iron, 4-iron, 5-iron, 6-iron, 7-iron, 8-iron, 9-iron, and wedges, however with the loft, lie, and head weight adjusted accordingly, one embodiment of which is seen in Table 3; as well as hybrid iron type golf club heads, often referred to as rescue golf club heads, generally having a hollow construction and curved, or flat, faces, however with the loft, lie, and head weight adjusted accordingly, one embodiment of which is seen in Table 4; as well as fairway wood type golf club heads, generally having a hollow construction and curved faces, however with the loft, lie, and head weight adjusted accordingly, one embodiment of which is seen in Table 5; and even driver golf club heads, generally having a hollow construction and curved faces, however with the loft, lie, and head weight adjusted accordingly, one embodiment of which is seen in Table 6.

TABLE 3

| | 3-iron | 4-iron | 5-iron | 6-iron | 7-iron | 8-iron | 9-iron |
|---|---|---|---|---|---|---|---|
| Finished Head Weight (grams) ± 5 g | 240 | 247 | 254 | 261 | 268 | 275 | 282 |
| Loft (degrees) ± 3 degrees | 19 | 21 | 23.5 | 26.5 | 30.5 | 35 | 40 |
| Lie (degrees) ± 3 degrees | 60.5 | 61.0 | 61.5 | 62 | 62.5 | 63 | 63.5 |
| Club Length ± 2 inches | 39" | 38.5" | 38" | 37.5" | 37" | 36.5" | 36" |

TABLE 4

| | 2-hybrid | 3-hybrid | 4- hybrid | 5- hybrid | 6- hybrid | 7-hybrid |
|---|---|---|---|---|---|---|
| Finished Head Weight (grams) ± 5 g | 217 | 227 | 237 | 247 | 257 | 267 |
| Loft (degrees) ± 3 degrees | 16.5 | 19 | 22 | 25 | 29 | 33 |
| Lie (degrees) ± 3 degrees | 57.5 | 58.00 | 58.5 | 59 | 59.5 | 60 |
| Club Length ± 2 inches | 41.25" | 40.75" | 40.25" | 39.75" | 39.25" | 38.75" |

TABLE 5

| | 3 fairway wood | 5 fairway wood |
|---|---|---|
| Finished Head Weight (grams) ± 5 g | 215 | 218 |
| Loft (degrees) ± 3 degrees | 15 | 18 |
| Lie (degrees) ± 3 degrees | 58.5 | 59.50 |
| Club Length ± 2 inches | 43.25" | 42.25" |

TABLE 6

| | driver |
|---|---|
| Finished Head Weight (grams) ± 5 g | 190-210 |
| Loft (degrees) ± 3 degrees | 10 |
| Lie (degrees) ± 3 degrees | 58.00 |
| Club Length ± 2 inches | 45.75" |

Any embodiments of the club head may include an electronic display, as disclosed in U.S. Ser. No. 17/878,734, filed Aug. 1, 2022, U.S. application Ser. No. 16/352,537, filed Mar. 13, 2019, and U.S. application Ser. No. 17/695,194, filed Mar. 15, 2022, which are all incorporated by reference herein in their entirety. In addition to the various features described herein, any of the features of the golf club heads disclosed herein may also incorporate additional features, which can include any of the following features found in the following, which are all incorporated by reference herein in their entirety: U.S. Pat. Nos. 11,179,608; 10,874,928; 10,391,369; 10,052,530; 9,827,479; 9,522,313; 9,468,817; 9,375,619; 9,220,960; 8,328,654; 8,066,581; 7,648,425; 7,594,865; 7,465,240; 7,438,648; 7,396,295; 7,278,926; 6,929,564; U.S. Ser. No. 18/534,512, filed Dec. 8, 2023; U.S. Ser. No. 17/878,734, filed Aug. 1, 2022; U.S. Ser. No. 17/645,033, filed Dec. 17, 2021; U.S. Ser. No. 17/974,279, filed Oct. 26, 2022; U.S. Ser. No. 17/566,263, filed Mar. 16, 2022; U.S. Ser. No. 18/068,347, filed Dec. 19, 2022; U.S. Ser. No. 17/722,632, filed Apr. 18, 2022; U.S. Ser. No. 17/691,649, filed Mar. 10, 2022; U.S. Ser. No. 17/577,943, filed Jan. 18, 2022; U.S. Ser. No. 17/107,490, filed Nov. 30, 2020; U.S. Ser. No. 17/505,511, filed Oct. 19, 2021; U.S. Ser. No. 17/736,766, filed May 4, 2022; U.S. Ser. No. 17/963,491, filed Oct. 11, 2022; U.S. Pat. No. 9,468,817, issued Oct. 18, 2016; U.S. Pat. No. 9,375,619, issued Jun. 28, 2016; U.S. Pat. No. 9,522,313, issued Dec. 20, 2016; U.S. Pat. No. 8,758,155, issued Jun. 24, 2014; U.S. Pat. No. 9,375,619, issued Jun. 28, 2016; U.S. Pat. No. 9,220,960, issued Dec. 29, 2015; U.S. Pat. No. 7,465,240, issued Dec. 16, 2008; U.S. Provisional Patent Application No. 63/436,330, filed Dec. 30, 2022; U.S. Provisional Patent Application No. 63/433,380, filed Dec. 27, 2022; U.S. Pat. No. D925,677, issued Jul. 20, 2021; U.S. Pat. No. D924,991, issued Jul. 13, 2021; and U.S. Pat. No. D924992, issued Jul. 13, 2021.

In addition to the various features described herein, any of the golf club heads disclosed herein may also incorporate additional features, which can include any of the following features:

- movable weight features including those described in more detail in U.S. Pat. Nos. 6,773,360, 7,166,040, 7,452,285, 7,628,707, 7,186,190, 7,591,738, 7,963,861, 7,621,823, 7,448,963, 7,568,985, 7,578,753, 7,717,804, 7,717,805, 7,530,904, 7,540,811, 7,407,447, 7,632,194, 7,846,041, 7,419,441, 7,713,142, 7,744,484, 7,223,180, 7,410,425 and 7,410,426, the entire contents of each of which are incorporated by reference in their entirety herein;
- slidable weight features including those described in more detail in U.S. Pat. Nos. 7,775,905 and 8,444,505, U.S. patent application Ser. No. 13/898,313 filed on May 20, 2013, U.S. patent application Ser. No. 14/047,880 filed on Oct. 7, 2013, the entire contents of each of which are hereby incorporated by reference herein in their entirety;
- aerodynamic shape features including those described in more detail in U.S. Patent Publication No. 2013/0123040A1, the entire contents of which are incorporated by reference herein in their entirety;
- removable shaft features including those described in more detail in U.S. Pat. No. 8,303,431, the contents of which are incorporated by reference herein in in their entirety;
- adjustable loft/lie features including those described in more detail in U.S. Pat. Nos. 8,025,587, 8,235,831, 8,337,319, U.S. Patent Publication No. 2011/0312437A1, U.S. Patent Publication No. 2012/0258818A1, U.S. Patent Publication No. 2012/0122601A1, U.S. Patent Publication No. 2012/0071264A1, U.S. patent application Ser. No. 13/686,677, the entire contents of which are incorporated by reference herein in their entirety; and
- adjustable sole features including those described in more detail in U.S. Pat. No. 8,337,319, U.S. Patent Publication Nos. US2011/0152000A1, US2011/0312437, US2012/0122601A1, and U.S. patent application Ser. No. 13/686,677, the entire contents of each of which are incorporated by reference herein in their entirety.

The technology described herein may also be combined with other features and technologies for golf clubs, such as:

variable thickness face features described in more detail in U.S. patent application Ser. No. 12/006,060, U.S. Pat. Nos. 6,997,820, 6,800,038, and 6,824,475, which are incorporated herein by reference in their entirety;

composite face plate features described in more detail in U.S. patent application Ser. Nos. 11/998,435, 11/642,310, 11/825,138, 11/823,638, 12/004,386, 12/004,387, 11/960,609, 11/960,610 and U.S. Pat. No. 7,267,620, which are herein incorporated by reference in their entirety.

Additionally, in addition to the various features described herein, any of the golf club heads disclosed herein may also incorporate additional features, which can include any of the features disclosed in U.S. patent application Ser. No. 17/560,054, filed Dec. 22, 2021, Ser. No. 17/505,511, filed Oct. 19, 2021, Ser. No. 17/389,167, filed Jul. 19, 2021, Ser. No. 17/321,315, filed May 14, 2021, Ser. No. 18/179,848, filed Mar. 7, 2023, Ser. No. 17/124,134, filed Dec. 16, 2020, Ser. No. 17/137,151, filed Dec. 29, 2020, Ser. No. 17/691,649, filed Mar. 10, 2022, Ser. No. 18/510,476, filed Nov. 15, 2023, Ser. No. 17/228,511, filed Apr. 12, 2021, Ser. No. 17/224,026, filed Apr. 6, 2021, Ser. No. 17/564,077, filed Dec. 28, 2021, 63/292,708, filed Dec. 22, 2021, 63/478,107, filed Dec. 30, 2022, 63/433,380, filed Dec. 16, 2022, Ser. No. 14/694,998, filed Apr. 23, 2015, Ser. No. 18/068,347, filed Dec. 19, 2022, Ser. No. 17/547,519, filed Dec. 10, 2021, Ser. No. 17/360,179, filed Jun. 28, 2021, Ser. No. 17/531,979, filed Nov. 22, 2021, Ser. No. 17/722,748, filed Apr. 18, 2022, Ser. No. 17/006,561, filed Aug. 28, 2020, Ser. No. 16/806,254, filed Mar. 2, 2020, Ser. No. 17/696,664, filed Mar. 16, 2022, Ser. No. 17/565,580, filed Dec. 30, 2021, Ser. No. 17/727,963, filed Apr. 25, 2022, Ser. No. 16/288,499, filed Feb. 28, 2019, Ser. No. 17/530,331, filed Nov. 18, 2021, Ser. No. 17/586,960, filed Jan. 28, 2022, Ser. No. 17/884,027, filed Aug. 9, 2022, Ser. No. 13/842,011, filed Mar. 15, 2013, Ser. No. 16/817,311, filed Mar. 12, 2020, Ser. No. 17/355,642, filed Jun. 23, 2021, Ser. No. 17/132,645, filed Dec. 23, 2020, Ser. No. 17/390,615, filed Jul. 30, 2021, Ser. No. 17/164,033, filed Feb. 1, 2021, Ser. No. 17/107,474, filed Nov. 30, 2020, Ser. No. 17/526,981, filed Nov. 15, 2021, Ser. No. 16/352,537, filed Mar. 13, 2019, Ser. No. 17/156,205, filed Jan. 22, 2021, Ser. No. 17/132,541, filed Dec. 23, 2020, Ser. No. 17/824,727, filed May 25, 2022, Ser. No. 17/722,632, filed Apr. 18, 2022, Ser. No. 17/712,041, filed Apr. 1, 2022, Ser. No. 17/695,194, filed Mar. 15, 2022, Ser. No. 17/686,181, filed Mar. 3, 2022, 63/305,777, filed Feb. 2, 2022, Ser. No. 17/577,943, filed Jan. 18, 2022, Ser. No. 17/570,613, filed Jan. 7, 2022, Ser. No. 17/569,810, filed Jan. 6, 2022, Ser. No. 17/566,833, filed Dec. 31, 2021, Ser. No. 17/566,131, filed Dec. 30, 2021, Ser. No. 17/566,263, filed Dec. 30, 2021, Ser. No. 17/557,759, filed Dec. 21, 2021, Ser. No. 17/558,387, filed Dec. 21, 2021, Ser. No. 17/645,033, filed Dec. 17, 2021, Ser. No. 17/541,107, filed Dec. 2, 2021, Ser. No. 17/526,855, filed Nov. 15, 2021, Ser. No. 17/524,056, filed Nov. 11, 2021, Ser. No. 17/522,560, filed Nov. 9, 2021, Ser. No. 17/515,112, filed Oct. 29, 2021, Ser. No. 17/513,716, filed Oct. 28, 2021, Ser. No. 17/504,335, filed Oct. 18, 2021, Ser. No. 17/504,327, filed Oct. 18, 2021, Ser. No. 17/494,416, filed Oct. 5, 2021, Ser. No. 17/493,604, filed Oct. 4, 2021, 63/261,457, filed Sep. 21, 2021, Ser. No. 17/479,785, filed Sep. 20, 2021, Ser. No. 17/476,839, filed Sep. 16, 2021, Ser. No. 17/477,258, filed Sep. 16, 2021, Ser. No. 17/476,025, filed Sep. 15, 2021, Ser. No. 17/467,709, filed Sep. 7, 2021, Ser. No. 17/403,516, filed Aug. 16, 2021, Ser. No. 17/399,823, filed Aug. 11, 2021, 63/227,889, filed Jul. 30, 2021, Ser. No. 17/387,181, filed Jul. 28, 2021, Ser. No. 17/378,407, filed Jul. 16, 2021, Ser. No. 17/368,520, filed Jul. 6, 2021, Ser. No. 17/330,033, filed May 25, 2021, Ser. No. 17/235,533, filed Apr. 20, 2021, Ser. No. 17/233,201, filed Apr. 16, 2021, Ser. No. 17/216,185, filed Mar. 29, 2021, Ser. No. 17/198,030, filed Mar. 10, 2021, Ser. No. 17/191,617, filed Mar. 3, 2021, Ser. No. 17/190,864, filed Mar. 3, 2021, Ser. No. 17/183,905, filed Feb. 24, 2021, Ser. No. 17/183,057, filed Feb. 23, 2021, Ser. No. 17/181,923, filed Feb. 22, 2021, Ser. No. 17/171,678, filed Feb. 9, 2021, Ser. No. 17/171,656, filed Feb. 9, 2021, Ser. No. 17/107,447, filed Nov. 30, 2020, and 63/338,818, filed May 5, 2022, all of which are herein incorporated by reference in their entirety. Additionally, in addition to the various features described herein, any of the golf club heads disclosed herein may also incorporate additional features, which can include any of the features disclosed in U.S. Pat. No. 9,610,479, issued Apr. 4, 2017, U.S. Pat. No. 11,213,726, issued Jan. 4, 2022, U.S. Pat. No. 8,777,776, issued Jul. 15, 2014, U.S. Pat. No. 7,278,928, issued Oct. 9, 2007, U.S. Pat. No. 7,445,561, issued Nov. 4, 2008, U.S. Pat. No. 9,409,066, issued Aug. 9, 2016, U.S. Pat. No. 8,303,435, issued Nov. 6, 2012, U.S. Pat. No. 7,874,937, issued Jan. 25, 2011, U.S. Pat. No. 8,628,434, issued Jan. 14, 2014, U.S. Pat. No. 8,608,591, issued Dec. 17, 2013, U.S. Pat. No. 8,740,719, issued Jun. 3, 2014, U.S. Pat. No. 9,694,253, issued Jul. 4, 2017, U.S. Pat. No. 9,683,301, issued Jun. 20, 2017, U.S. Pat. No. 9,468,816, issued Oct. 18, 2016, U.S. Pat. No. 8,262,509, issued Sep. 11, 2012, U.S. Pat. No. 7,901,299, issued Mar. 8, 2011, U.S. Pat. No. 8,119,714, issued Feb. 21, 2012, U.S. Pat. No. 8,764,586, issued Jul. 1, 2014, U.S. Pat. No. 8,227,545, issued Jul. 24, 2012, U.S. Pat. No. 8,066,581, issued Nov. 29, 2011, 10052530, issued Aug. 21, 2018, 10195497, issued Feb. 5, 2019, 10086240, issued Oct. 2, 2018, U.S. Pat. No. 9,914,027, issued Mar. 13, 2018, U.S. Pat. No. 9,174,099, issued Nov. 3, 2015, and U.S. Pat. No. 11,219,803, issued Jan. 11, 2022, all of which are herein incorporated by reference in their entirety.

The above-described embodiments are just examples of possible implementations of the disclosed technologies, and are set forth for a clear understanding of the principles of the present disclosure. Any process descriptions or blocks in flow diagrams should be understood as representing modules, segments, or portions of processes for implementing specific functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure.

Many variations and modifications may be made to the above-described embodiment(s) without departing substantially from the spirit and principles of the present disclosure. Further, the scope of the present disclosure includes any and all combinations and sub-combinations of all elements, features, and aspects disclosed herein and in the documents that are incorporated by reference. All such combinations, modifications, and variations are included herein within the scope of the present disclosure, and all possible claims to individual aspects or combinations of elements or steps are intended to be supported by the present disclosure.

Reference throughout this specification to "one example," "an example," "one embodiment," "an embodiment," or similar language means that a particular feature, structure, or characteristic described in connection with the example or embodiment is included in at least one example or embodiment of the present disclosure. Appearances of the phrases "in one example," "in an example," "in one embodiment," "in an embodiment," and similar language throughout this specification may, but do not necessarily, all refer to the same example or embodiment. Similarly, the use of the term "implementation" means an implementation having a particular feature, structure, or characteristic described in connection with one or more examples or embodiments of the present disclosure, however, absent an express correlation to indicate otherwise, an implementation may be associated with one or more examples or embodiments.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." The term "about" in some embodiments, is defined to mean within +/−5% of a given value, however in additional embodiments any disclosure of "about" may be further narrowed and claimed to mean within +/−4% of a given value, within +/−3% of a given value, within +/−2% of a given value, within +/−1% of a given value, or the exact given value. Further, when at least two values of a variable are disclosed, such disclosure is specifically intended to include the range between the two values regardless of whether they are disclosed with respect to separate embodiments or examples, and specifically intended to include the range of at least the smaller of the two values and/or no more than the larger of the two values. Additionally, when at least three values of a variable are disclosed, such disclosure is specifically intended to include the range between any two of the values regardless of whether they are disclosed with respect to separate embodiments or examples, and specifically intended to include the range of at least the A value and/or no more than the B value, where A may be any of the disclosed values other than the largest disclosed value, and B may be any of the disclosed values other than the smallest disclosed value. Any tables and/or examples disclosed herein that give exact values, are to be interpreted as also disclosing an embodiment where each of the values is +10% of the value indicated, and in further embodiments each of the values is +7.5%, +5%, or +2.5%, thereby disclosing distinct upper values for each, distinct lower values for each, as well as closed ranges having upper and lower limiting values.

Throughout the disclosure embodiments are described often with one embodiment setting a minimum value for variable or relationship, followed by an embodiment setting a maximum value for a variable or relationship. For example, in one sentence the disclosure states: "in another embodiment the toe weight portion mass is at least 100% greater than the toe washer portion mass, and in further embodiments at least 200%, 400%, 600%, 800%, 1000%, 1200%, 1400%, or 1600% greater." In another sentence the disclosure states: "while in another embodiment the toe weight portion mass is no more than 4000% greater than the toe washer portion mass, and in further embodiments no more than 3800%, 3600%, 3400%, 3200%, 3000%, 2800%, 2600%, or 2400% greater." In any such disclosure, any integer value meeting these limitations is enabled and may be claimed, such as ≥220%, ≥240%, ≥260%, ≥280%, ≥300%, ≥320%, etc., and likewise for the disclosed upper end boundary values, and likewise for any disclosed variable. Further, any discreet value within the disclosed ranges is fully enabled and may be claimed either as a value or as a boundary to a range, which applies to all the disclosure herein. Further, any discreet value within the disclosed ranges is fully enabled and may be claimed either as a value or as a boundary to a range. These principles apply to each variable and/or relationship disclosed, and the contents of each table.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described embodiments are to be considered in all respects only as illustrative and not restrictive. All changes which come within the meaning and range of equivalency of the examples below are to be embraced within their scope. In view of the many possible embodiments to which the principles of the disclosure may be applied, it should be recognized that the illustrated embodiments are only preferred examples and should not be taken as limiting the scope of the disclosure. Various modifications may be made thereto without departing from the broader spirit and scope of the disclosure as set forth. The specification and drawings are, accordingly, to be regarded in an illustrative sense rather than a restrictive sense. Accordingly, the scope of the disclosure is at least as broad as the full scope of the following exemplary claims and their equivalents.

What is claimed is:

1. A putter head, comprising:

a top portion, a sole portion, a heel portion, a toe portion, a face portion, a rearward portion, a maximum length L of at least 70 mm, a maximum width W of at least 80 mm, and a maximum height H of no more than 35 mm;

the face portion having a striking surface with a geometric center defining an origin of a club head origin coordinate system having a club head X-axis tangent to the striking surface at the origin and parallel to a ground plane, a club head Y-axis intersecting the origin and parallel to the ground plane and orthogonal to the club head X-axis, and a club head Z-axis extending in a positive direction vertically from the origin toward the top portion and orthogonal to the club head X-axis and the club head Y-axis;

a Y-Z plane containing the club head Y-axis and the club head Z-axis, wherein the Y-Z plane delineates a heel half of the putter head from a toe half of the putter head;

a putter head center of gravity (CG) having a CG X-axis, a CG Y-axis, and a CG Z-axis;

a total putter head mass of 330-435 grams;

a Ixx moment of inertia about the CG X-axis, a Iyy moment of inertia about the CG Y-axis, and a Izz moment of inertia about the vertical CG Z-axis;

a heel weight assembly repositionable within a heel track located on the heel half of the putter head, wherein the heel weight assembly has a total heel weight assembly mass of 5-35% of the total putter head mass, and the heel track has a HT length of at least 50% of the maximum length L, and a HT longitudinal axis oriented at a HTLA x-axis angle from the club head X-axis, wherein the HTLA x-axis angle is obtuse resulting in a heel weight assembly center of gravity getting further away from the Y-Z plane as the heel weight assembly moves closer to the striking surface;

a toe weight assembly repositionable within a toe track located on the toe half of the putter head, wherein the toe weight assembly has a total toe weight assembly mass of 5-35% of the total putter head mass, and the toe track has a TT length of at least 50% of the maximum length L, and a TT longitudinal axis oriented at a TTLA x-axis angle from the club head X-axis, wherein the TTLA x-axis angle is obtuse resulting in a toe weight assembly center of gravity getting further away from the Y-Z plane as the toe weight assembly moves closer to the striking surface; and the putter head has an outer perimeter and in at least one position a portion of the heel weight assembly creates a portion of the outer perimeter, and in at least one position the toe weight assembly creates a portion of the outer perimeter.

2. The putter head of claim 1, wherein a first distance of the heel weight assembly center of gravity from the Y-Z plane changes by 1-14 mm as the heel weight assembly is repositioned within the heel track, and a second distance of the toe weight assembly center of gravity from the Y-Z plane changes by 1-14 mm as the toe weight assembly is repositioned within the toe track.

3. The putter head of claim 2, wherein the total heel weight assembly mass is 7-32.5% of the total putter head mass, the total toe weight assembly mass is 7-32.5% of the total putter head mass, the first distance changes by 2-12 mm, and the second distance changes by 2-12 mm.

4. The putter head of claim 3, wherein the total heel weight assembly mass is at least 10% of the total putter head mass, and the total toe weight assembly mass is at least 10% of the total putter head mass.

5. The putter head of claim 1, wherein the heel weight assembly has a maximum HWA visible surface area and a minimum HWA visible surface area of at least 20% less than the maximum HWA visible surface area, and the toe weight assembly has a maximum TWA visible surface area and a minimum TWA visible surface area of at least 20% less than the maximum TWA visible surface area.

6. The putter head of claim 5, wherein the maximum HWA visible surface area is 1-20 $cm^2$, and the maximum TWA visible surface area is 1-20 $cm^2$.

7. The putter head of claim 6, wherein the minimum HWA visible surface area is zero, and the minimum TWA visible surface area is zero.

8. The putter head of claim 1, wherein:

the heel weight assembly center of gravity is offset from the HT longitudinal axis in at least one direction such that at least one of a CGh X-axis, a CGh Y-axis, and a CGh Z-axis do not intersect the HT longitudinal axis; and the toe weight assembly center of gravity is offset from the TT longitudinal axis in at least one direction such that at least one of a CGt X-axis, a CGt Y-axis, and a CGt Z-axis do not intersect the TT longitudinal axis.

9. The putter head of claim 1, further including a hosel joining the top portion at a hosel interface and defining a forwardmost hosel interface point and a rearwardmost hosel interface point, wherein a heel track-face offset distance is measured between a HT proximal end and the striking surface, a rear interface offset distance is measured between the rearwardmost hosel interface point and the striking surface, and the heel track-face offset distance is less than the rear interface offset distance.

10. The putter head of claim 1, further including a hosel joining the top portion at a hosel interface and defining a hosel interface front-back toeward plane, wherein a portion of the heel track is located between the hosel interface front-back toeward plane and the heel portion.

11. The putter head of claim 1, further including a hosel joining the top portion at a hosel interface and defining a hosel interface front-back heelward plane, wherein the heel weight assembly center of gravity is located heelward of the hosel interface front-back heelward plane at least two locations of the heel weight assembly located at least 25 mm apart.

12. The putter head of claim 1, further including a hosel joining the top portion at a hosel interface and defining a hosel interface front-back centerline plane, wherein HT longitudinal axis intersects the hosel interface front-back centerline plane.

13. The putter head of claim 1, further a toe hang value that varies from a minimum toe hang to a maximum toe hang depending on the position of the heel weight assembly and the toe weight assembly, wherein the minimum toe hang is 19 degrees or less, and the maximum toe hang is at least 21 degrees.

14. The putter head of claim 1, wherein:

the putter head center of gravity (CG) has a y-coordinate of the center of gravity CGy;

the center of gravity of the heel weight assembly CGh has a y-coordinate of the heel weight assembly CGhy, and the center of gravity of the toe weight assembly CGt has a y-coordinate of the toe weight assembly CGty;

in a rearward weight assembly position both CGhy and CGty are greater than 55 mm, the putter head has a rearward Ixx moment of inertia about the CG X-axis, a rearward Izz moment of inertia about the vertical CG Z-axis, and a rearward y-coordinate of the center of gravity;

in a forward weight assembly position both CGhy and CGhy are less than 30 mm, the putter head has a forward Ixx moment of inertia about the CG X-axis, a forward Izz moment of inertia about the vertical CG Z-axis, and a forward y-coordinate of the center of gravity;

the forward Ixx moment of inertia is 0.6-0.73 of the rearward Ixx moment of inertia;

the forward Izz moment of inertia is 0.8-0.92 of the rearward Izz moment of inertia;

the forward y-coordinate of the center of gravity is 0.63-0.75 of the rearward y-coordinate of the center of gravity;

a forward toe hang is greater than a rearward toe hang;

the rearward Ixx moment of inertia is at least 2600 $g*cm^2$; and the rearward Izz moment of inertia is no more than 14000 $g*cm^2$.

15. The putter head of claim 14, wherein the rearward Ixx moment of inertia is no more than 5500 $g*cm^2$, and the rearward Izz moment of inertia is at least 4500 $g*cm^2$.

16. A putter head, comprising:

a top portion, a sole portion, a heel portion, a toe portion, a face portion, a rearward portion, a maximum length L of at least 70 mm, a maximum width W of at least 80 mm, and a maximum height H of no more than 35 mm;

the face portion having a striking surface with a geometric center defining an origin of a club head origin coordinate system having a club head X-axis tangent to the striking surface at the origin and parallel to a ground plane, a club head Y-axis intersecting the origin and parallel to the ground plane and orthogonal to the club head X-axis, and a club head Z-axis extending in a positive direction vertically from the origin toward the top portion and orthogonal to the club head X-axis and the club head Y-axis;

a Y-Z plane containing the club head Y-axis and the club head Z-axis, wherein the Y-Z plane delineates a heel half of the putter head from a toe half of the putter head;

a putter head center of gravity (CG) having a CG X-axis, a CG Y-axis, and a CG Z-axis;

a total putter head mass of 330-435 grams;

a Ixx moment of inertia about the CG X-axis, a Iyy moment of inertia about the CG Y-axis, and a Izz moment of inertia about the vertical CG Z-axis;

a heel weight assembly repositionable within a heel track located on the heel half of the putter head, wherein the heel weight assembly has a total heel weight assembly mass of 5-35% of the total putter head mass, and the heel track has a HT length of at least 50% of the maximum length L, and a HT longitudinal axis oriented at a HTLA x-axis angle from the club head X-axis, wherein the HTLA x-axis angle results in a change in a distance of a heel weight assembly center of gravity from the Y-Z plane as the heel weight assembly moves closer to the striking surface;

a toe weight assembly repositionable within a toe track located on the toe half of the putter head, wherein the toe weight assembly has a total toe weight assembly mass of 5-35% of the total putter head mass, and the toe track has a TT length of at least 50% of the maximum length L, and a TT longitudinal axis oriented at a TTLA x-axis angle from the club head X-axis, wherein the TTLA x-axis angle results in a change in a distance of a toe weight assembly center of gravity from the Y-Z plane as the toe weight assembly moves closer to the striking surface;

the putter head center of gravity (CG) has a y-coordinate of the center of gravity CGy;

the center of gravity of the heel weight assembly CGh has a y-coordinate of the heel weight assembly CGhy, and the center of gravity of the toe weight assembly CGt has a y-coordinate of the toe weight assembly CGty;

in a rearward weight assembly position both CGhy and CGty are greater than 55 mm, the putter head has a rearward Ixx moment of inertia about the CG X-axis, a rearward Izz moment of inertia about the vertical CG Z-axis, and a rearward y-coordinate of the center of gravity;

in a forward weight assembly position both CGhy and CGhy are less than 30 mm, the putter head has a forward Ixx moment of inertia about the CG X-axis, a forward Izz moment of inertia about the vertical CG Z-axis, and a forward y-coordinate of the center of gravity;

the forward y-coordinate of the center of gravity is 0.63-0.75 of the rearward y-coordinate of the center of gravity;

the rearward Ixx moment of inertia is at least 2600 $g*cm^2$; and the rearward Izz moment of inertia is no more than 14000 $g*cm^2$.

17. The putter head of claim 16, wherein the forward Ixx moment of inertia is 0.6-0.73 of the rearward Ixx moment of inertia, and the forward Izz moment of inertia is 0.8-0.92 of the rearward Izz moment of inertia.

18. The putter head of claim 17, wherein:

the heel weight assembly center of gravity is offset from the HT longitudinal axis in at least one direction such that at least one of a CGh X-axis, a CGh Y-axis, and a CGh Z-axis do not intersect the HT longitudinal axis; and the toe weight assembly center of gravity is offset from the TT longitudinal axis in at least one direction such that at least one of a CGt X-axis, a CGt Y-axis, and a CGt Z-axis do not intersect the TT longitudinal axis.

19. A putter head, comprising:

a top portion, a sole portion, a heel portion, a toe portion, a face portion, a rearward portion, a maximum length L of at least 70 mm, a maximum width W of at least 80 mm, and a maximum height H of no more than 35 mm;

the face portion having a striking surface with a geometric center defining an origin of a club head origin coordinate system having a club head X-axis tangent to the striking surface at the origin and parallel to a ground plane, a club head Y-axis intersecting the origin and parallel to the ground plane and orthogonal to the club head X-axis, and a club head Z-axis extending in a positive direction vertically from the origin toward the top portion and orthogonal to the club head X-axis and the club head Y-axis;

a Y-Z plane containing the club head Y-axis and the club head Z-axis, wherein the Y-Z plane delineates a heel half of the putter head from a toe half of the putter head;

a putter head center of gravity (CG) having a CG X-axis, a CG Y-axis, and a CG Z-axis;

a total putter head mass of 330-435 grams;

a Ixx moment of inertia about the CG X-axis, a Iyy moment of inertia about the CG Y-axis, and a Izz moment of inertia about the vertical CG Z-axis;

a heel weight assembly repositionable within a heel track located on the heel half of the putter head, wherein the heel weight assembly has a total heel weight assembly mass of 5-35% of the total putter head mass, and the heel track has a HT length of at least 50% of the maximum length L, and a HT longitudinal axis oriented at a HTLA x-axis angle from the club head X-axis, wherein the HTLA x-axis angle results in a change in a distance of a heel weight assembly center of gravity from the Y-Z plane as the heel weight assembly moves closer to the striking surface;

a toe weight assembly repositionable within a toe track located on the toe half of the putter head, wherein the toe weight assembly has a total toe weight assembly mass of 5-35% of the total putter head mass, and the toe track has a TT length of at least 50% of the maximum length L, and a TT longitudinal axis oriented at a TTLA x-axis angle from the club head X-axis, wherein the TTLA x-axis angle results in a change in a distance of a toe weight assembly center of gravity from the Y-Z plane as the toe weight assembly moves closer to the striking surface;

the putter head center of gravity (CG) has a y-coordinate of the center of gravity CGy;

the center of gravity of the heel weight assembly CGh has a y-coordinate of the heel weight assembly CGhy, and the center of gravity of the toe weight assembly CGt has a y-coordinate of the toe weight assembly CGty;

in a rearward weight assembly position both CGhy and CGty are greater than 55 mm, the putter head has a rearward Ixx moment of inertia about the CG X-axis, a rearward Izz moment of inertia about the vertical CG Z-axis, and a rearward y-coordinate of the center of gravity;

in a forward weight assembly position both CGhy and CGhy are less than 30 mm, the putter head has a forward Ixx moment of inertia about the CG X-axis, a forward Izz moment of inertia about the vertical CG Z-axis, and a forward y-coordinate of the center of gravity;

the forward Izz moment of inertia is 0.8-0.92 of the rearward Izz moment of inertia;

the rearward Ixx moment of inertia is at least 2600 $g*cm^2$; and the rearward Izz moment of inertia is no more than 14000 $g*cm^2$.

20. The putter head of claim 19, wherein the forward y-coordinate of the center of gravity is 0.63-0.75 of the rearward y-coordinate of the center of gravity.

* * * * *